US011097197B2

(12) United States Patent
Kassam et al.

(10) Patent No.: US 11,097,197 B2
(45) Date of Patent: Aug. 24, 2021

(54) INTERACTIVE TOYS THAT COMPLY WITH THE MONTESSORI EDUCATIONAL METHOD AND THE SAFETY REQUIREMENTS

(71) Applicant: MONTI KIDS, INC., Oakland, CA (US)

(72) Inventors: Zahra Kassam, Oakland, CA (US); Yuki Kawae, Oakland, CA (US)

(73) Assignee: MONTI KIDS, INC., Oakland, CA (US)

( * ) Notice: Subject to any disclaimer, the term of this patent is extended or adjusted under 35 U.S.C. 154(b) by 0 days.

(21) Appl. No.: 16/543,493

(22) Filed: Aug. 16, 2019

(65) Prior Publication Data

US 2020/0147506 A1 May 14, 2020

Related U.S. Application Data

(63) Continuation of application No. PCT/US2018/018544, filed on Feb. 17, 2018.

(60) Provisional application No. 62/460,724, filed on Feb. 17, 2017.

(51) Int. Cl.
*A63H 33/00* (2006.01)

(52) U.S. Cl.
CPC ..... *A63H 33/006* (2013.01)

(58) Field of Classification Search
CPC ..... A63H 33/006; A63H 33/00
USPC ..... 446/227, 97
See application file for complete search history.

(56) References Cited

U.S. PATENT DOCUMENTS 2,399,566 A * 4/1946 Owen ..... A63F 9/1252 434/258
2,475,306 A * 7/1949 Beder ..... A63F 9/1288 446/97
2,577,309 A 12/1951 Carwile
2,839,842 A 6/1958 Keyko
3,190,656 A * 6/1965 Weisbecker ..... A63H 33/00 273/138.4
3,660,927 A * 5/1972 De Christopher ... A63H 33/108 446/94
4,895,548 A * 1/1990 Holland ..... A63H 33/044 182/178.5
5,013,245 A * 5/1991 Benedict ..... G09B 1/10 434/113

(Continued)

FOREIGN PATENT DOCUMENTS

EP 1530990 B1 3/2007
KR 20-0476234 Y1 2/2015

OTHER PUBLICATIONS

WO, PCT/US2018/018544 ISR and Written Opinion, dated May 25, 2018.

*Primary Examiner* — Nini F Legesse
(74) *Attorney, Agent, or Firm* — One LLP; Joseph K. Liu

(57) ABSTRACT

A structure for hanging toys while complying with the safety and educational standards is provided. The structure includes one or more top portions, wherein one or more top portions comprises a head, a platform and a base. The base includes a slot to attach a string to which the toy can be attached. The structure further comprises a bottom portion, which is detachable from the top portion. The bottom portion includes at least two legs that are consequently detachable from the top portion and can be interchanged with another set of legs in order to adjust the height of the structure.

1 Claim, 178 Drawing Sheets

(56) References Cited

U.S. PATENT DOCUMENTS

| | | | | |
|---|---|---|---|---|
| 5,478,268 | A | 12/1995 | Au | |
| 5,944,254 | A * | 8/1999 | Liu | A45C 1/12<br>232/1 D |
| 7,922,556 | B2 * | 4/2011 | Schreff | A63H 33/088<br>446/93 |

* cited by examiner

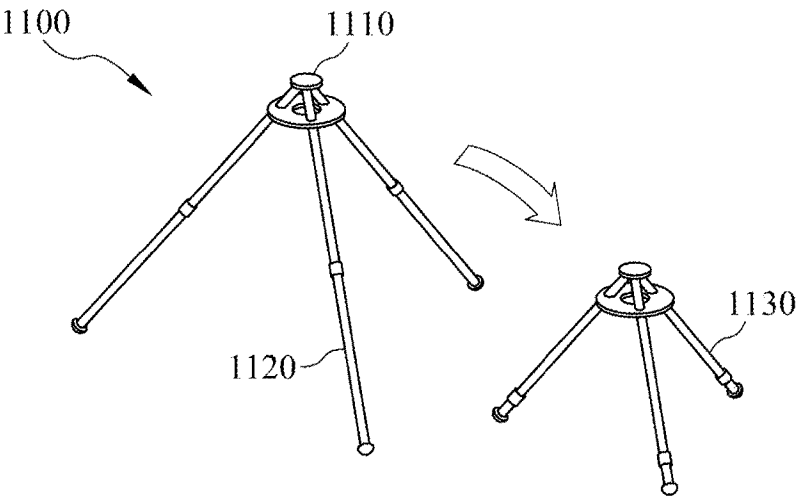
FIG. 11B
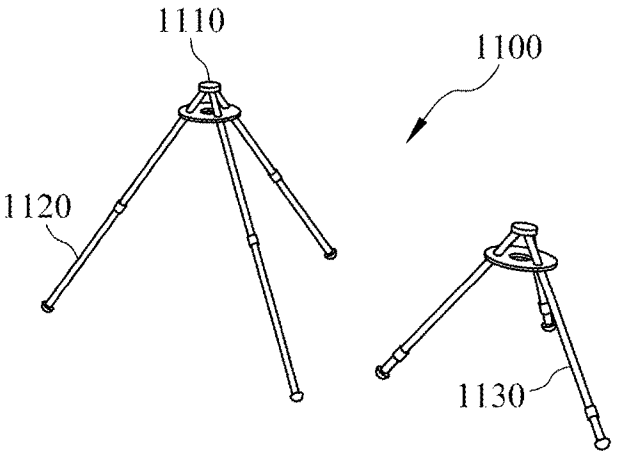
FIG. 11A
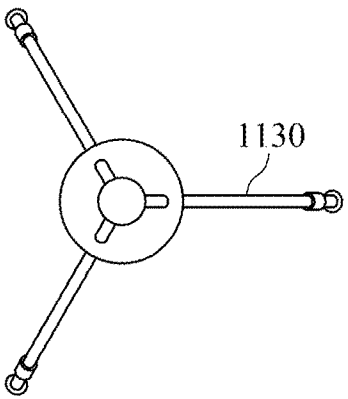
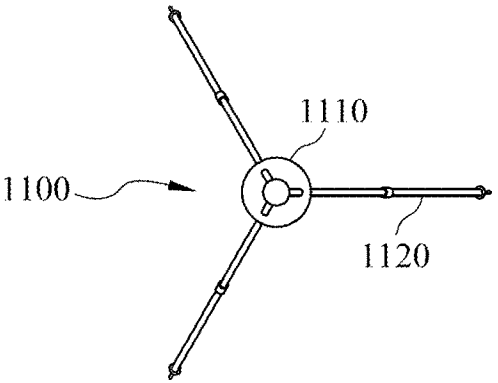
FIG. 11C

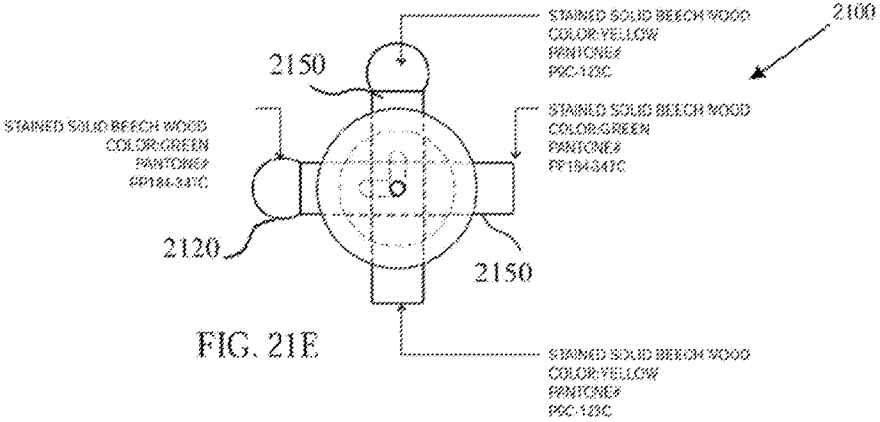
FIG. 21E
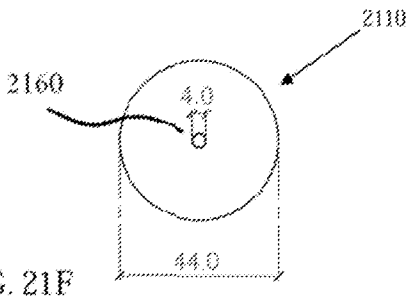
FIG. 21F
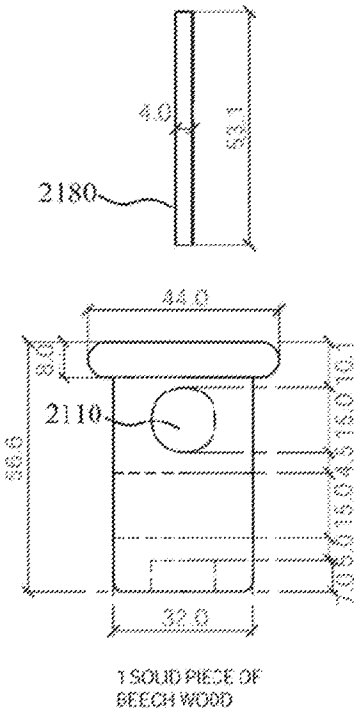
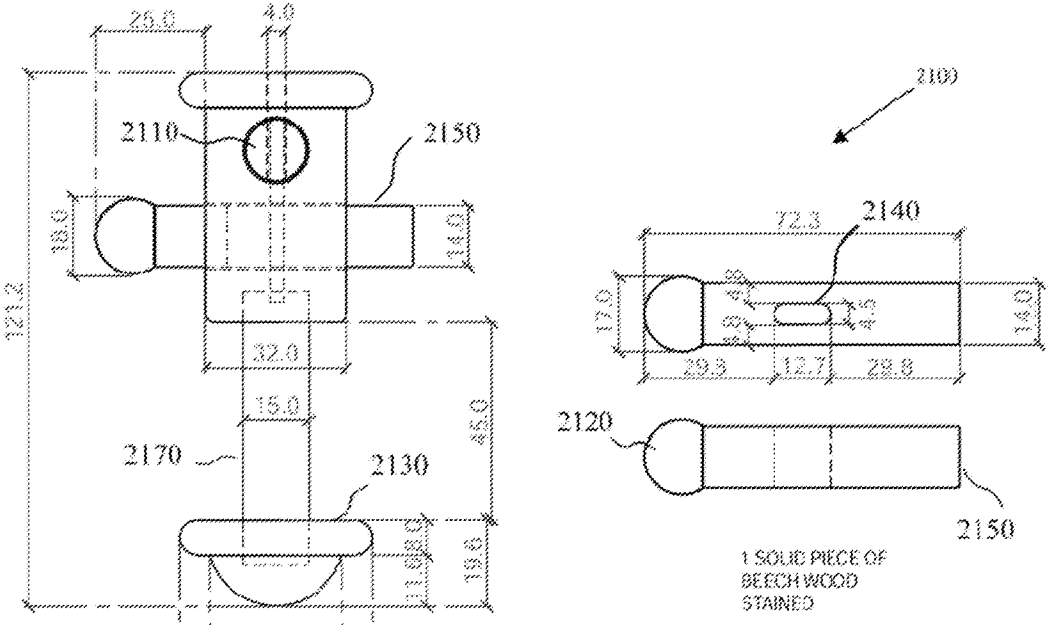
FIG. 21G

2 RAMP ELEVATION

PAINTED WOOD
SPHERE 46MM DIA

COLOR: RED
PANTONE#
P.38C-2035C

NOTE:
BALL MUST NOT BE
LESS THAN 46MM TO
PASS THE SAFETY
TEST

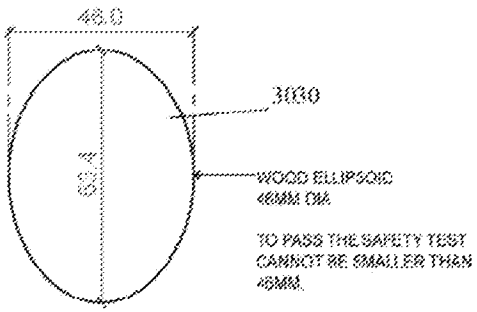
FIG. 30G
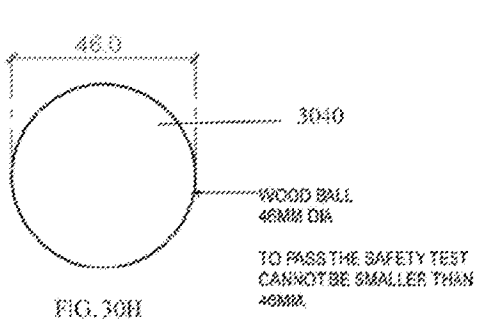
FIG. 30H
FIG. 30I
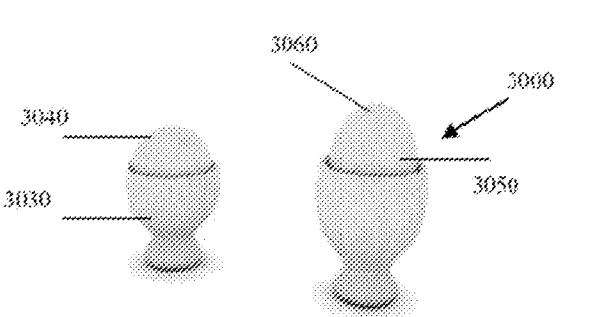
FIG. 30J
FIG. 30K

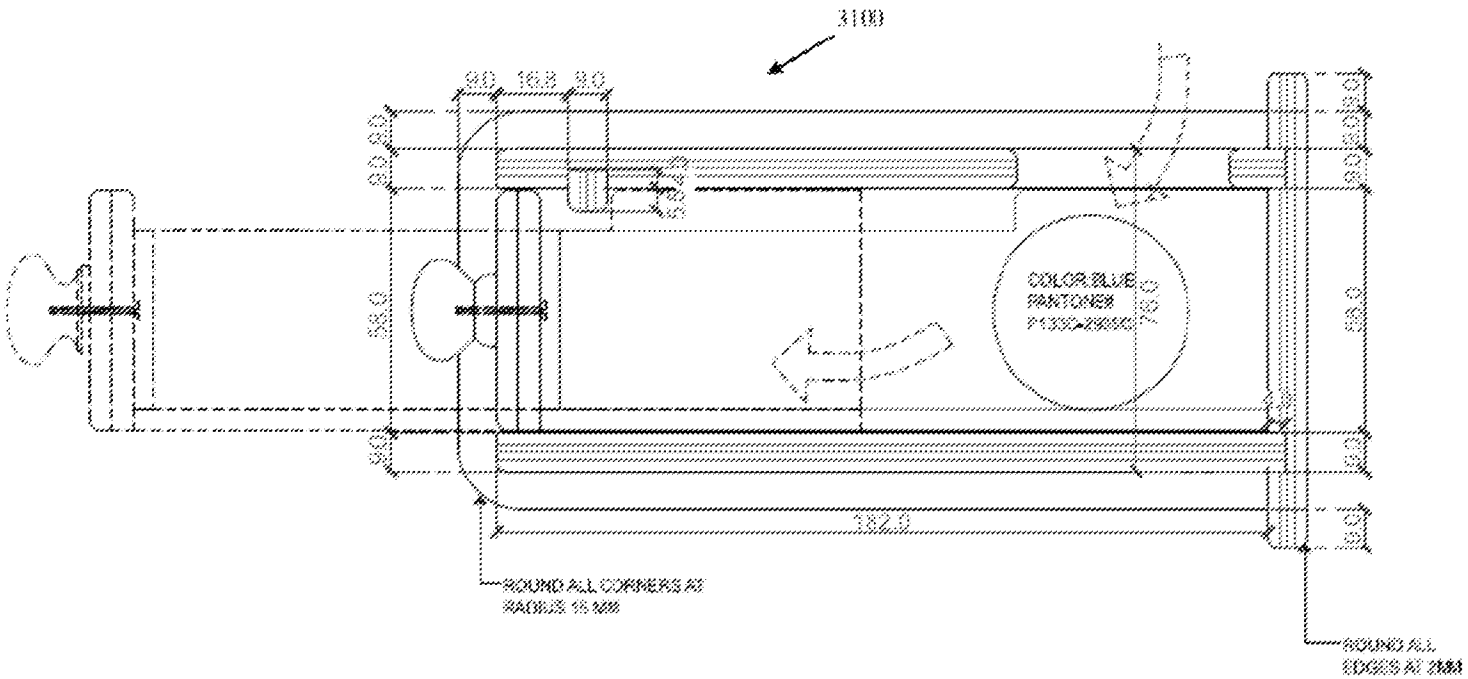
310B
ROUND ALL EDGES AT .188
COLOR BLUE
PANTONE
ROUND ALL CORNERS AT
RADIUS .15 .188
0.90
58.0
90.0
16.2
3.0
1.2
1.5
1.5
0.6
0.6
0.6

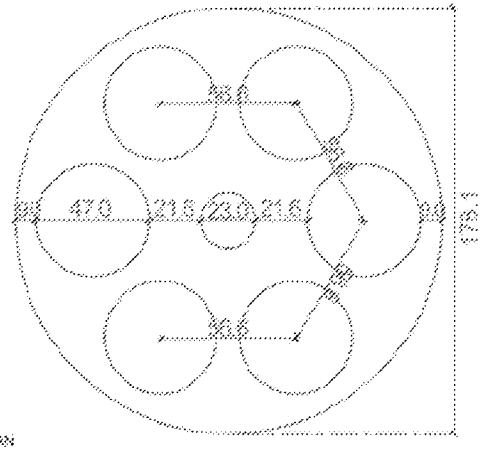
FIG. 33A
FIG. 33B
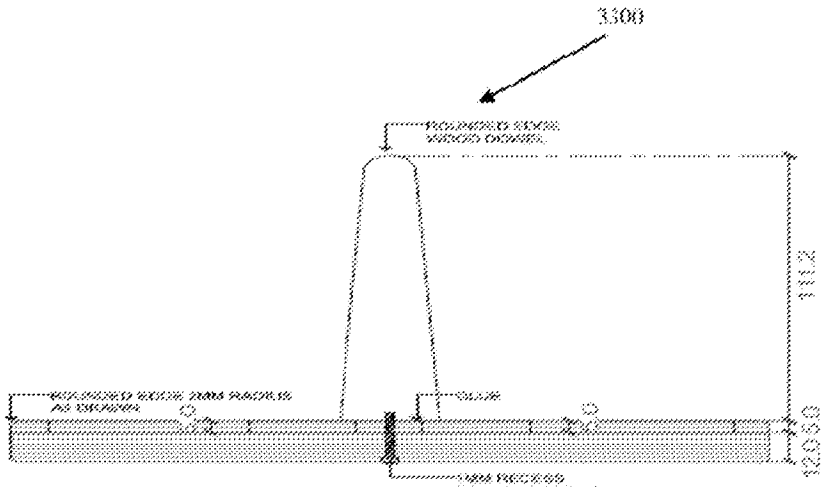
FIG. 33C
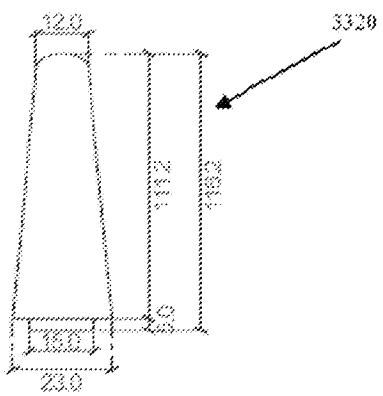
FIG. 33D

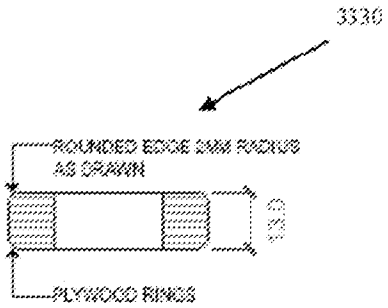
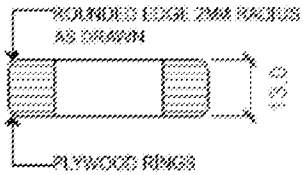
FIG. 33H
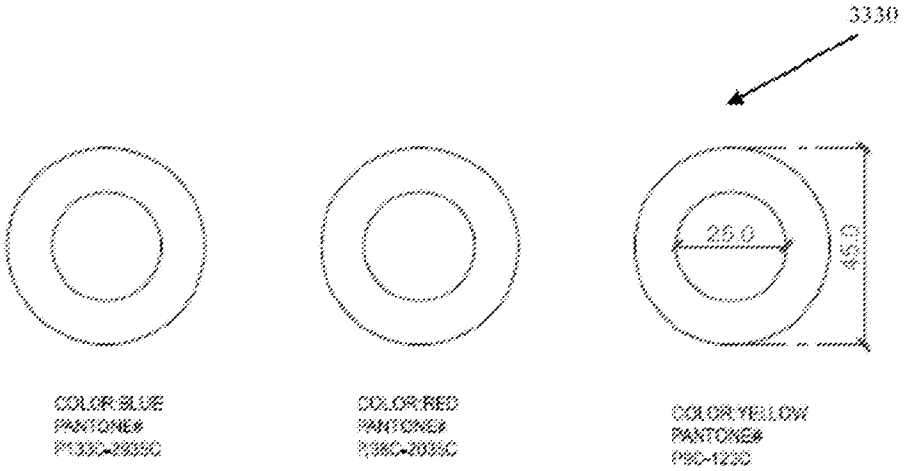
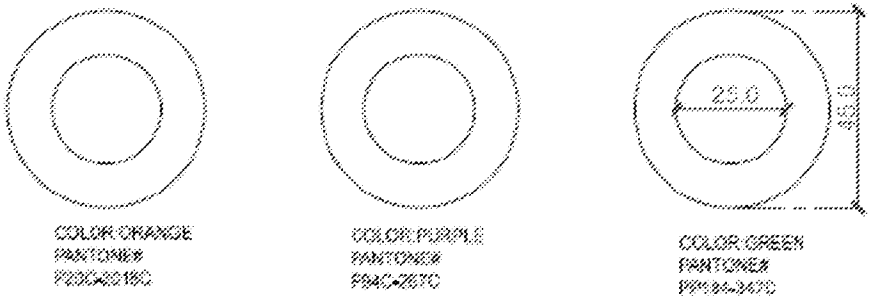
FIG. 33G

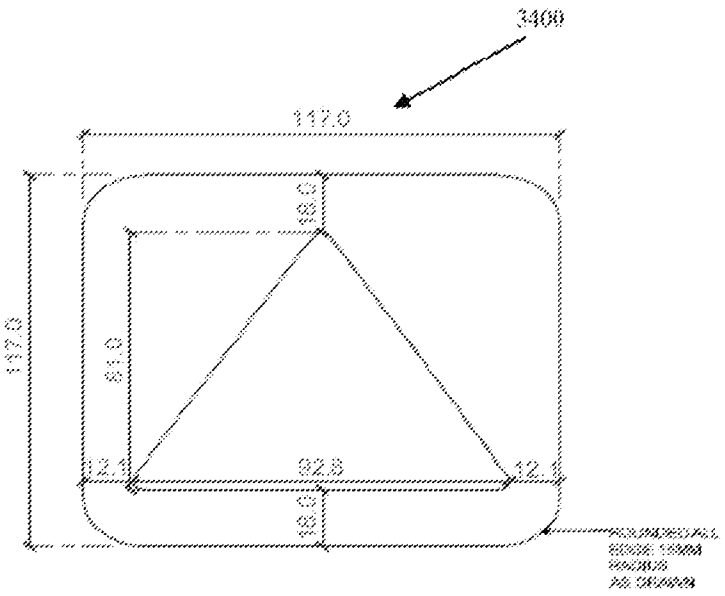
FIG. 34B
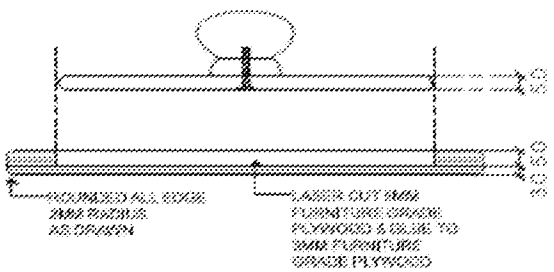
FIG. 34J
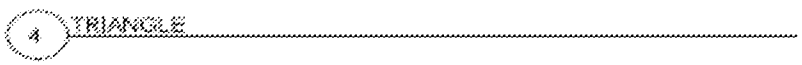
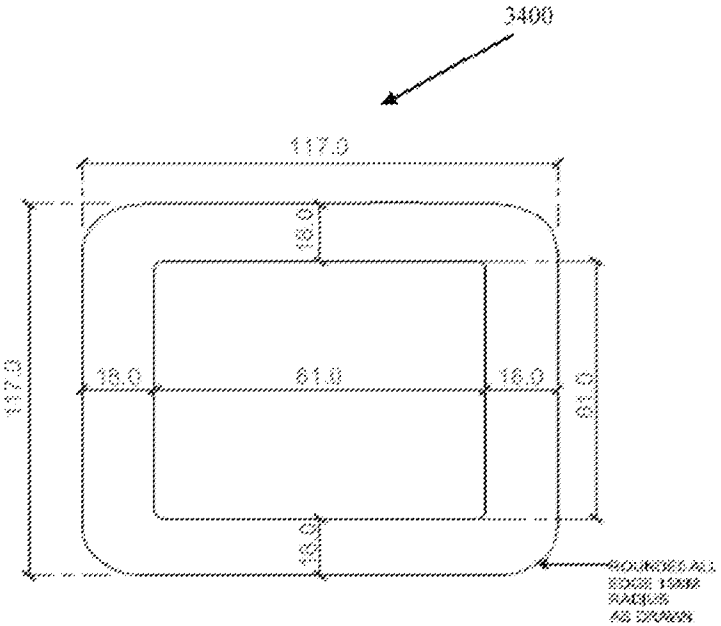
FIG. 34G
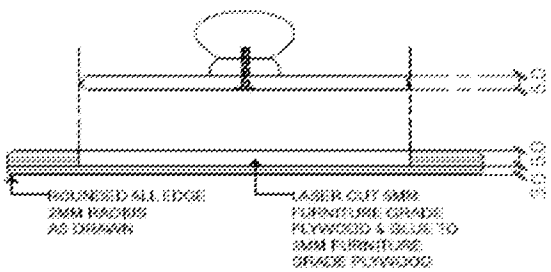
FIG. 34I
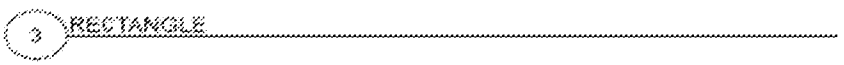

2 BIG CIRCLE

1 SMALL CIRCLE

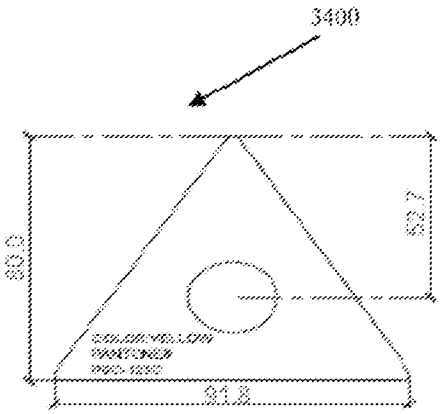
FIG. 34P
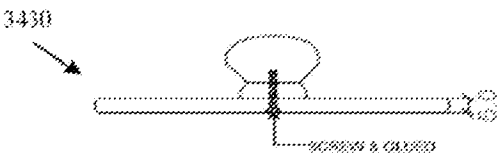
FIG. 34R
4 TRIANGLE
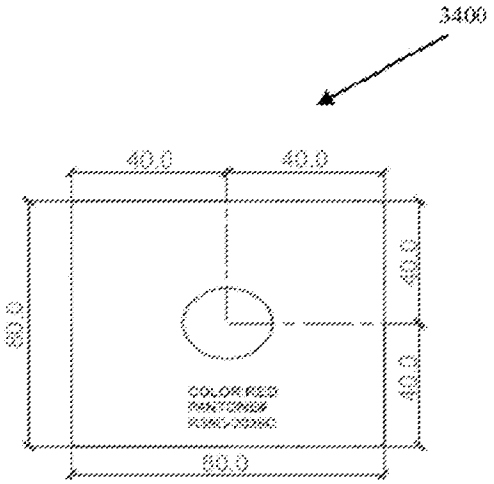
FIG. 34O
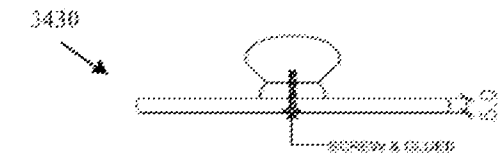
FIG. 34Q
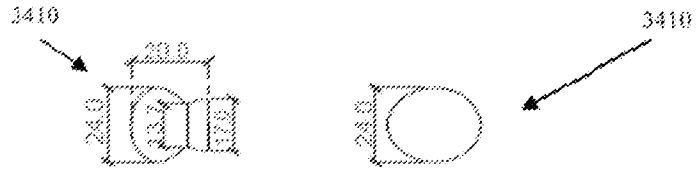
FIG. 34T
FIG. 34S
3 RECTANGLE
3 Knob Size Size

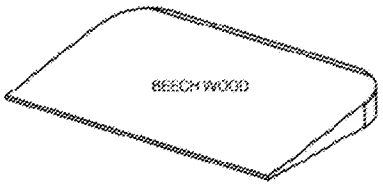
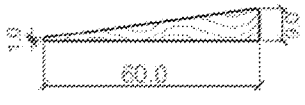
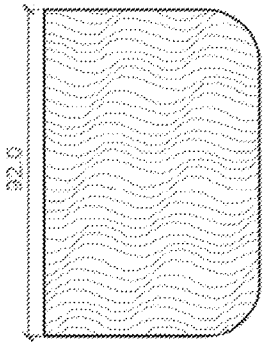
FIG. 36G
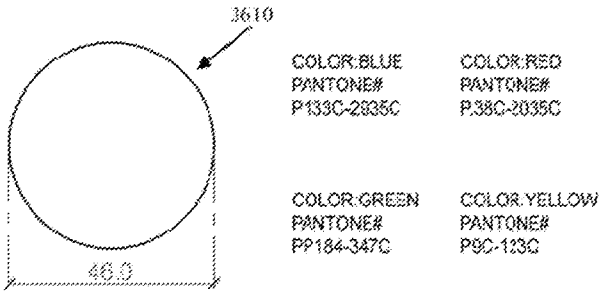
FIG. 36H
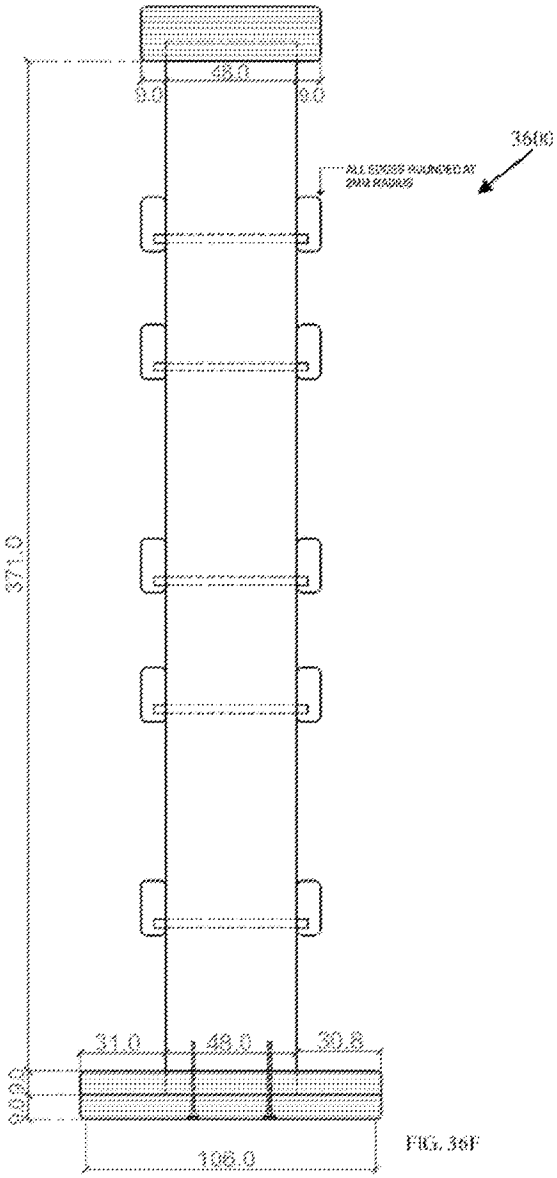
FIG. 36F

3900C

3900D

3900B

3900

4040
24.0

4040
20.0
17.0
10.2
24.0

COLOR: RED
PANTONE#
P38C-2035C
COLOR: BLUE
PANTONE#
P133C/2935C
COLOR: YELLOW
PANTONE#
P8C-133C
4020
7.0
7.0

4020
55.0
55.0
55.0
55.0

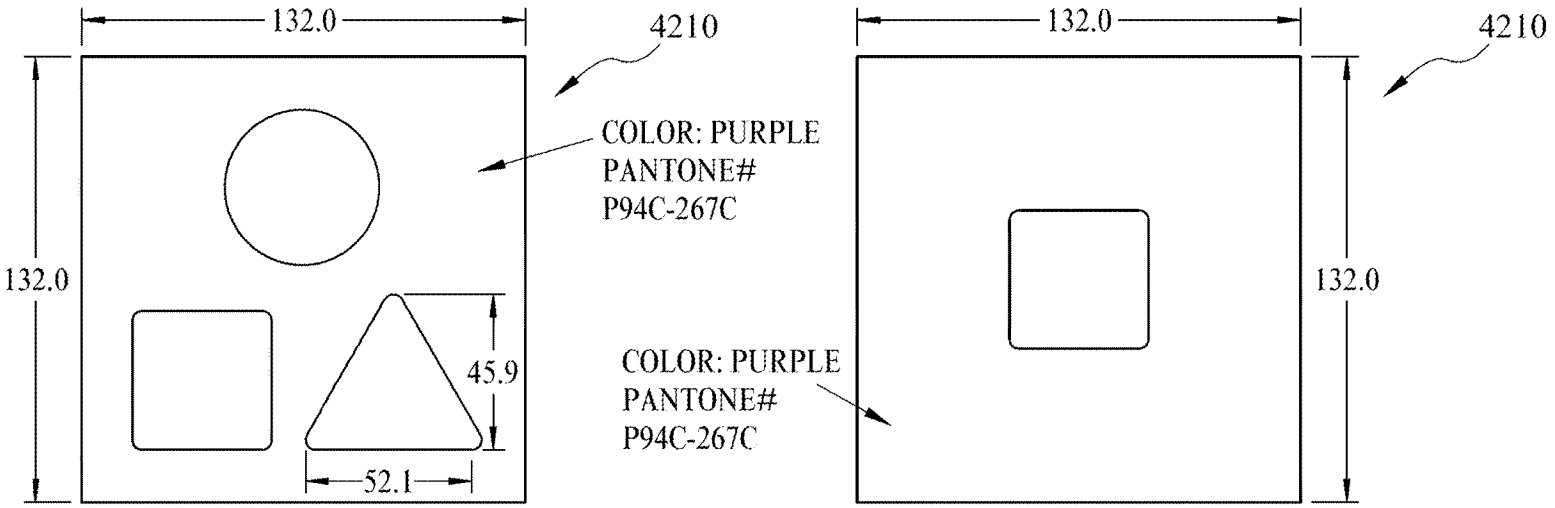
FIG. 42L
FIG. 42M
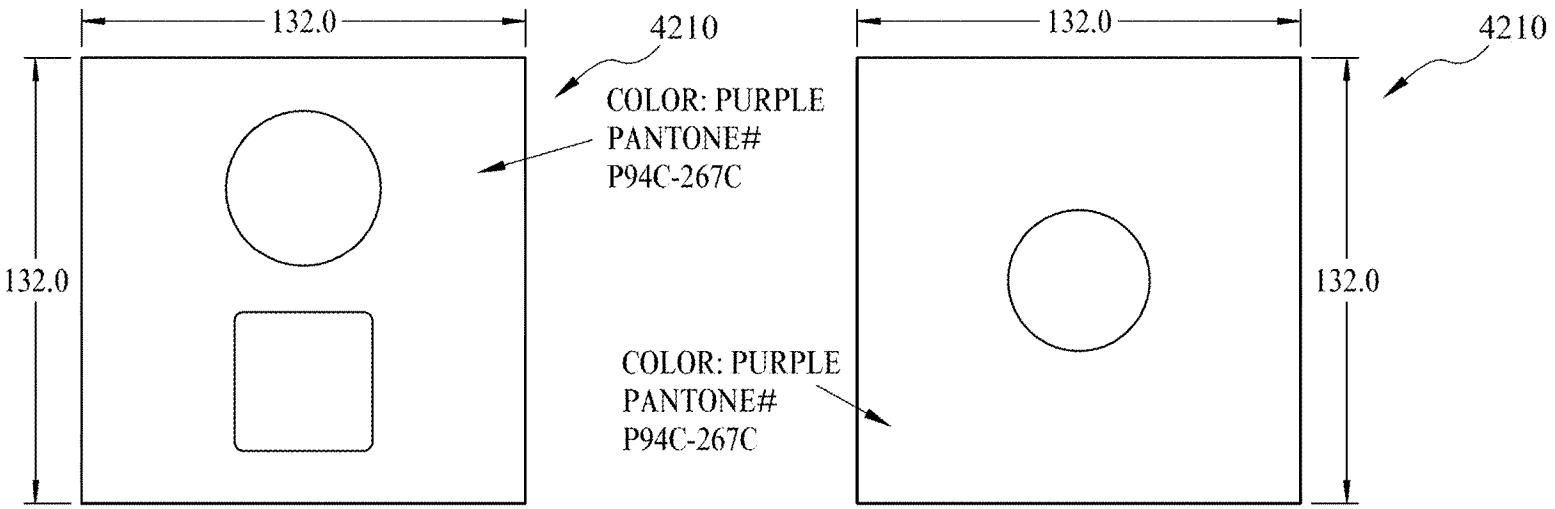
FIG. 42N
FIG. 42O

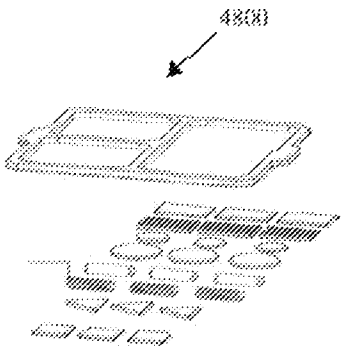
FIG. 48A
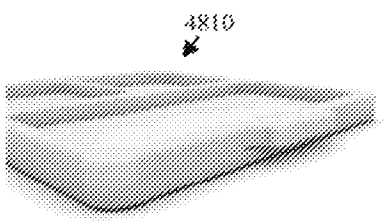
FIG. 48B
FIG. 48C 5300
5330
ALL EDGES ROUNDED AT 2MM RADIUS
1MM RECESS FOR ALL SCREWS
STAIN COLOR RED PANTONE# P180-2035C
STAIN COLOR BLUE PANTONE# P131C-2035C
STAIN COLOR YELLOW PANTONE# P22-1C
STAIN COLOR ORANGE PANTONE# P22-2016C
STAIN COLOR PURPLE PANTONE# P94-2C
STAIN COLOR GREEN PANTONE# P7-1A-3XTC
STAMPED PLYWOOD
GLUE AND SCREW
1MM RECESS

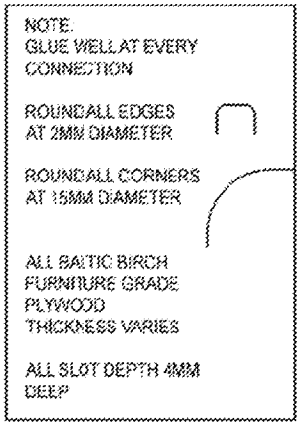
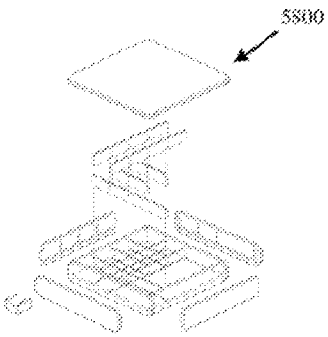
FIG. 58B
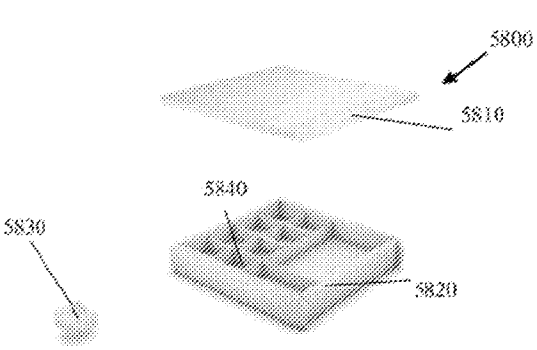
FIG. 58A
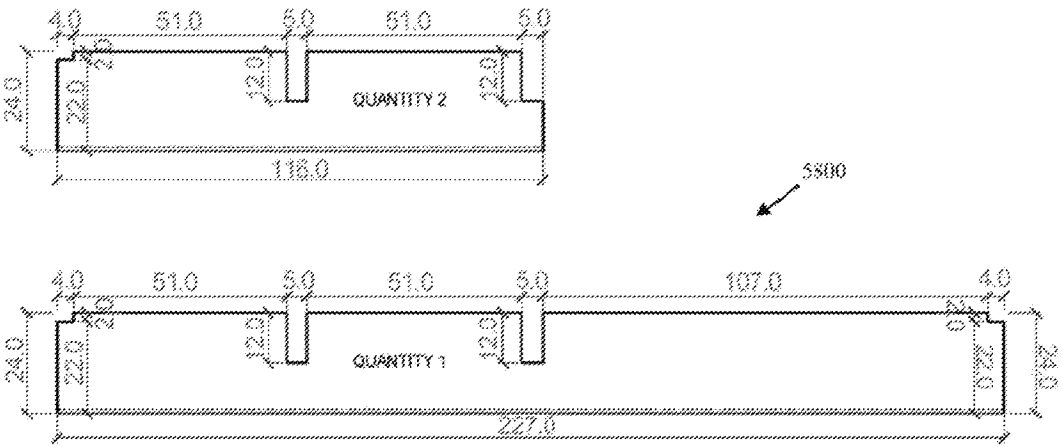
FIG. 58C

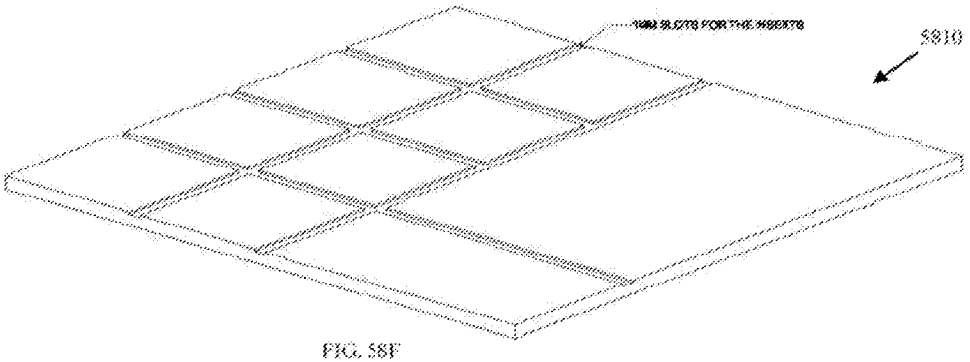
FIG. 58F
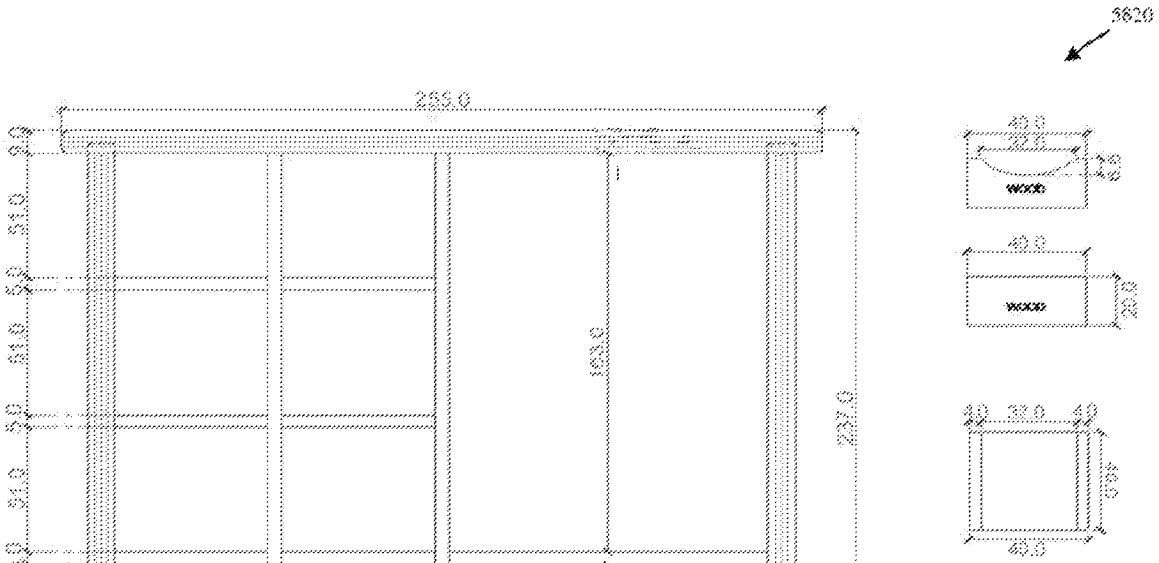
5820
WOOD
WOOD
46.0
40.0
38.0
40.0
40.0
40.0
227.0
265.0
163.0
61.0
97.0
61.0
61.0
61

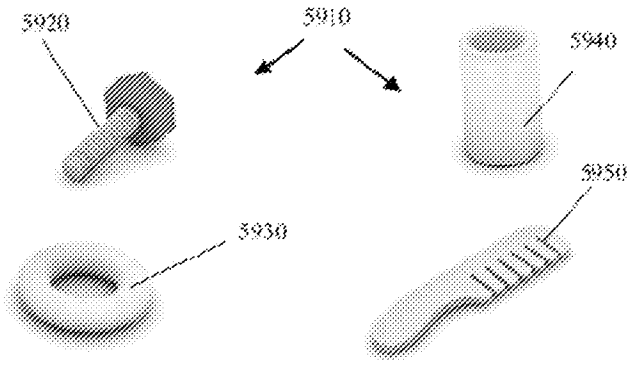
FIG. 59B
FIG. 59C
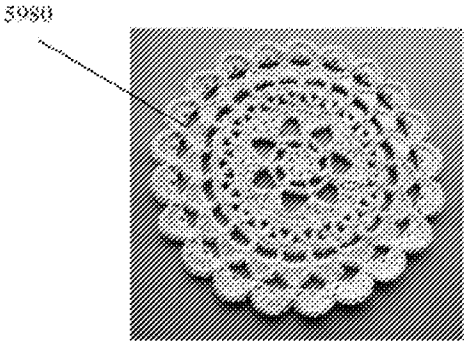
FIG. 59E
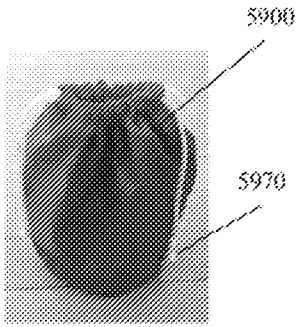
FIG. 59A
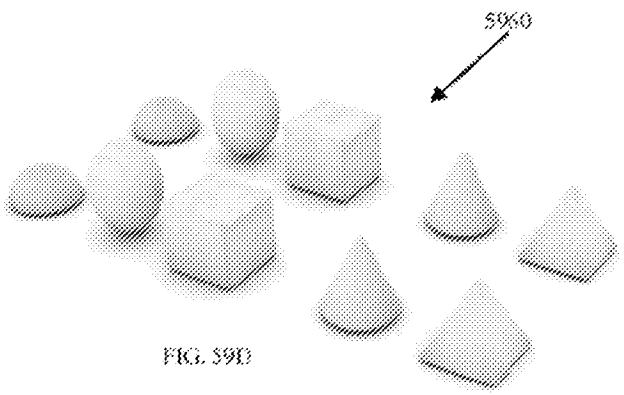
FIG. 59D

CUP NEEDS TO BE SANDED SMOOTH TO TOUCH INTERIOR & EXTERIOR

YK1

INTERACTIVE TOYS THAT COMPLY WITH THE MONTESSORI EDUCATIONAL METHOD AND THE SAFETY REQUIREMENTS

CROSS-REFERENCE TO RELATED APPLICATIONS

This application is a continuation of International Patent Application No. PCT/US2018/018544, filed Feb. 17, 2018, which claims priority pursuant to U.S.C § 119(e) to U.S. Provisional Patent Application No. 62/460,724, filed Feb. 17, 2017, the disclosures of both of which are hereby incorporated by reference in their entireties for all purposes.

TECHNICAL FIELD

Embodiments of the present invention generally relate to toys, and more specifically to children's interactive, educational toys that comply with the Montessori method and various safety test requirements as provided by various agencies such as United States Consumer Product Safety Commission ("CPSC"), American Society for Testing and Materials ("ASTM"), etc.

BACKGROUND OF THE INVENTION

The Montessori Method of education, developed by Dr. Maria Montessori, is a child-centered educational approach based on scientific observations of children from birth to adulthood. Montessori's education method called for free activity within a "prepared environment," meaning an educational environment tailored to basic human characteristics, to the specific characteristics of children at different ages, and to the individual personalities of each child. The function of the environment is to help and allow the child to develop independence in all areas according to his or her inner psychological directives. To this end, Montessori's method of education focuses on self-directed activity, hands-on learning, and collaborative play. In addition to offering access to the Montessori materials appropriate to the age of the children, the environment generally exhibits the following characteristics: 1) An arrangement that facilitates movement and activity; 2) Beauty and harmony, cleanliness of environment; 3) Construction in proportion to the child and her/his needs; 4) Limitation of materials, so that only material that supports the child's development is included; and 5) Order.

For children aged 0-3 years, toys, to a big extent determine the world around them, are a powerful means of development, up-bringing and education. One major challenge with toys in general is keeping children interested in playing with the toy for more than a short period of time. Montessori school toys are designed to help children develop respect for others and the environment, self-esteem and self-confidence, self-discipline, coordination, independence, social skills, emotional growth, and cognitive preparation. To this end, Montessori toys are designed to be interactive, educational, and comply with the characteristics listed above. The Montessori toys are designed in a manner that allows the children to actively use their imagination and learn while playing with the toys.

For children aged 0-3 the toys not only need to comply with the characteristics listed above but also need to be safe for children to use. However, currently the available Montessori toys fail to do so since they do not conform with the CPSC or ASTM safety requirements. The fact that kids aged 0-3 may get severely injured from toys that are not safe is obvious. For example, if the toys are made using unsafe materials, they may break while the kids are playing with them or the kids may bite the toy and ingest unsafe materials, etc. Such unsafe toys may not just have an effect on the kids' physical health but since toys are such an integral part of such kids' life, especially in a Montessori school setting, the unsafe toys may also erode the kids' trust in themselves and their world; confidence in their emerging abilities; gross motor coordination, fine motor skills, and language skills; and independence in daily tasks.

Accordingly, it is advantageous to have Montessori toys that provide both an interactive, educational environment and also comply with the safety requirements as provided by various agencies.

SUMMARY OF THE INVENTION

Provided herein are embodiments of interactive, educational Montessori toys that comply with the safety requirements as provided by various agencies such as CPSC, ASTM, etc.

According to some embodiments of the present invention, a variety of inventive toys are provided. The toys described above have all been uniquely designed after multiple experimentations in order to comply with both the Montessori educational method and also comply with the safety requirements as provided by various agencies such as CPSC, ASTM, etc. For example, the safety standards do not allow hanging mobiles or reaching, batting, grasping, and/or kicking toys from the ceiling. There are some activity gyms made by large toy companies like Plan Toys that are used for the reaching, batting, and/or grasping toys but those designs do not facilitate the hanging of a toy out of a child's reach. There is one activity gym that can be adjusted to accommodate different height settings to facilitate the hanging of a toy out of a child's reach, but the height adjustment is done by folding and extending the long legs, which is a tedious process. Such an activity gym takes up too much space in the home. Some embodiments of the present invention solve those problems. According to some embodiments of the present invention, one of the toys is a structure for hanging other toys while complying with the safety and educational standards. The structure includes one or more top portions, wherein one or more top portions comprises a head, a platform, and a base. The base includes a slot to attach a string to which the toy can be attached. The structure further comprises a bottom portion, which is detachable from the top portion. The bottom portion includes at least two legs that are consequently detachable from the top portion and can be interchanged with another set of legs in order to adjust the height of the structure.

This summary and the following detailed description are merely exemplary, illustrative, and explanatory, and are not intended to limit, but to provide further explanation of the invention as claimed. Additional features and advantages of the invention will be set forth in the descriptions that follow, and in part will be apparent from the description, or may be learned by practice of the invention. The objectives and other advantages of the invention will be realized and attained by the structure particularly pointed out in the written description, claims and the appended drawings.

BRIEF DESCRIPTION OF THE DRAWINGS

The present invention may be better understood by referring to the following figures. The components in the figures are not necessarily to scale. Emphasis instead being placed upon illustrating the principles of the disclosure. In the figures, reference numerals designate corresponding parts throughout the different views.

FIGS. 11A and 11B illustrate perspective views of a Level 1 Montessori toy, according to some embodiments of the present invention.

FIGS. 11C and 11E illustrate top views of a Level 1 Montessori toy, according to some embodiments of the present invention.

FIGS. 21E and 21F illustrate top views of a Level 2 Montessori toy, according to some embodiments of the present invention.

FIG. 21G illustrates a side view of components of a Level 2 Montessori toy, according to some embodiments of the present invention.

FIGS. 23A, 23B, and 23D illustrate perspective views of a Level 2 Montessori toy, according to exemplary embodiments of the present invention.

FIGS. 30A and 30G illustrate perspective views of a Level 3 Montessori toy, according to exemplary embodiments of the present invention.

FIGS. 30B-30F and 30H-30K illustrate side views of a Level 3 Montessori toy and various components of a Level 3 Montessori toy, according to exemplary embodiments of the present invention.

FIGS. 31C-31G illustrate side views of a Level 4 Montessori toy, according to exemplary embodiments of the present invention.

FIGS. 32C and 32D illustrate top views of a Level 4 Montessori toy, according to exemplary embodiments of the present invention.

FIGS. 34C, 34D, 34G, 34H, 34K, 34L, 34O, 34P, and 34T illustrate top views of components of a Level 4 Montessori toy, according to exemplary embodiments of the present invention.

FIGS. 34E, 34F, 34I, 34J, 34M, 34N, 34Q, 34R, and 34S illustrate side views of a Level 4 Montessori toy, according to exemplary embodiments of the present invention.

FIG. 36F illustrates an end view of a Level 4 Montessori toy, according to exemplary embodiments of the present invention.

FIG. 36G illustrates a perspective view, an end view, and a top view of a component of a Level 4 Montessori toy, according to exemplary embodiments of the present invention.

FIG. 36H illustrates a side view of a component of a Level 4 Montessori toy, according to exemplary embodiments of the present invention.

FIG. 39Q illustrates an end view of a component of a Level 5 Montessori toy, according to exemplary embodiments of the present invention.

FIGS. 40A and 40B illustrate perspective views of a Level 5 Montessori toy, according to exemplary embodiments of the present invention.

FIG. 40C illustrates a front view of a Level 5 Montessori toy, according to exemplary embodiments of the present invention.

FIG. 40D illustrates a top view of a Level 5 Montessori toy, according to exemplary embodiments of the present invention.

FIG. 40E illustrates a side view of a Level 5 Montessori toy, according to exemplary embodiments of the present invention.

Figure 40B:
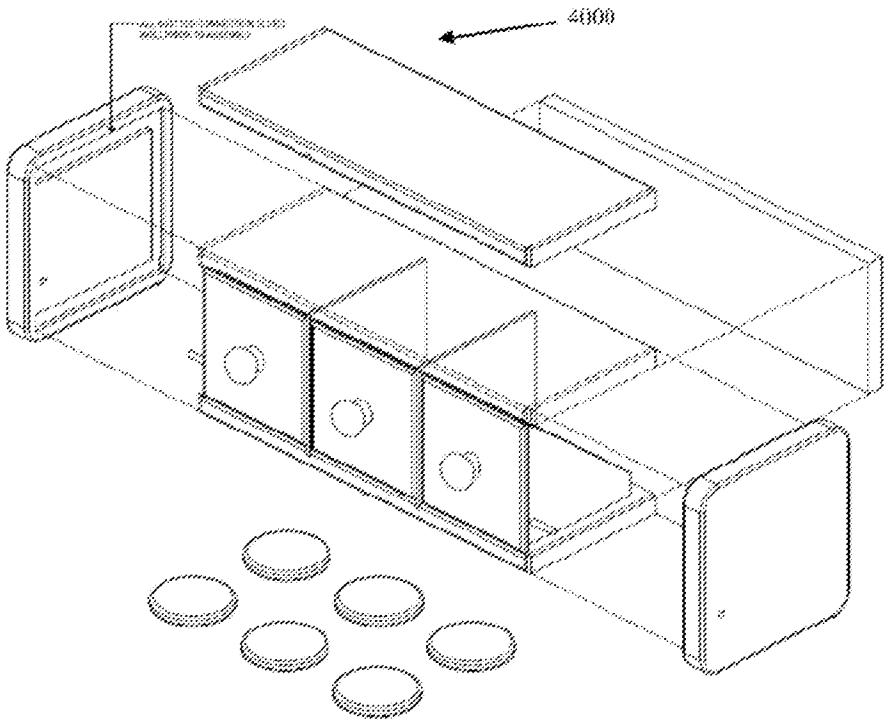
Figure 40A:
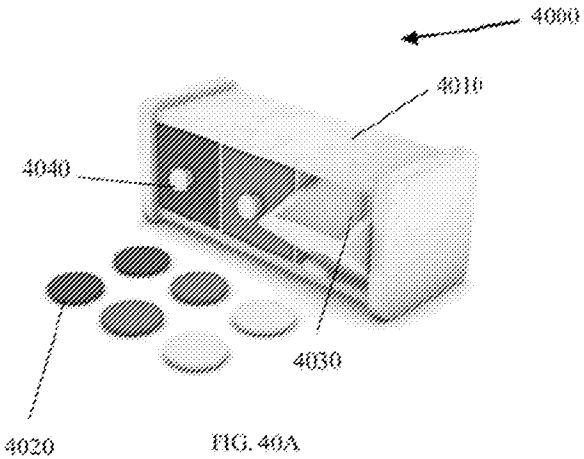
Figure 40C:
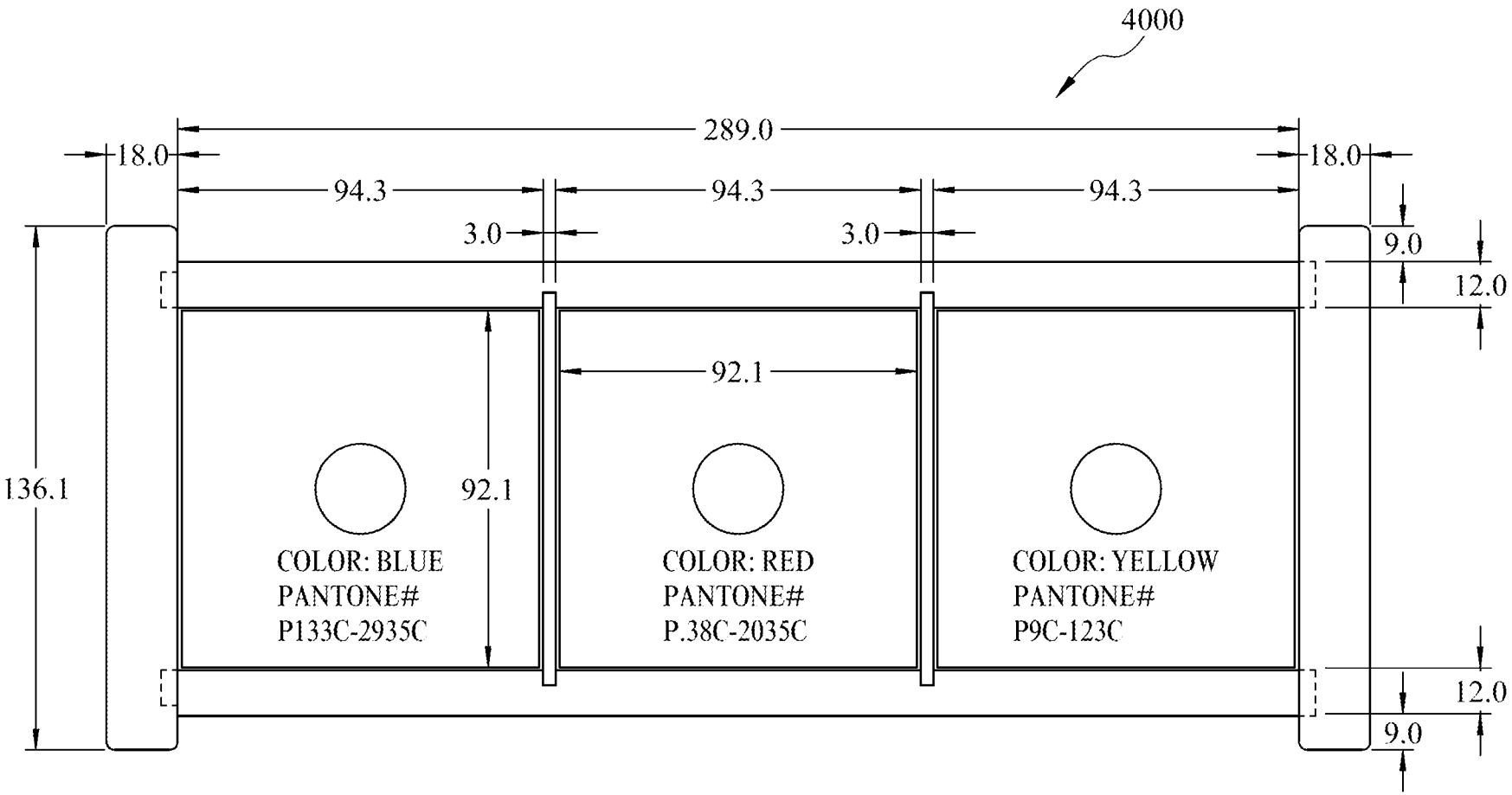
Figure 40E:
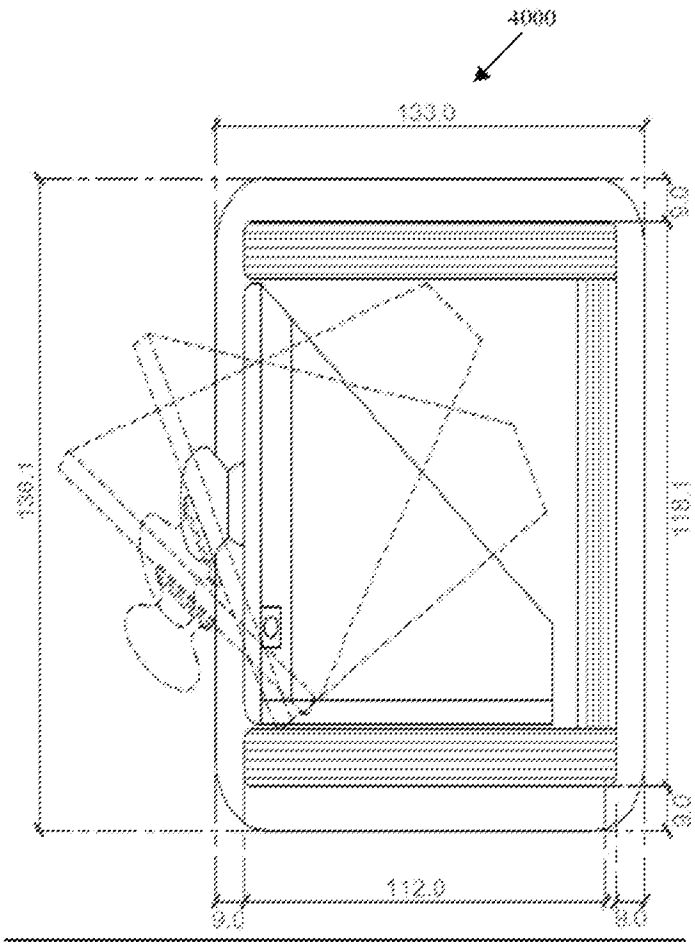
Figure 40G:
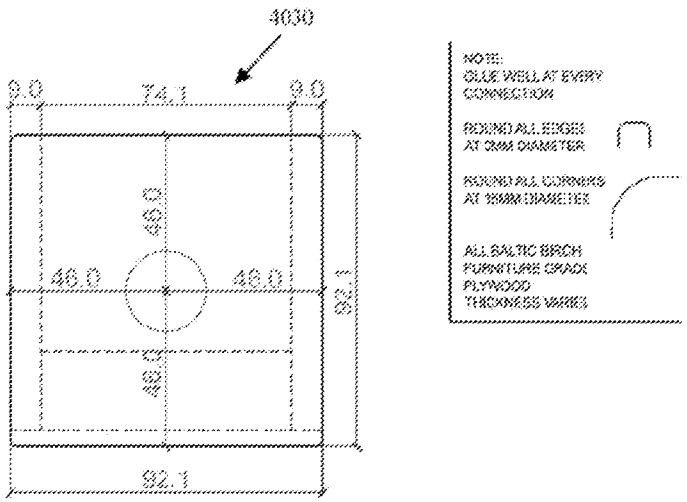
Figure 40I:
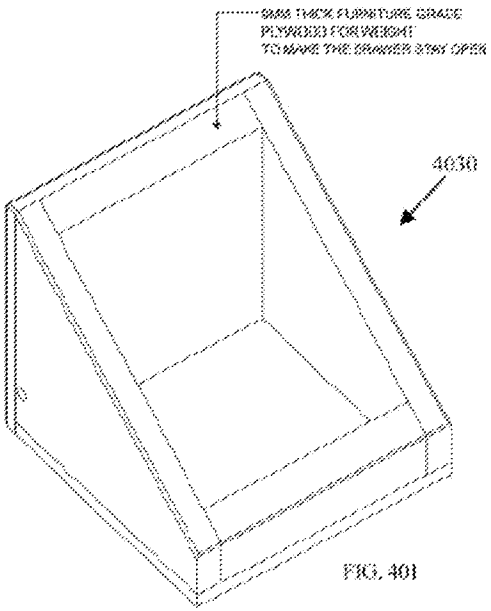
Figure 40F:
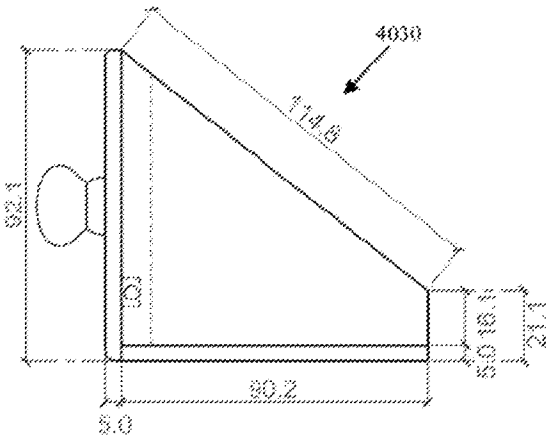
Figure 40H:
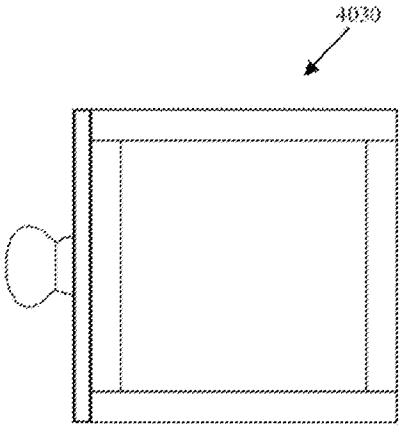
Figures 40J, 40K, 40L, 40M:
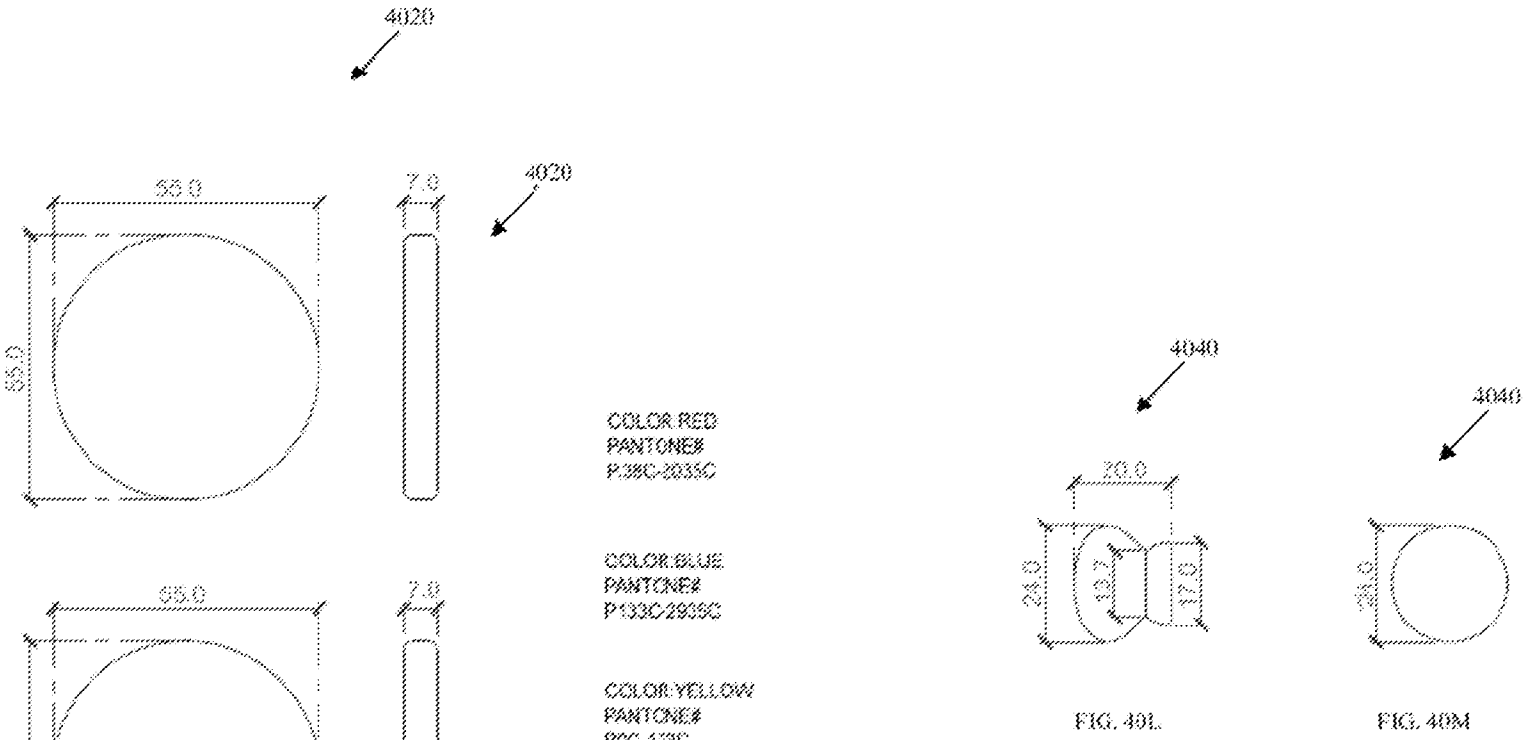

FIGS. 40F, 40K, and 40L illustrate side views of components of a Level 5 Montessori toy, according to exemplary embodiments of the present invention.

FIGS. 40G and 40M illustrate front views of components of a Level 5 Montessori toy, according to exemplary embodiments of the present invention.

FIGS. 40H and 40J illustrate top views of components of a Level 5 Montessori toy, according to exemplary embodiments of the present invention.

FIG. 40I illustrates a perspective view of a component of a Level 5 Montessori toy, according to exemplary embodiments of the present invention.

Figure 41A:
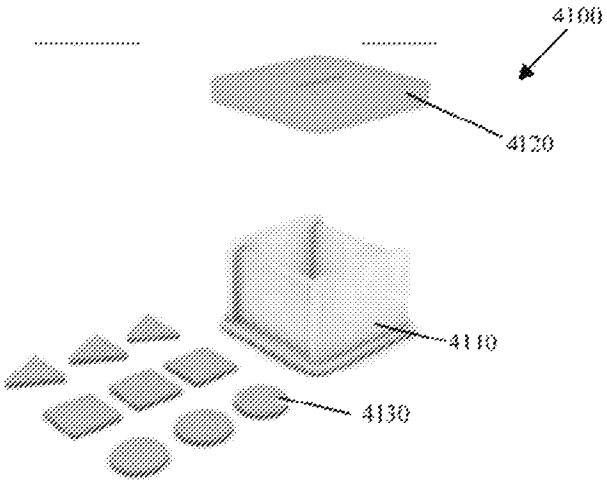
Figure 41B:
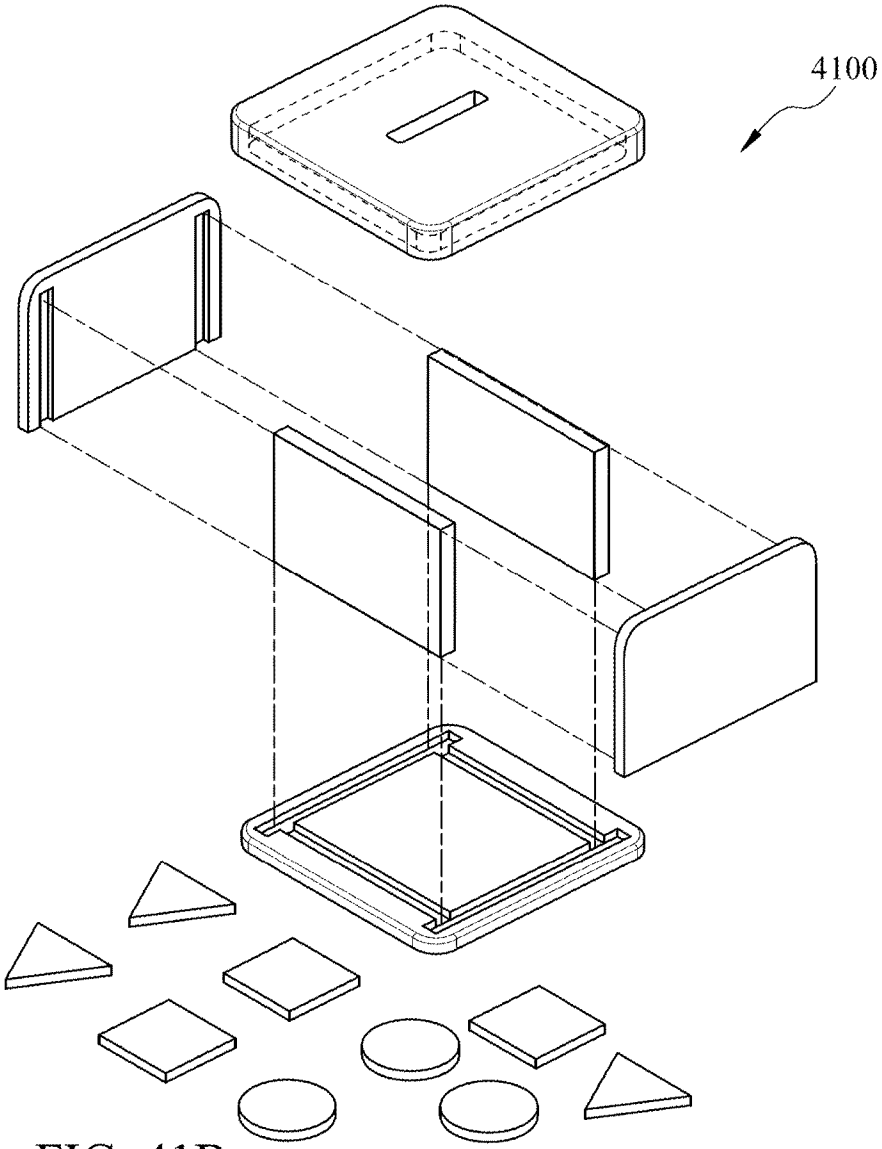

FIGS. 41A and 41B illustrate perspective views of a Level 5 Montessori toy, according to exemplary embodiments of the present invention.

Figure 41C:
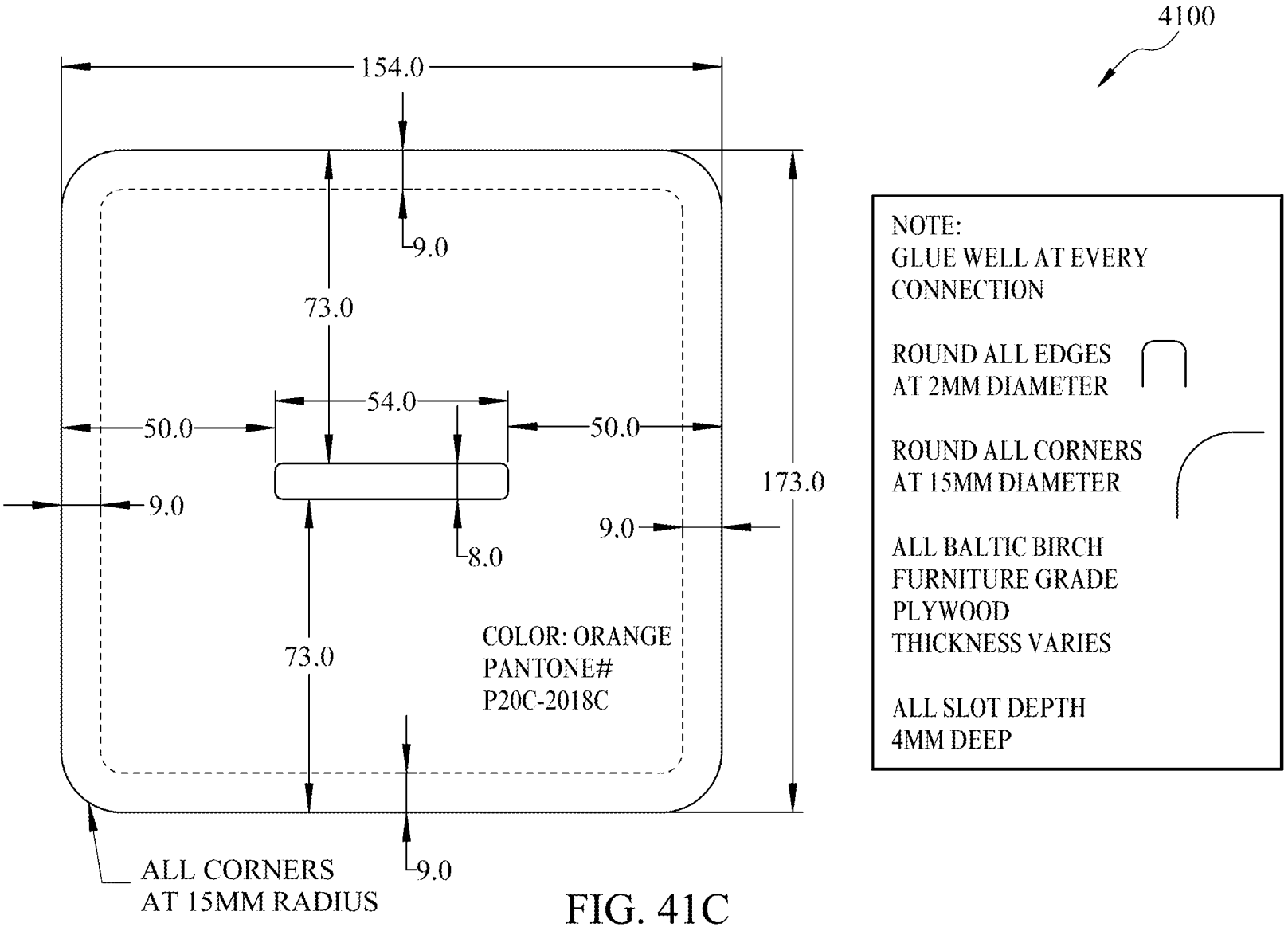

FIG. 41C illustrates a top view of a component of a Level 5 Montessori toy, according to exemplary embodiments of the present invention.

Figure 41E:
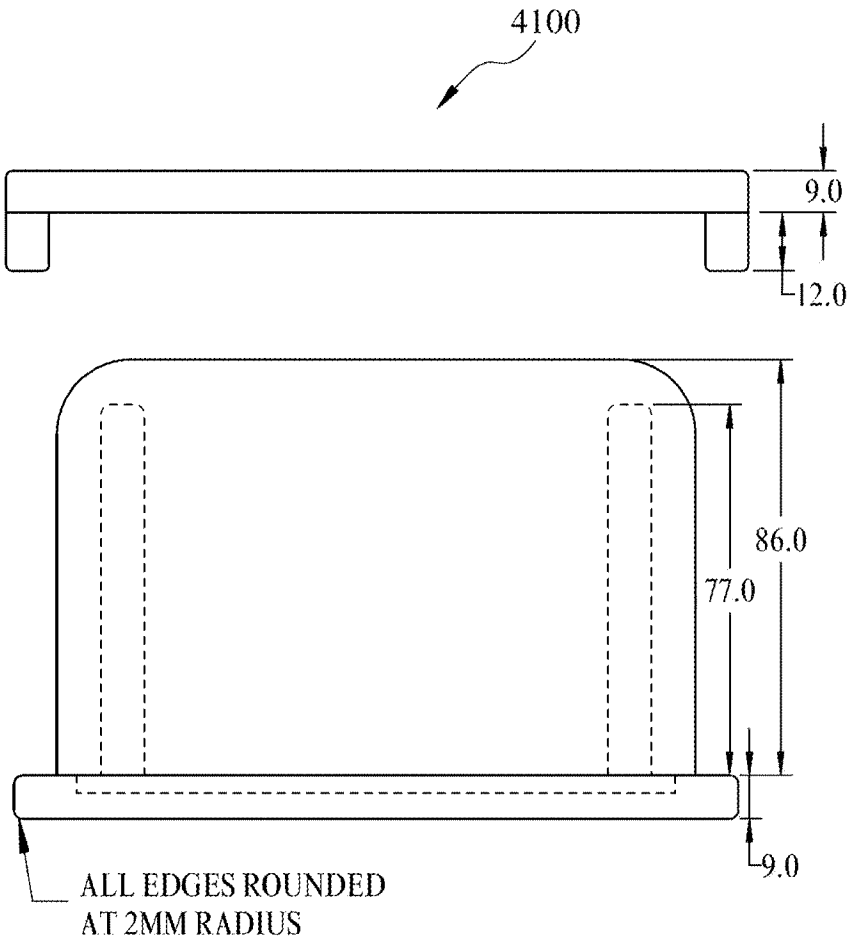
Figure 41D:
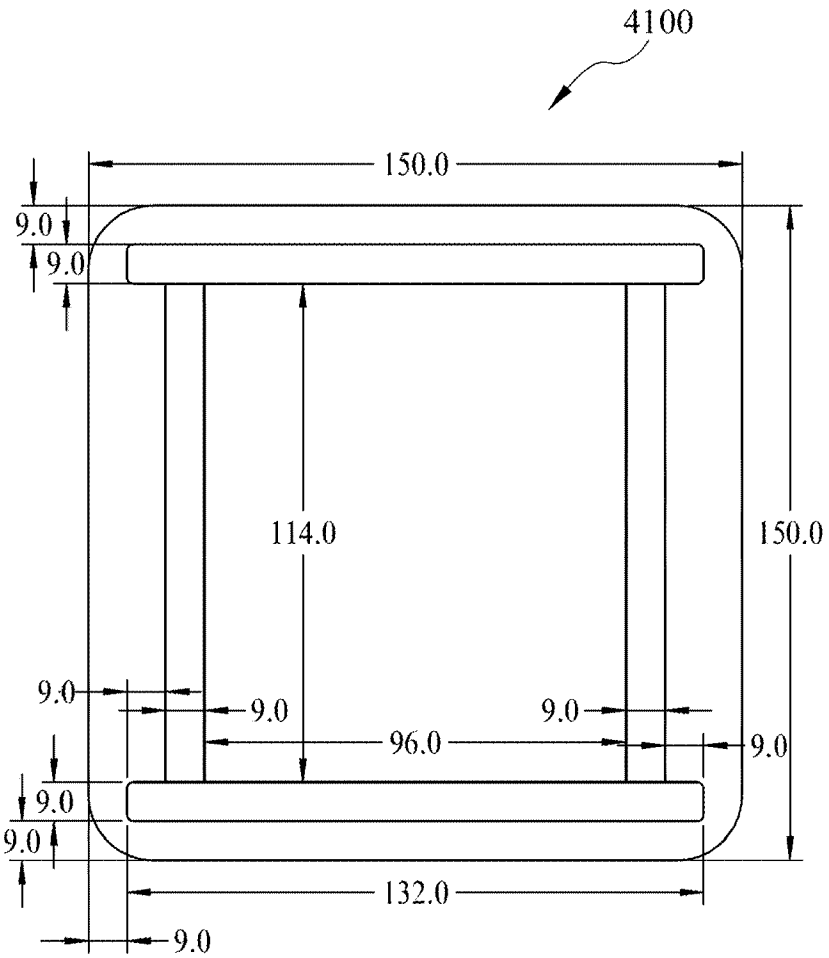

FIG. 41D illustrates a bottom view of a component of a Level 5 Montessori toy, according to exemplary embodiments of the present invention.

FIG. 41E illustrates a side view of a Level 5 Montessori toy, according to exemplary embodiments of the present invention.

Figure 41G:
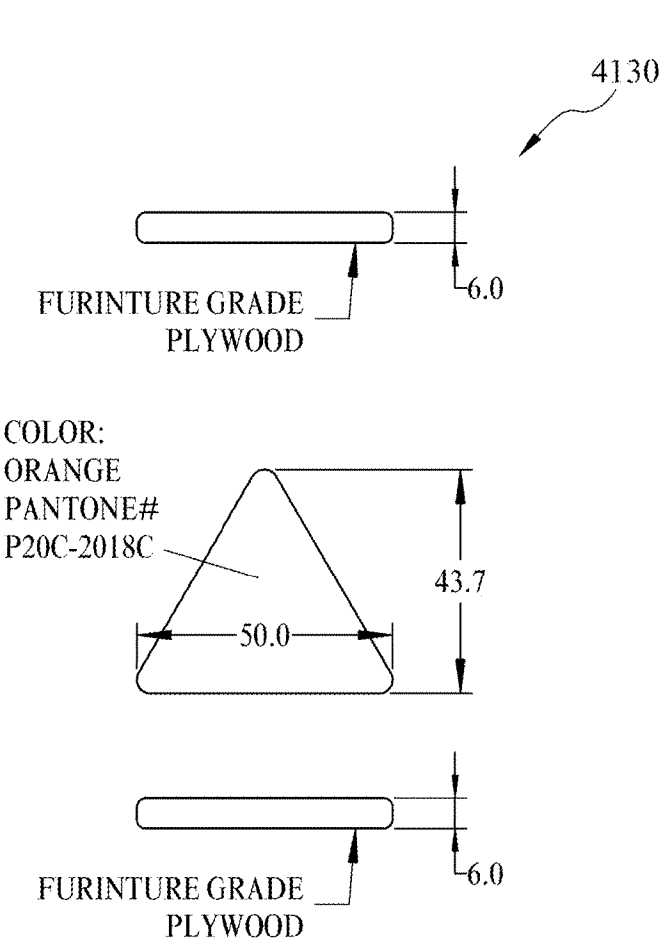
Figure 41F:
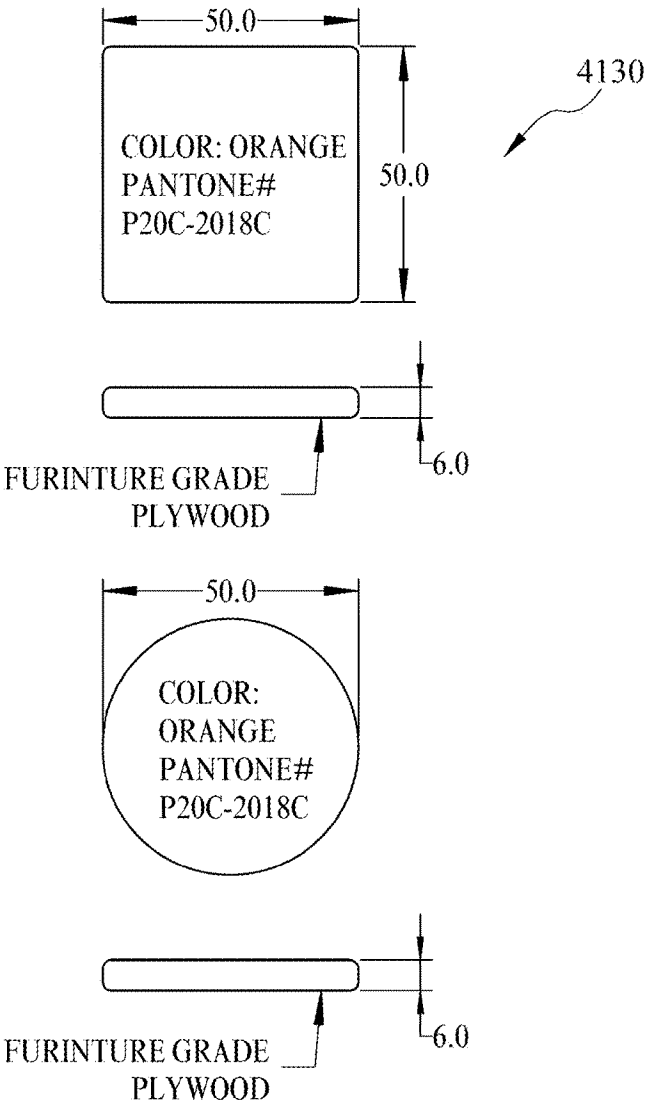

FIG. 41F illustrates a side view and a top view of a component of a Level 5 Montessori toy, according to exemplary embodiments of the present invention.

FIG. 41G illustrates a side view and a top view of a component of a Level 5 Montessori toy, according to exemplary embodiments of the present invention.

Figure 42C:
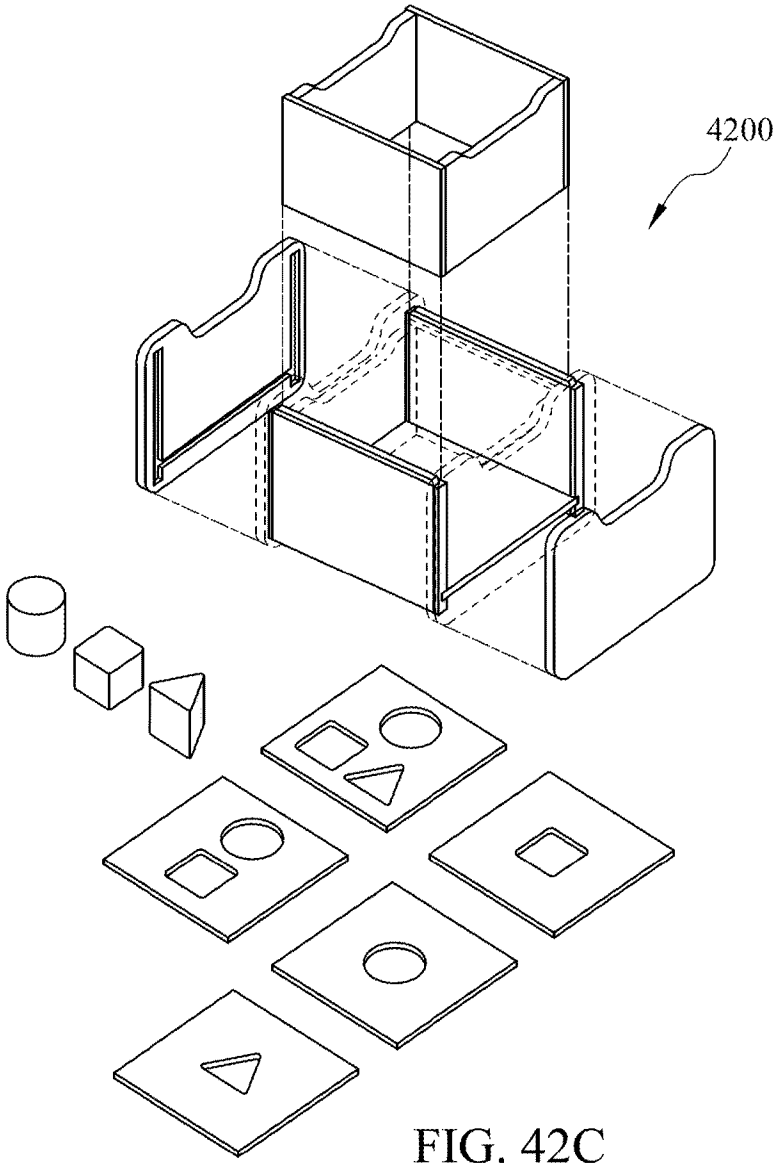
Figure 42A:
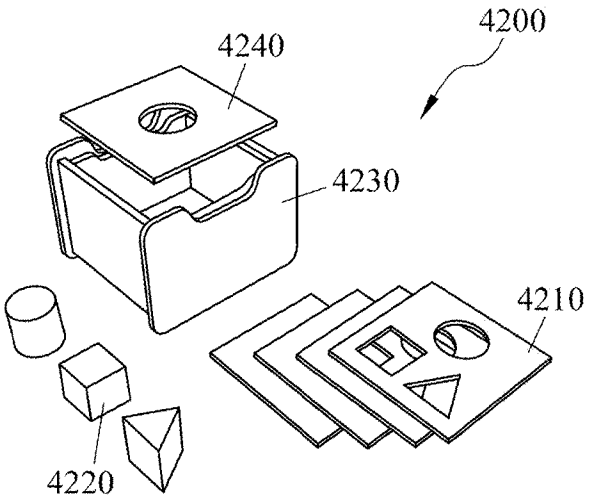
Figure 42B:
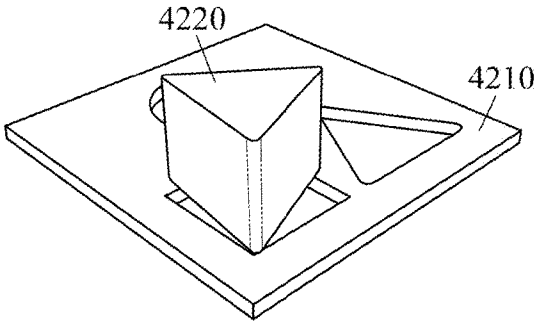

FIGS. 42A, 42B, and 42C illustrate perspective views of a Level 5 Montessori toy, according to exemplary embodiments of the present invention.

Figure 42D:
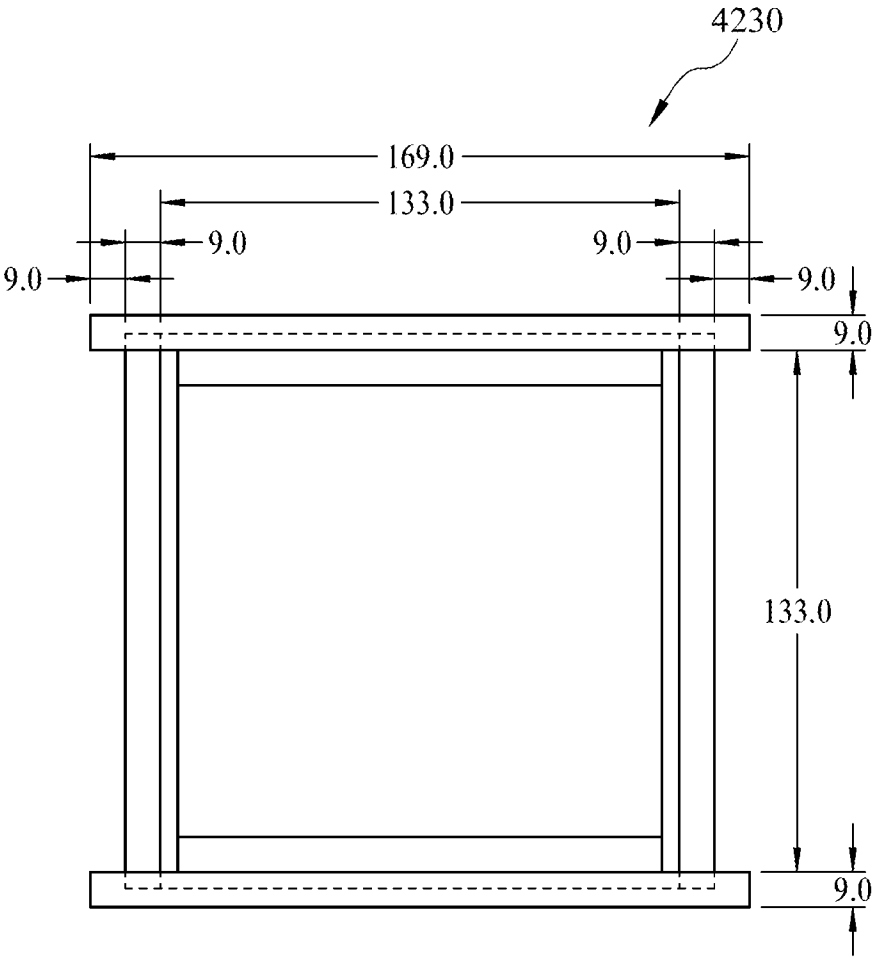
Figure 42E:
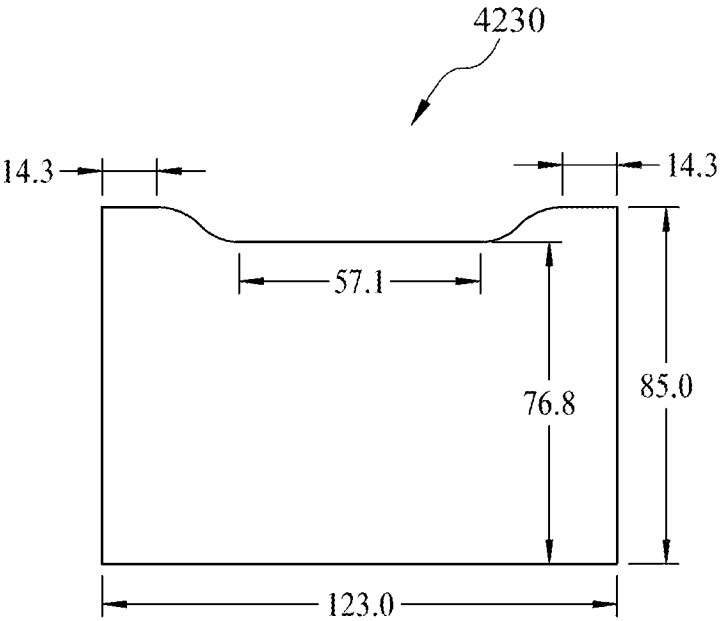
Figure 42G:
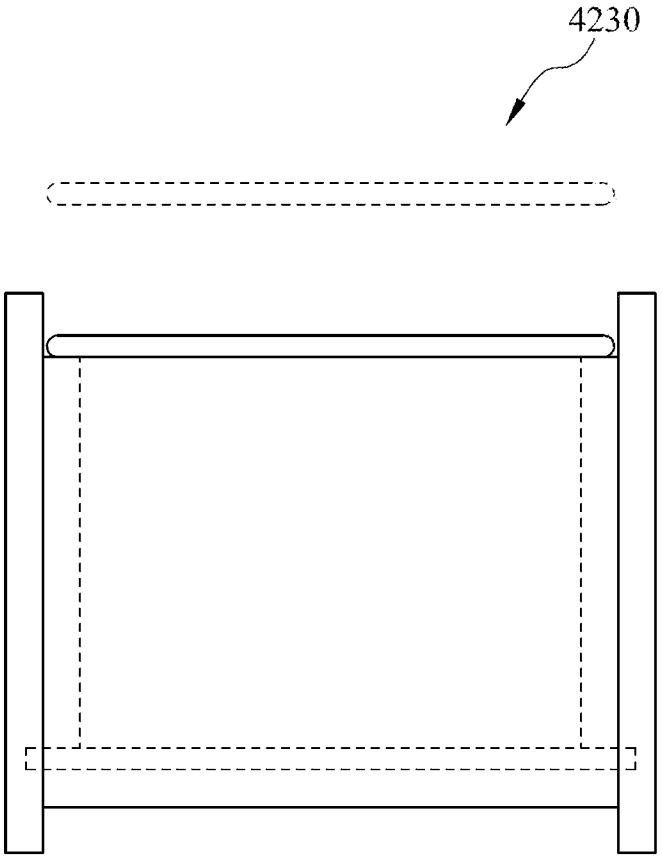
Figure 42F:
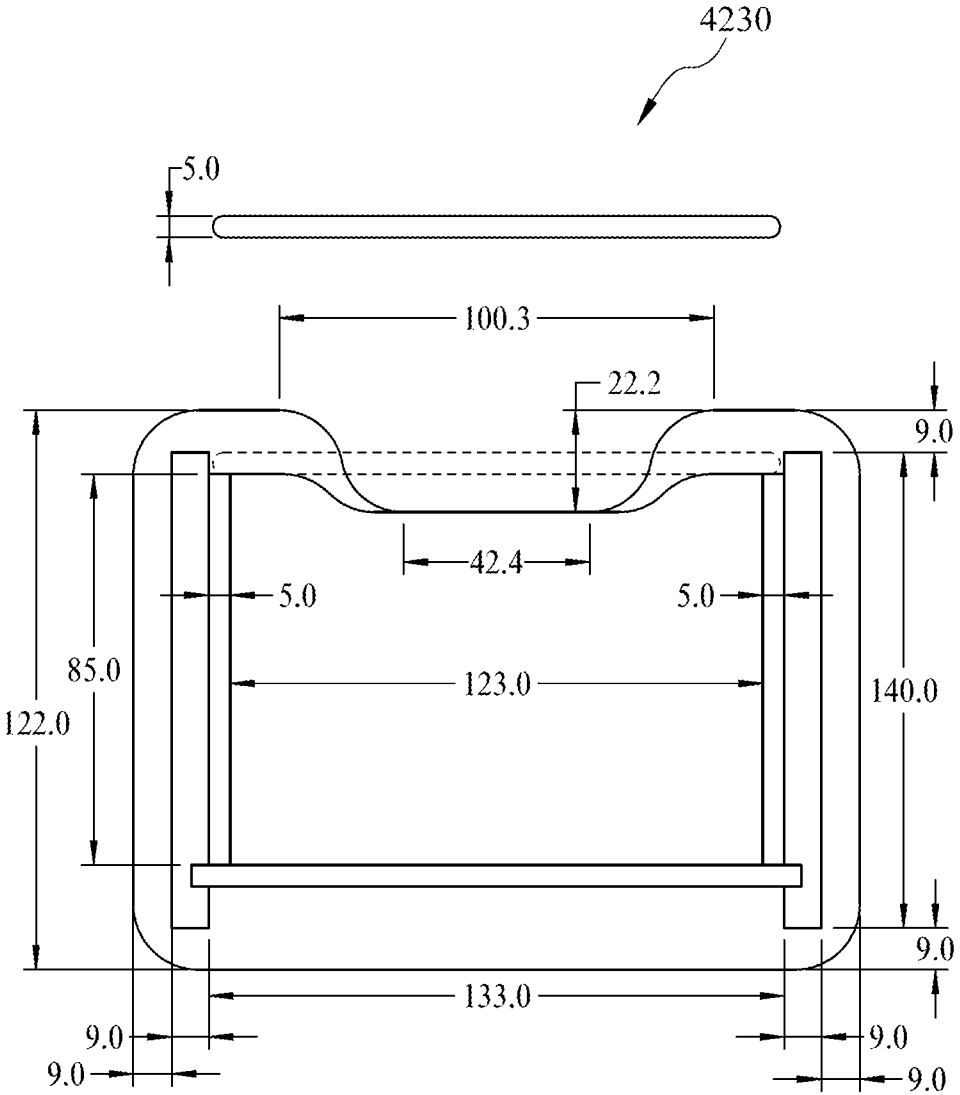
Figure 42H:
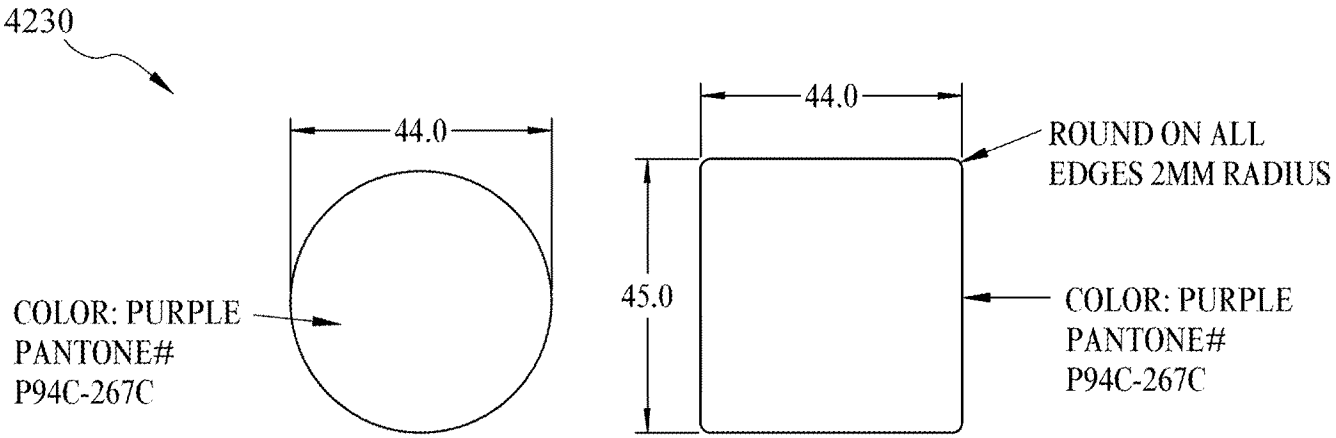
Figure 42I:
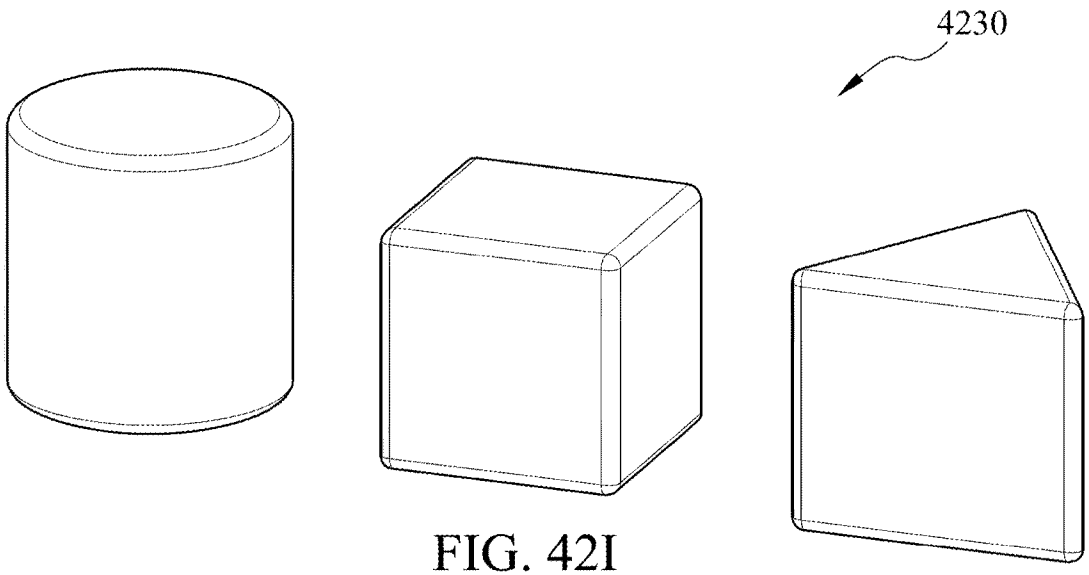
Figure 42J:
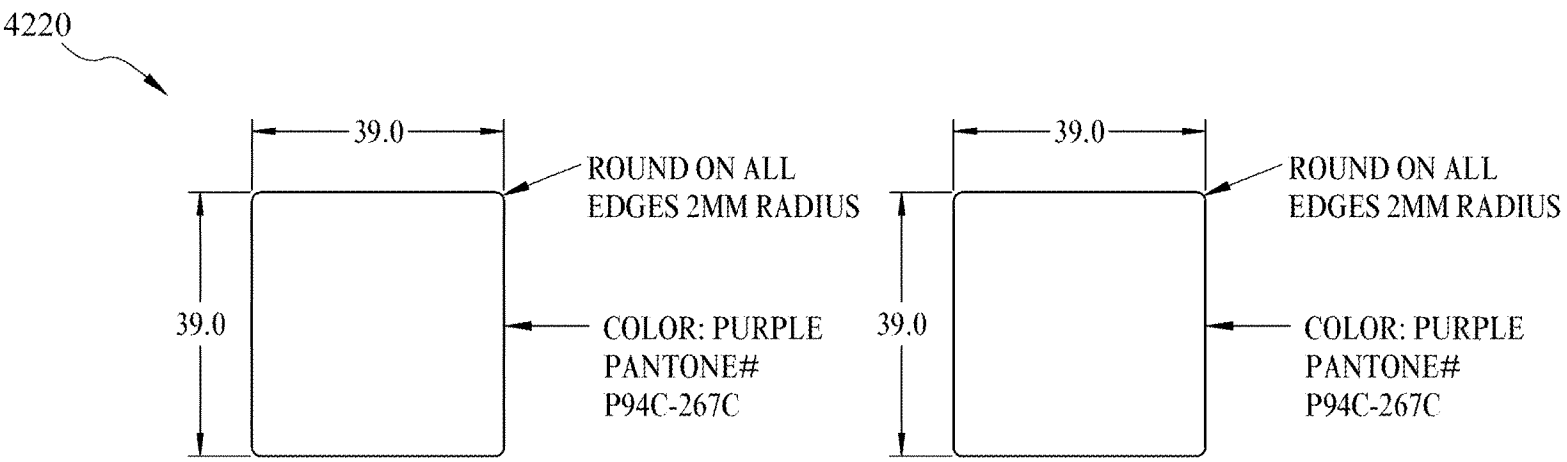
Figure 42K:
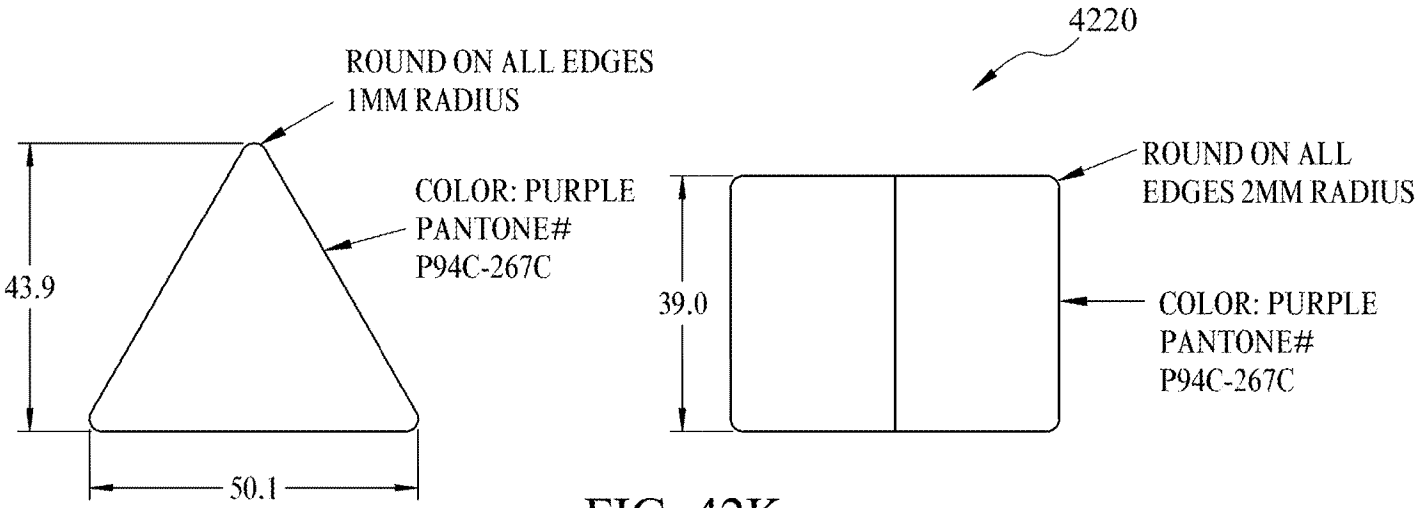

FIG. 42D illustrates a top view of a component of a Level 5 Montessori toy, according to exemplary embodiments of the present invention.

FIG. 421 illustrates a perspective view of a component of a Level 5 Montessori toy, according to exemplary embodiments of the present invention.

FIGS. 42E, 42F, 42G, 42J, and 42K illustrate side views of a component of a Level 5 Montessori toy, according to exemplary embodiments of the present invention.

FIGS. 42H, 42L, 42M, 42N, 42O, and 42Q illustrate top views of a component of a Level 5 Montessori toy, according to exemplary embodiments of the present invention.

Figure 42P:
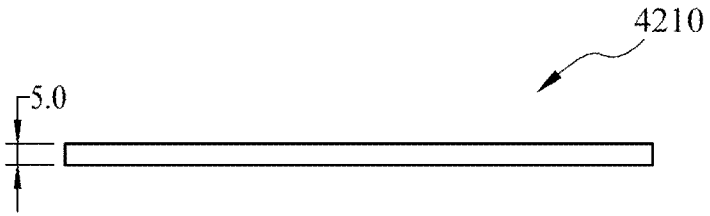

FIG. 42P illustrates a side view of a component of a Level 5 Montessori toy, according to exemplary embodiments of the present invention.

Figure 43B:
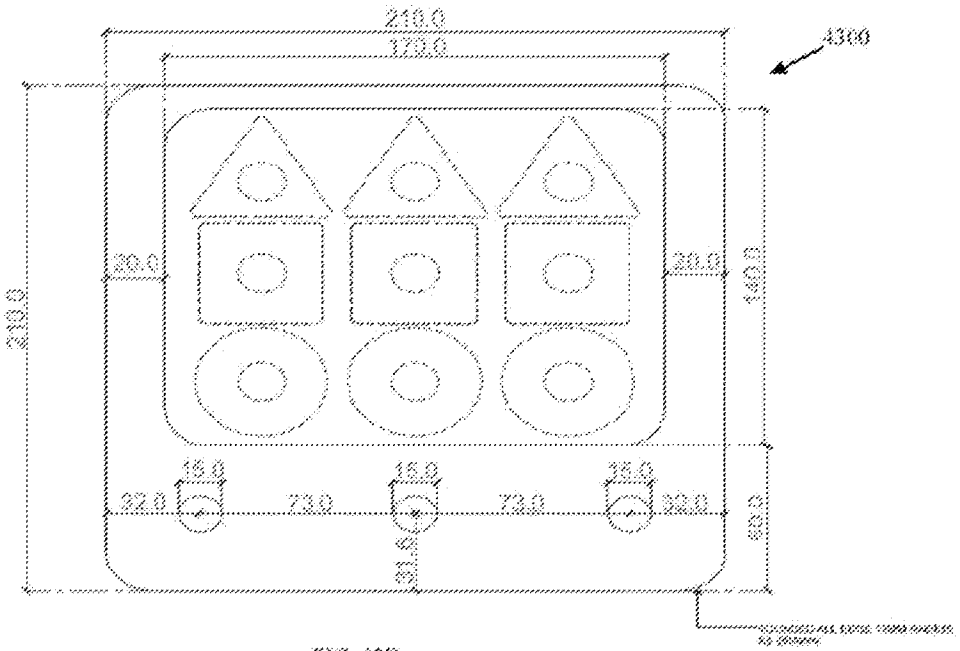
Figure 43A:
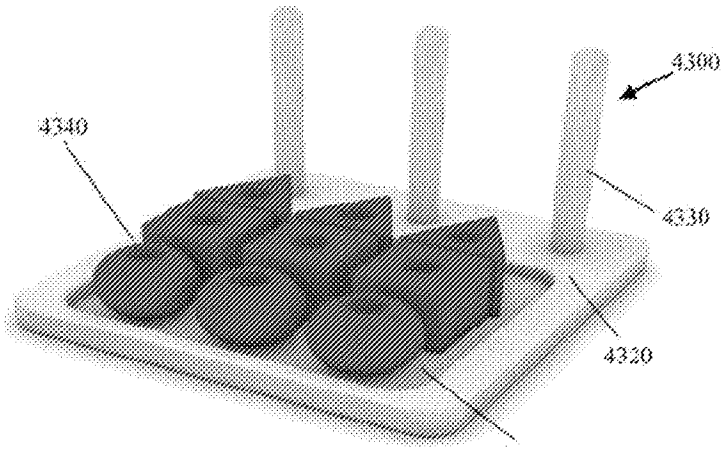

FIG. 43A illustrates a perspective view of a Level 6 Montessori toy, according to exemplary embodiments of the present invention.

FIG. 43B illustrates a top view of a Level 6 Montessori toy, according to exemplary embodiments of the present invention.

Figure 43C:
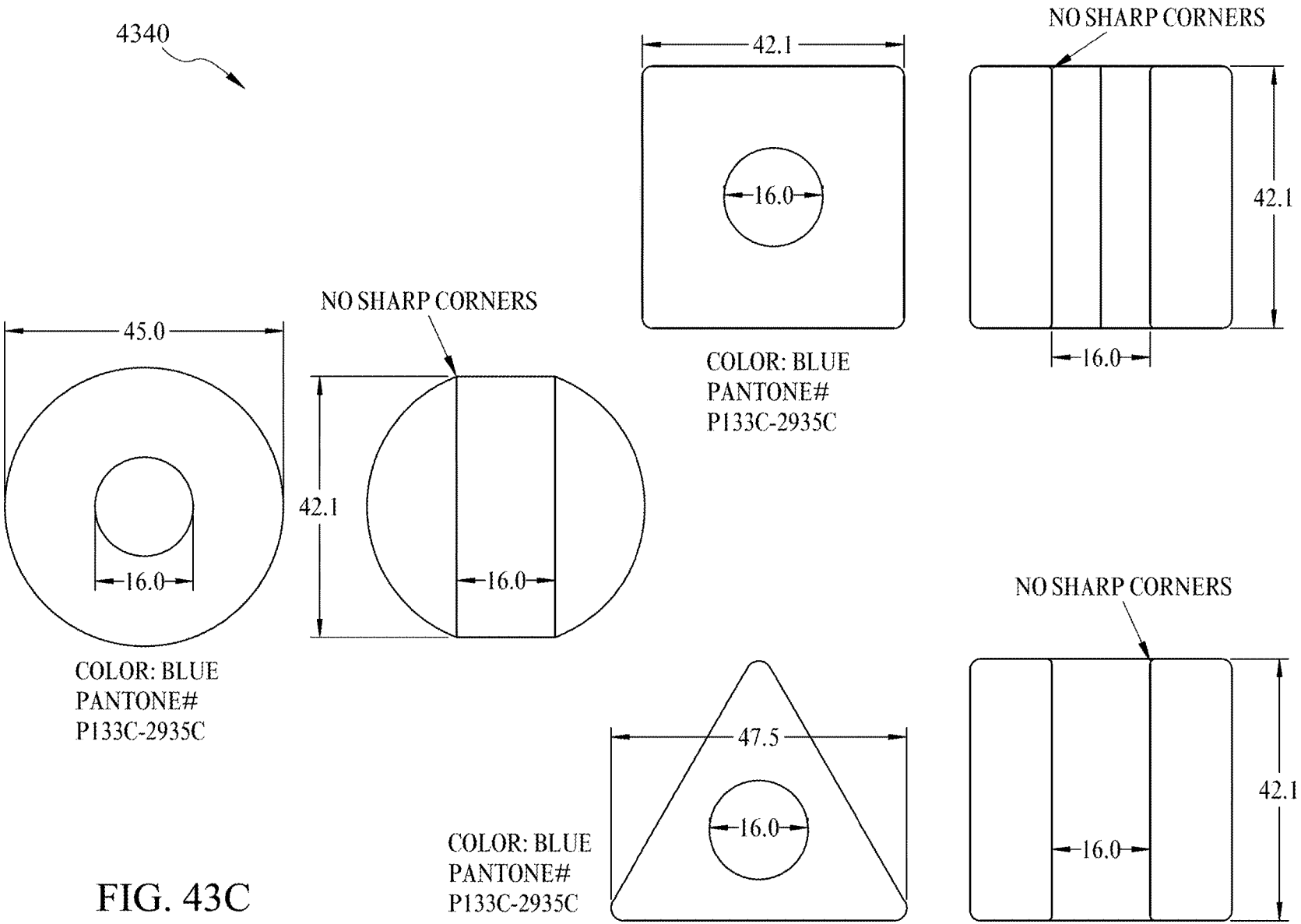

FIG. 43C illustrates top views of components of a Level 6 Montessori toy, according to exemplary embodiments of the present invention.

Figure 43D:
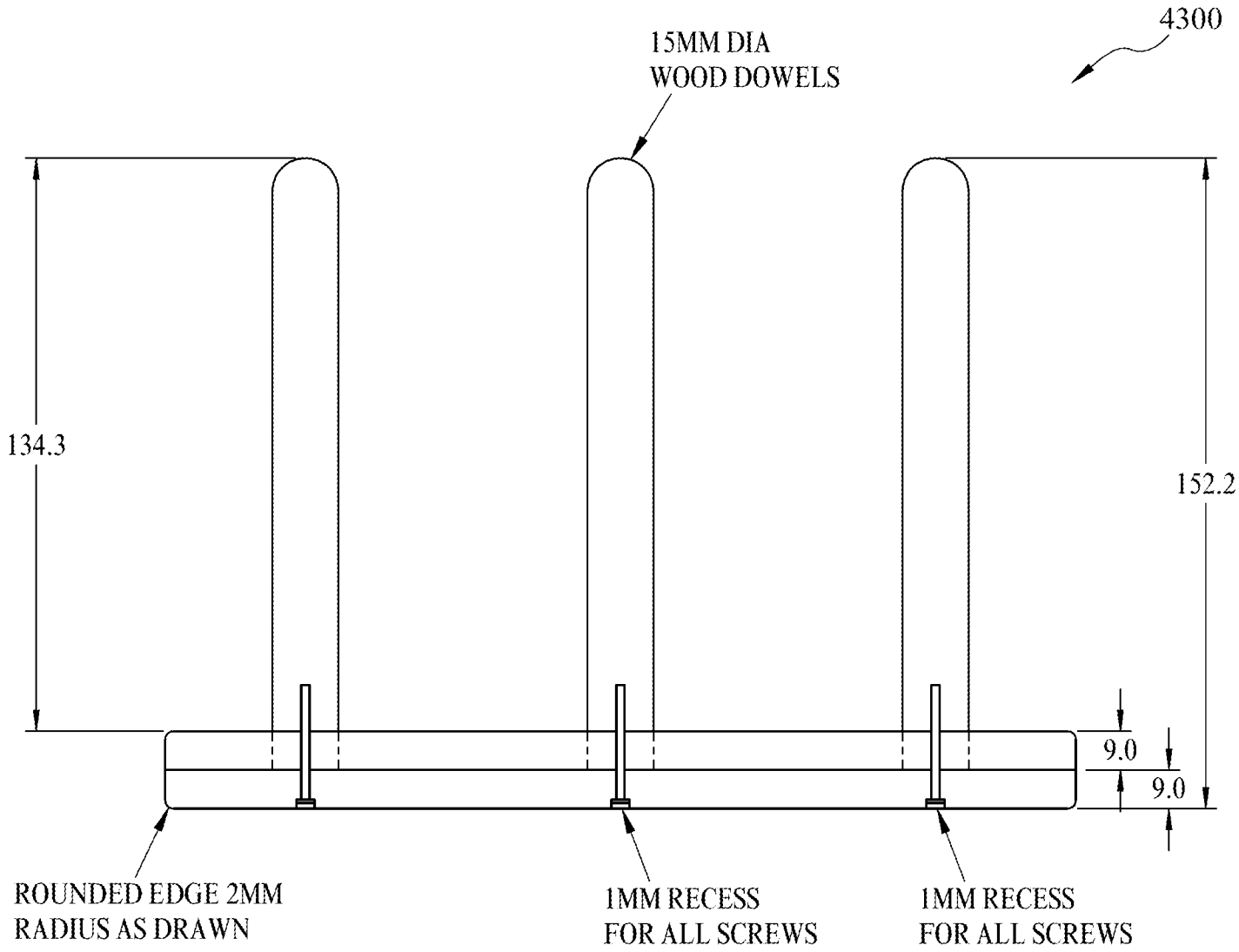

FIG. 43D illustrates a front view of a Level 6 Montessori toy, according to exemplary embodiments of the present invention.

Figure 43E:
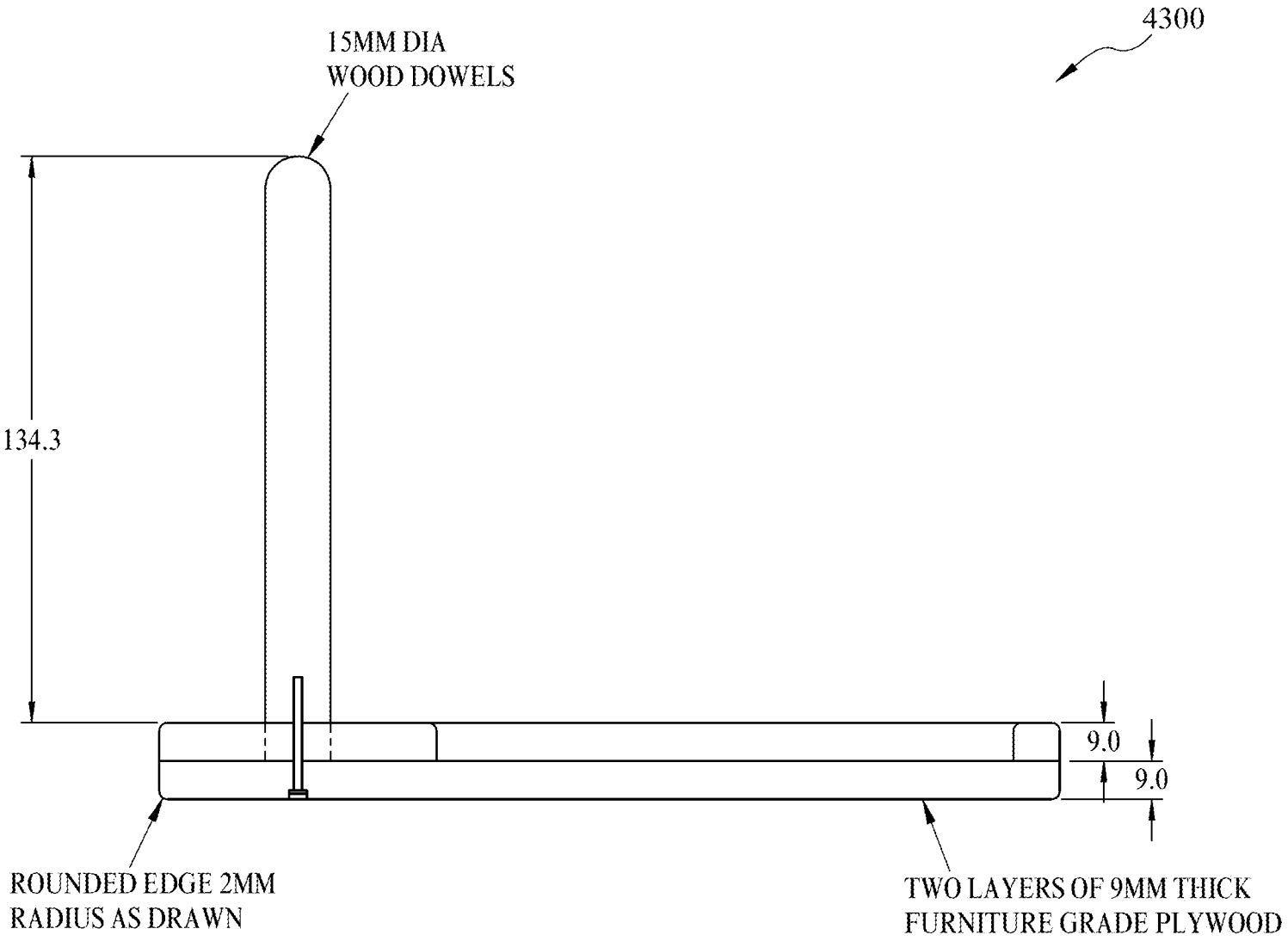

FIG. 43E illustrates a side view of a Level 6 Montessori toy, according to exemplary embodiments of the present invention.

Figure 44B:
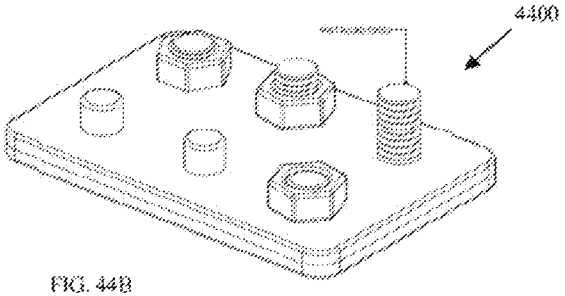
Figure 44D:
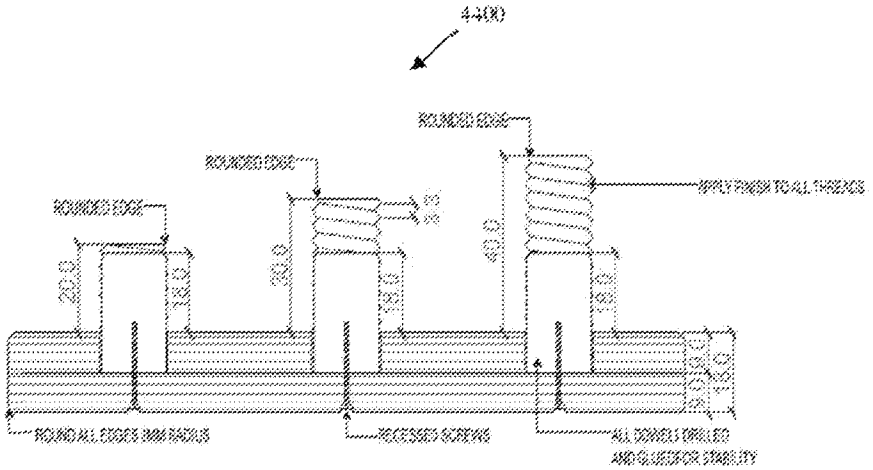
Figure 44A:
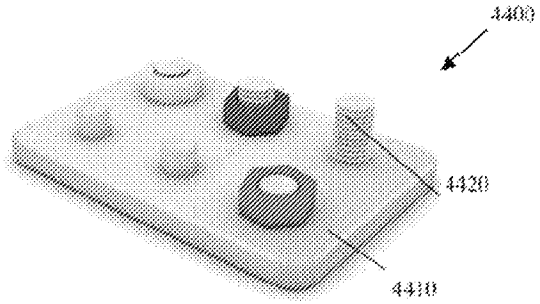

FIGS. 44A and 44B illustrate perspective views of a Level 6 Montessori toy, according to exemplary embodiments of the present invention.

Figure 44C:
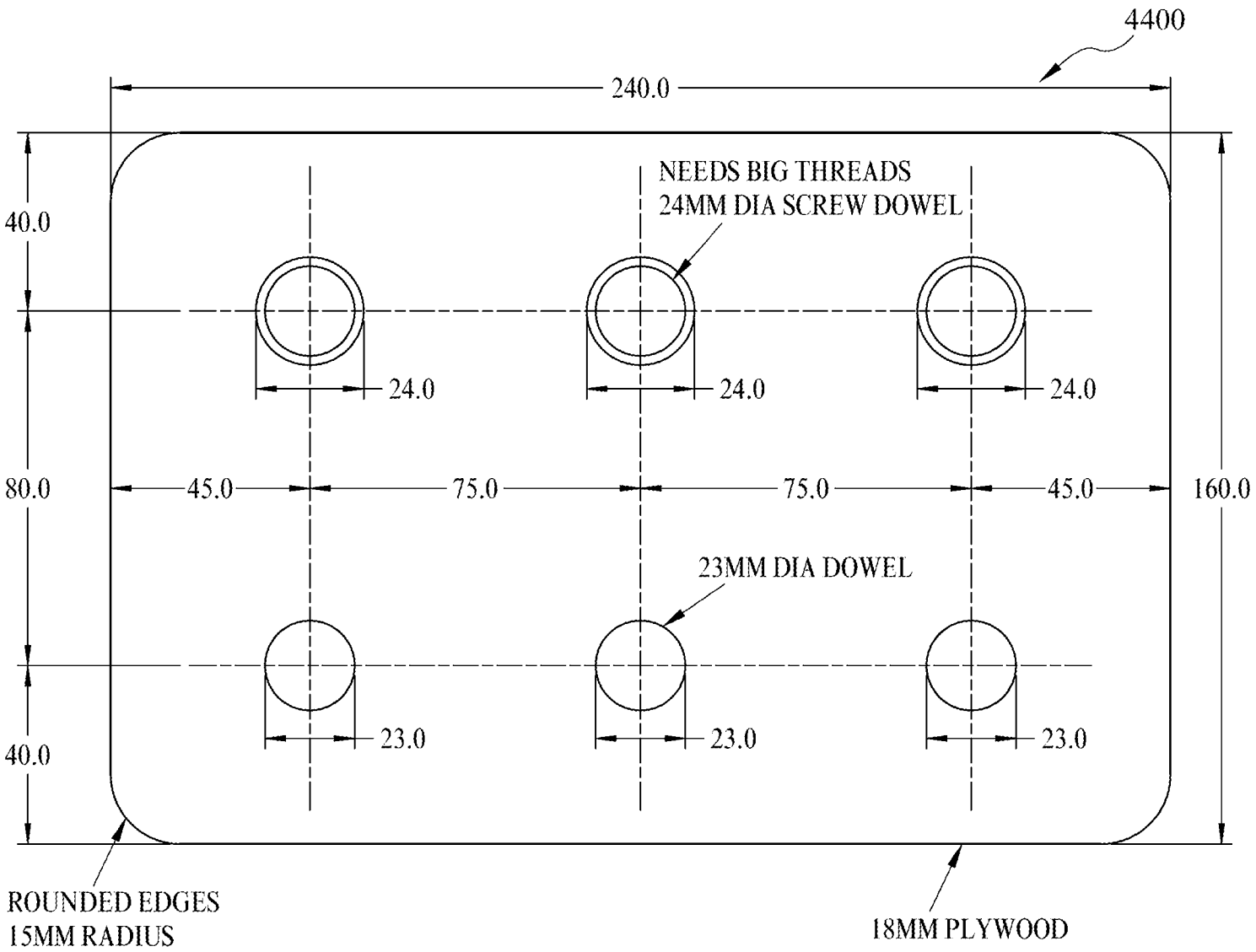

FIG. 44C illustrates a top view of a Level 6 Montessori toy, according to exemplary embodiments of the present invention.

Figures 44E, 44F, 44G:
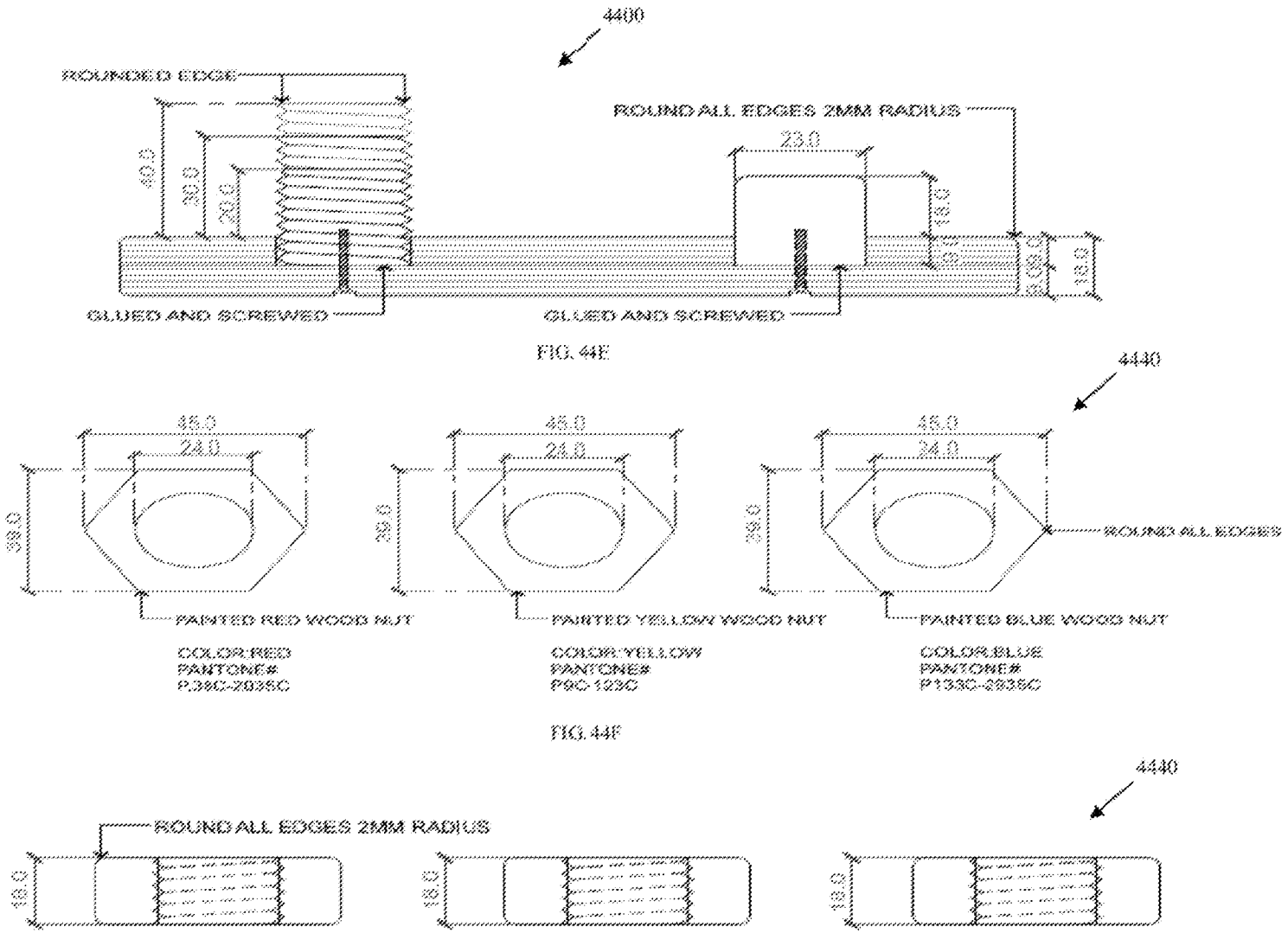

FIGS. 44D and 44E illustrate side views of a Level 6 Montessori toy, according to exemplary embodiments of the present invention.

FIG. 44F illustrates top views of components of a Level 6 Montessori toy, according to exemplary embodiments of the present invention.

FIG. 44G illustrates side views of components of a Level 6 Montessori toy, according to exemplary embodiments of the present invention.

Figure 45A:
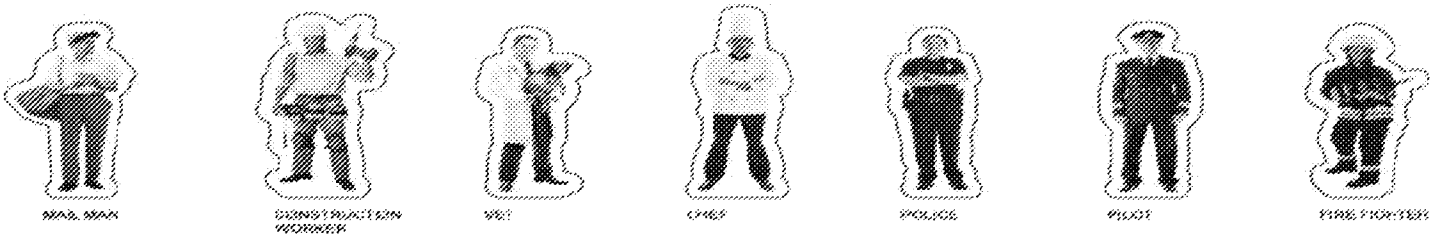
Figure 45B:
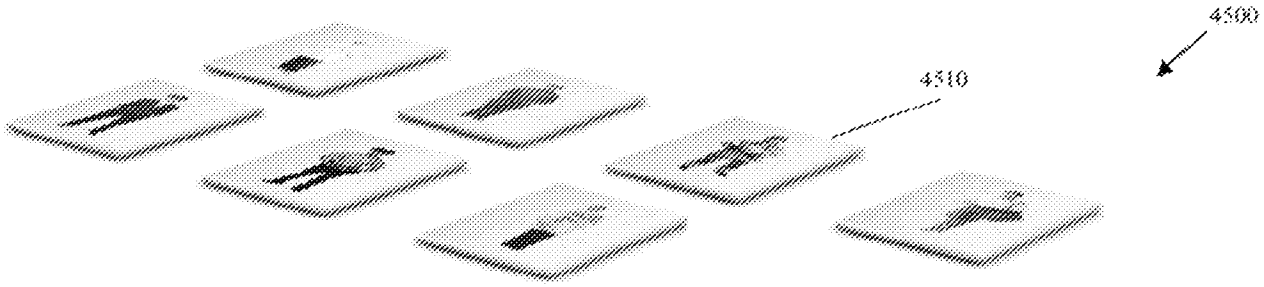
Figure 45C:
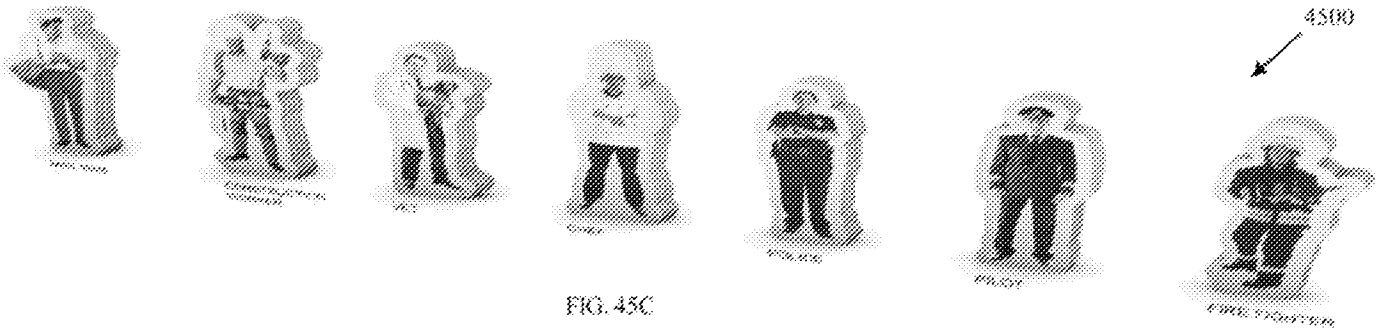

FIGS. 45A, 45B, and 45C illustrate perspective views of a Level 6 Montessori toy, according to exemplary embodiments of the present invention.

Figure 45E:
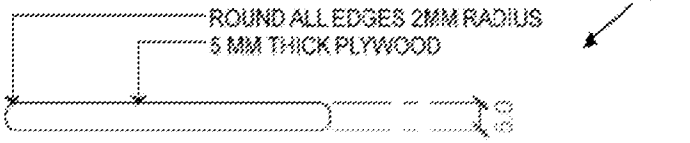
Figure 45D:
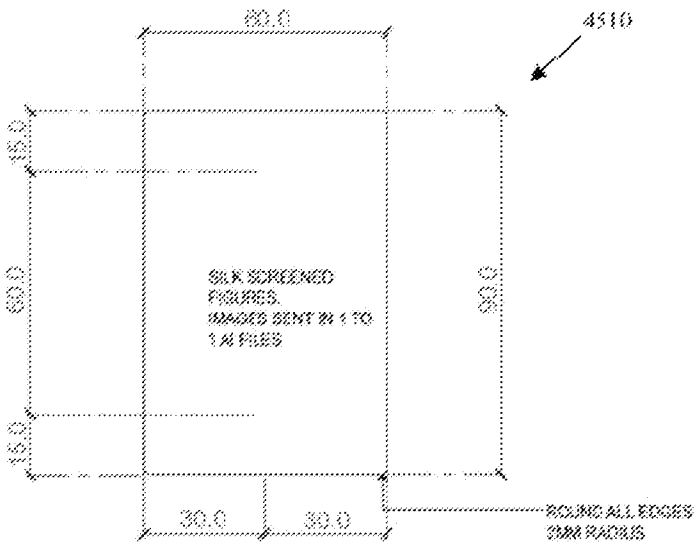
Figure 45F:
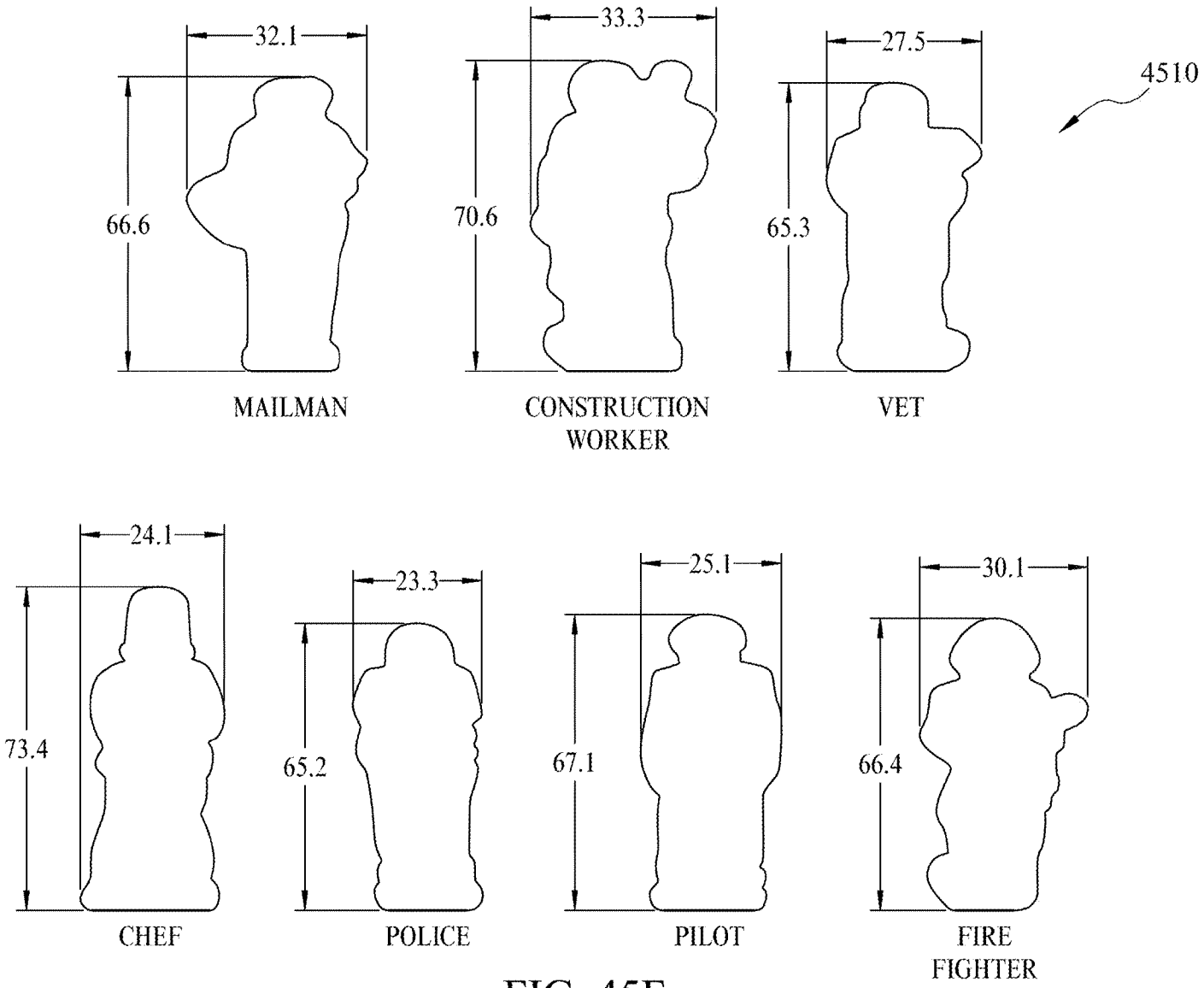
Figure 45G:
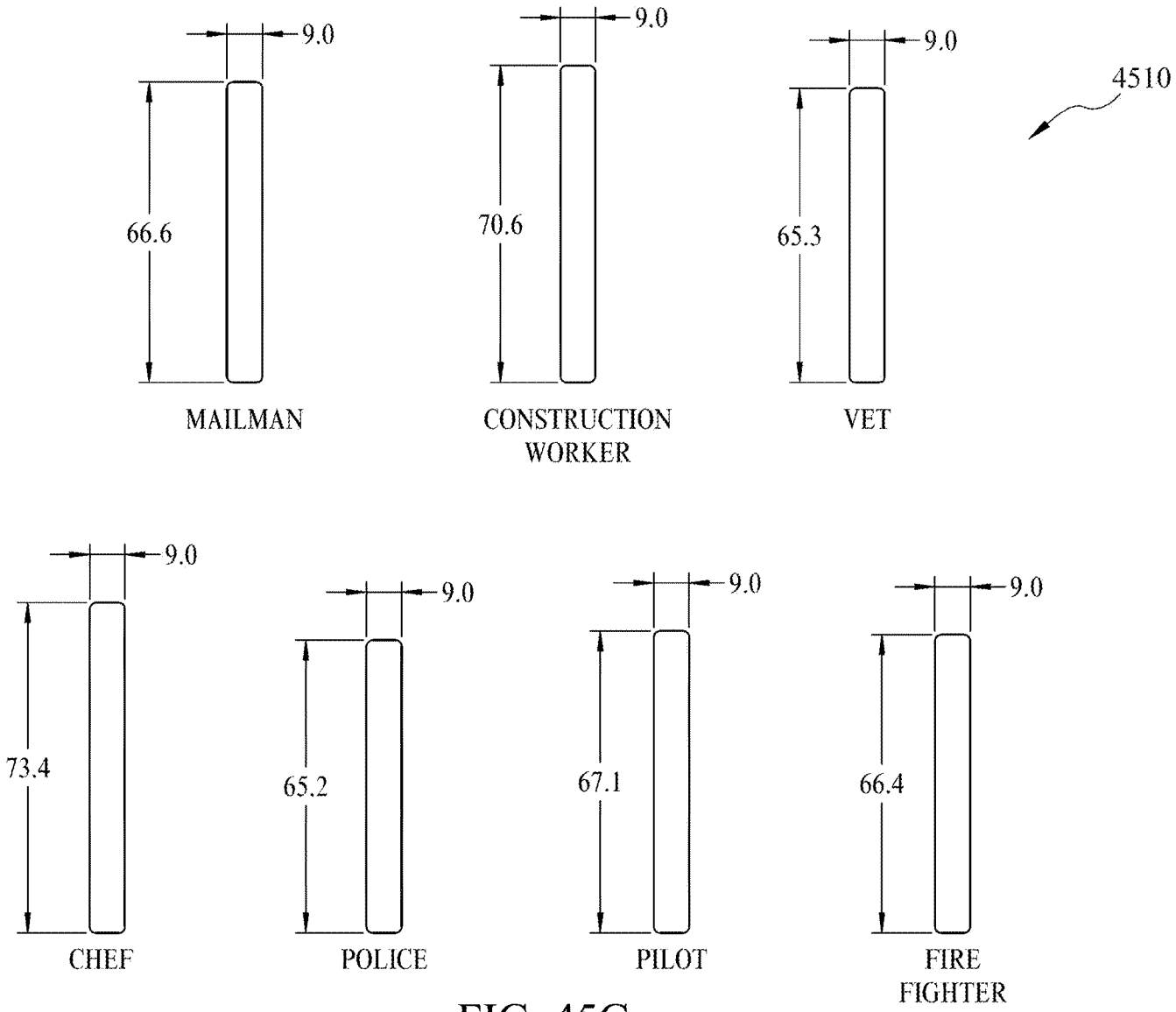
Figure 45H:
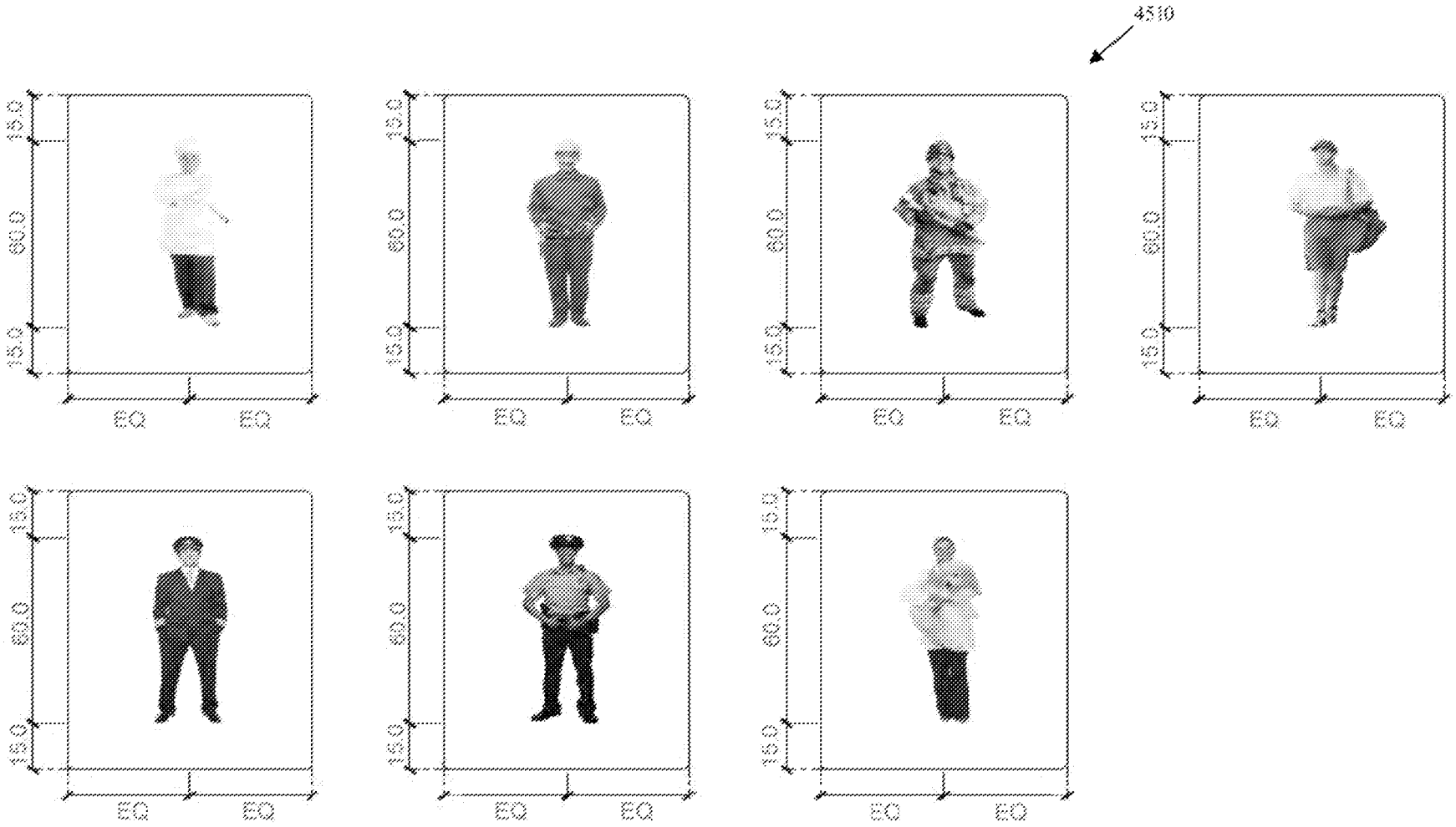

FIGS. 45D, 45F, and 45H illustrate top views of components of a Level 6 Montessori toy, according to exemplary embodiments of the present invention.

FIGS. 45E and 45G illustrate side views of components of a Level 6 Montessori toy, according to exemplary embodiments of the present invention.

Figure 46A:
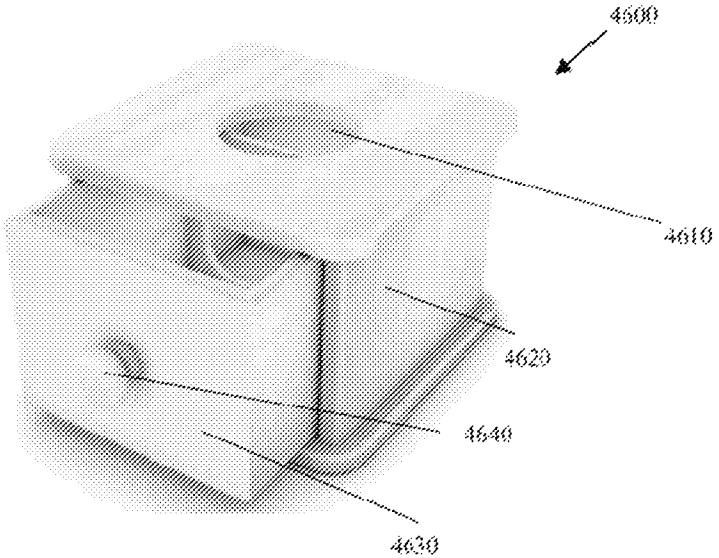
Figure 46B:
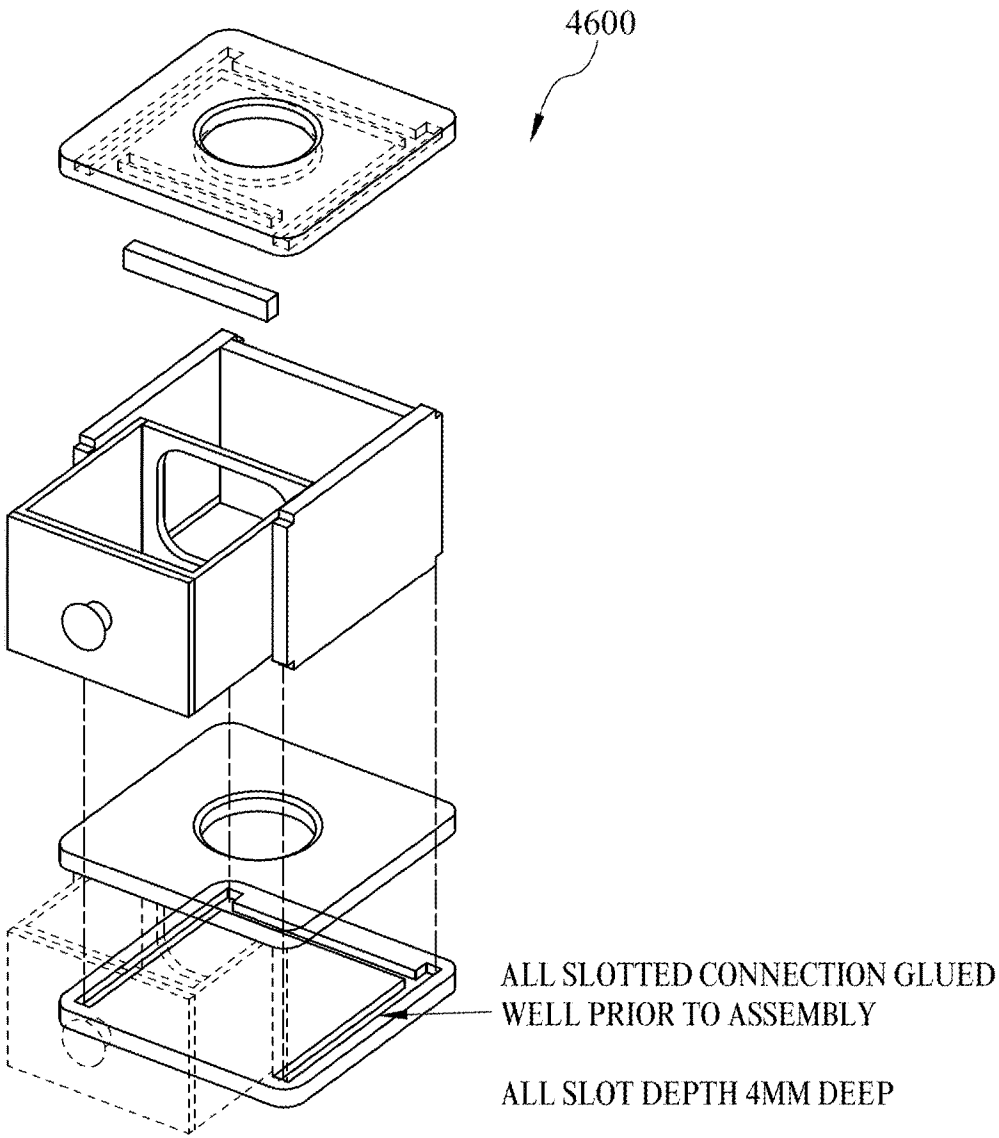
Figure 46B:
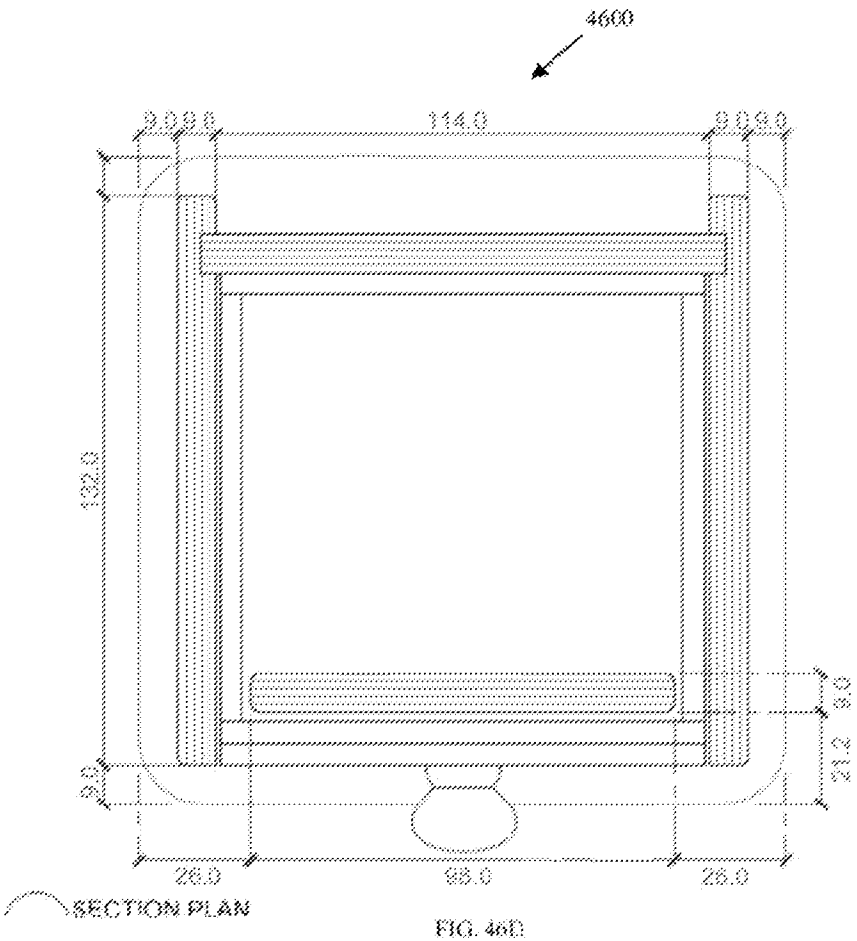
Figure 46C:
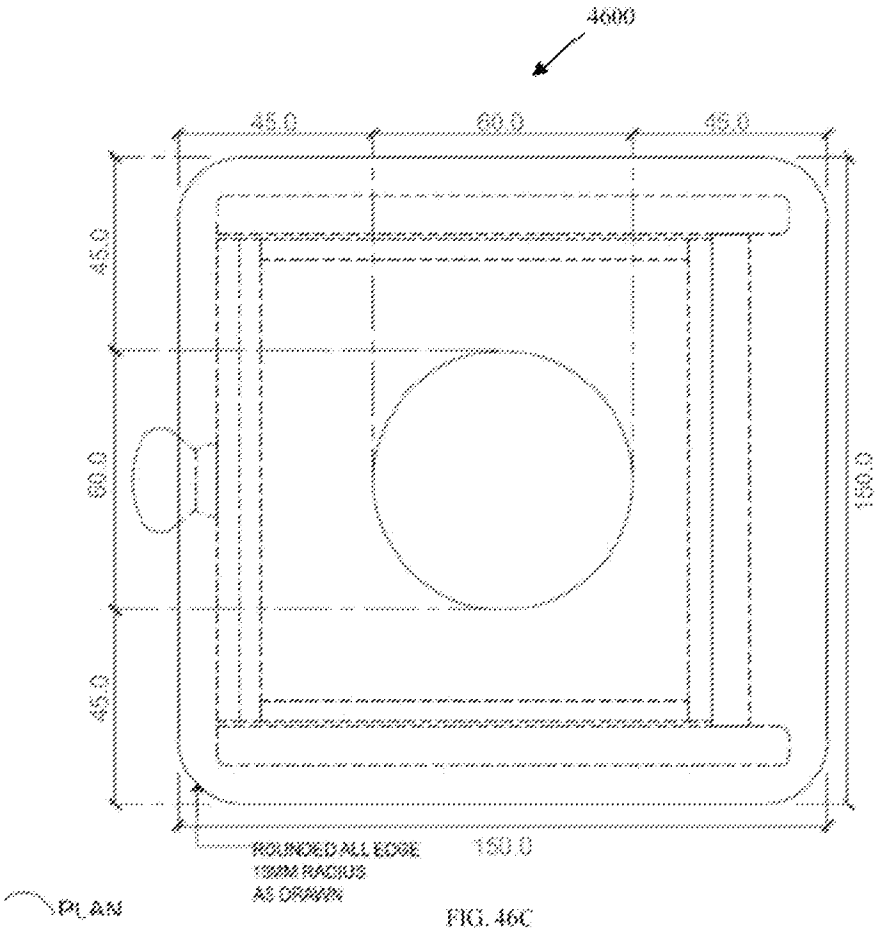

FIGS. 46A and 46B illustrate perspective views of a Level 6 Montessori toy, according to exemplary embodiments of the present invention.

FIGS. 46C, 46D, 46E, and 46G illustrate top views of a Level 6 Montessori toy, according to exemplary embodiments of the present invention.

Figure 46F:
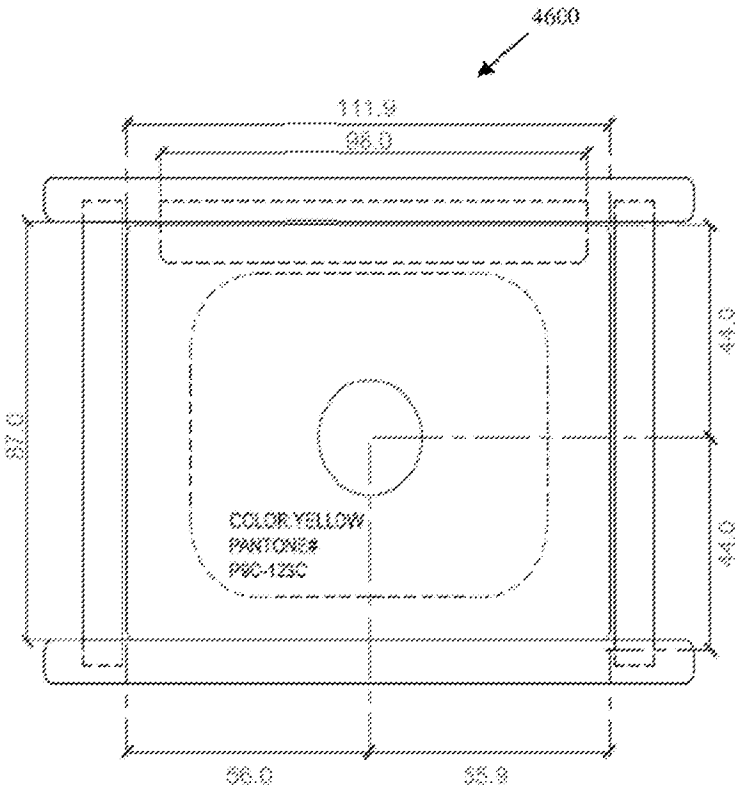
Figure 46E:
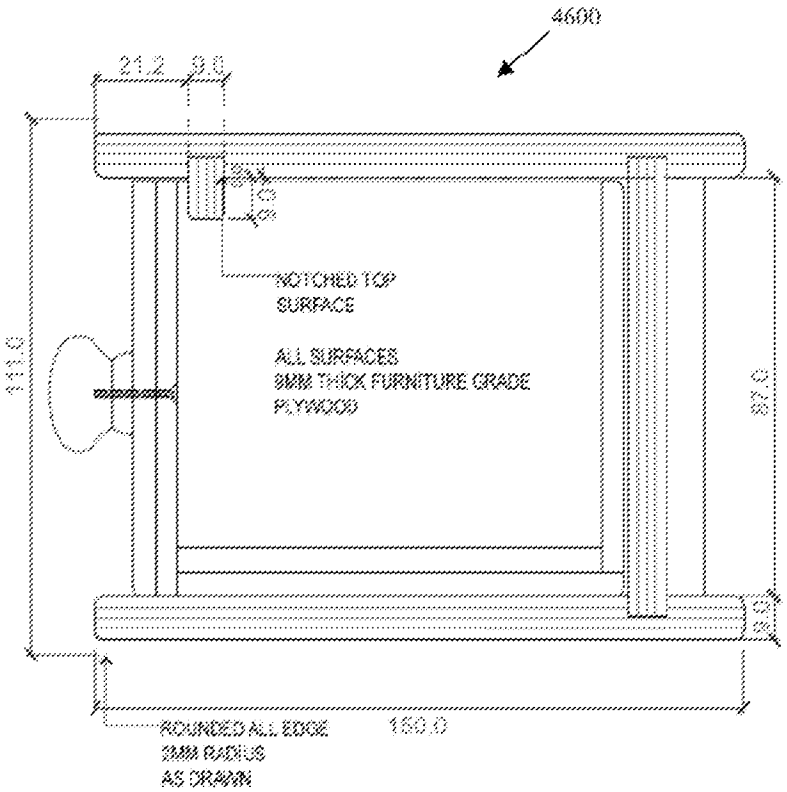

FIG. 46F illustrates a front view of a Level 6 Montessori toy, according to exemplary embodiments of the present invention.

Figure 46H:
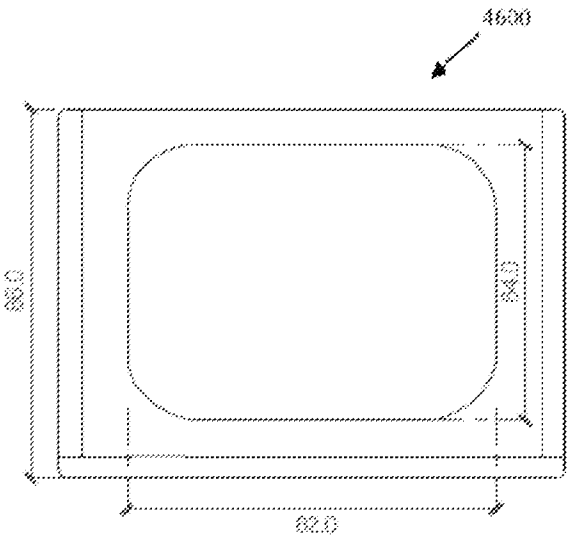

FIG. 46H illustrates a side view of a Level 6 Montessori toy, according to exemplary embodiments of the present invention.

Figure 46K:
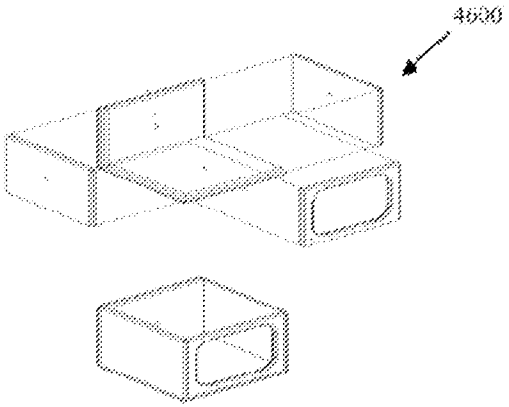
Figure 46G:
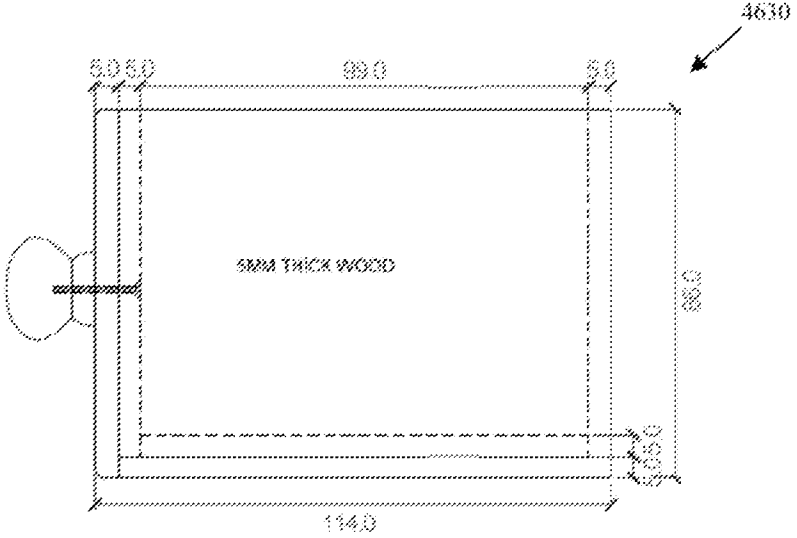
Figure 46J:
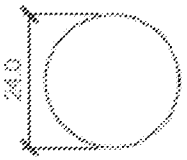
Figure 46I:
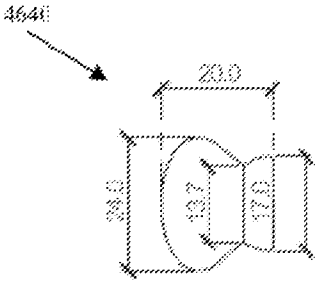

FIG. 46I illustrates a side view of a component of a Level 6 Montessori toy, according to exemplary embodiments of the present invention.

FIG. 46J illustrates a front view of a component of a Level 6 Montessori toy, according to exemplary embodiments of the present invention.

FIG. 46K illustrates a perspective view of a component of a Level 6 Montessori toy, according to exemplary embodiments of the present invention.

Figure 47C:
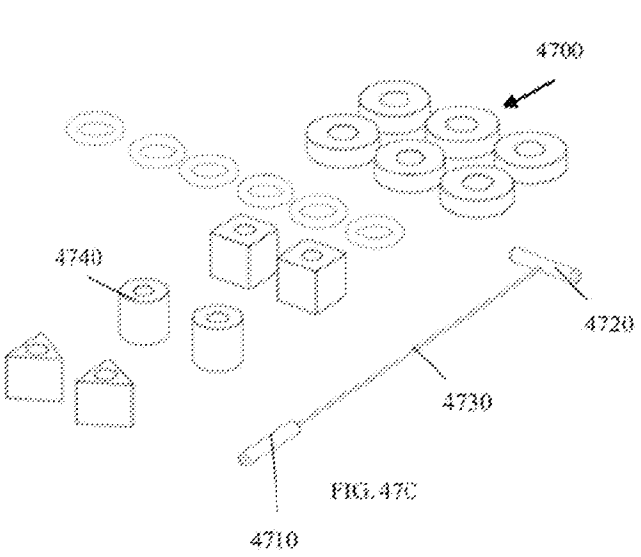
Figure 47B:
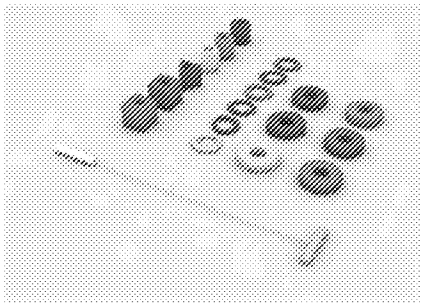
Figure 47A:
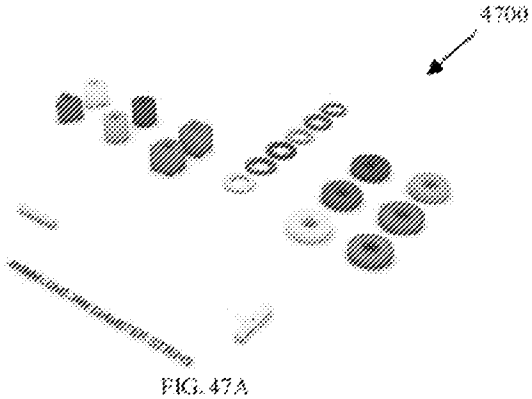

FIGS. 47A-47C illustrate perspective views of a Level 6 Montessori toy, according to exemplary embodiments of the present invention.

Figure 47D:
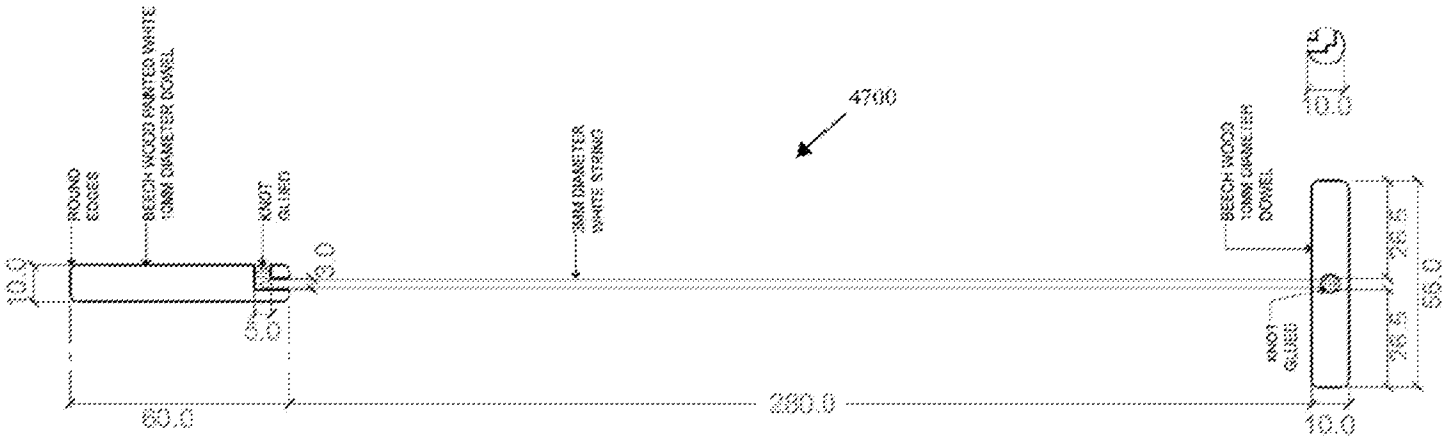
Figure 47E:
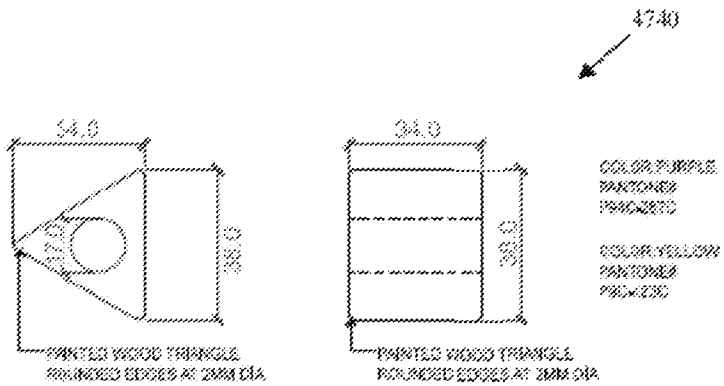
Figure 47F:
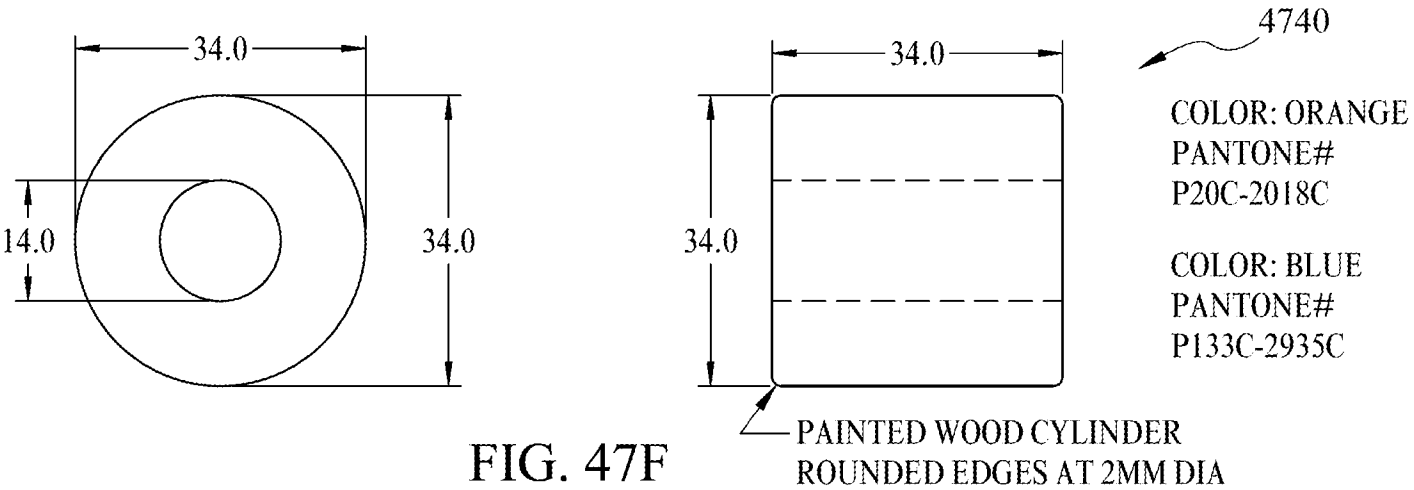
Figure 47G:
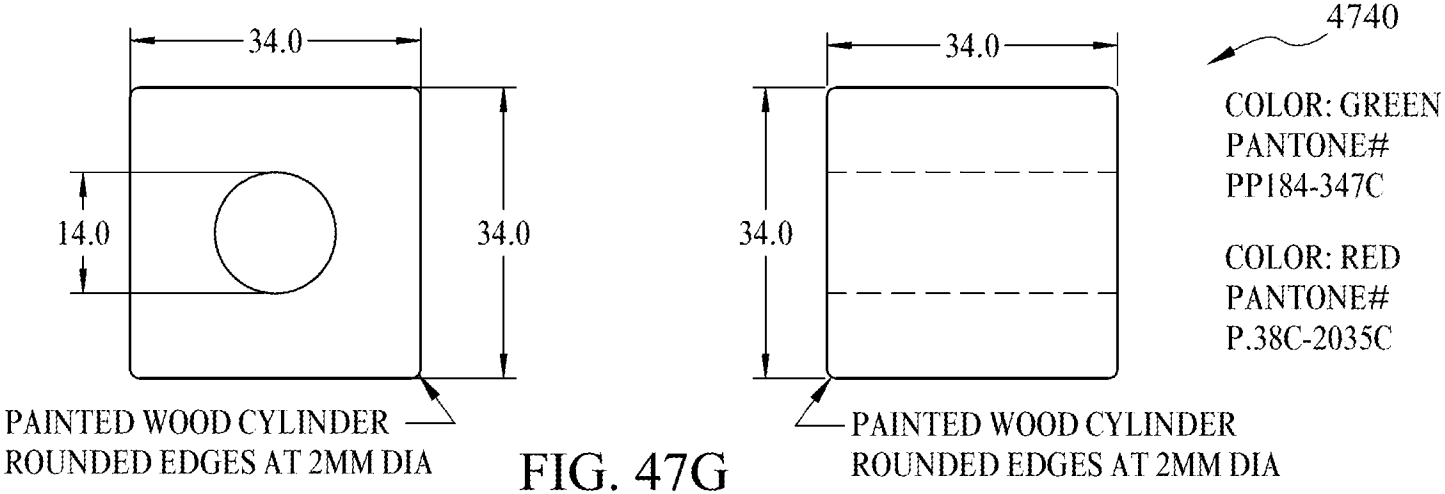
Figure 47H:
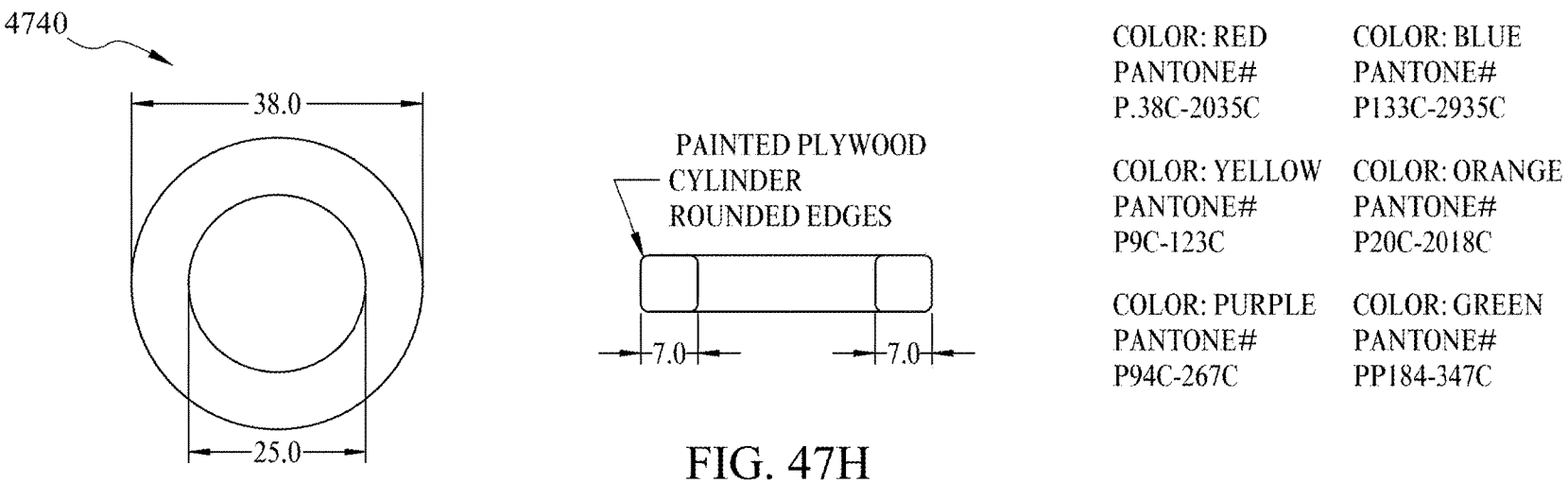
Figure 47I:
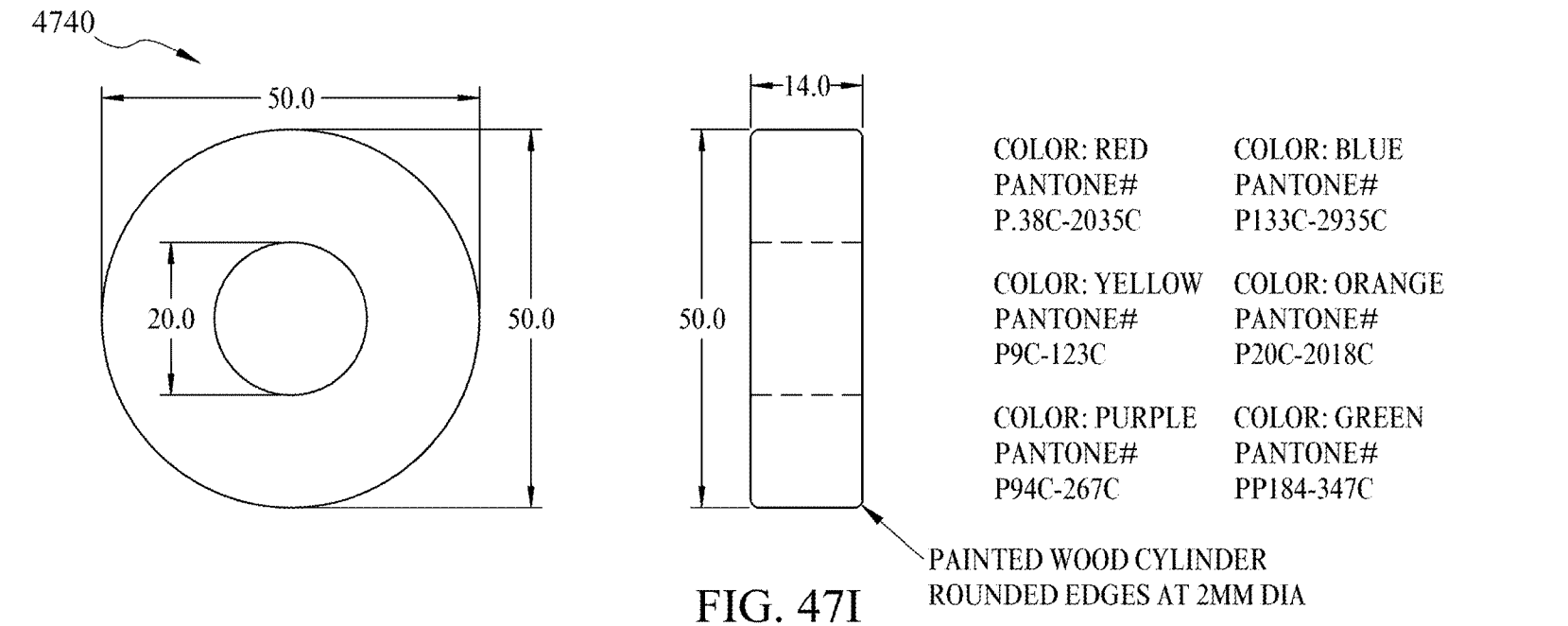

FIG. 47D illustrates a front view of a Level 6 Montessori toy, according to exemplary embodiments of the present invention.

FIGS. 47E-47I illustrate top views and side views of various components of a Level 6 Montessori toy, according to exemplary embodiments of the present invention.

FIGS. 48A-48C illustrate perspective views of a Level 6 Montessori toy, according to exemplary embodiments of the present invention.

Figure 48D:
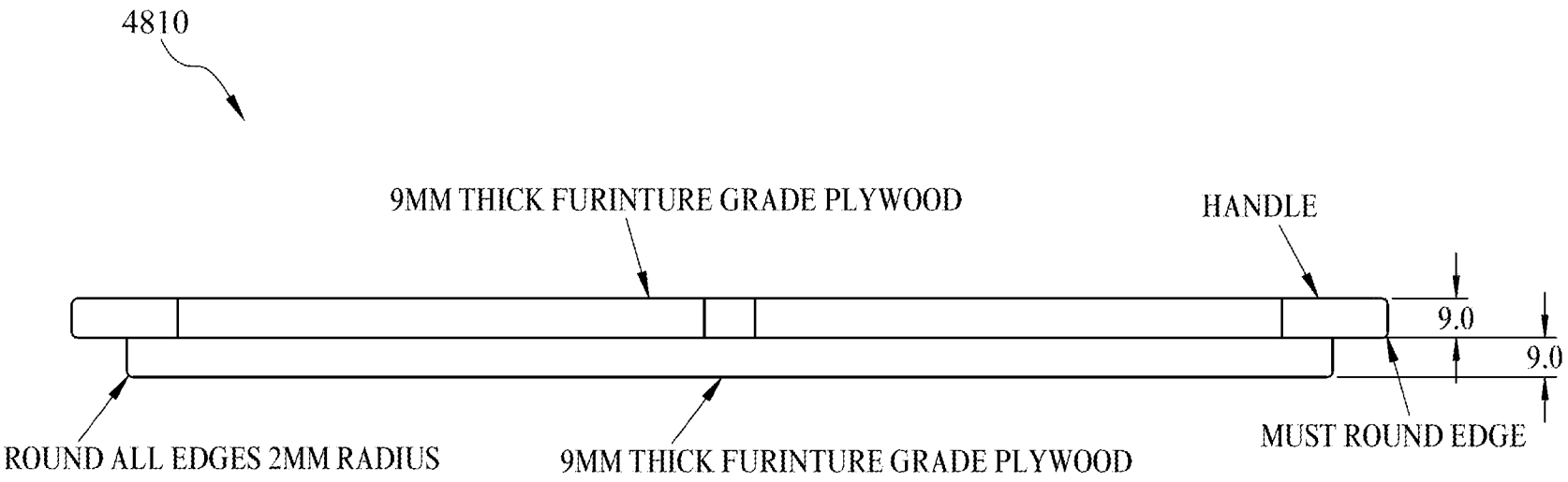

FIG. 48D illustrates a side view of a Level 6 Montessori toy, according to exemplary embodiments of the present invention.

Figure 48E:
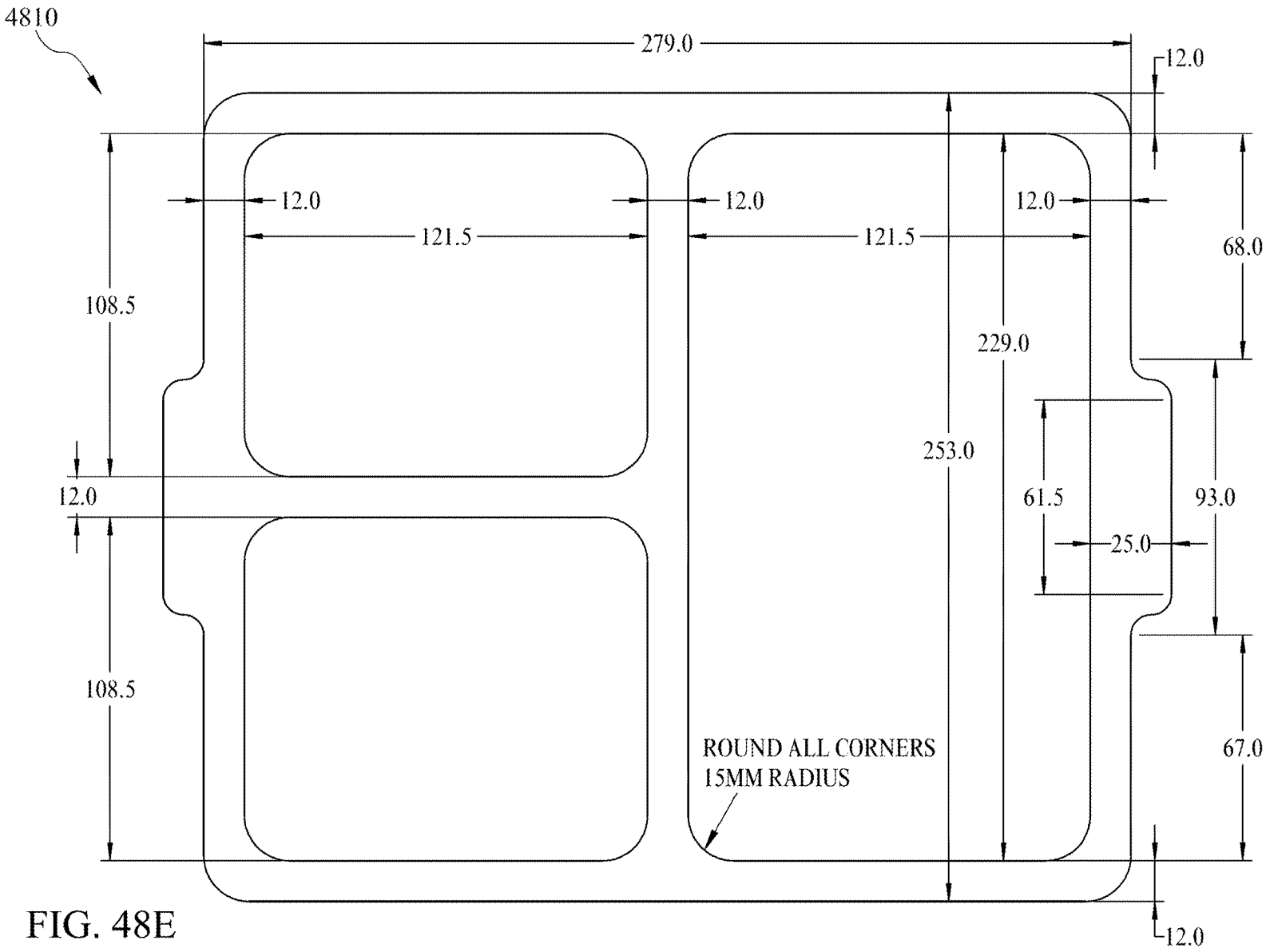
Figure 48G:
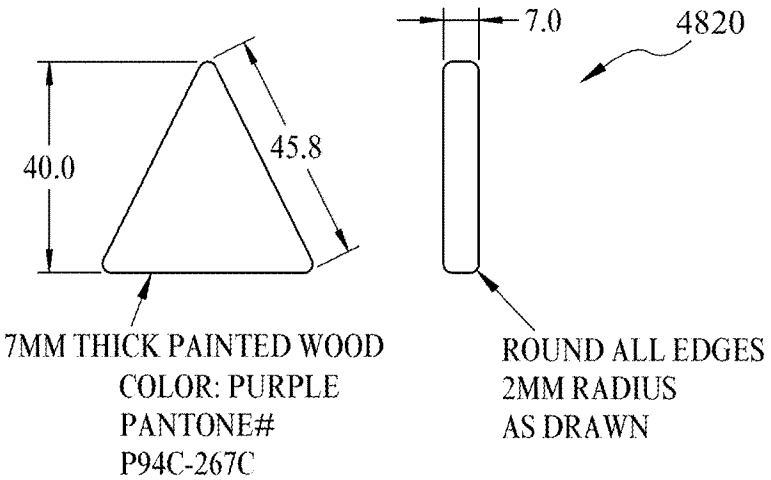
Figure 48F:
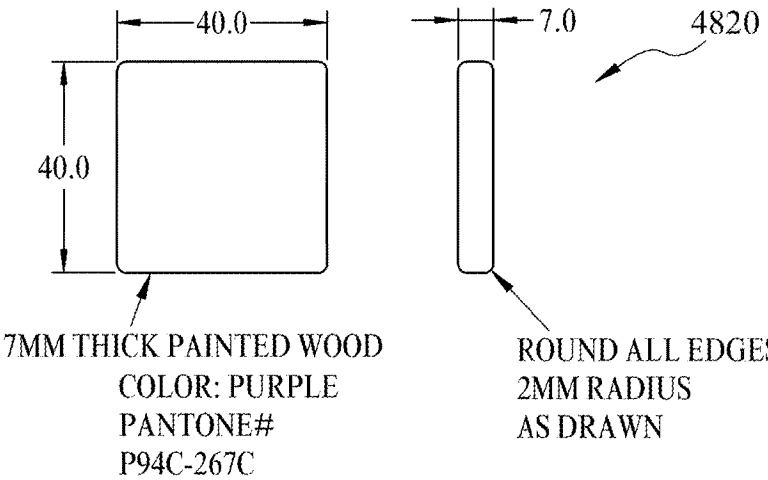
Figure 48I:
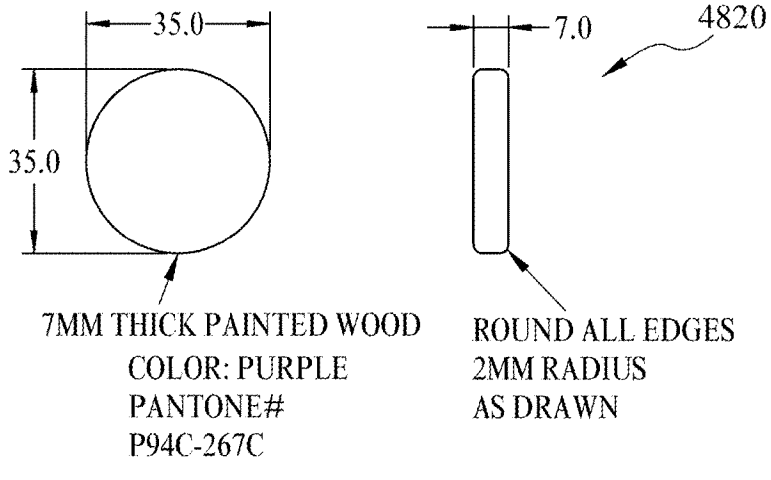
Figure 48H:
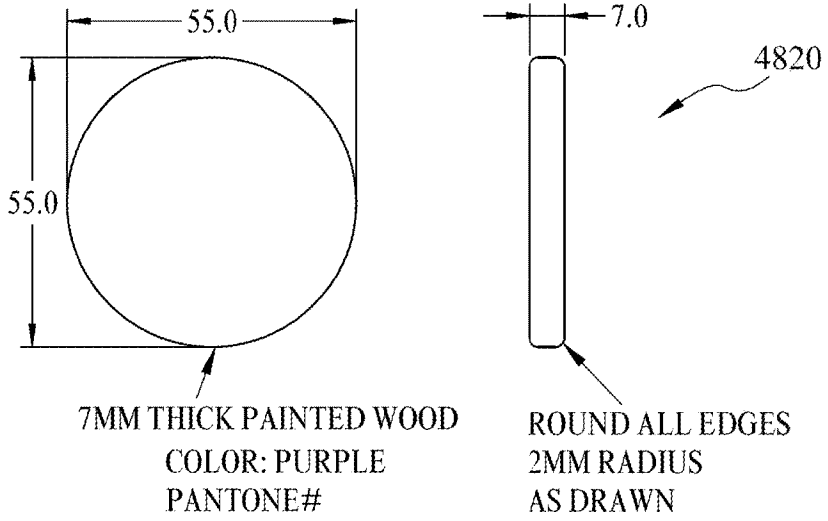
Figure 48K:
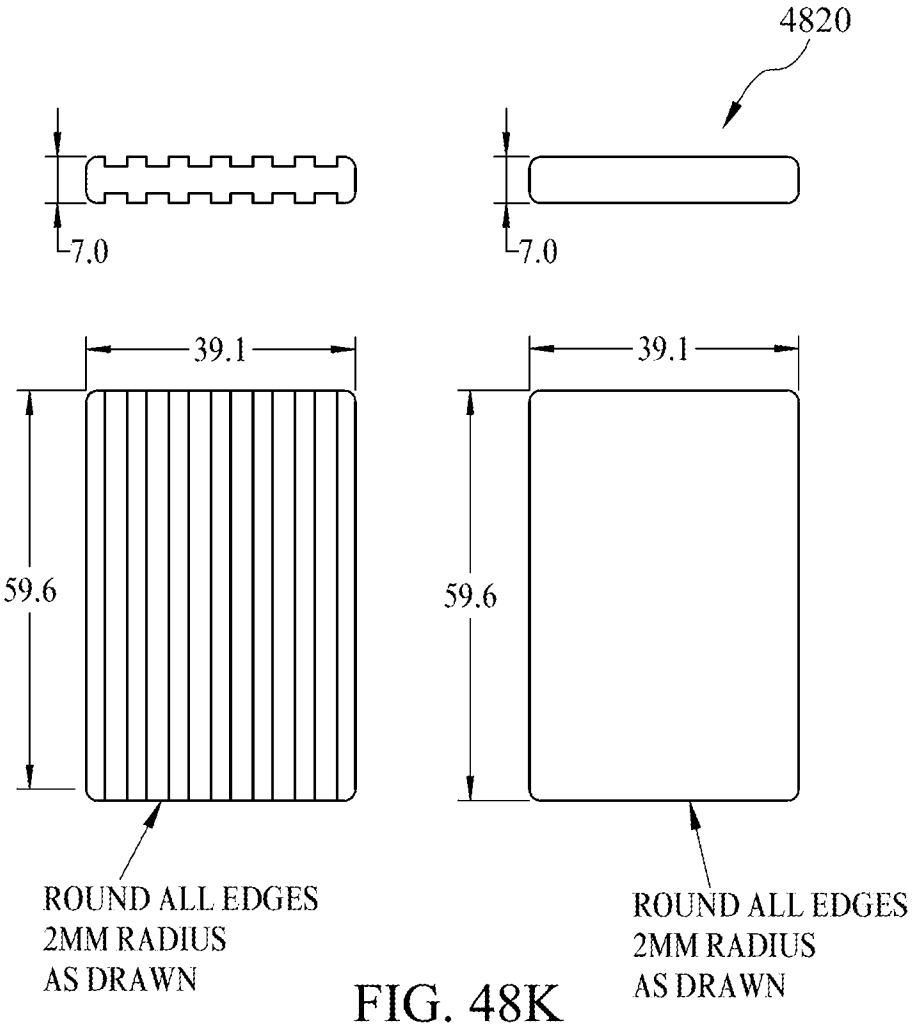
Figure 48J:
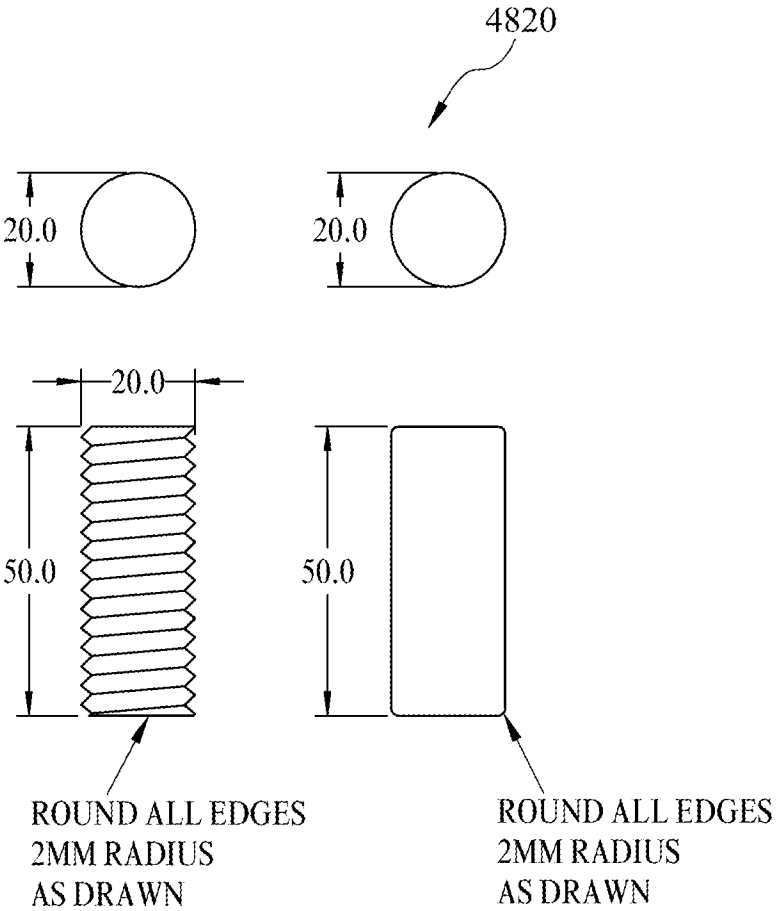

FIG. 48E illustrates a top view of a component of a Level 6 Montessori toy, according to exemplary embodiments of the present invention.

FIGS. 48F-48K illustrate top views and side views of various components of a Level 6 Montessori toy, according to exemplary embodiments of the present invention.

Figure 49B:
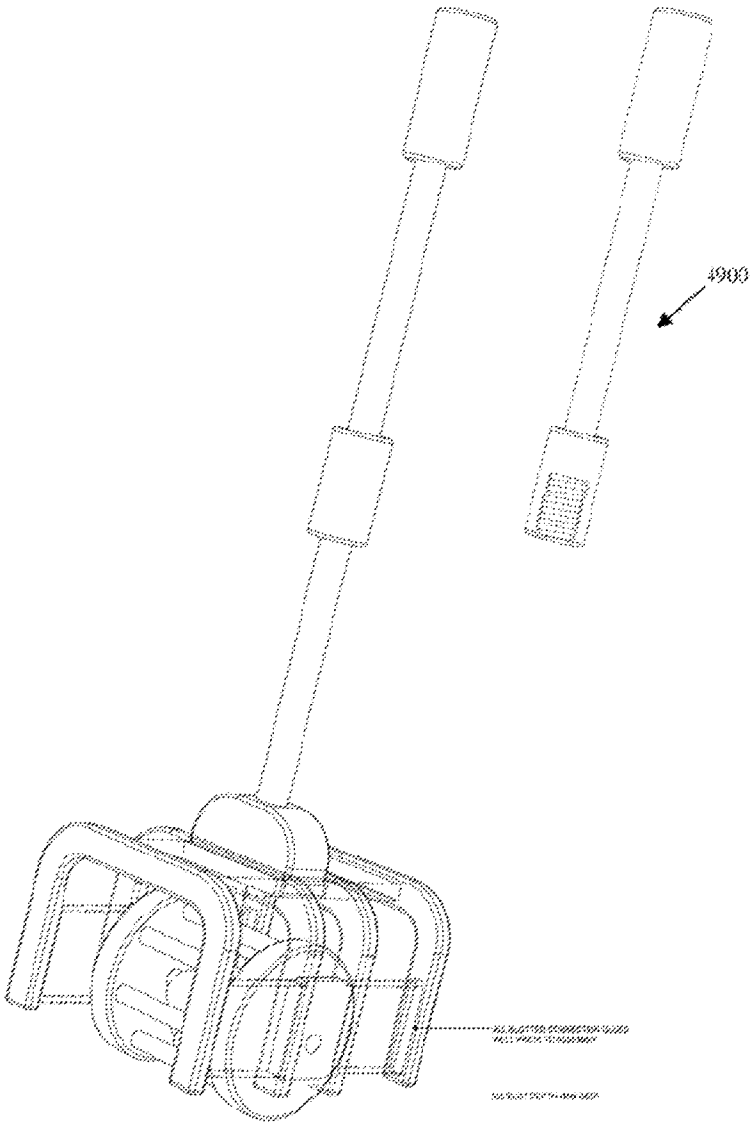
Figure 49A:
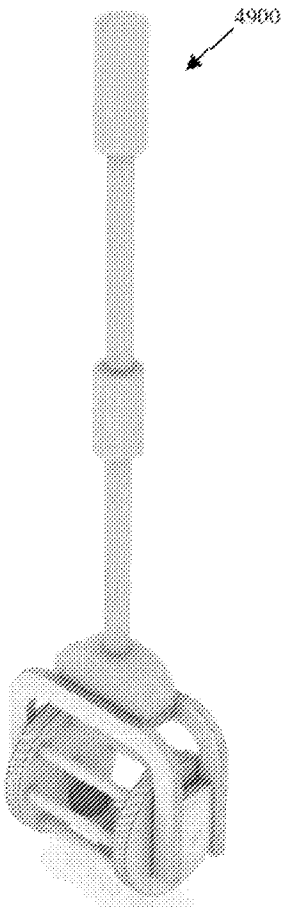

FIGS. 49A and 49B illustrate perspective views of a Level 6 Montessori toy, according to exemplary embodiments of the present invention.

Figures 1, 49C:
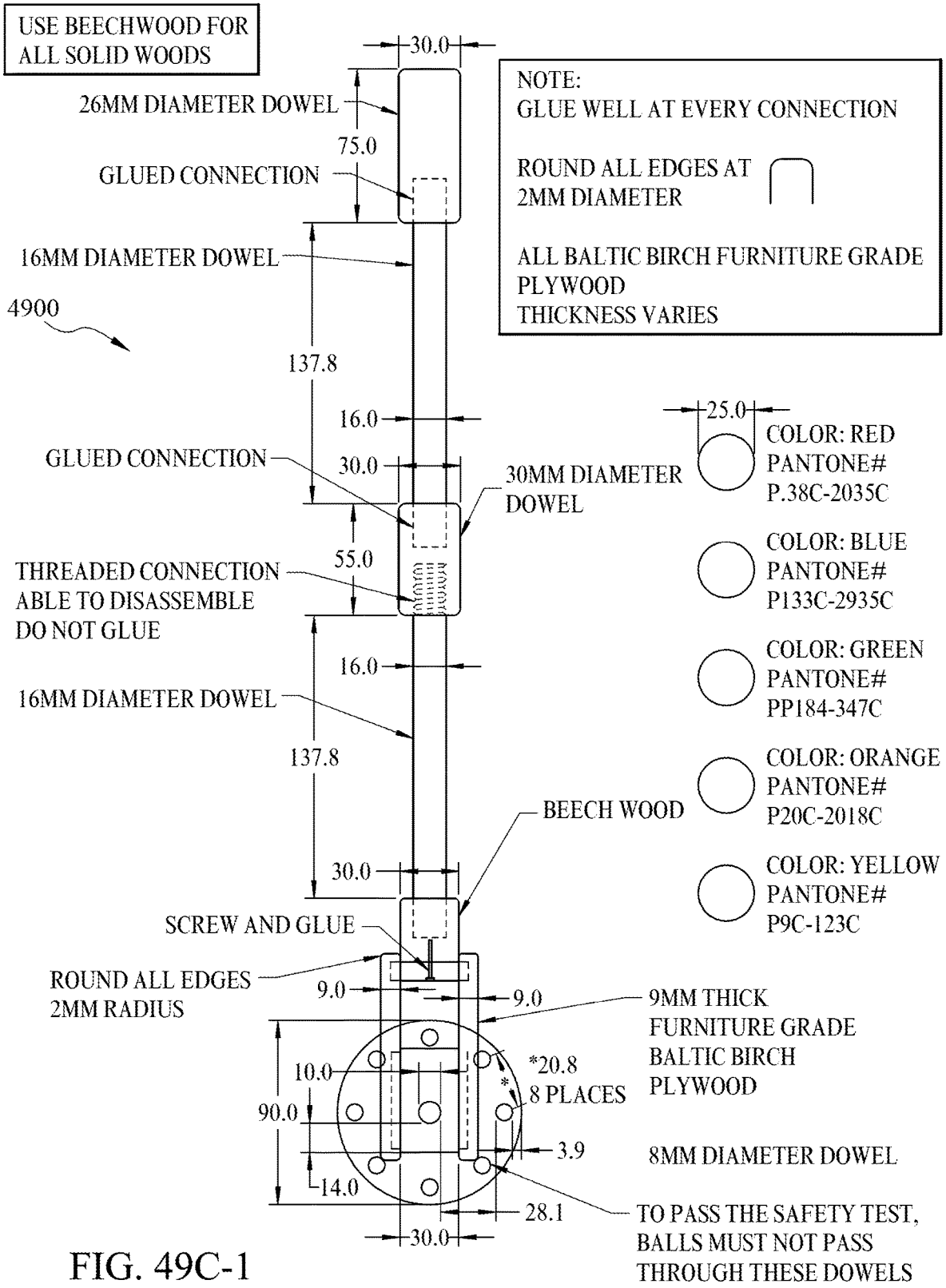
Figures 2, 49C:
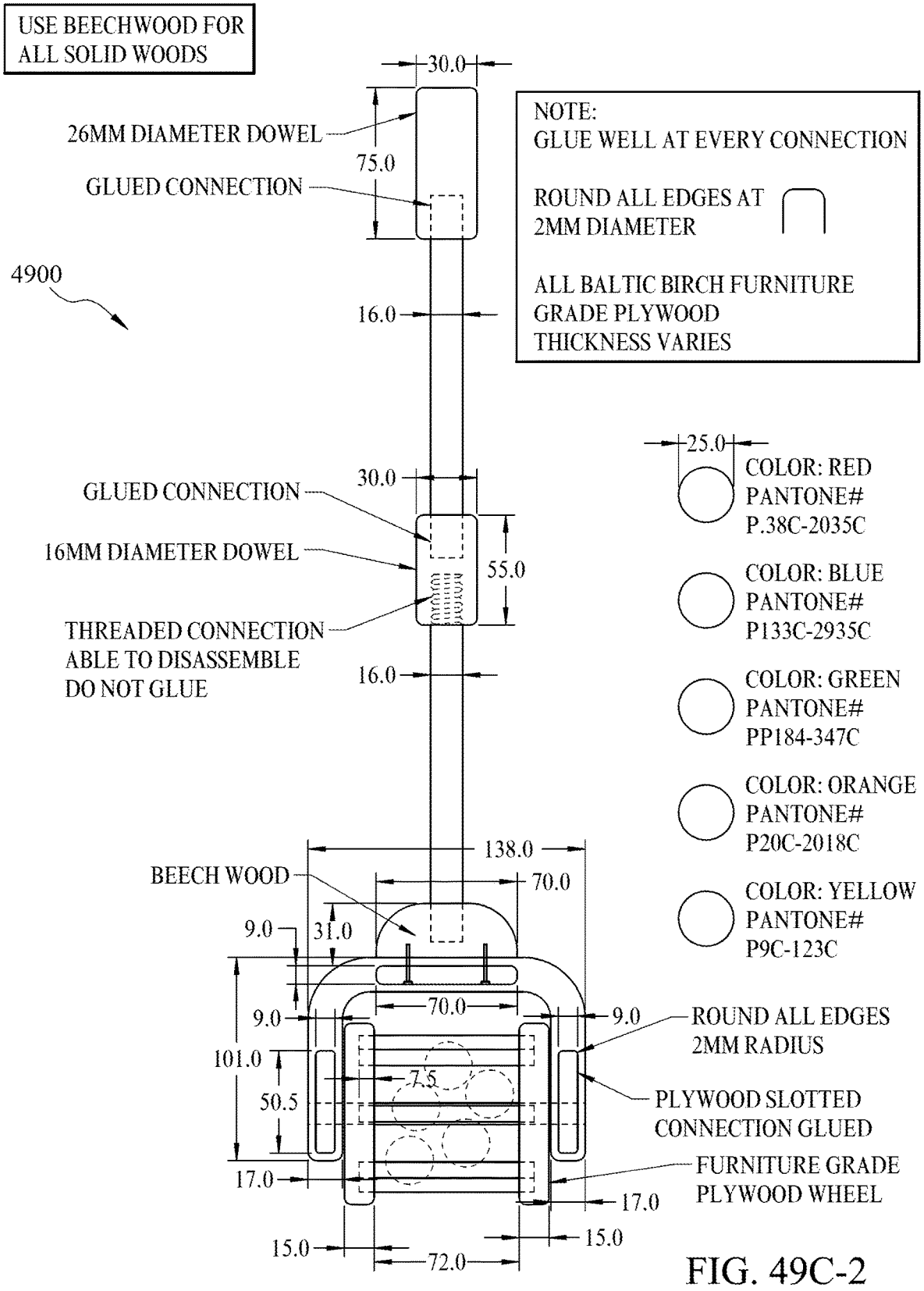
Figure 50B:
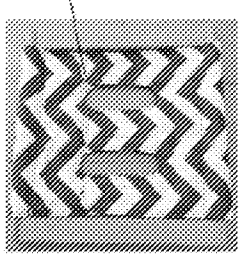
Figure 50A:
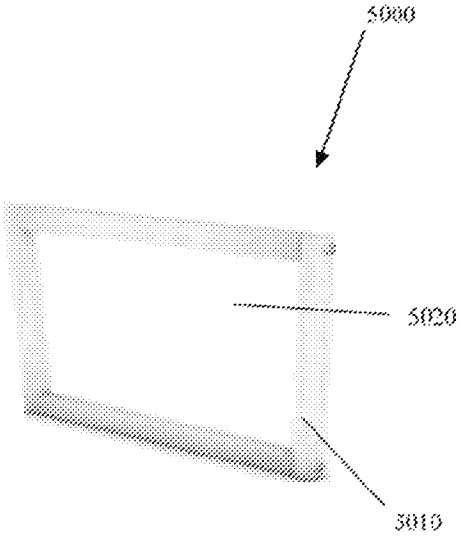
Figure 50C:
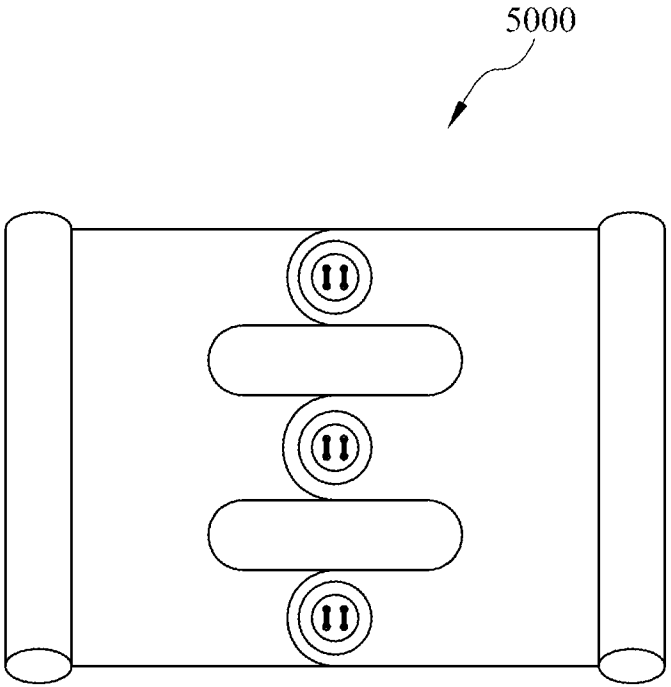

FIG. 49C illustrates a front view of a Level 6 Montessori toy, according to exemplary embodiments of the present invention.

FIGS. 50A-50D illustrate perspective views of a Level 7 Montessori toy, according to exemplary embodiments of the present invention.

Figure 50E:
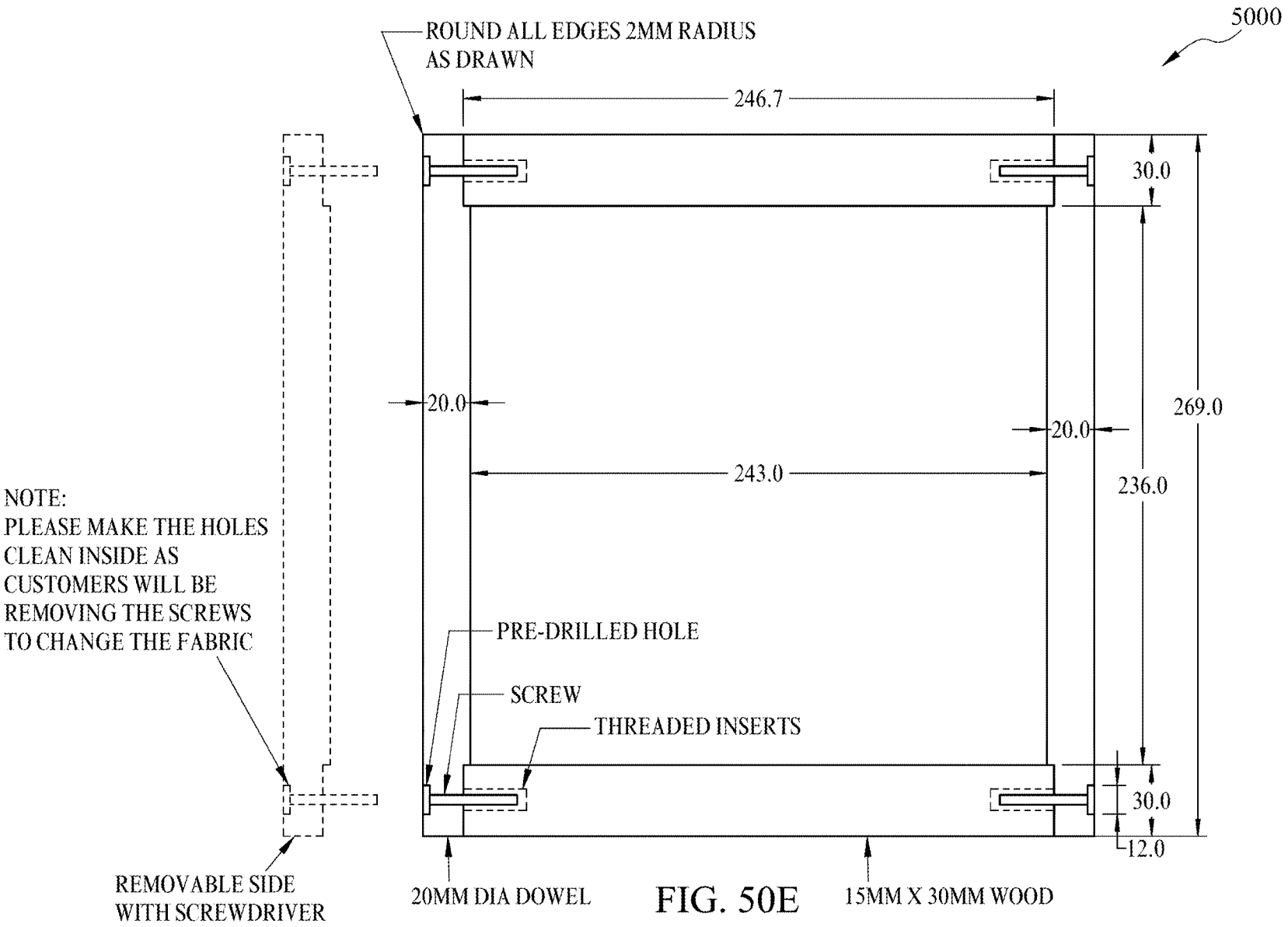

FIG. 50E illustrates a top view of a Level 7 Montessori toy, according to exemplary embodiments of the present invention.

FIG. 50F illustrates a side view of a Level 7 Montessori toy, according to exemplary embodiments of the present invention.

Figure 51A:
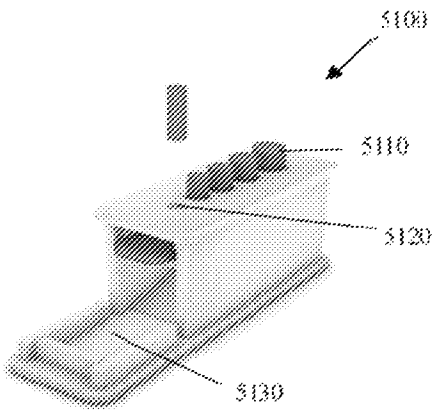
Figure 51B:
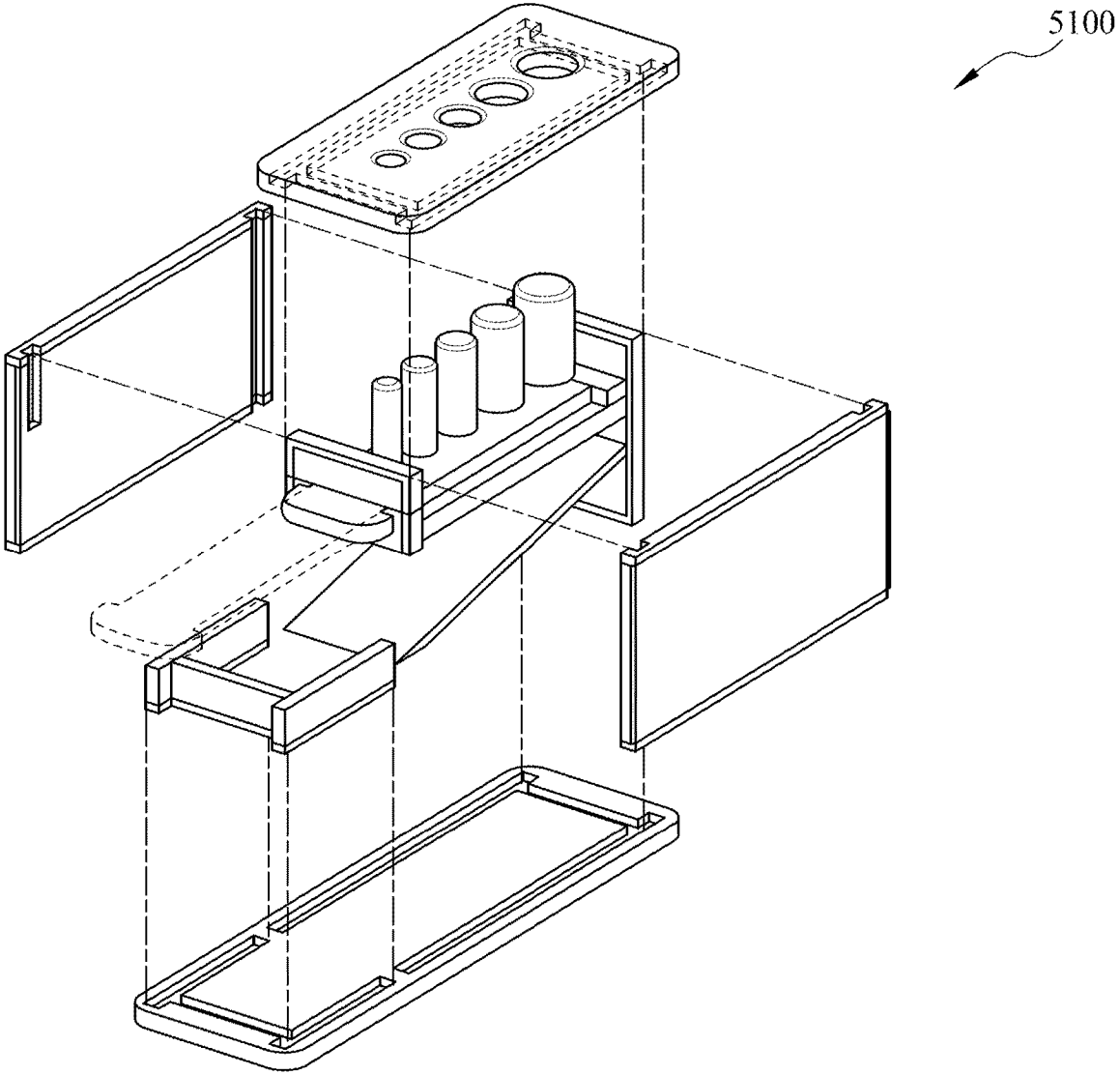

FIGS. 51A and 51B illustrate perspective views of a Level 7 Montessori toy, according to exemplary embodiments of the present invention.

Figure 51C:
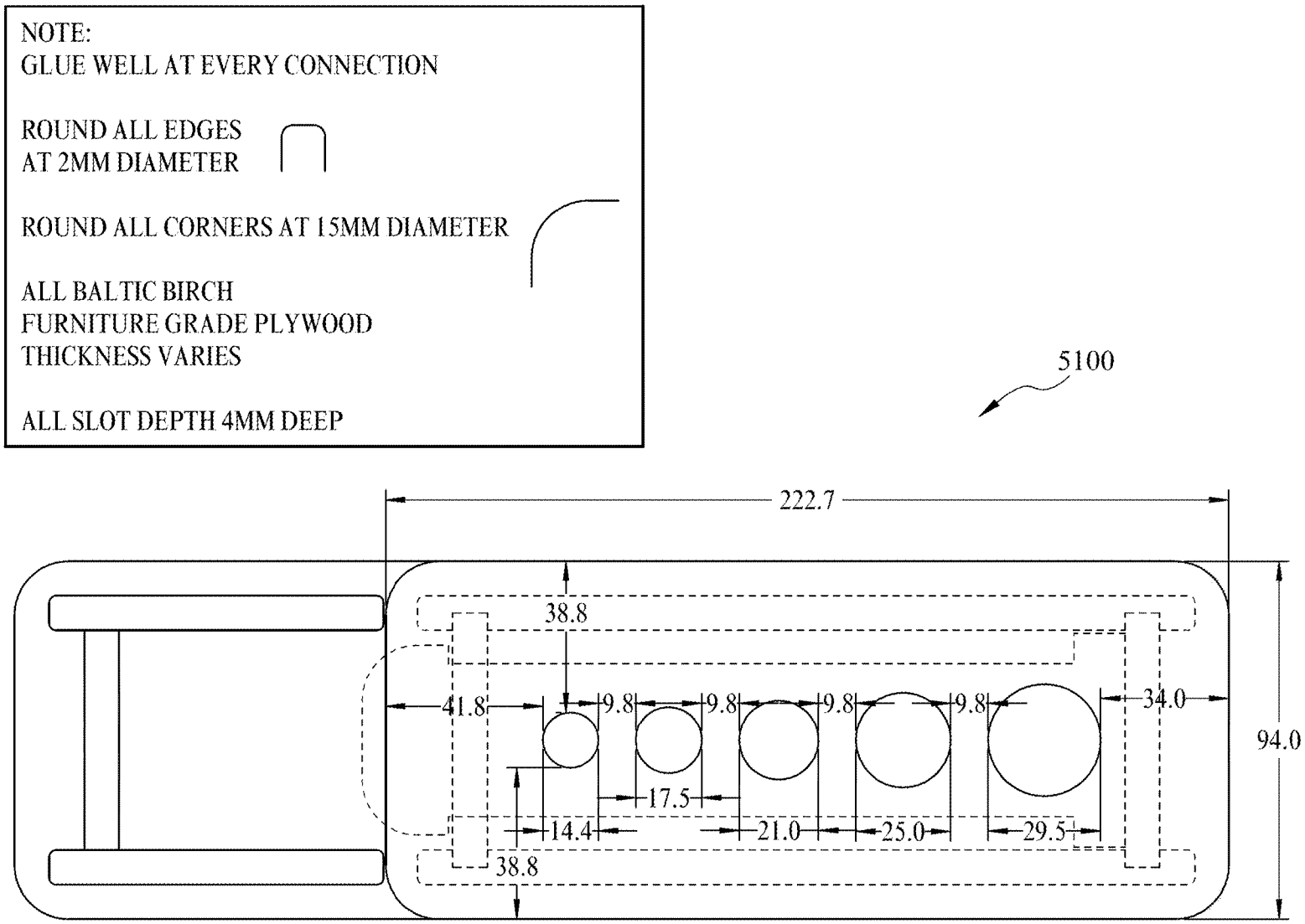
Figure 51D:
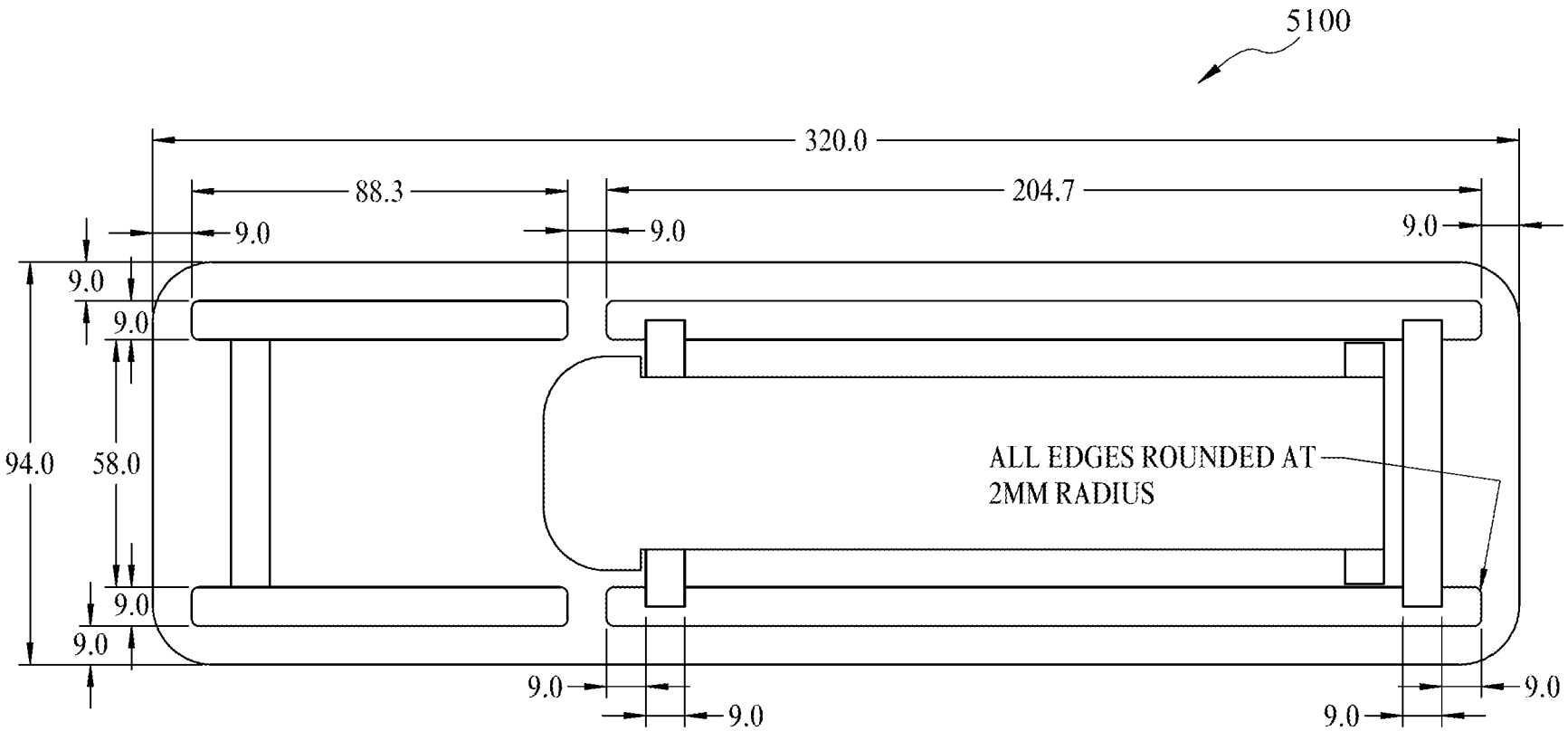

FIGS. 51C and 51D illustrate top views of a Level 7 Montessori toy, according to exemplary embodiments of the present invention.

Figure 51E:
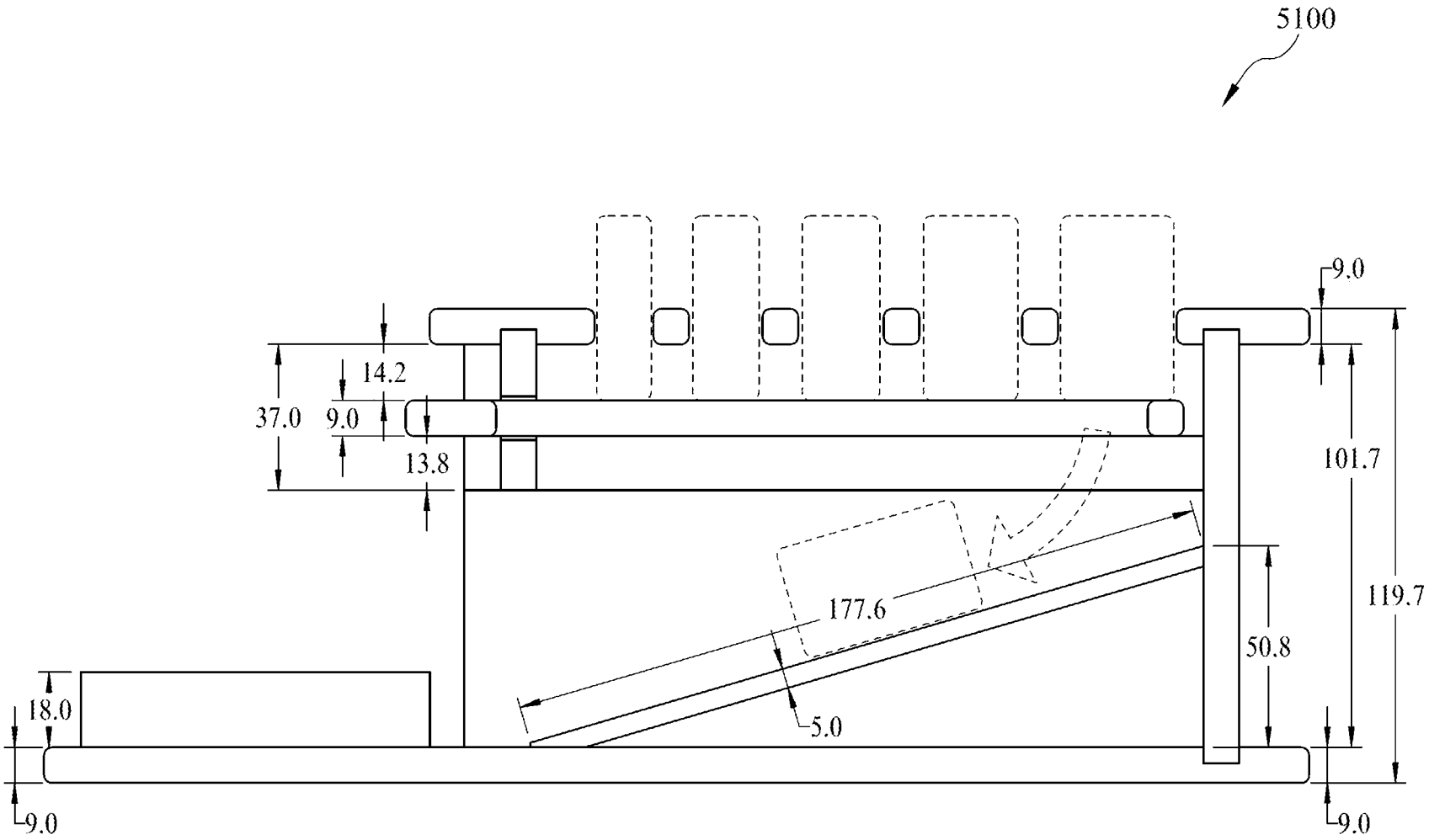

FIG. 51E illustrates a side view of a Level 7 Montessori toy, according to exemplary embodiments of the present invention.

Figure 51F:
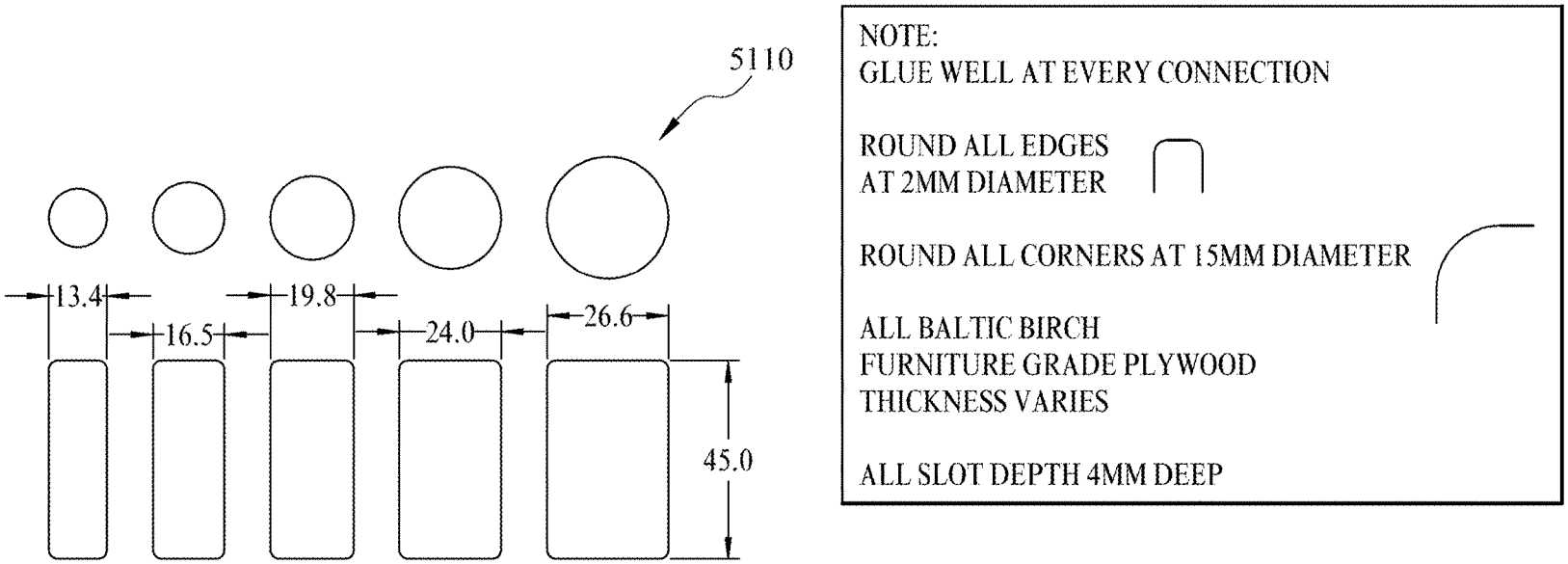

FIG. 51F illustrates a side view and top view of a component of a Level 7 Montessori toy, according to exemplary embodiments of the present invention.

Figure 51G:
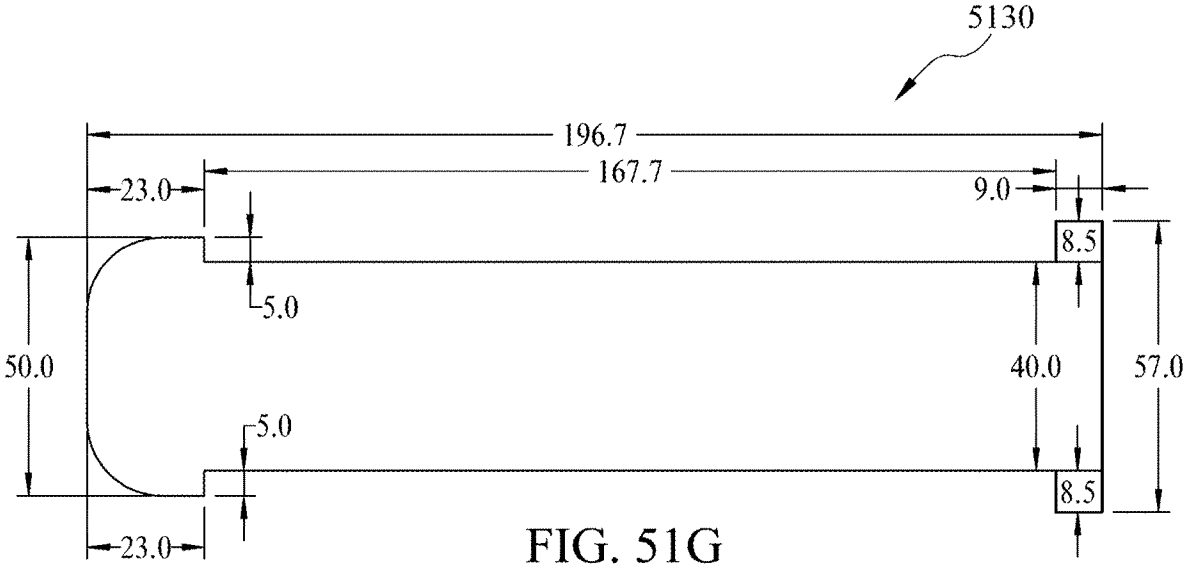
Figure 51I:
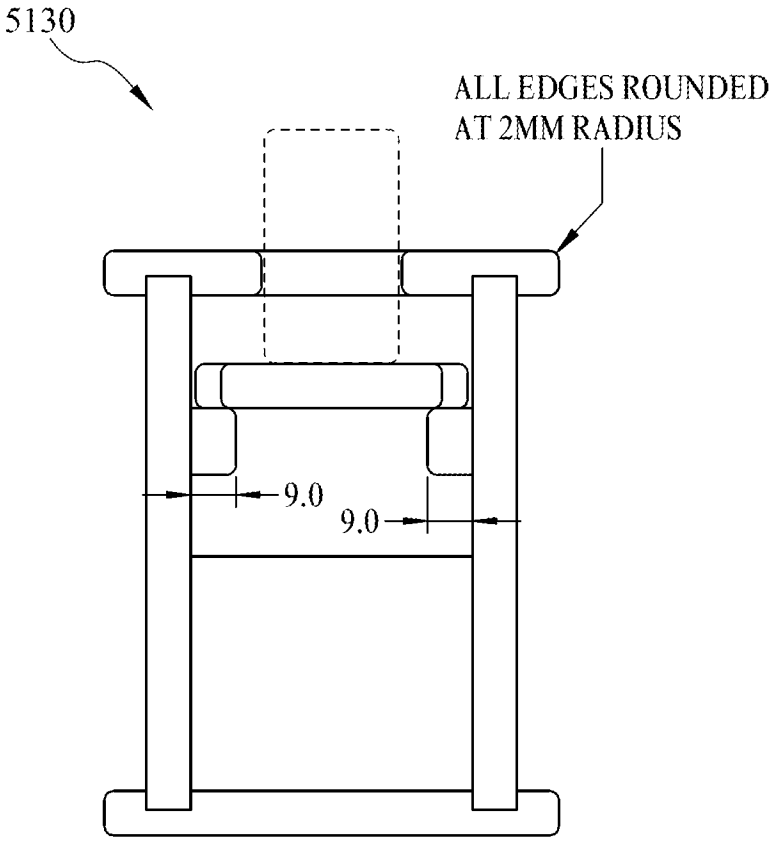
Figure 51H:
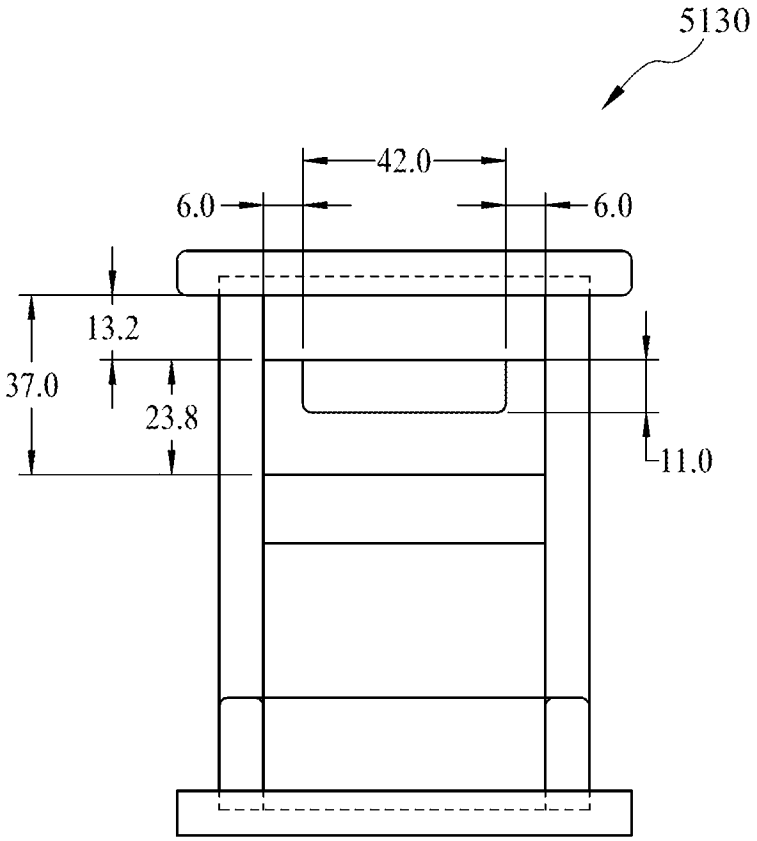

FIGS. 51G-51I illustrate side views of components of a Level 7 Montessori toy, according to exemplary embodiments of the present invention.

Figure 52A:
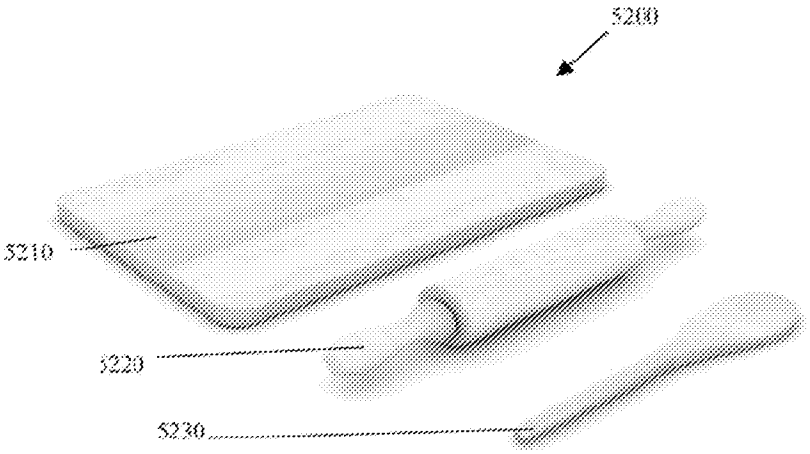
Figure 52B:
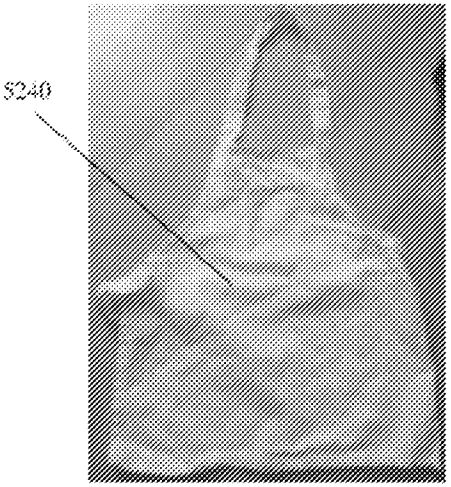
Figure 52C:
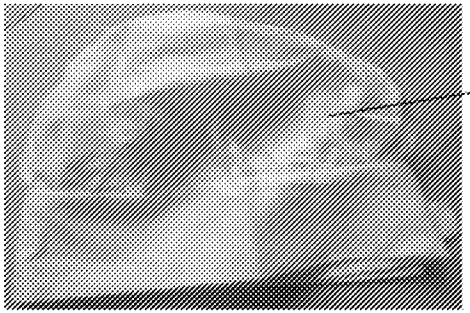
Figure 52E:
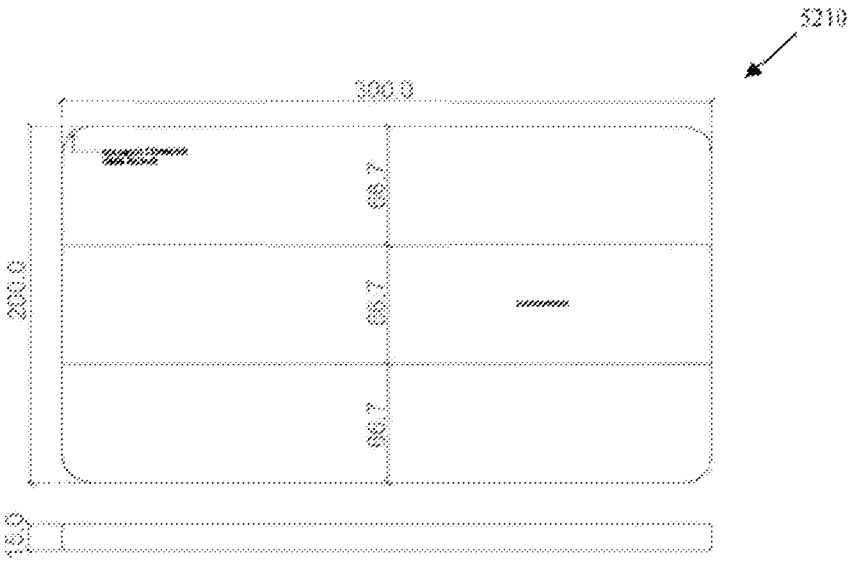
Figure 52D:
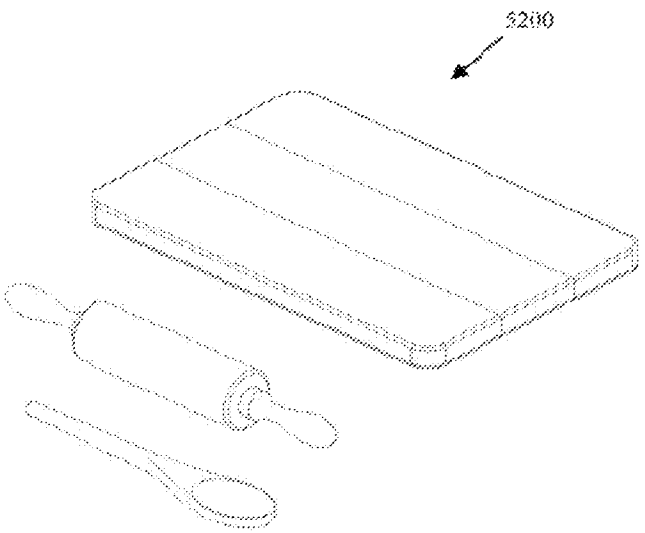

FIGS. 52A and 52D illustrate perspective views of a Level 7 Montessori toy, according to exemplary embodiments of the present invention.

FIGS. 52B and 52C illustrate perspective views of a Level 7 Montessori toy, according to exemplary embodiments of the present invention.

FIG. 52E illustrates a side view and top view of a component of a Level 7 Montessori toy, according to exemplary embodiments of the present invention.

Figure 52F:
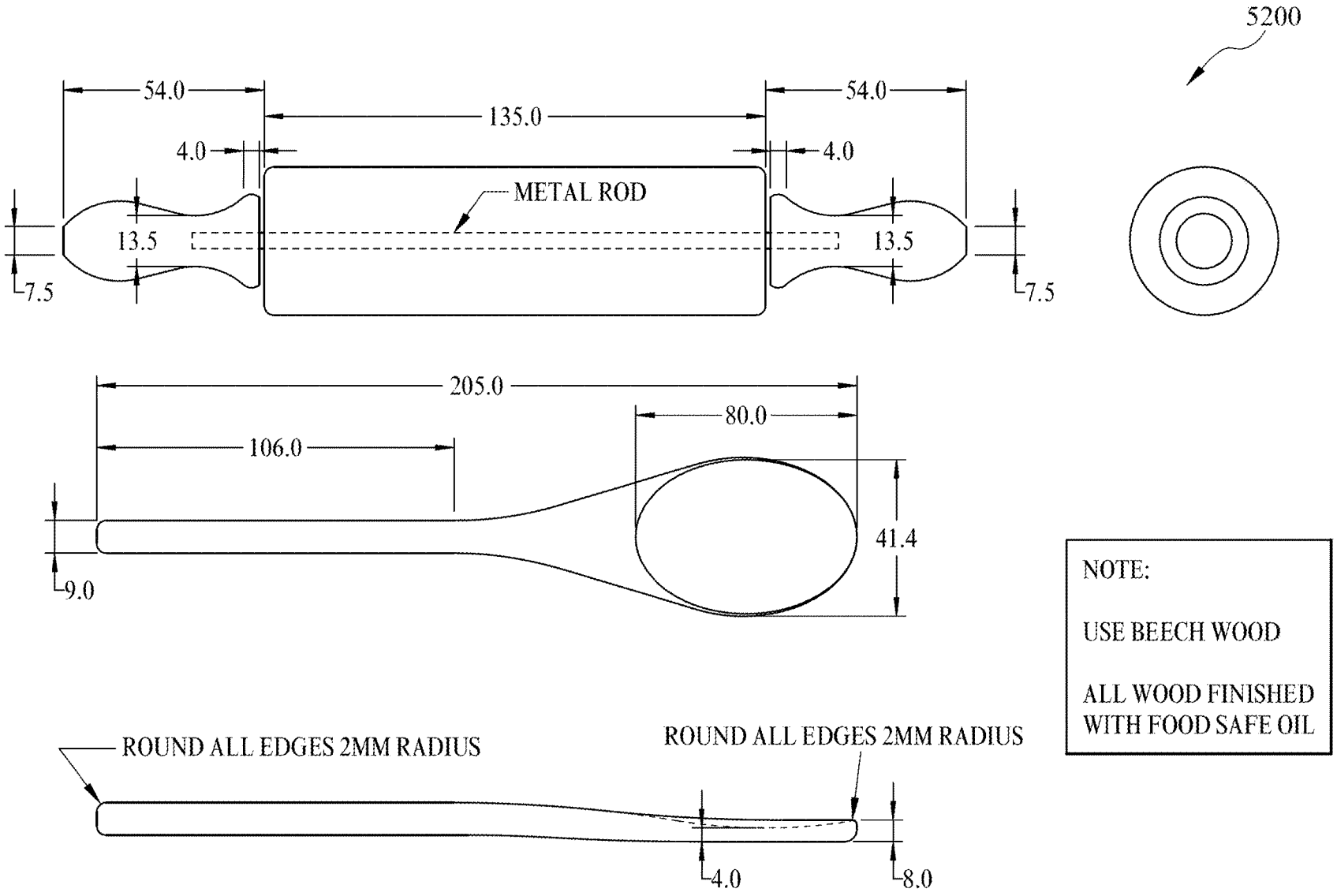

FIG. 52F illustrate top views of components of a Level 7 Montessori toy, according to exemplary embodiments of the present invention.

Figure 53A:
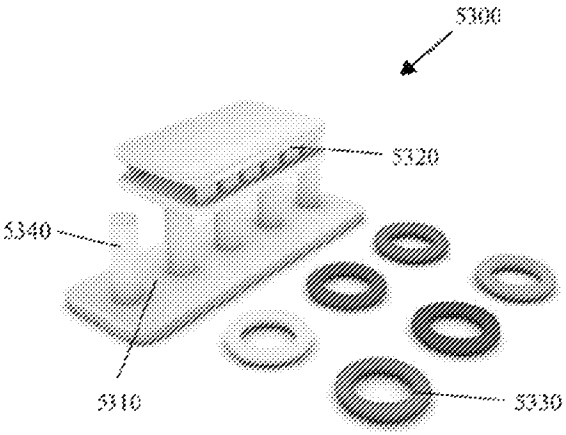
Figure 53B:
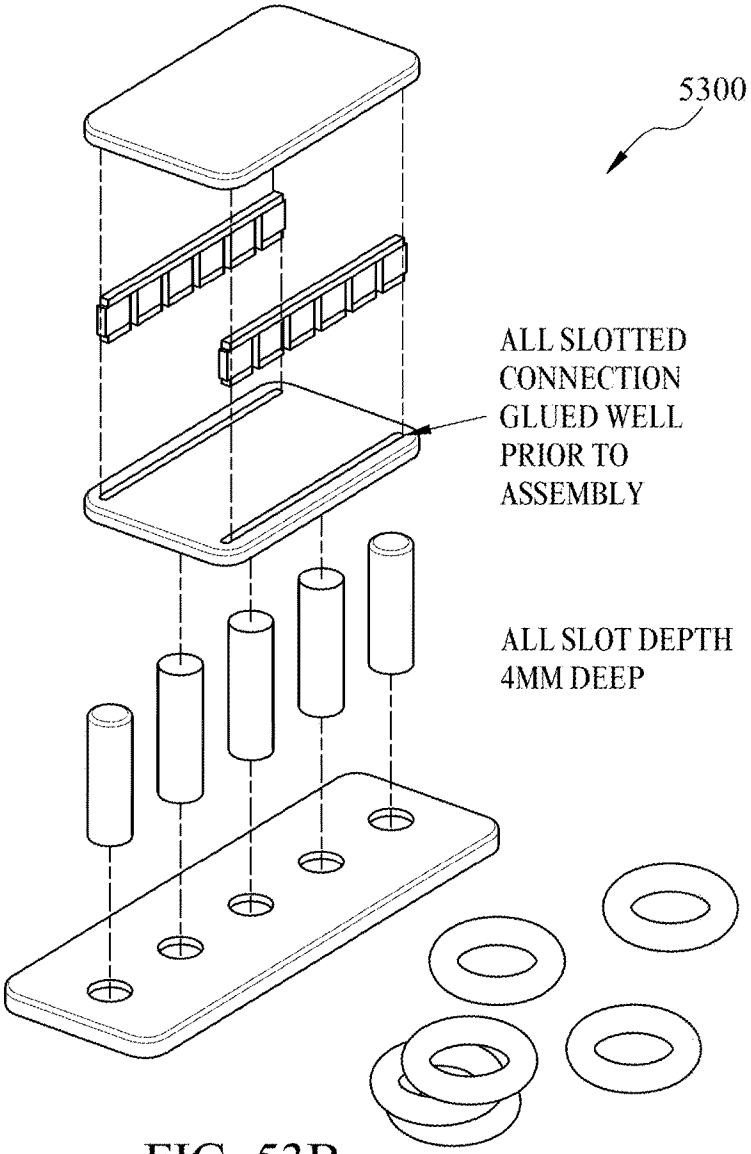

FIGS. 53A and 53B illustrate perspective views of a Level 7 Montessori toy, according to exemplary embodiments of the present invention.

Figure 53C:
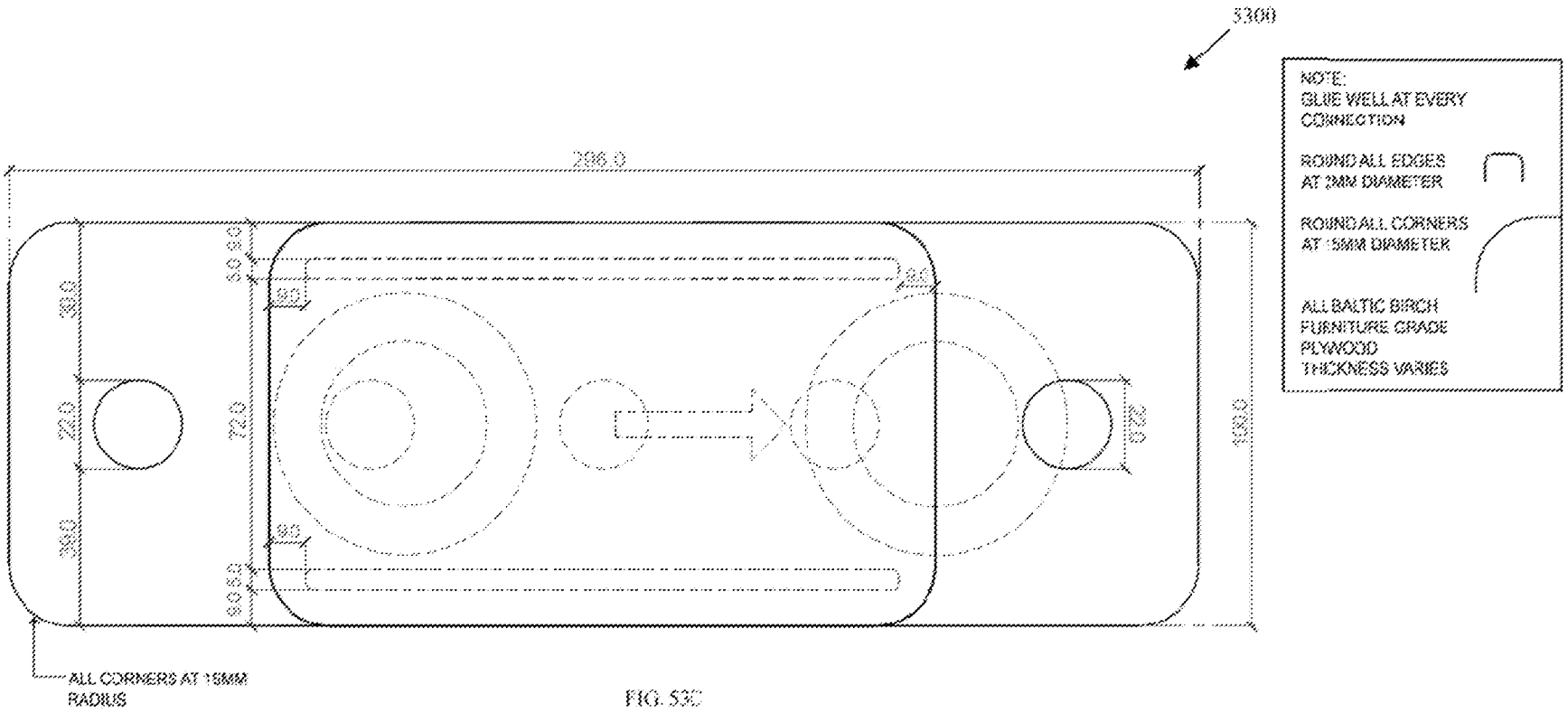

FIG. 53C illustrates a top view of a Level 7 Montessori toy, according to exemplary embodiments of the present invention.

Figures 53D, 53E, 53F:
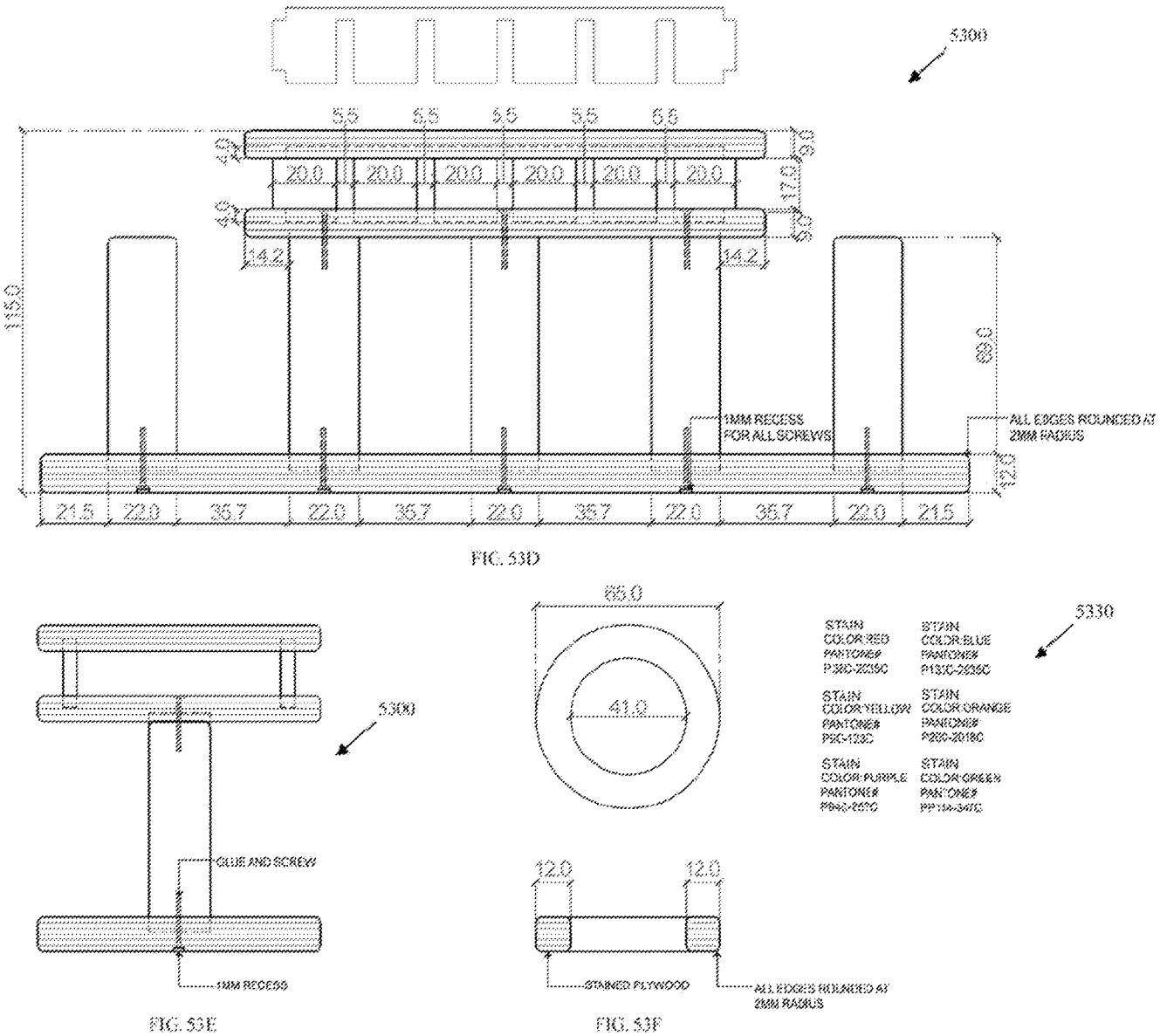

FIG. 53D illustrates a side view of a Level 7 Montessori toy, according to exemplary embodiments of the present invention.

FIG. 53E illustrates a front view of a Level 7 Montessori toy, according to exemplary embodiments of the present invention.

FIG. 53F illustrates a side view and top view of a component of a Level 7 Montessori toy, according to exemplary embodiments of the present invention.

Figure 54A:
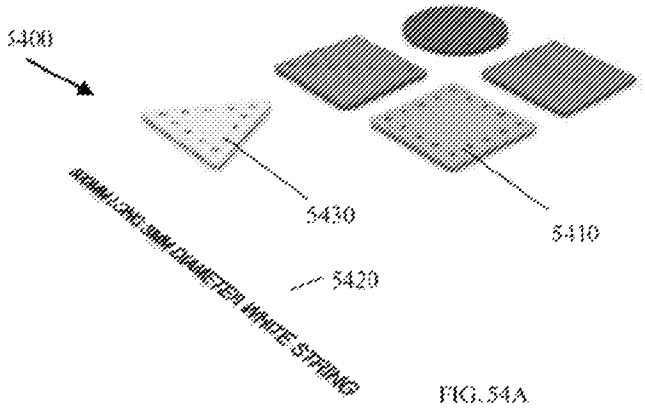
Figure 54B:
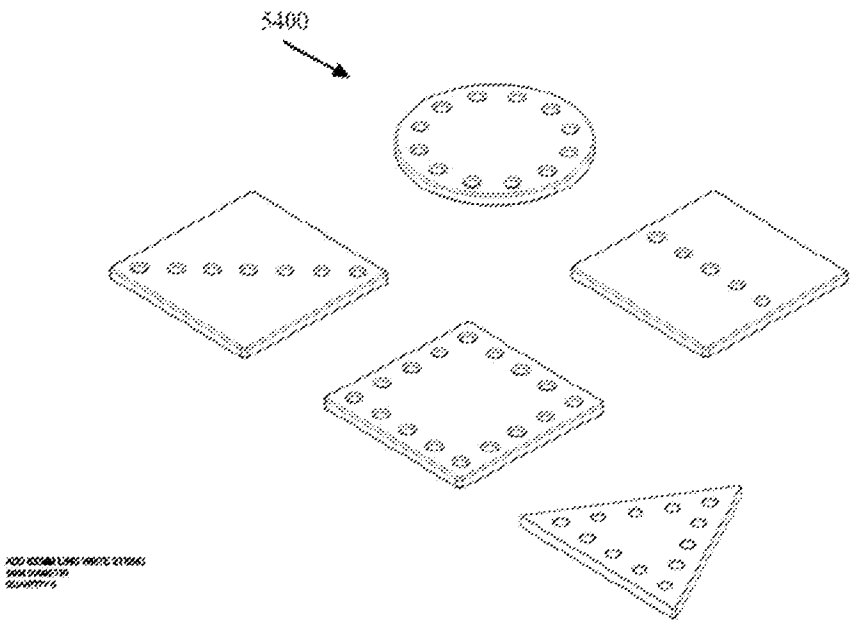

FIGS. 54A and 54B illustrate perspective views of a Level 7 Montessori toy, according to exemplary embodiments of the present invention.

Figure 54C:
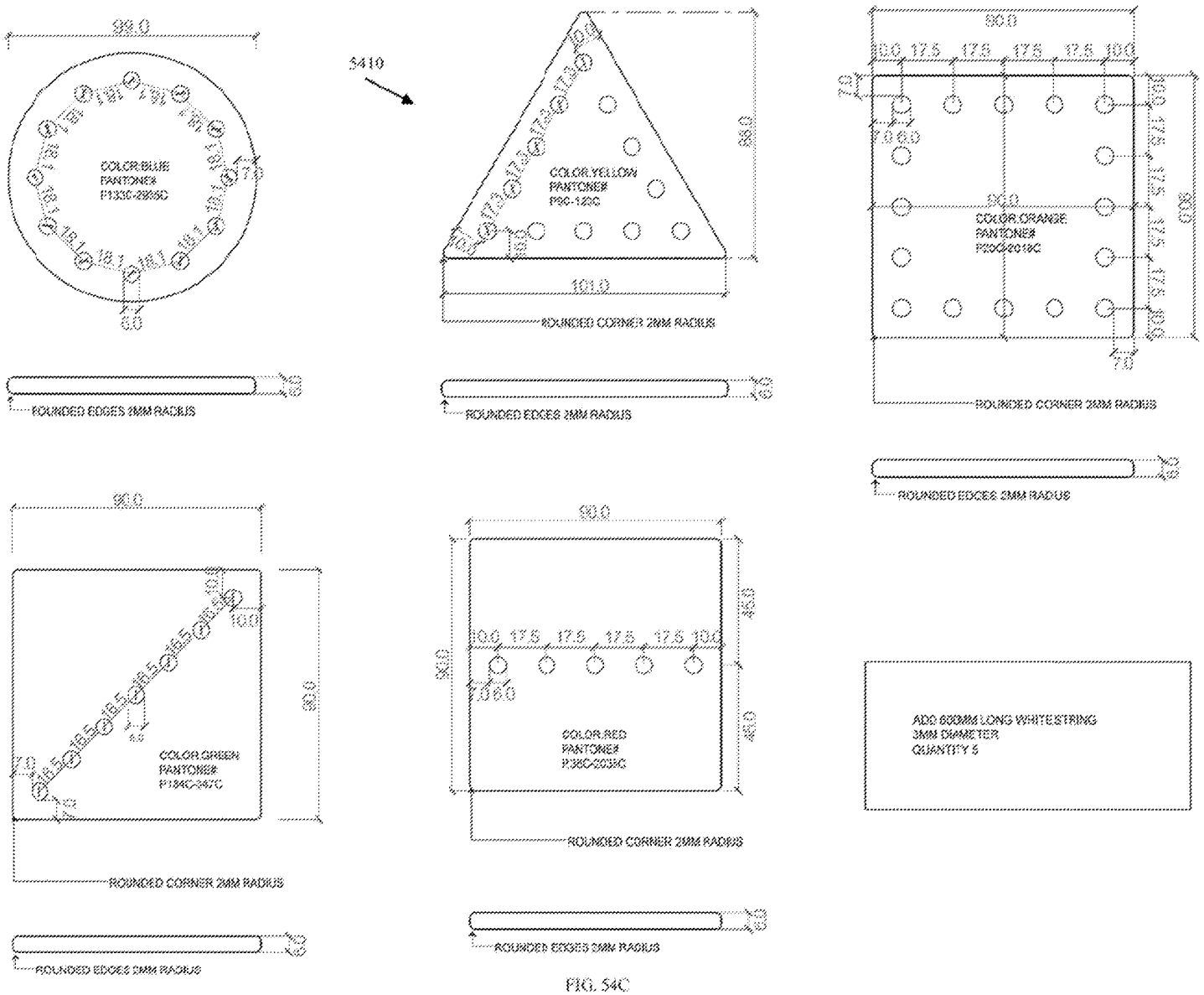

FIG. 54C illustrates a top view of components of a Level 7 Montessori toy, according to exemplary embodiments of the present invention.

Figure 55C:
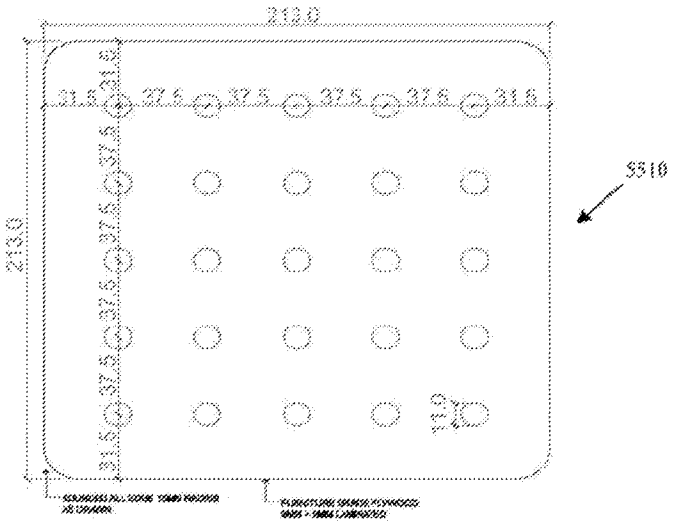
Figure 55D:
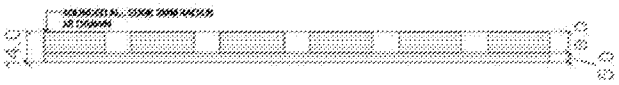
Figure 55E:
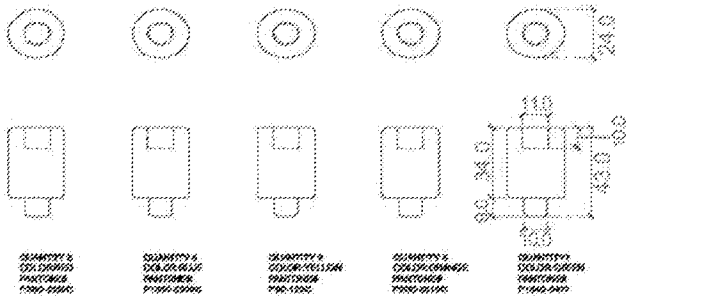
Figure 55A:
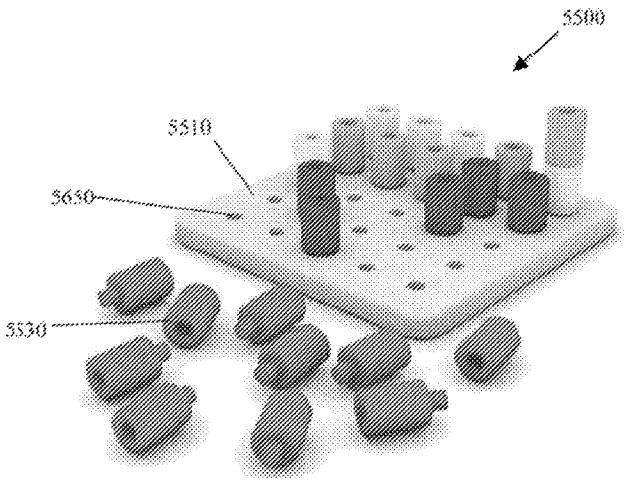
Figure 55B:
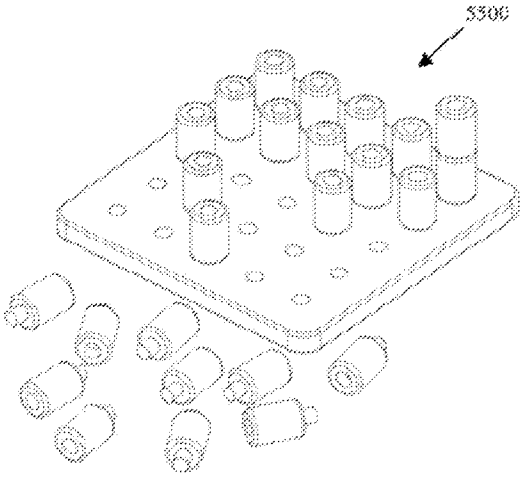

FIGS. 55A and 55B illustrate perspective views of a Level 7 Montessori toy, according to exemplary embodiments of the present invention.

FIG. 55C illustrates a top view of a component of a Level 7 Montessori toy, according to exemplary embodiments of the present invention.

FIG. 55D illustrates a side view of a component of a Level 7 Montessori toy, according to exemplary embodiments of the present invention.

FIG. 55E illustrates a side view and top view of components of a Level 7 Montessori toy, according to exemplary embodiments of the present invention.

Figure 56C:
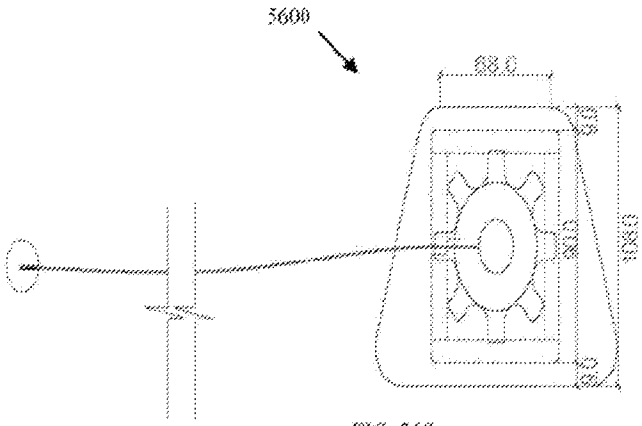
Figure 56E:
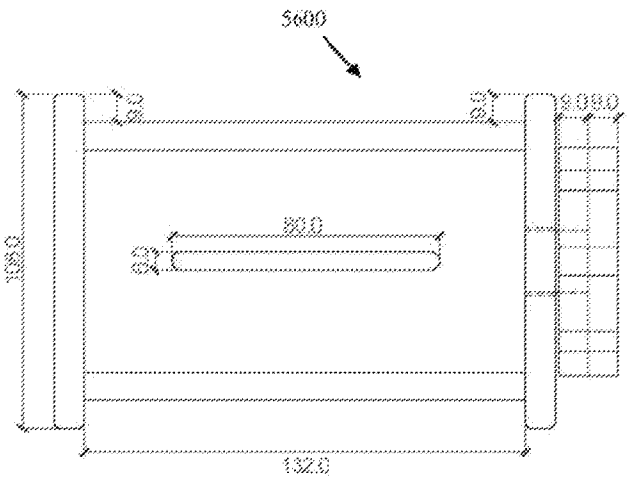
Figure 56B:
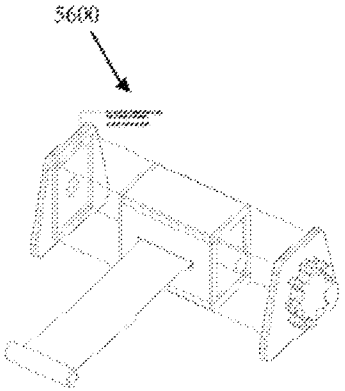
Figure 56D:
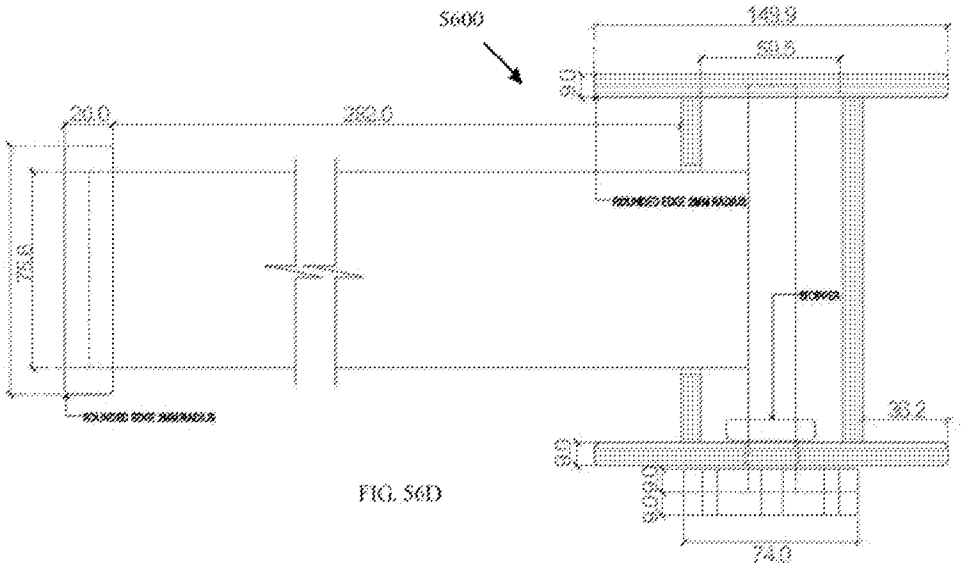
Figure 56A:
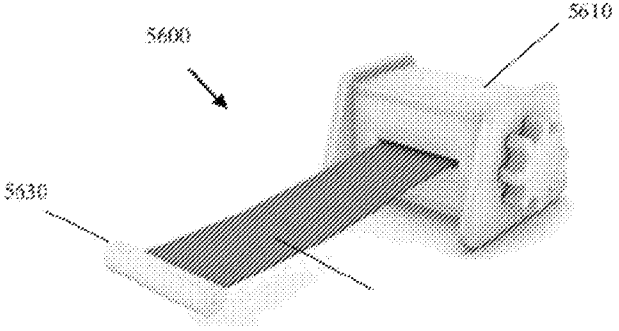

FIGS. 56A and 56B illustrate perspective views of a Level 8 Montessori toy, according to exemplary embodiments of the present invention.

FIG. 56C illustrates a side view of a Level 8 Montessori toy, according to exemplary embodiments of the present invention.

FIG. 56D illustrates a top view of a Level 8 Montessori toy, according to exemplary embodiments of the present invention.

FIG. 56E illustrates a front view of a Level 8 Montessori toy, according to exemplary embodiments of the present invention.

Figure 57C:
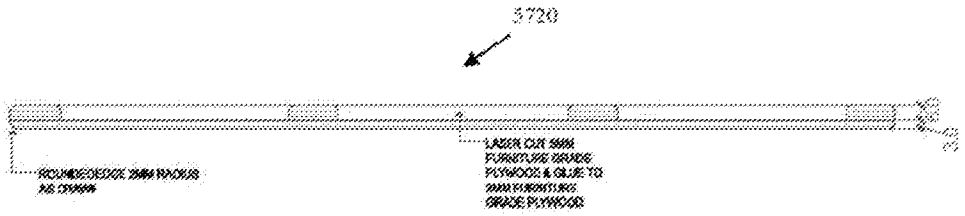
Figure 57D:
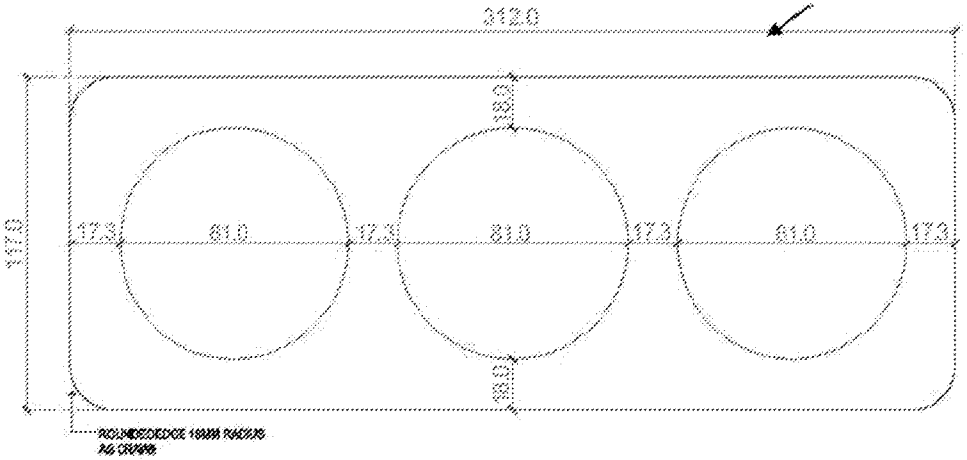
Figure 57E:
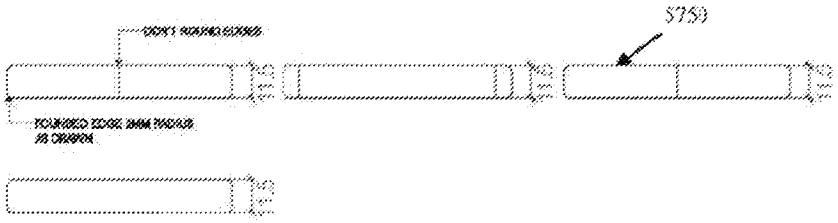
Figure 57A:
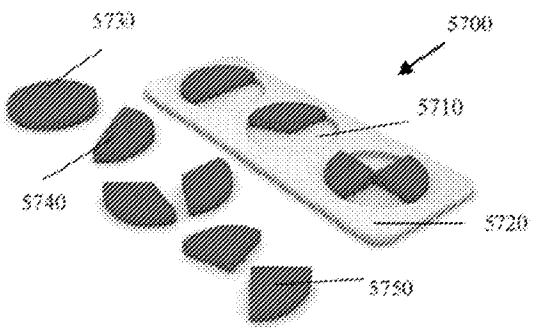
Figure 57B:
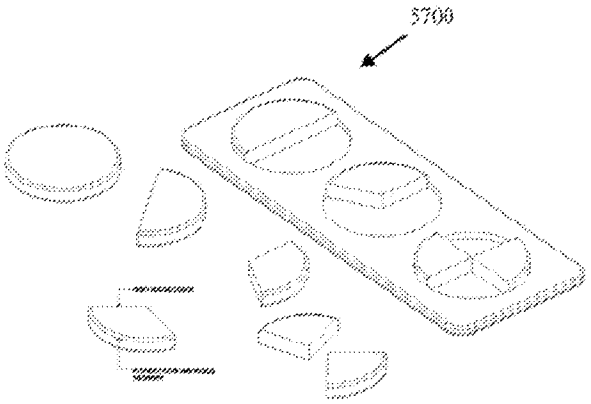

FIGS. 57A and 57B illustrate perspective views of a Level 8 Montessori toy, according to exemplary embodiments of the present invention.

FIG. 57C illustrates a side view of a component of a Level 8 Montessori toy, according to exemplary embodiments of the present invention.

FIG. 57D illustrates a top view of a component of a Level 8 Montessori toy, according to exemplary embodiments of the present invention.

FIG. 57E illustrates side views of components of a Level 8 Montessori toy, according to exemplary embodiments of the present invention.

Figure 57F:
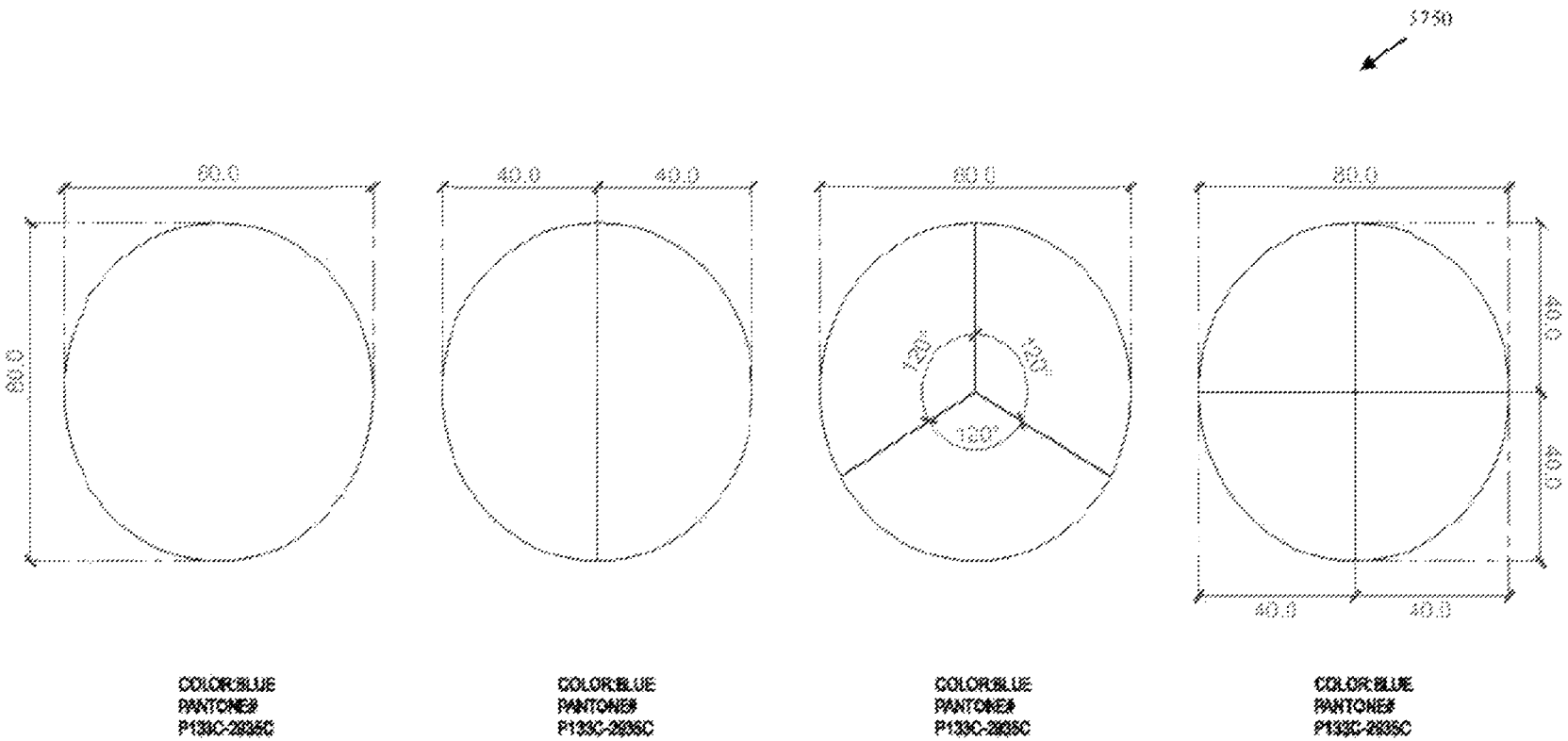

FIG. 57F illustrates top views of components of a Level 8 Montessori toy, according to exemplary embodiments of the present invention.

FIGS. 58A and 58B illustrate perspective views of a Level 8 Montessori toy, according to exemplary embodiments of the present invention.

FIG. 58C illustrates a front view of a Level 8 Montessori toy, according to exemplary embodiments of the present invention.

Figure 58D:
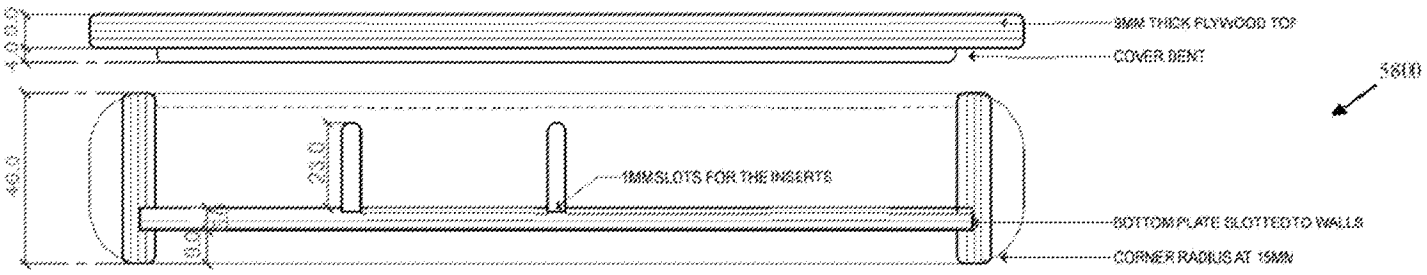

FIG. 58D illustrates a side view of a Level 8 Montessori toy, according to exemplary embodiments of the present invention.

Figure 58E:
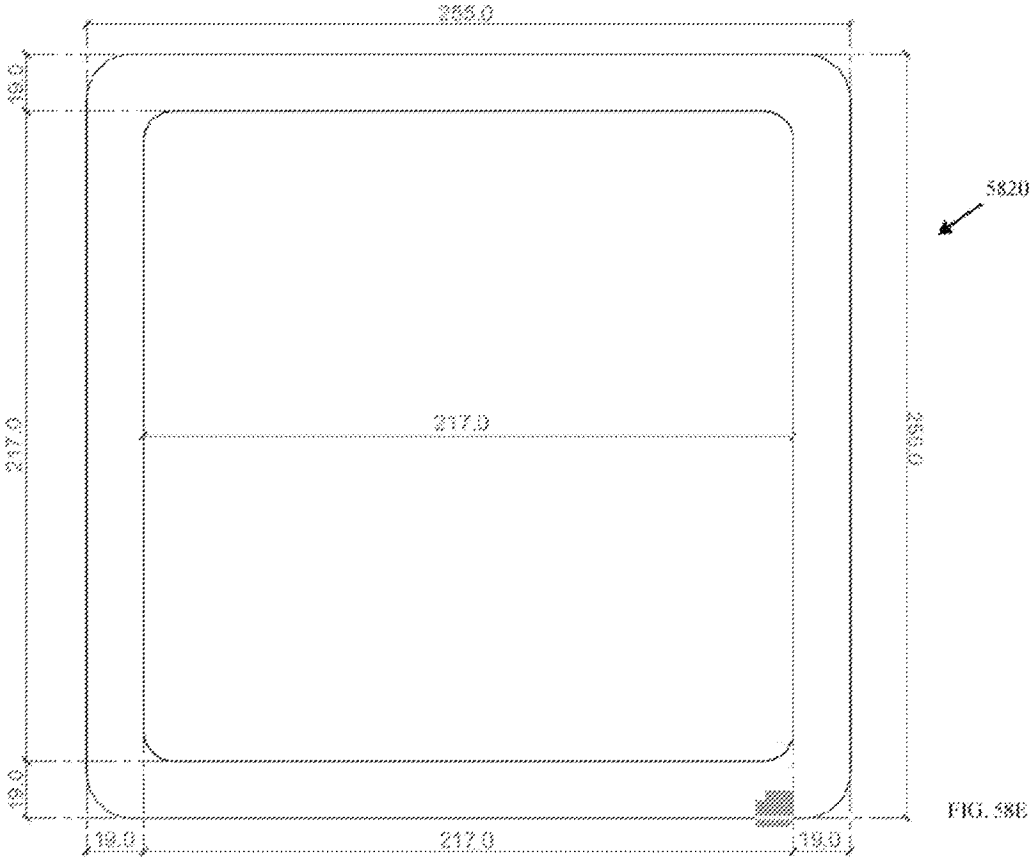

FIG. 58E illustrates a top view of a Level 8 Montessori toy, according to exemplary embodiments of the present invention.

FIG. 58F illustrates a perspective view of a component of a Level 8 Montessori toy, according to exemplary embodiments of the present invention.

FIG. 58G illustrates a top view of a component of a Level 8 Montessori toy, according to exemplary embodiments of the present invention.

FIGS. 59A-59E and 59O illustrate perspective views of a Level 8 Montessori toy, according to exemplary embodiments of the present invention.

FIGS. 59F, 59J, 59G, 59M, 59L, 59P, and 59Q illustrate top views of components of a Level 8 Montessori toy, according to exemplary embodiments of the present invention.

FIGS. 59H, 59I, 59K, and 59N illustrate side views of components of a Level 8 Montessori toy, according to exemplary embodiments of the present invention.

Figure 60:
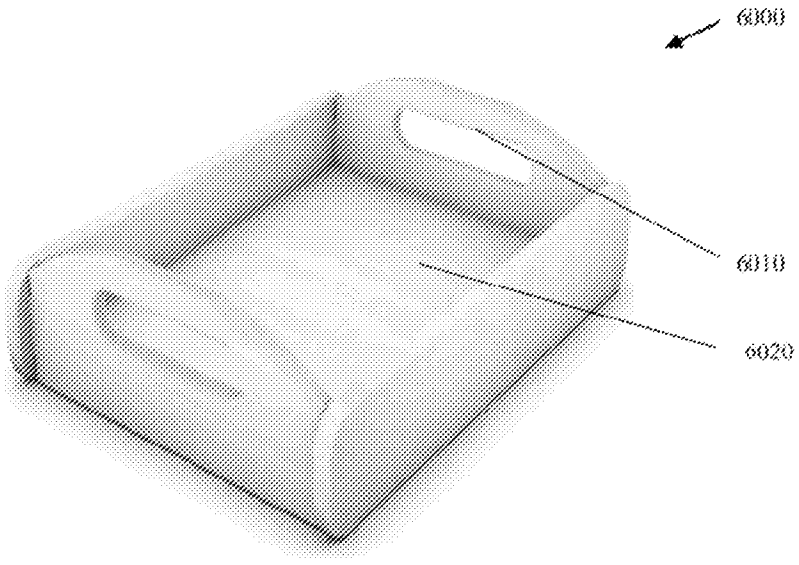

FIG. 60 illustrates a perspective view of a toy, according to exemplary embodiments of the present invention.

DETAILED DESCRIPTION

The following disclosure describes various embodiments of the present invention and method of use in at least one of its preferred, best mode embodiment, which is further defined in detail in the following description. Those having ordinary skill in the art may be able to make alterations and modifications to what is described herein without departing from its spirit and scope. While this invention is susceptible to different embodiments in different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

In the following description and in the figures, like elements are identified with like reference numerals. The use of "e.g.," "etc.," and "or" indicates non-exclusive alternatives without limitation, unless otherwise noted. The use of "including" or "includes" means "including, but not limited to," or "includes, but not limited to," unless otherwise noted.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As described below, various dimensions have been specified in exemplary embodiments. This disclosure is not limited to such dimensions and any dimensions that may still ensure educational and safety compliance as described herein may be used for the various components of the various toys described herein. Further, various components are not limited to the shapes, sizes, colors, and/or materials as described herein. Any shapes, sizes, colors, and/or materials that may still ensure educational and safety compliance as described herein may be used for the various components of the various toys described herein. The weights of the toys described herein may be according to the user's needs while complying with the safety and educational testing requirements described herein. Finally, various surfaces, sides, and features of various components of the toys described herein are per how a person skilled in the art would construe those characteristics unless otherwise specified.

Currently, Montessori toys are being manufactured by companies, such as Heutink USA, Kid Advance, Montessori Outlet, Juliana Group, MVita, Leader Joy, and Alison's Montessori. Montessori toys supplied by these companies have tiny fine print on the back of the toys' packaging with labels warnings that states phrases such as "not safe for children under 3" and "suitable for 3 years+." This is unsettling because these label markings are written on the packaging of toys that are all listed in the infant/toddler (implying children aged 0-3 years) sections of their websites and are based on the recommendations from the Association Montessori Internationale ("AMI") 0-3 teacher's training manual. Currently, there are none or just a few safety compliant Montessori toys for 0-3-year-olds that have passed safety testing in the traditional wooden materials. There is no company that has a full, safety compliant Montessori toy curriculum for 0-3-year-olds. In fact, only 4% of toys in the US have passed safety testing for children between 0-3 years old, and most of those toys are plastic and plush. Most toys fail to comply with the safety requirements not so much because of their chemical structure but because they do not pass the physical and/or mechanical tests.

After working for months and experimenting with various shapes and sizes of the toys, the current invention was developed. For example, as described in detail below, the rattles were particularly hard to develop. There are very few rattles on the market that are developmentally appropriate and small enough for the hands of children aged 0-3 years. The rattles recommended in the AMI teacher's training manual could not pass the safety tests. Accordingly, completely new rattles, according to some embodiments of the present invention, were designed that conformed with the highest safety and educational value standards. The invented designs were then submitted to contract manufacturers. The manufacturers' work product was then subjected to informal physical and/or mechanical safety testing, such as drop tests, compression tests, tension tests, small parts testing, rattle test, and/or fixture test at the inventor's lab. Most manufactured products failed again as they were still mostly constructed like the toys manufactured by Montessori toy suppliers listed above. Subsequently, all the toys were completely redesigned again until they passed the safety tests.

After a long and arduous experimentation and redesign process, Monti Kids reached out to the best toy testing safety lab in the country: Bureau Veritas with headquarters are in Buffalo, N.Y. where Fisher Price was founded. Fisher Price first started as a wooden toy company and eventually moved to plastic due to physical and/or mechanical safety testing challenges. After visiting Bureau Veritas with all the samples of the toys, Bureau Veritas advised the inventors to manufacture their toys in plastic. However, the inventors were determined to manufacture the toys in wood according to the Montessori educational standards while complying with the safety requirements as provided by various agencies such as CPSC, ASTM, etc. After the arduous redesign process, the inventors became experts in the safety standards, virtually memorizing all the relevant regulations. The inventors then set up a physical and/or mechanical safety testing site in their garage. The inventors would design the toys, model it in cardboard, then build it in wood, and then perform the physical and/or mechanical safety tests in their garage. This process was repeated multiple times for each toy and the results, such as what sizes and weights posed the biggest risk in each design, which type of wood would work best, which direction the wood grain had to flow, and which unique internal construction would work best for each design, were recorded. Subsequently, the inventor found two new contract manufacturers who had more experience building safe toys and submitted their new designs to the new contract manufacturers. Despite being told by others to use Bureau Veritas office in China in order to reduce testing costs, the inventors tested their toys in Bureau Veritas office in Buffalo so that the inventors could closely follow the process, discuss any failings or concerns with Bureau Veritas, and continue to learn from them in the process. Some of the toys passed the safety tests and for those that did not, the inventors continued the redesign process till the best iteration for the toy was achieved. This long and arduous experimentation and redesign process has resulted in the inventors' company being the only company that carries a full line of Montessori toys that are safe for children aged 0-3 years. The safety tests that the toys had to pass vary toy by toy. The two hardest safety tests to pass were 16 CFR 1500 & ASTM F963-11. Especially, because, when things broke, they often violated the small part requirement of 16 CFR 1501. However, eventually, the inventors after multiple experiments manage to design toys, described below, which pass the relevant safety tests as described by various agencies such as CPSC, ASTM (F963-11 and other relevant testing standards), etc. Additionally, the inventors also developed a new and useful methods of classifying various toys described below.

Figure 1:
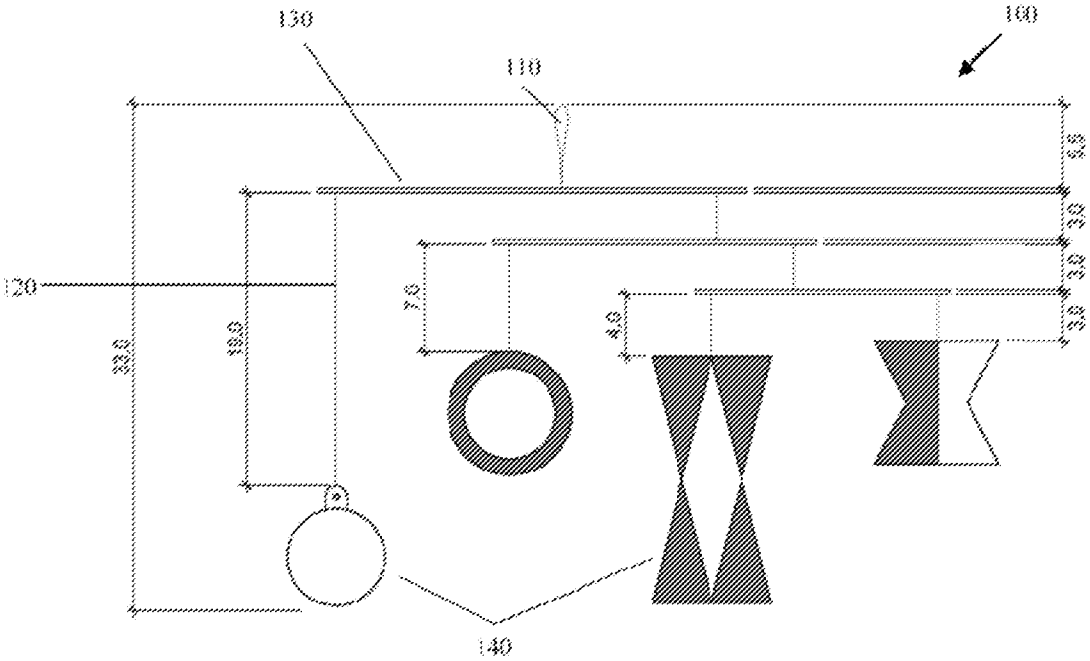
FIG. 1 illustrates a perspective view of a Level 1 Montessori toy, according to some embodiments of the present invention.

FIG. 1 illustrates a Level 1 Montessori toy called the Munari 100 according to exemplary embodiments of the present invention. This toy is described in the AMI teacher's training manual for children aged between 0-3 years. Currently, MVita manufacturers the Munari 100 for the inventor. Initially, the MVita failed to supply designs that passed the safety tests. In some embodiments, the Munari 100 may weigh 1.63 oz. with an error correction of 0.33 oz. In some embodiments, the Munari 100 may include a top string 110, hanging strings 120, hanging sticks 130, and danglers 140. In some embodiment, in order to pass the safety tests, the Munari 100 has hanging strings 120 with varying lengths, as depicted in the exemplary embodiment illustrated in FIG. 1. In some embodiments, the Munari 100 may include a top string 110 of length 5.5 cm. In some embodiments, the hanging sticks 130 may be equidistant from each other. In some embodiments, the one hanging stick 130 may be spaced 3 cm from the next hanging stick 130. In some embodiments, the overall length of the Munari 100 may be 33 cm in order to pass the safety test and meet the design requirements. In some embodiments, the hanging strings 120 may have different lengths while maintaining the important design and/or educational elements of how and where each piece hangs. In some embodiments, instead of the traditional glass sphere dangler 140 that does not pass the safety test, the Munari 100 has a plastic sphere dangler 140 that is appropriately sized. Before the current inventive design was achieved, some plastic sphere danglers 140 kept opening. However, in some of the embodiments, the plastic sphere danglers 140 in the Munari 100 may be closed and remain closed. In some embodiments, the Munari 100 and its various components may have dimensions as illustrated in FIG. 1.

Figure 2:
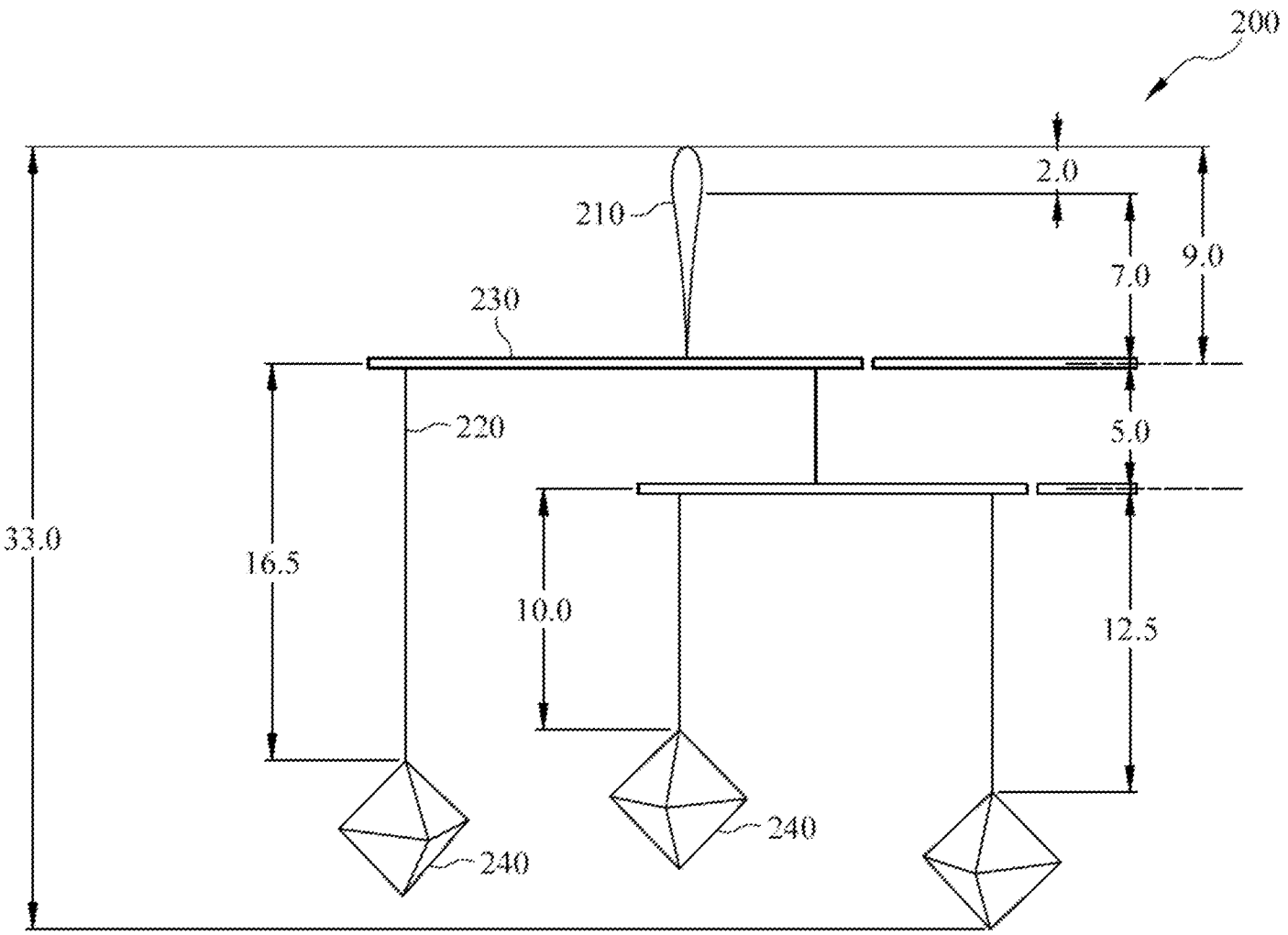
FIG. 2 illustrates a perspective view of a Level 1 Montessori toy, according to some embodiments of the present invention.

FIG. 2 illustrates a Level 1 Montessori toy called the Octahedron 200 according to exemplary embodiments of the present invention. This toy is described in the AMI teacher's training manual for children aged between 0-3 years. In some embodiments, the Octahedron 200 may weigh 0.38 oz. with an error correction of 0.13 oz. In some embodiments, the Octahedron 200 may include a top string 210, hanging strings 220, hanging sticks 230, and danglers 240. In some embodiment, in order to pass the safety tests, the Octahedron 200 has hanging strings 220 with varying lengths as depicted in the exemplary embodiment illustrated in FIG. 2. In some embodiment, the Octahedron 200 may include a top string of length 5.5 cm. In some embodiments, the hanging sticks 230 may be equidistant from each other. In some embodiments, the one hanging stick 230 may be spaced 5 cm from the next hanging stick 230. In some embodiments, the overall length of the Octahedron 200 may be 33 cm in order to pass the safety test and meet the design requirements. In some embodiments, the hanging strings 220 may have different lengths while maintaining the important design and/or educational elements of how and where each piece hangs. In some embodiments, the Octahedron 200 and its various components may have dimensions as illustrated in FIG. 2.

Figure 3B:
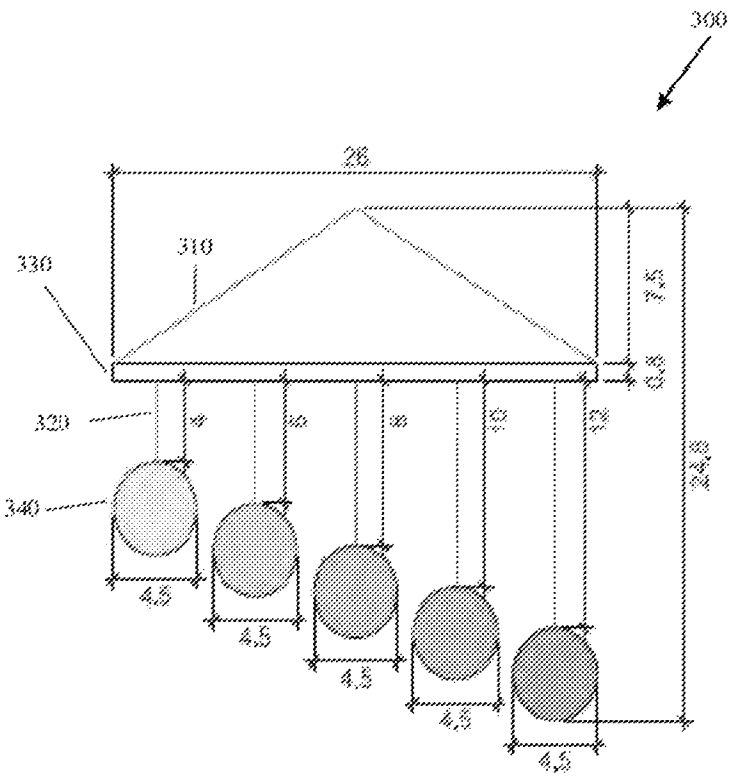
FIGS. 3A and 3B illustrate perspective views of a Level 1 Montessori toy, according to some embodiments of the present invention.
Figure 3A:
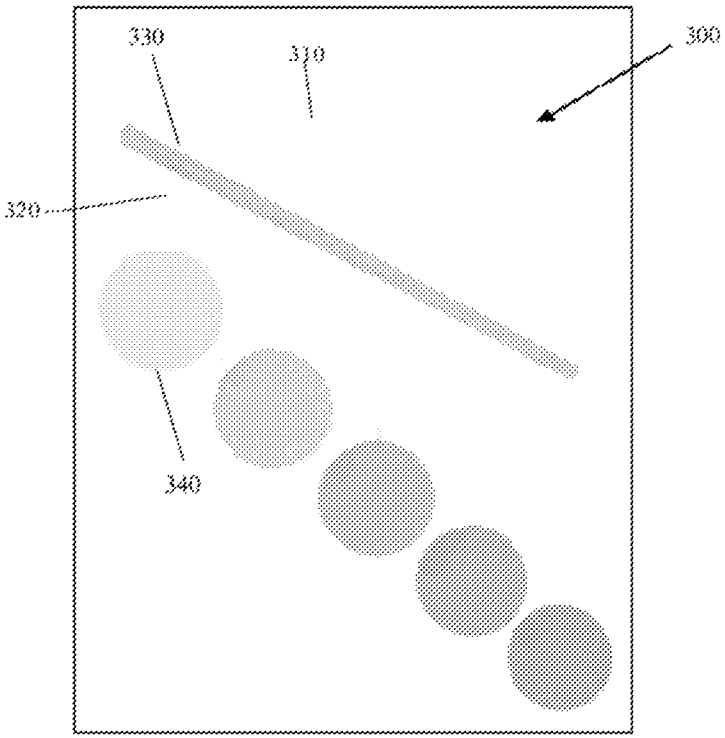

FIGS. 3A-3B illustrate a Level 1 Montessori toy called the Gobbi 300 according to exemplary embodiments of the present invention. This toy is included in the AMI teacher's training manual for children aged between 0-3 years. The final, safety tested embodiments were developed after repeated testing, failing, and redesigning five times. In some embodiments, the Gobbi 300 may weigh 1.25 oz. with an error correction of 0.25 oz. In some embodiments, the Gobbi 300 may include a top string 310, hanging strings 320, hanging stick 330, and danglers 340. In some embodiments, the length of the hanging strings 320 was changed from the length of the strings in commercially available Gobbis in order to comply with the safety requirement. In some embodiments, the length of the hanging strings 320 are different to each other. In some embodiments, the danglers 340 are spherical or circular with a diameter of 4.5 cm. In some embodiments, the maximum length of the hanging string 320 is 12 cm. In some embodiments, the shorter hanging string 320 is 2 cm shorter than the next hanging string 320. In some embodiments, the diameter of the danglers 340 was increased from 3.2 cm to 4.5 cm. The change in the dangler's 340 size allows it to conform with the safety requirements and prevents the balls from being a choking hazard. In some embodiments, the diameter of the danglers 340 is greater than 32 mm. In other embodiments, the diameter of the danglers 340 and the length of hanging strings 320 conform to a specific mathematical relationship. In some embodiments, the Gobbi 300 and its various components may have dimensions as illustrated in FIG. 3B.

Figure 4:
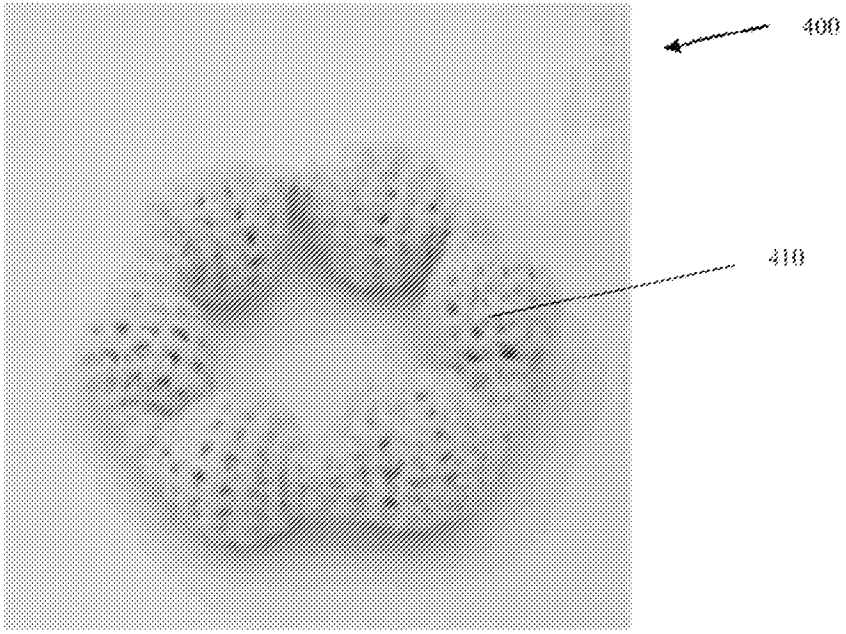
FIG. 4 illustrates a perspective view of a Level 1 Montessori toy, according to some embodiments of the present invention.

FIG. 4 illustrates a Level 1 Montessori toy called the Crochet Ring 400, which is included in the AMI teacher's training manual for children aged between 0-3 years. Other companies such as MVita make a similar toy that does not comply with the safety standard. Additionally, the AMI teacher's training manual for children aged 0-3 years has many grasping toys but they do not pass the safety tests. Specifically, the bells inside the MVita's Crochet Ring does not comply with the chemistry standard. In some embodiments, the Crochet Ring 400 may weigh 0.63 oz. with an error correction of 0.13 oz. In some embodiments, the Crochet Ring 400 may include bells 410. In some embodiments, the bells 410 inside the Crochet Ring 400 are made of plastic. In some embodiments, the bells 410 are made of any other material that can pass the safety tests. In some embodiments, there are six bells 410 in the Crochet Ring 400. In some embodiments, there may be more than or less than six 6 bells 410 in the Crochet Ring 400. In some embodiments, the Crochet Ring 400 may have an 8-cm diameter. In some embodiments, the diameter may be less than or greater than 8-cm. In some embodiments, the crochet may be made out of a natural cream color yarn. In some embodiments, the crochet may be of any other singular or combination of colors.

Figure 5B:
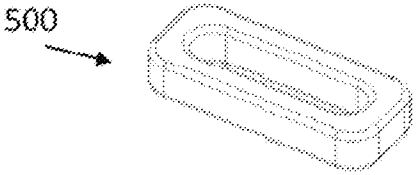
FIGS. 5A and 5B illustrate perspective views of a Level 1 Montessori toy, according to some embodiments of the present invention.
Figure 5D:
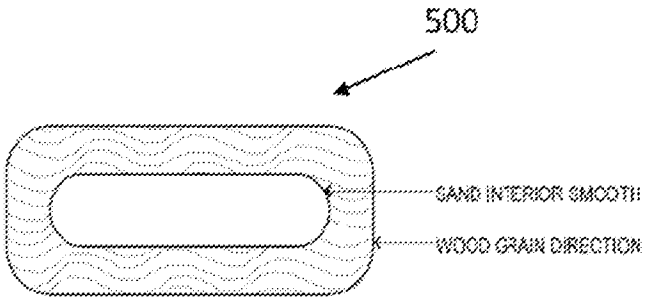
FIGS. 5C and 5D illustrate top views of a Level 1 Montessori toy, according to some embodiments of the present invention.
Figure 5F:
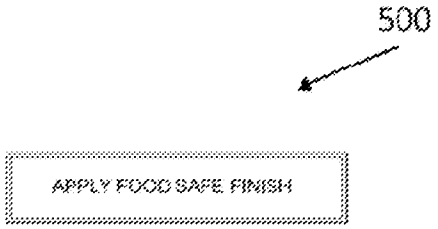
FIGS. 5E and 5F illustrate side views of a Level 1 Montessori toy, according to some embodiments of the present invention.
Figure 5A:
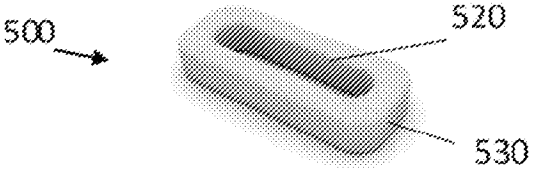
Figure 5C:
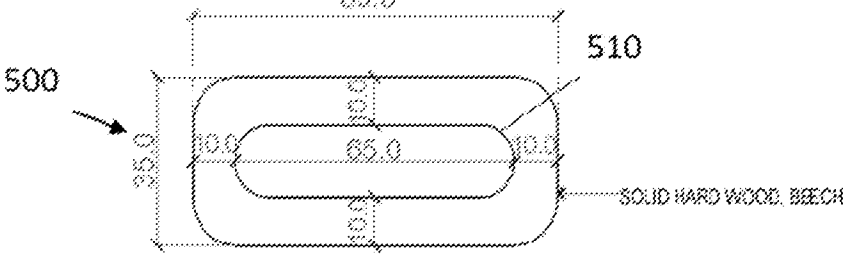
Figure 5E:
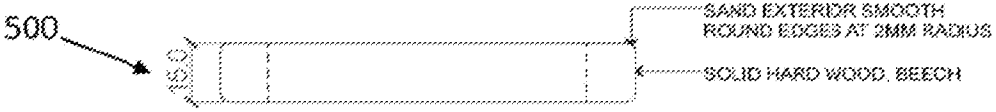

FIGS. 5A-5F illustrate a Level 1 Montessori toy called the Grasping Toy 500. The Grasping Toy 500 is based on a child's need to grasp different sizes, shapes, and textures with one hand or two hands. In some embodiments, the Grasping Toy 500 may weigh 0.75 oz. with an error correction of 0.15 oz. In some embodiments, the dimensions of the Grasping Toy 500 are as specified in the exemplary illustrations in FIGS. 5C and 5E. In some embodiments, the wood grain direction may be specified, as illustrated in FIG. 5D. In some embodiments, the interior 520 of the Grasping Toy 500 is sanded smooth. In some embodiments, the exterior 530 of the Grasping Toy 500 is sanded smooth and the edges 540 are rounded to 2 mm radius. In some embodiments, the Grasping Toy 500 may be made of solid hard wood. In some embodiments, the Grasping Toy 500 may be made of any other safety test compliant material. In some embodiments, as depicted in FIG. 5F, food safe finish may be applied to the Grasping Toy 500.

Figure 6:
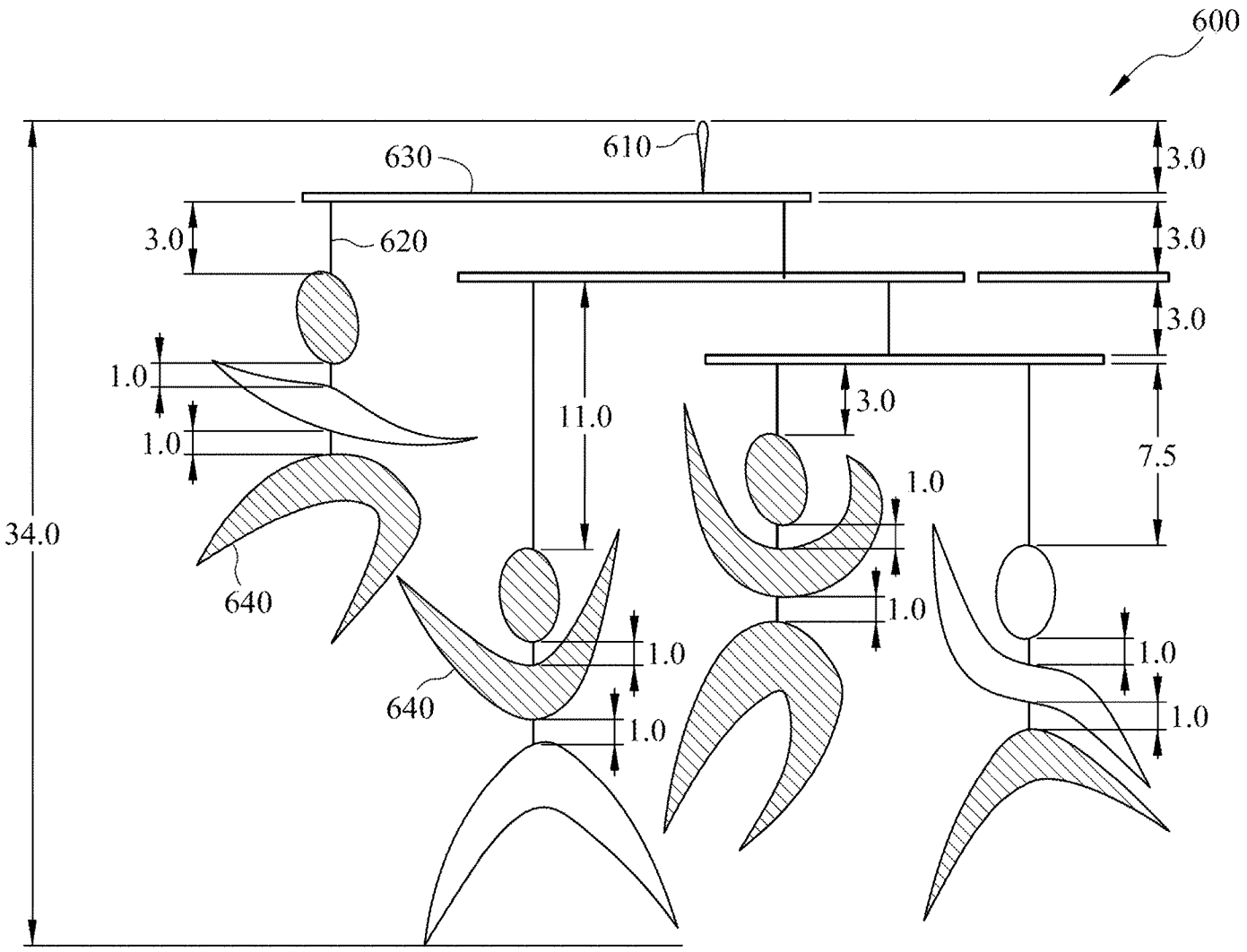
FIG. 6 illustrates a perspective view of a Level 1 Montessori toy, according to some embodiments of the present invention.

FIG. 6 illustrates a Level 1 Montessori toy called Dancers 600, according to exemplary embodiments of the present invention. Dancers 600 is included in the AMI teacher's training manual for children aged between 0-3 years. In some embodiments, the Dancers 600 may weigh 0.38 oz.

with an error correction of 0.13 oz. In some embodiments, the Dancers 600 may include a top string 610, hanging strings 620, hanging sticks 630, and danglers 640. In some embodiments, the length of the hanging strings 620 differ from each other. In some embodiments, the length of the hanging strings 620 was changed from other commercially available Dancers in order to comply with the safety requirement, while still keeping the mobile balanced. In some embodiments, the danglers 640 have components that are spaced 1 cm from each other. In some embodiments, the hanging sticks 630 are spaced 3 cm from each other. In some embodiments, the danglers 640 are a combination of two or more colors. In some embodiments, the dangers 640 are made of one color. In some embodiments, the dimensions of the Dancers 600 may be as specified in the exemplary illustration in FIG. 6. In some embodiments, the Dancers 600 may have a total length of 34 cm.

Figure 7H:
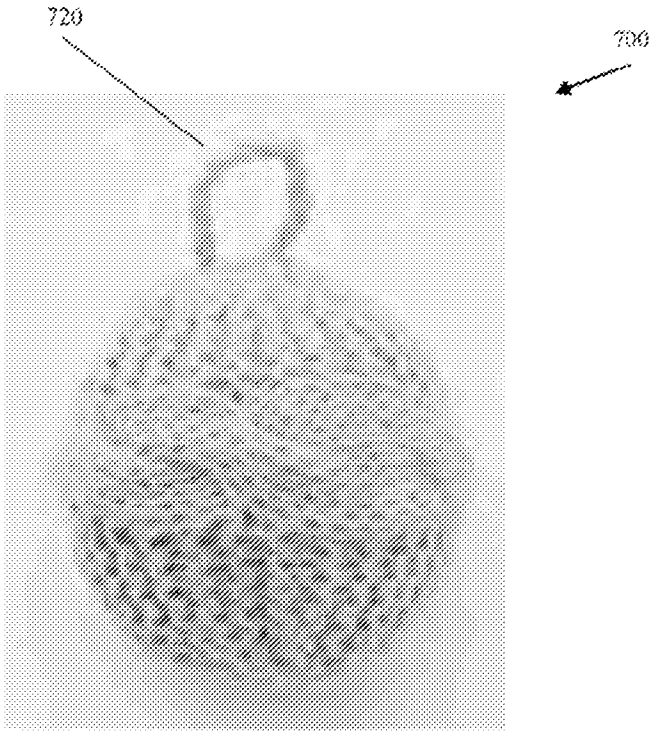
FIG. 7 illustrates a perspective view of a Level 1 Montessori toy, according to some embodiments of the present invention.
Figure 8B:
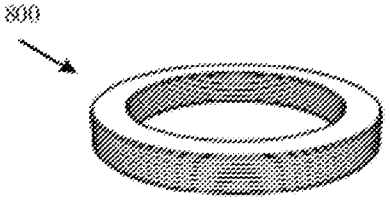
FIGS. 8A and 8B illustrate perspective views of a Level 1 Montessori toy, according to some embodiments of the present invention.
Figure 8D:
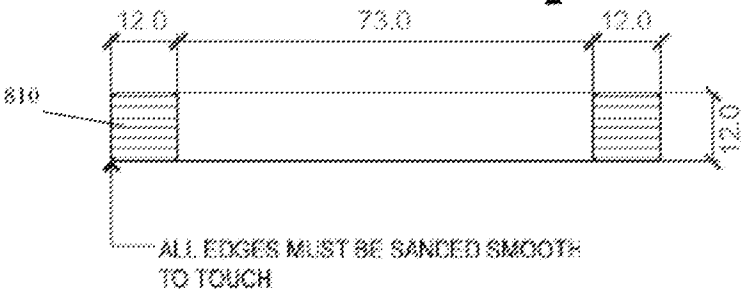
FIG. 8D illustrates a side view of a Level 1 Montessori toy, according to some embodiments of the present invention
Figure 8A:
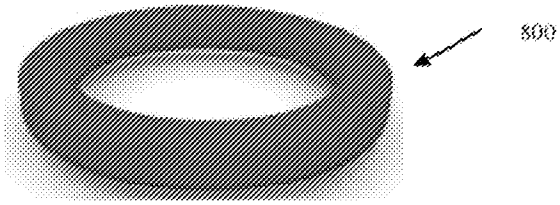
Figure 8C:
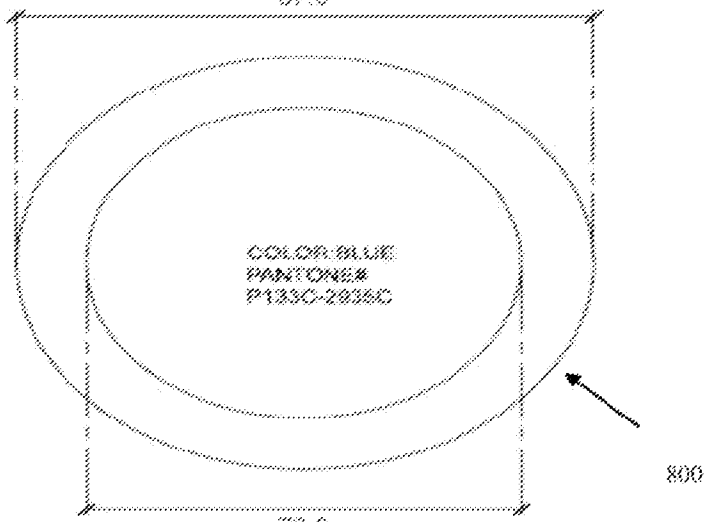
FIG. 8C illustrates a top view of a Level 1 Montessori toy, according to some embodiments of the present invention.

FIG. 7 illustrates a Level 1 Montessori toy called Batting Ball 700, according to exemplary embodiments of the present invention. Batting Ball 700 is included in the AMI teacher's training manual for children aged between 0-3 years. The Batting Ball 700 is based on a child's need to reach, bat, and grasp toys of different sizes, shapes, textures that make some sound. In some embodiments, the Batting Ball 700 may weigh 0.625 oz. with an error correction of 0.13 oz. In some embodiments, the Batting Ball 700 has bells (not pictured) inside it. The AMI teacher's training manual suggests tying a metal bell from a ribbon and hanging that ribbon from the ceiling to serve this purpose. However, hanging a long ribbon within children's, aged 0-3 years, reach is in violation of safety standards. Additionally, many metal bells have sharp edges that could injure a child aged 0-3 years. In some embodiments, the Batting Ball 700 may have a diameter of 5.5 cm. In some embodiments, the Batting Ball 700 may have a loop 720 on top of it. In some embodiments, the loop may have a diameter of 1.5 cm. In some embodiments, the Batting Ball 700 may be blue in color. In some embodiments, the Batting Ball 700 may be of any other color or a combination of colors. In some embodiments, the Batting Ball 700 may be stuffed firmly with poly-fil polyester batting. In some embodiments, the bells inside the Batting Ball 700 may be made of plastic. In some embodiments, the bells may be made of any safety compliant material. In some embodiments, there may be four plastic bells in each Batting Ball 700. In some embodiments, there may be less or more than four bells in each Batting Ball 700. In some embodiments, there may be less or more than four bells in each Batting Ball 700. In some embodiments, the Batting Ball 700 may have a hard casing made of plastic or wood filled with bells and covered with fabric.

FIGS. 8A-8D illustrate various views of a Level 1 Montessori toy called the Grasping Ring 800, according to exemplary embodiments of the present invention. Grasping Ring 800 is included in the AMI teacher's training manual for children aged between 0-3 years. The AMI teacher's training manual suggests tying a ring onto a ribbon and hanging that ribbon from the ceiling, so a child can reach, bat, and grasp it. However, hanging a long ribbon within a baby's reach is in violation of the safety standards. For these reasons, the invention was designed. Previous iterations of the design failed the safety tests the first time because it was made in solid wood and solid wood in this shape, size, and weight cannot pass the drop tests. In some embodiments, the Grasping Ring 800 may weigh 0.75 oz. with an error correction of 0.15 oz. In some embodiments, the Grasping Ring 800 may be made of plywood. In some embodiments, the Grasping Ring 800 may be made of any other material that can pass the safety test. In some embodiments, the Grasping Ring 800 may be made in blue color. In some embodiments, the Grasping Ring 800 may be made of any other singular or combination of colors. In some embodiments, the dimensions of the Grasping Ring may be as depicted in the exemplary illustrations FIGS. 8C and 8D.

Figure 9A:
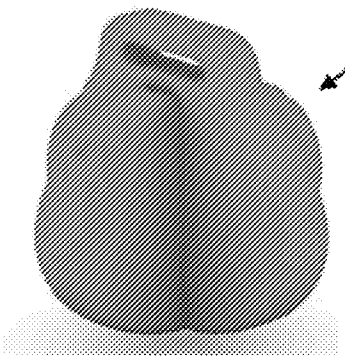
FIGS. 9A-9C and 9I illustrate perspective views of a Level 1 Montessori toy, according to some embodiments of the present invention.
Figure 9B:
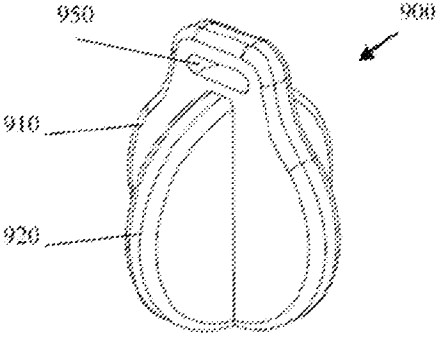
Figure 9C:
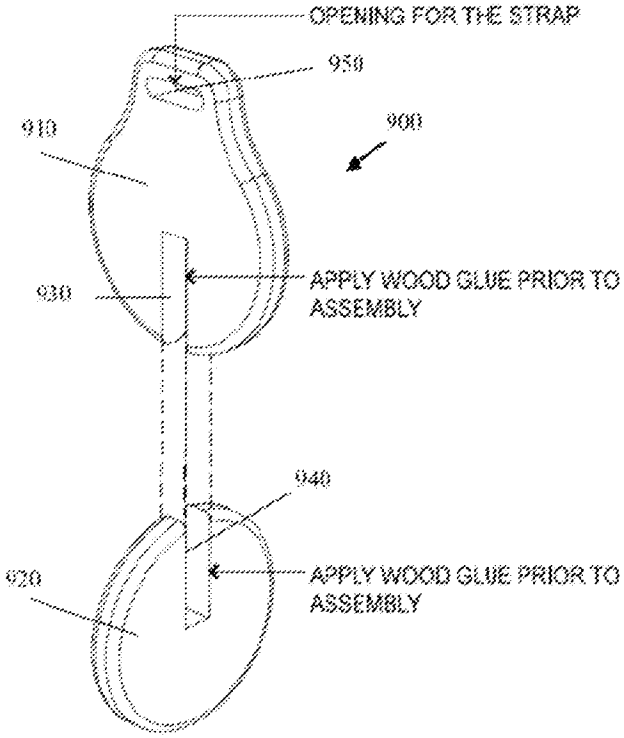
Figure 9D:
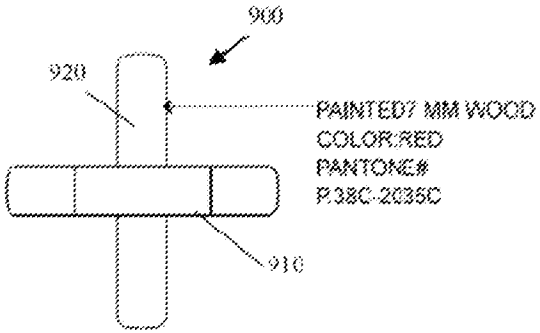
FIG. 9D illustrates a top view of a Level 1 Montessori toy, according to some embodiments of the present invention.
Figure 9F:
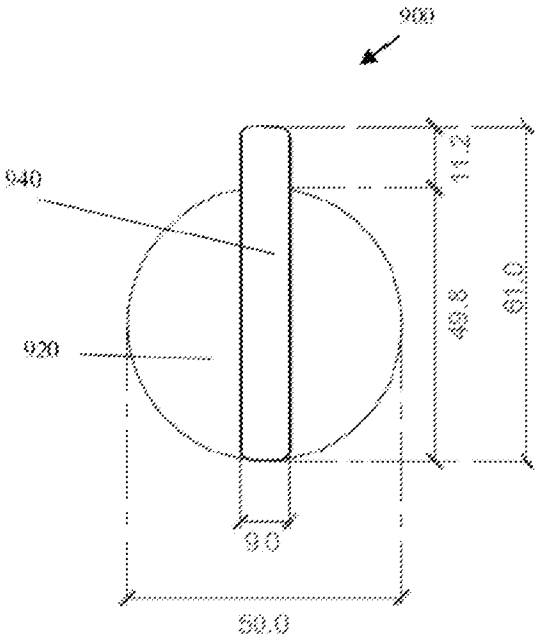
FIG. 9E-9H illustrate side views of a component of a Level 1 Montessori toy, according to some embodiments of the present invention.
Figure 9E:
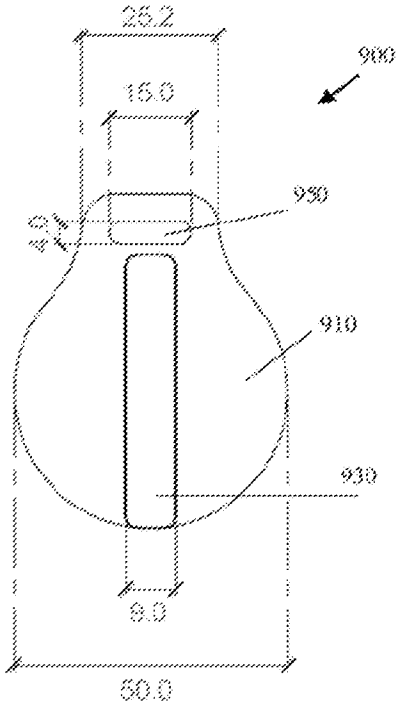
Figure 9I:
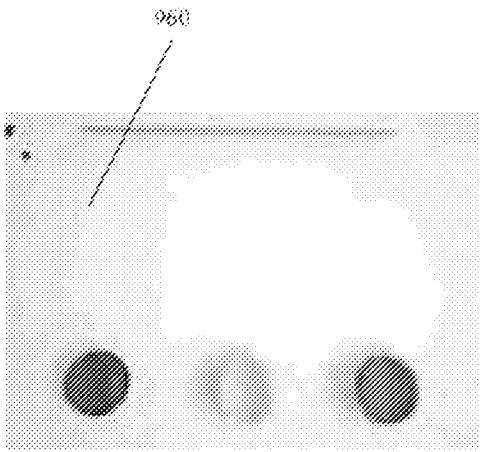
Figure 9H:
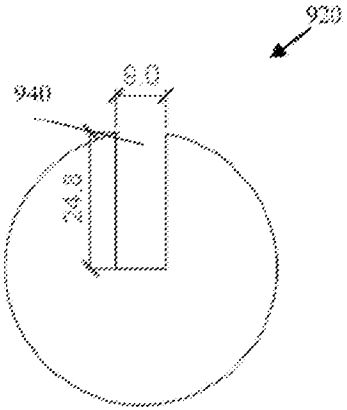
Figure 9G:
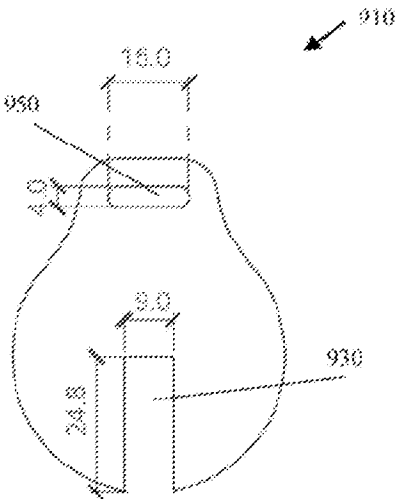

FIGS. 9A-9I illustrate various views of a Level 1 Montessori toy called the Hanging Discs 900, according to exemplary embodiments of the present invention. It is included in the AMI teacher's training manual for children aged between 0-3 years. The AMI teacher's training manual includes a mobile for grasping. However, according to the safety standards, mobiles should always be hung out of a baby's reach to prevent strangulation and choking. In some embodiments, the Hanging Discs 900 may weigh 0.75 oz. with an error correction of 0.15 oz. In some embodiments, the Hanging Discs 900 may include an upper disc 910 and a lower disc 920. The upper disc 910 may have a slit 930 the lower disc may have a corresponding slit 940. The upper disc 910 and the lower disc 920 may fit together at the slits 930 and 940. In some embodiments, the upper disc has an opening 950 on it top that may permit it to be hung from something. Given the developmental benefits of an infant reaching and grasping an object this shape, in some embodiments, the Hanging Discs 900 may be hung from an activity gym (not pictured). In some embodiments, the dimensions of the various components of the Hanging Discs may be as described in the exemplary illustrations in FIGS. 9E-9I. Previous iterations of the current invention failed the safety tests because it was made in solid wood and solid wood in this shape, size and weight cannot pass the drop tests. After experimentation, it was determined that plywood would pass the safety test. Accordingly, some embodiments of the present invention are made out of plywood and are safety compliant. In some embodiments, the opening 950 may allow the Hanging Discs 900 to be threaded onto a strap 960, as illustrated in FIG. 9I. The opening 950 had to be redesigned several times in order to withstand the safety tests.

Figure 10:
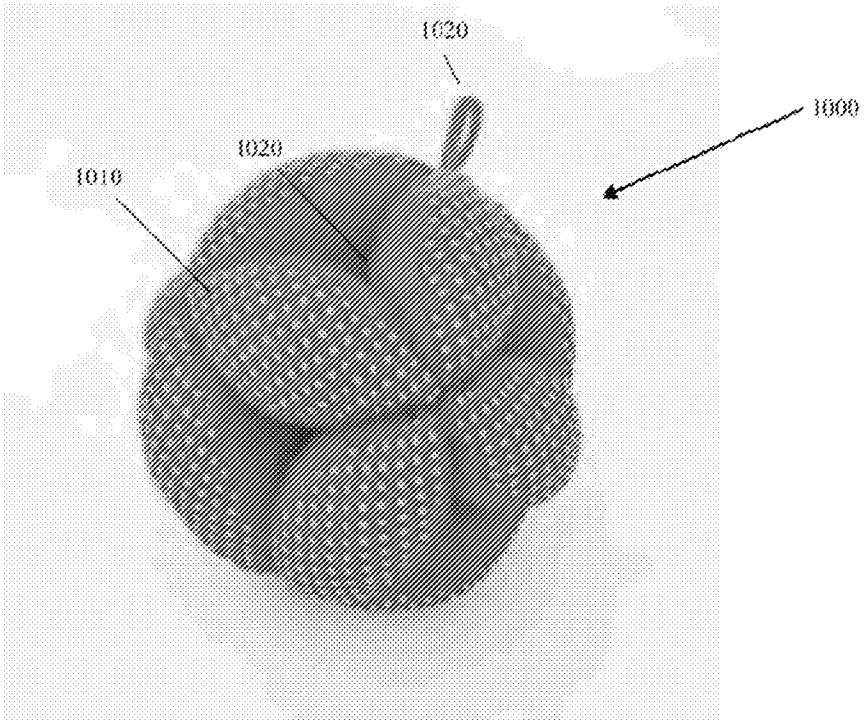
FIG. 10 illustrates a perspective view of a Level 1 Montessori toy, according to some embodiments of the present invention.
Figure 11D:
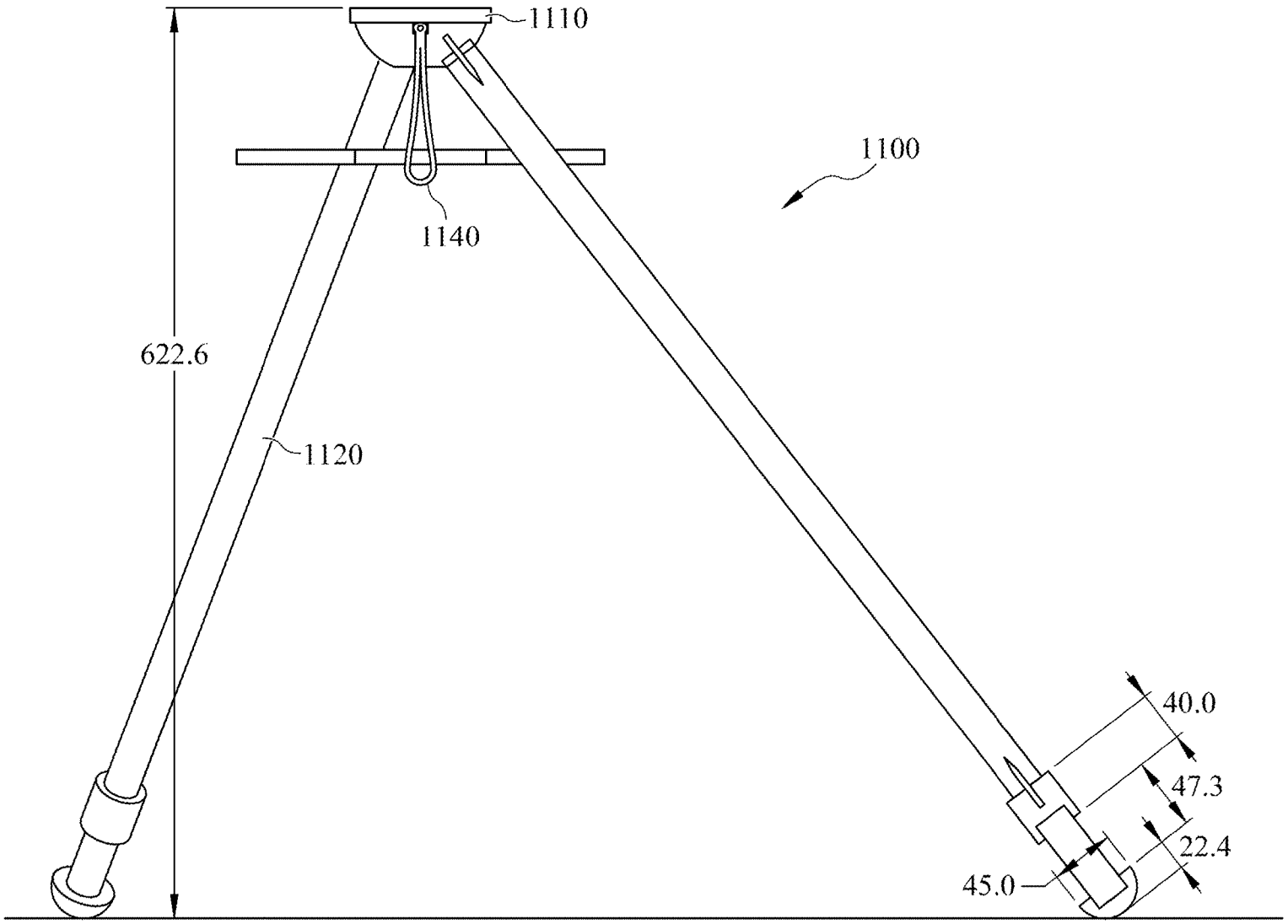
FIG. 11D illustrates a side view of a Level 1 Montessori toy, according to some embodiments of the present invention.
Figure 11E:
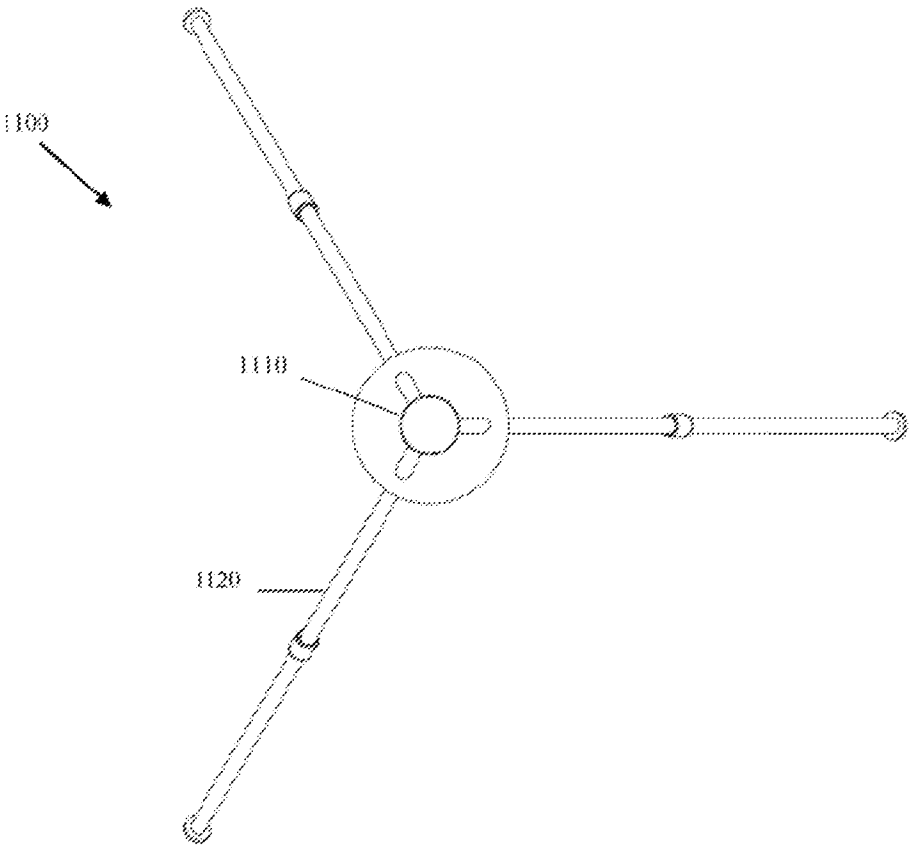
Figure 11F:
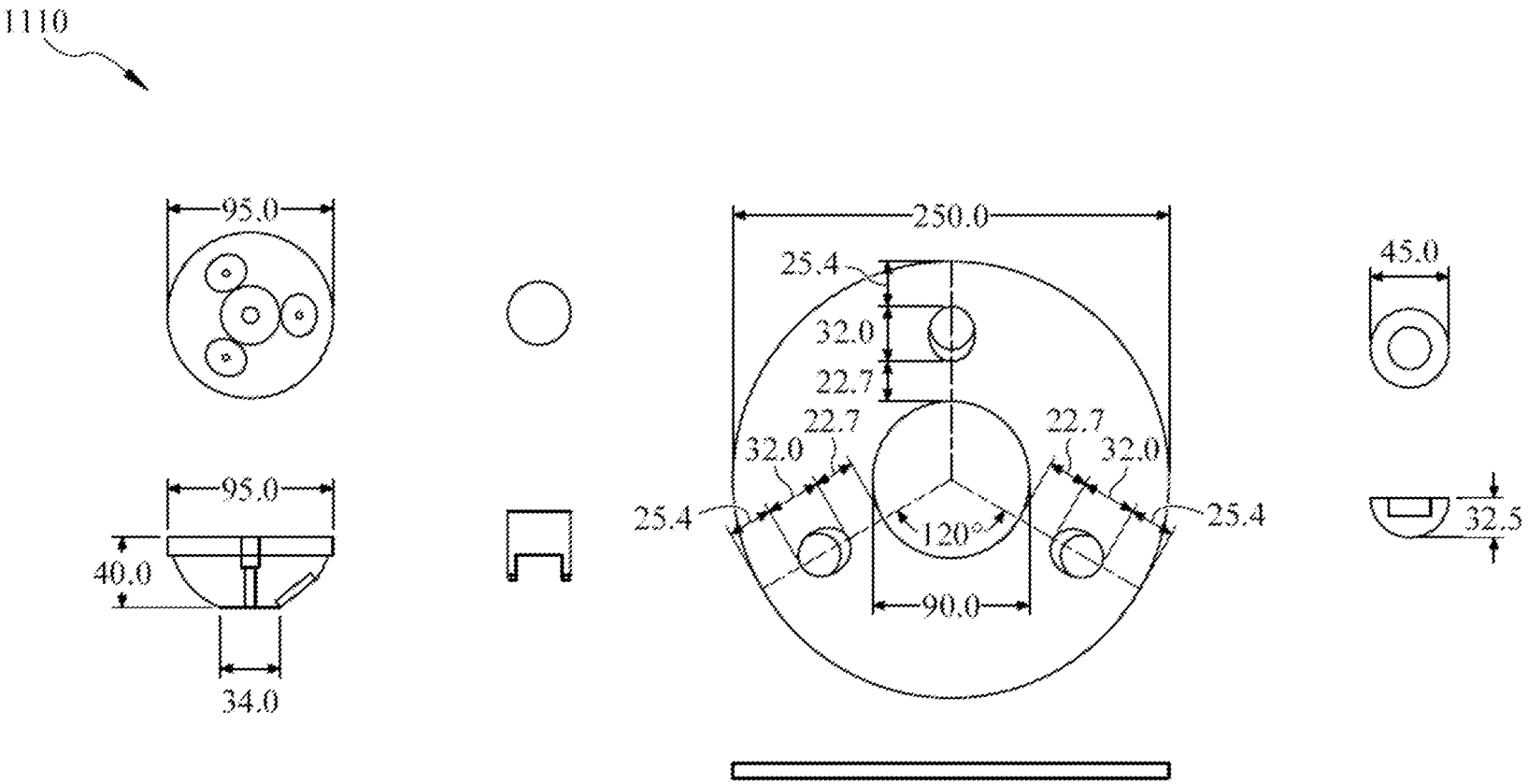
FIG. 11F illustrates a perspective view of a component of a Level 1 Montessori toy, according to some embodiments of the present invention.

FIG. 10 illustrates a Level 1 Montessori toy called the Kicking Ball 1000, according to exemplary embodiments of the present invention. The AMI teacher's training manual includes this toy in a different size, and it can also be found in some handmade shops on Etsy. The AMI teacher's training manual suggests attaching a Kicking Ball to a ribbon hanging from a ceiling but that is in violation of the safety laws. In some embodiments, the Kicking Ball 1000 may weigh 2.375 oz. with an error correction of 0.48 oz. In some embodiments, the Kicking Ball 1000 may include petals 1010. In some embodiments, the Kicking Ball 1000 may include 12 petals 1010. In some embodiments, each petal 1010 may me made out of 3 pieces of 100% cotton light weight twill fabric sown together with ¼-inch seam allowances; 2 lower petals, which may be solid red colored and made of lightweight twill fabric; and 1 upper petal, which may be red colored with white polka dot fabric. In some embodiments, the petals 1010 may be of completely different, same, singular, and/or any combination of colors. In some embodiments, the petals 1010 may be made of polyester thread in the same color as the fabric, to sew seams. In some embodiments, the polyester thread may be in a different color to the fabric. In some embodiments, the petals 1010 may be stuffed firmly with poly-fil polyester stuffing. In some embodiments, the petals 1010 may be stuffed with any other safety test compliant material. Subsequently, the completely stuffed parts may be sewn together or joined in any other safety test compliant manner at the center of the Kicking Ball 1000. In some embodiments, the cone tips may be hand-sewn to 3 other tips securely using at least 4 passes of thread. This may form and "X" shape at each cone tip. In some embodiments, the sewing thread may then be knotted multiple times and hidden inside or under the Kicking Ball's 1000 fabric. In some embodiments, twill loop 1020 may be added for hanging. In some embodiments, the top petal may be 9 cm long and 4.5 cm wide. In some embodiments, the Kicking Ball 1000 may include lower cone 1020. In some embodiments, the lower cone 1020 may be 6 cm long and 8.5 cm wide. In some embodiments, the Kicking Ball 1000 may have 35.5 cm circumference. In some embodiments, the Kicking Ball 1000 may have a diameter of 12 cm. In some embodiments, the Kicking Ball 1000 may have any other dimensions that conform it to the safety requirements. In some embodiments, the Kicking Ball 1000 may be hung from the Activity Gym (described below) in order to make it safer than just having a ribbon hung from the ceiling.

Given that the safety standards do not allow hanging mobiles or reaching, batting, grasping, and/or kicking toys from the ceiling, FIGS. 11A-11F illustrate various views of a Level 1 Montessori toy called the Activity Gym 1100, according to exemplary embodiments of the present invention. There are some activity gyms made by large toy companies like Plan Toys that are used to hang other toys, but those activity gyms do not facilitate the hanging of a mobile out of a child's reach. There is one activity gym that can be adjusted to accommodate the two height settings that may work, but the height adjustment is done by folding and extending the long legs, which is a tedious process and takes up too much space in the home. In some embodiments, the Activity Gyms 1100 may weigh 68.75 oz. with an error correction of 13.75 oz. In some embodiments, Activity Gyms may include a top 1110 and long legs 1120. In some embodiments, Activity Gyms 1100 may include short legs 1130 that may be interchangeable with the long legs 1120. In some embodiments, the Activity Gym 1100 may have dimensions as described in exemplary embodiment illustrated in FIG. 11D. In some embodiments, the top 1110 may include an elastic string 1140. In some embodiments, the dimensions of the Activity Gym may be as described in exemplary embodiment illustrated in FIG. 11E. In some embodiments, the top 1110 of the Activity Gym 1100 may have dimensions as described in exemplary embodiment illustrated in FIG. 11F.

Figure 12A:
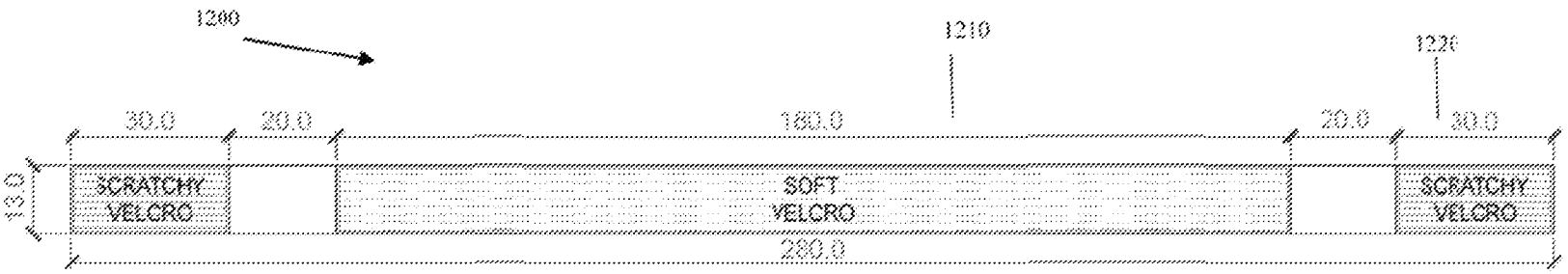
FIG. 12A illustrates a top view of a Level 1 Montessori toy, according to some embodiments of the present invention.
Figure 12B:
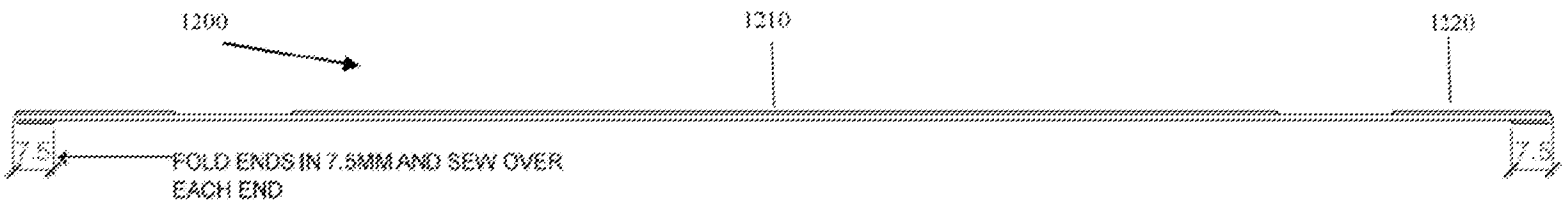
FIG. 12B illustrates a side view of a Level 1 Montessori toy, according to some embodiments of the present invention.

FIGS. 12A and 12B illustrate various views of a Level 1 Montessori toy called the Long Cloth Strap 1200, according to exemplary embodiments of the present invention. In some embodiments, the Long Cloth Strap 1200 may have multiple sections 1210 and 1220. In some embodiments, the dimensions of the sections may be as described in the exemplary illustration FIGS. 12A and 12B. In some embodiments, the section 1210 may be made of soft Velcro. In some embodiments, the sections 1220 may me made of scratchy Velcro. In some embodiments, the sections may be made of any other safety test compliant material.

Figure 13B:
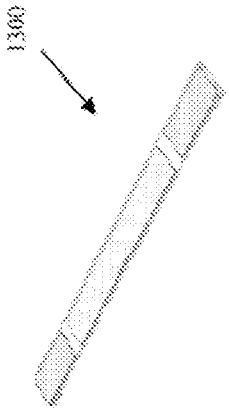
FIGS. 13A and 13B illustrate perspective views of a Level 1 Montessori toy, according to some embodiments of the present invention.
Figure 13A:
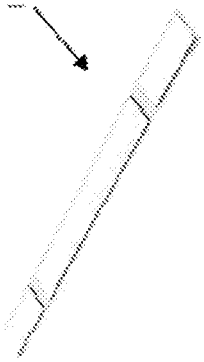
Figure 13C:
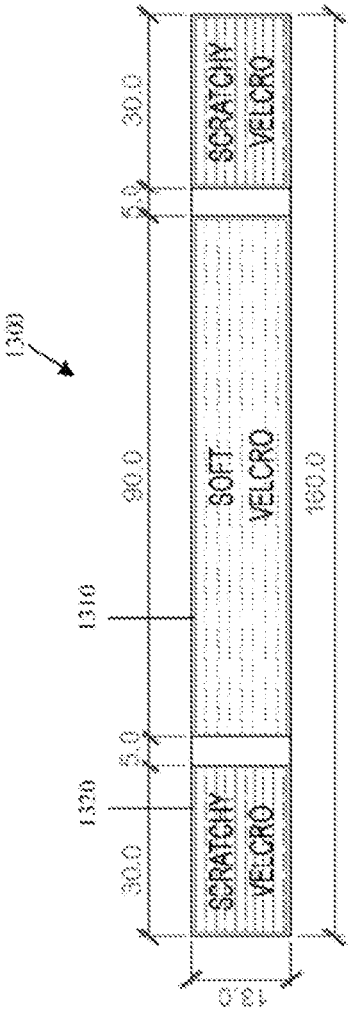
FIG. 13C illustrates a top view of a Level 1 Montessori toy, according to some embodiments of the present invention.
Figure 13D:
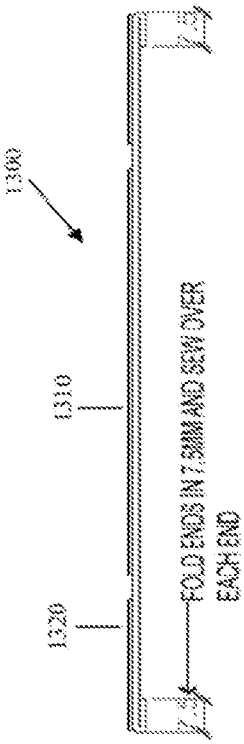
FIG. 13D illustrates a side view of a Level 1 Montessori toy, according to some embodiments of the present invention.

FIGS. 13A-13B illustrate various views of a Level 1 Montessori toy called the Short Cloth Strap 1300, according to exemplary embodiments of the present invention. In some embodiments, the Short Cloth Strap 1200 may have multiple sections 1310 and 1320. In some embodiments, the dimensions of the sections may be as described in the exemplary illustration FIGS. 13A and 13B. In some embodiments, the section 1310 may be made of soft Velcro. In some embodiments, the sections 1320 may me made of scratchy Velcro. In some embodiments, the sections may be made of any other safety test compliant material.

Figure 14B:
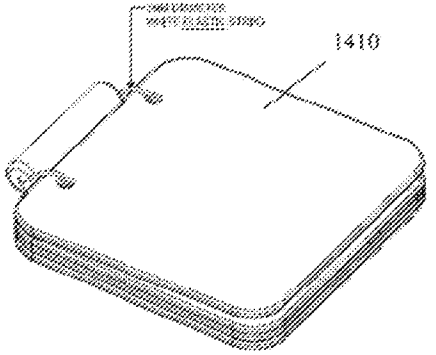
FIGS. 14A and 14B illustrate perspective views of a Level 2 Montessori toy, according to some embodiments of the present invention.
Figure 14A:
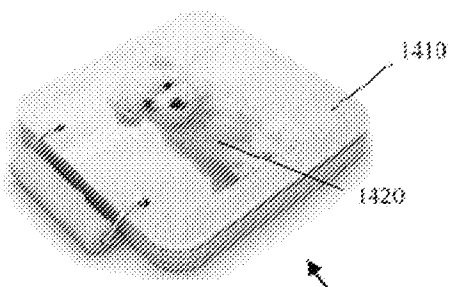
Figure 14C:
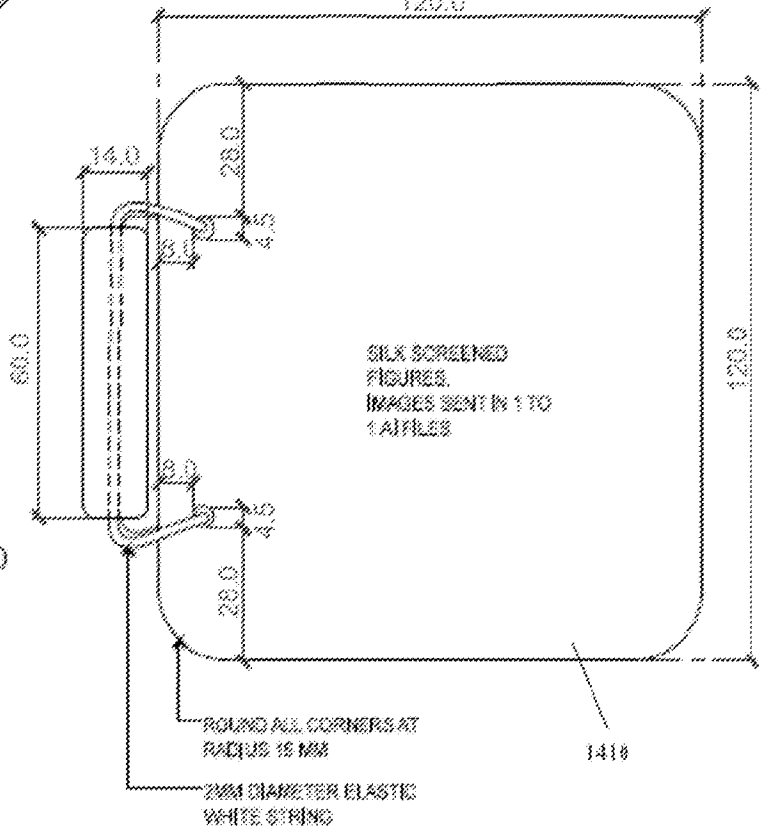
FIG. 14C illustrates a top view of a Level 2 Montessori toy, according to some embodiments of the present invention.
Figure 14D:
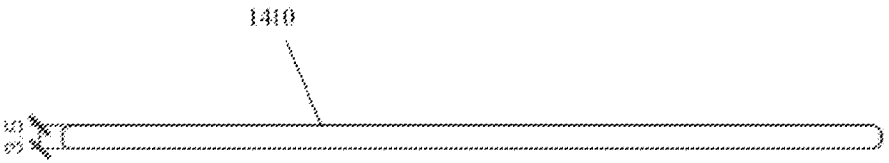
FIG. 14D illustrates a side view of a Level 2 Montessori toy, according to some embodiments of the present invention.
Figure 14E:
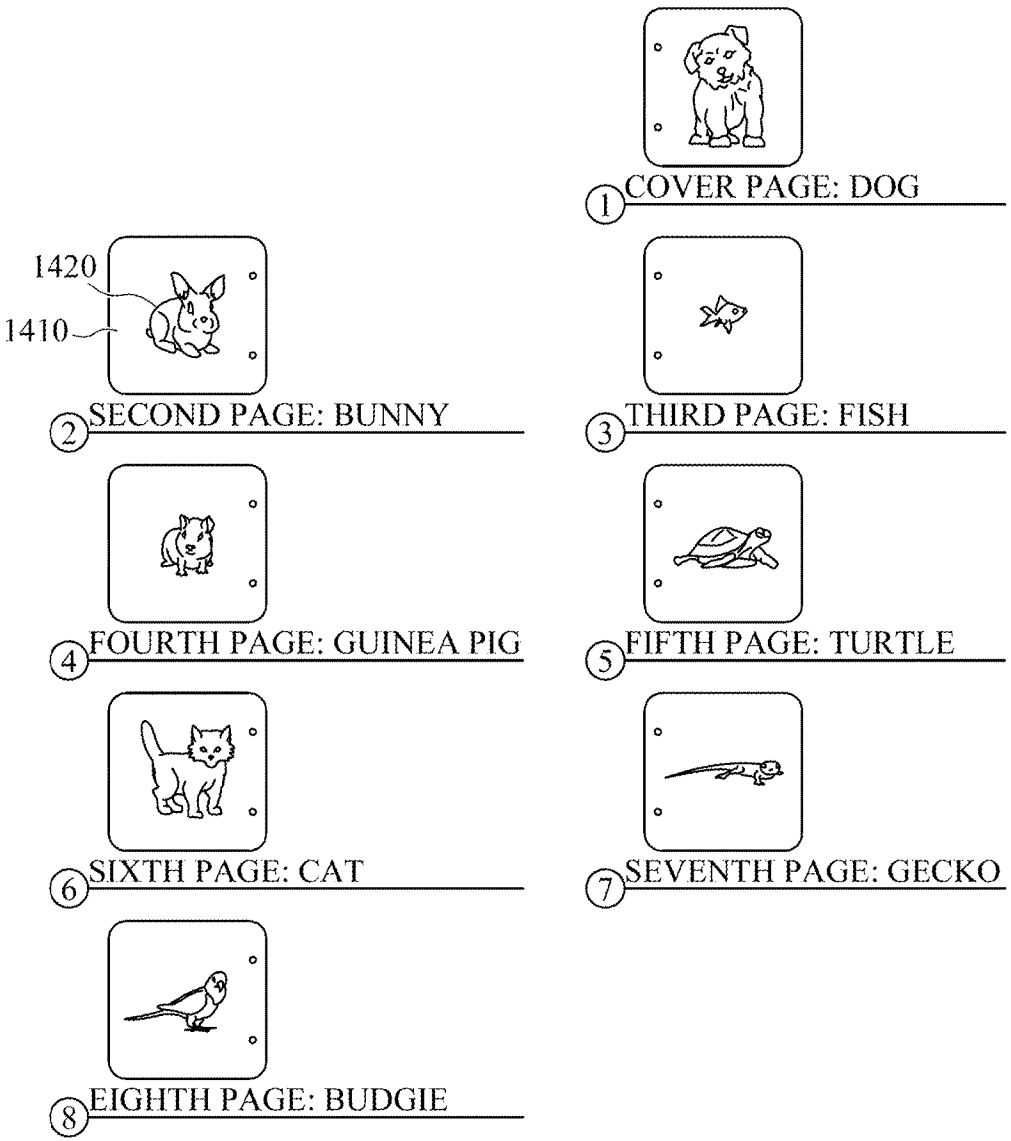
FIG. 14E illustrates a perspective view of components of a Level 2 Montessori toy, according to some embodiments of the present invention.
Figure 15C:
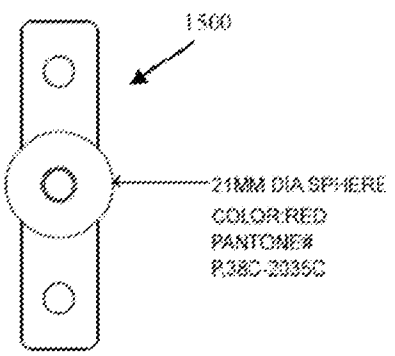
FIGS. 15C and 15E illustrate top views of a Level 2 Montessori toy, according to some embodiments of the present invention.
Figure 15E:
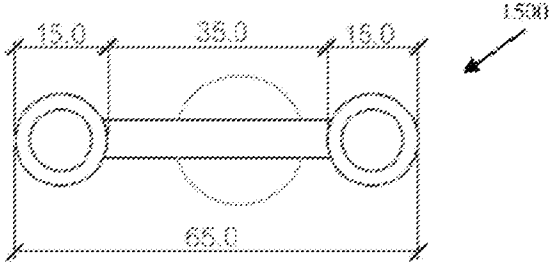
Figure 15B:
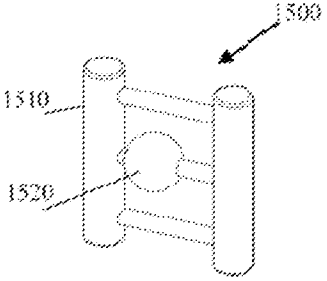
FIGS. 15A-15B illustrate perspective views of a Level 2 Montessori toy, according to some embodiments of the present invention.
Figure 15A:
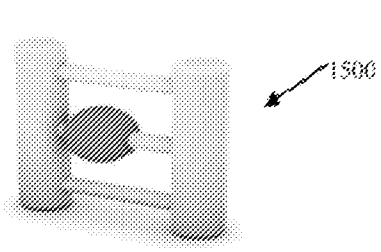
Figure 15D:
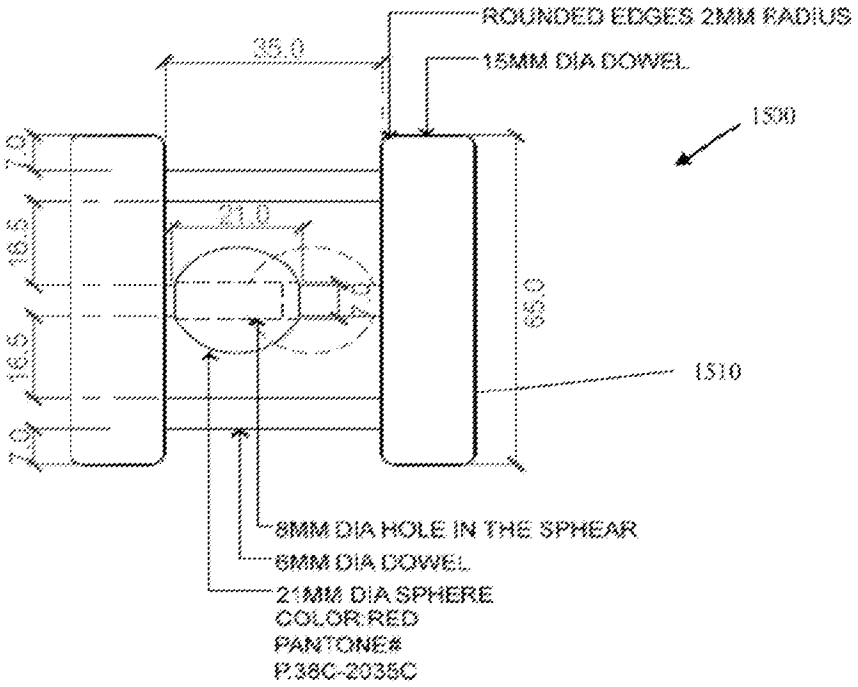
FIG. 15D illustrates a side view of a Level 2 Montessori toy, according to some embodiments of the present invention.
Figure 16A:
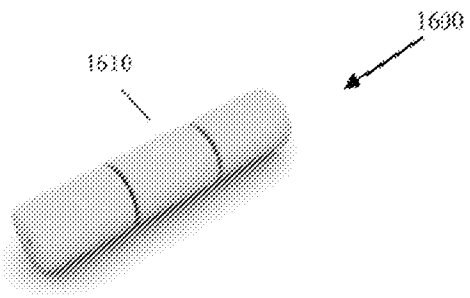
FIGS. 16A and 16B illustrate perspective views of a Level 2 Montessori toy, according to some embodiments of the present invention.
Figure 16C:
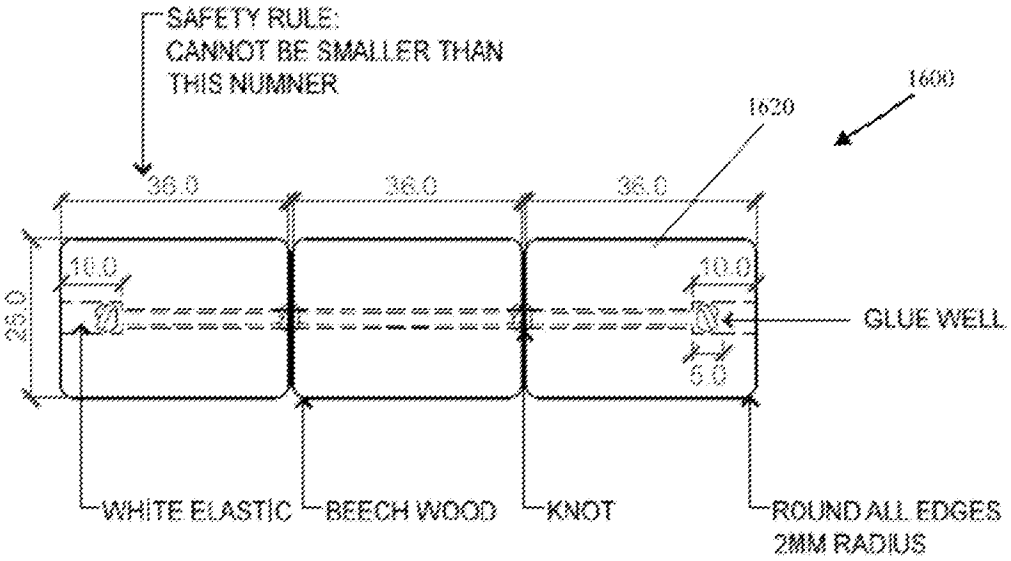
FIG. 16C illustrates a side view of a Level 2 Montessori toy, according to some embodiments of the present invention.
Figure 16D:
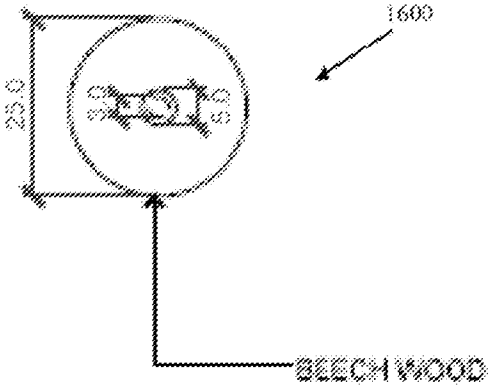
FIG. 16D illustrates an end view of a Level 2 Montessori toy, according to some embodiments of the present invention
Figure 16B:
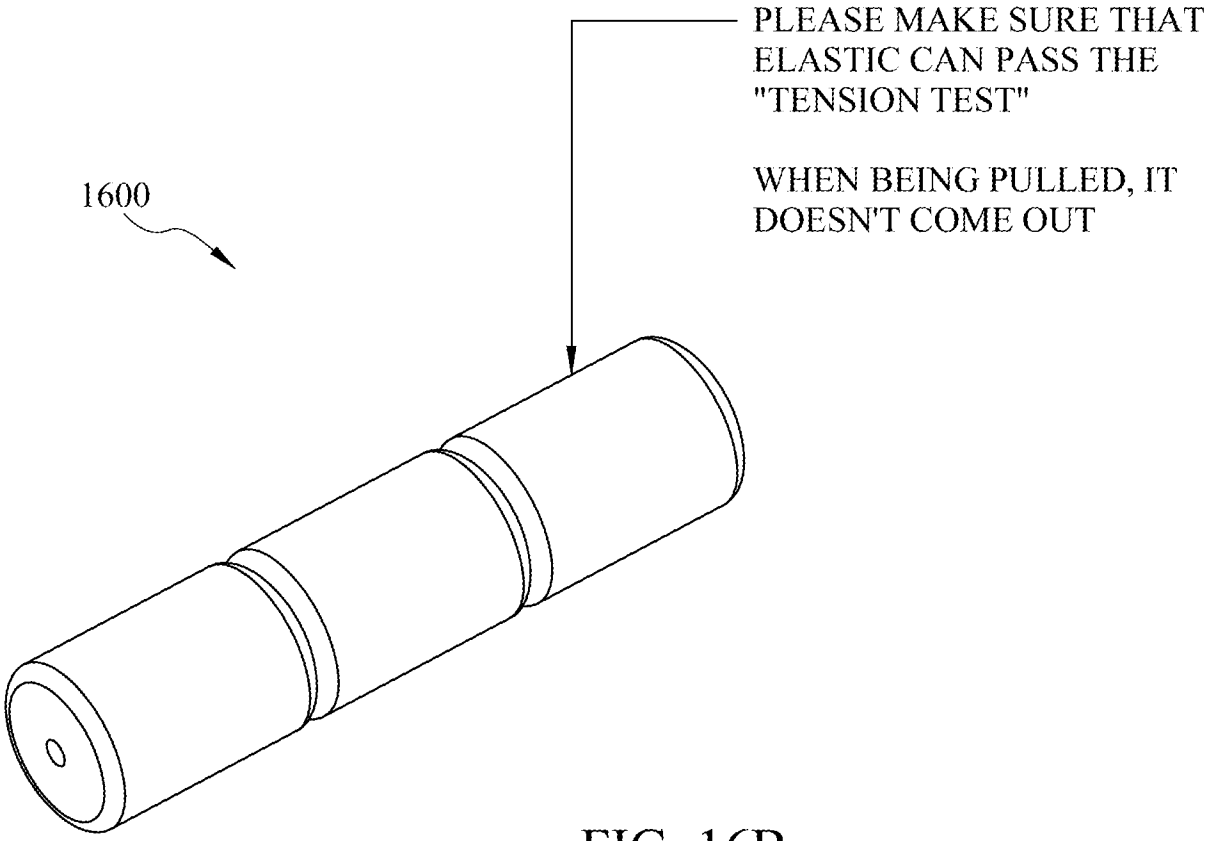

FIGS. 14A-14E illustrate various views of a Level 2 Montessori toy called the Wooden Book 1400, according to exemplary embodiments of the present invention. In some embodiments, the Wooden Book 1400 may include photos 1420 that would have the most educational value for babies, such as full body photos of pet animals, on the pages 1410. In some embodiments, the photos 1420 may include pictures, such as photos of animals as illustrated in FIG. 14E, which are categorized to help children learn and remember vocabulary and objects. In some embodiments, the photos 1400 may include pictures that are proportional to each other such that children can see how large the animals are in relation to one another. In some embodiments, the dimensions of the Wooden Block 1400 may be as described in exemplary embodiment illustrated in FIGS. 14B-14D.

FIGS. 15A-15E illustrate various views of a Level 2 Montessori toy called the Square Rattle 1500, according to exemplary embodiments of the present invention. In some embodiments, the Square Rattle 1500 does not have any side beads and the dowels 1510 are thin. In some embodiments, the Square Rattle 1500 may include a dowel 1510 and a bead 1520. In some embodiments, the bead 1520 may be red in color. In some embodiments, the bead 1520 may be of a different color or a combination of colors. In some embodiments, the dimensions of the Square Rattle 1500 may be as described in exemplary embodiment illustrated in FIGS. 15C-15E.

FIGS. 16A-16D illustrate various views of a Level 2 Montessori toy called the Grasping Cylinder 1600, according to exemplary embodiments of the present invention. The AMI teacher's training manual, for children between the age of 0-3 years, has a toy called Grasping Beads. However, the Grasping Beads failed the safety tests especially because the strings were susceptible to breaking thereby exposing the unsecured beads to children between the age of 0-3 years. However, even after strengthening the string and ensuring that it stays intact, a child aged 0-3 years can swallow one of the beads of the string and choke. The primary purpose of the Grasping Bead is to provide the children with a grasping challenge because the child has to work to maintain his grasp of the beads as the string moves in his hands. In some embodiments, the Grasping Cylinder 1600 meets the objective of increasing the children's grasping motor skills and increasing their grip strength by using cylinders 1610 instead of beads that do not violate the "small ball" safety rule, which essentially discourages using balls of small sizes that the children aged 0-3 years old can swallow. In some embodiments, each cylinder 1610 may be large enough that even if the string 1620 broke, the cylinder 1610 would still not pose a choking hazard because of its size thereby avoiding the "small parts" violation. In some embodiments, the size of the Grasping Cylinder 1600 may be as described in FIGS. 16B-16D. In some embodiments, the knots of the string 1620 may be glued to make sure that the cylinders 1610 do not detach.

Figure 17B:
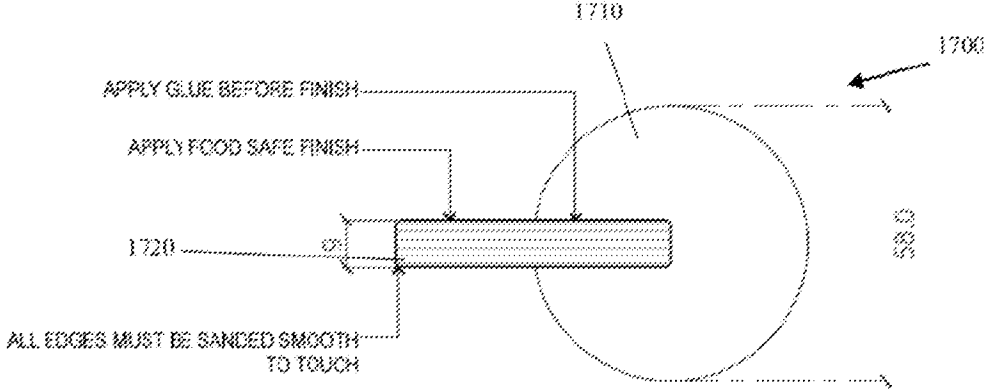
FIGS. 17B and 17C illustrate side views of a Level 2 Montessori toy, according to some embodiments of the present invention.
Figure 17C:
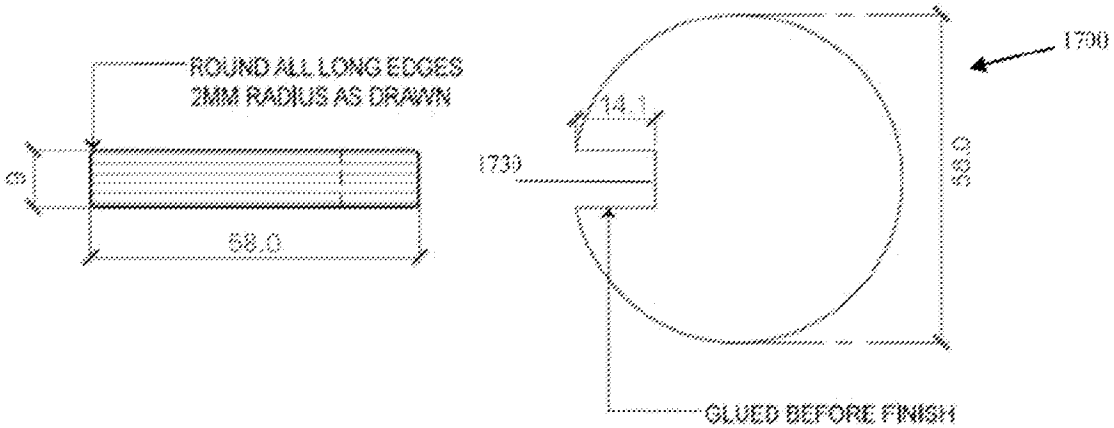
Figure 17A:
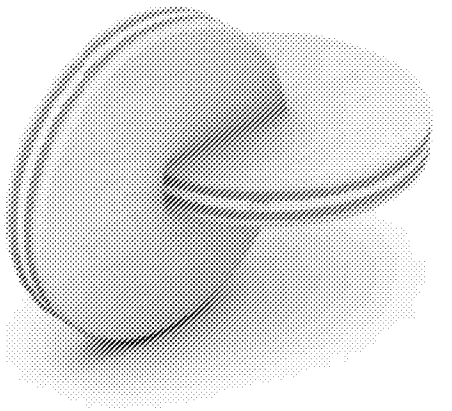
FIG. 17A illustrates a perspective view of a Level 2 Montessori toy, according to some embodiments of the present invention.
Figure 18A:
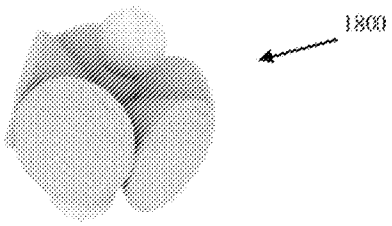
FIGS. 18A-18C illustrate perspective views of a Level 2 Montessori toy, according to some embodiments of the present invention.
Figure 18B:
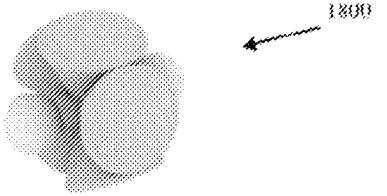
Figure 18C:
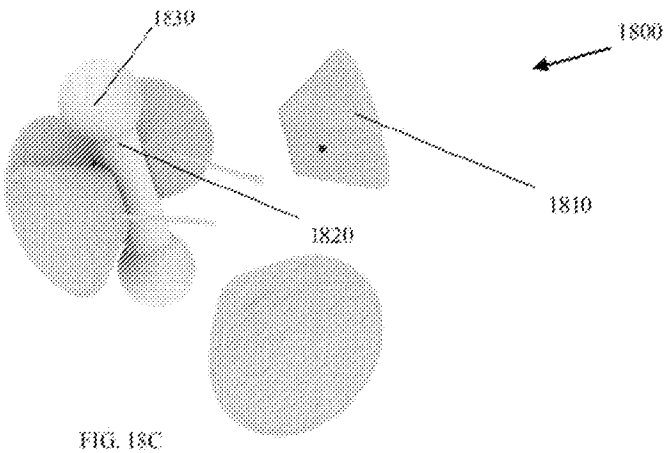
Figure 18D:
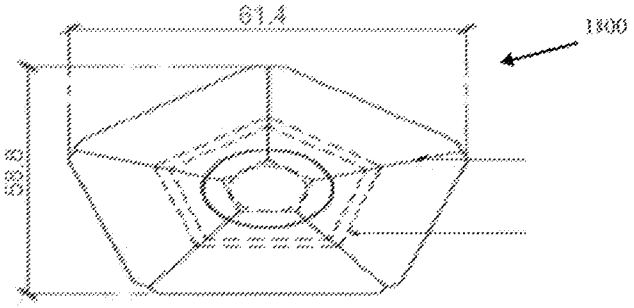
FIG. 18D illustrates a top view of a Level 2 Montessori toy, according to some embodiments of the present invention.
Figure 18E:
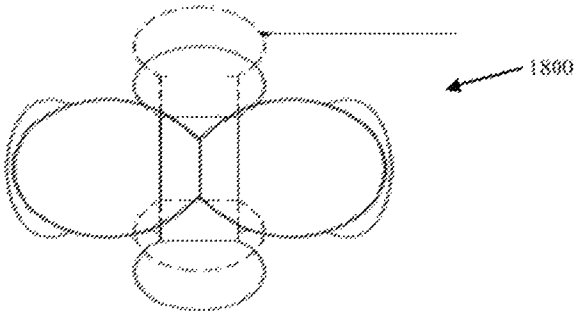
FIG. 18E illustrates a side view of a Level 2 Montessori toy, according to some embodiments of the present invention.
Figure 18I:
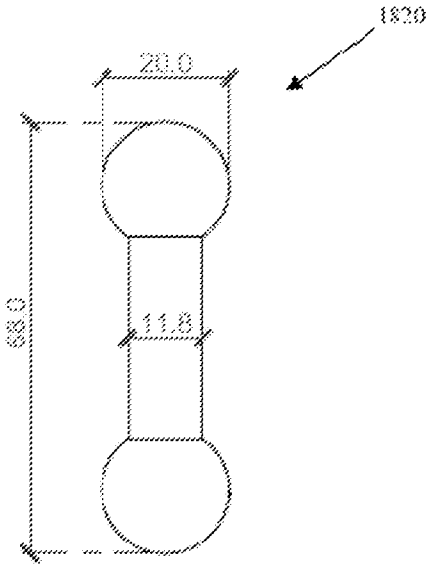
FIGS. 18F, 18G, and 18I illustrate side views of a component of a Level 2 Montessori toy, according to some embodiments of the present invention.
Figure 18F:
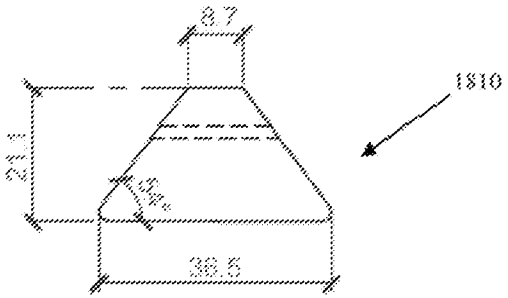
Figure 18G:
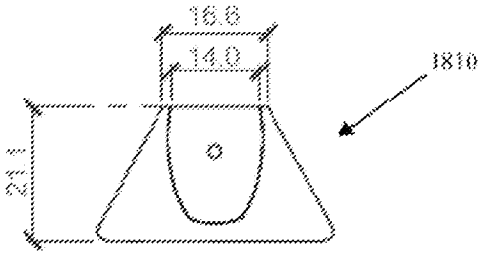
Figure 18H:
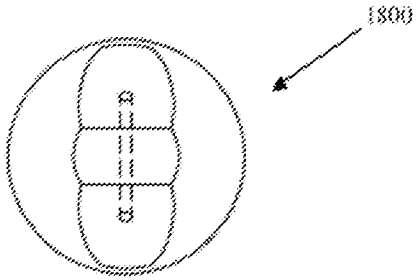
FIG. 18H illustrates a top view of a component of a Level 2 Montessori toy, according to some embodiments of the present invention.
Figure 19C:
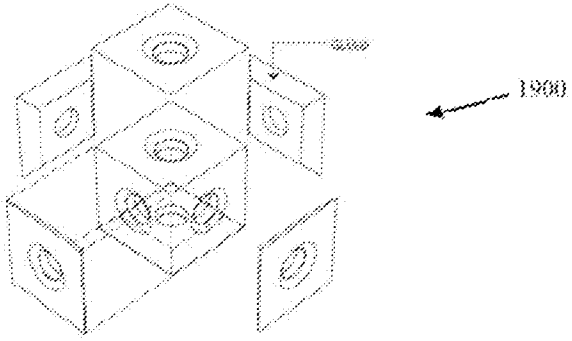
FIG. 19C illustrates a side view of a Level 2 Montessori toy, according to some embodiments of the present invention.
Figure 19D:
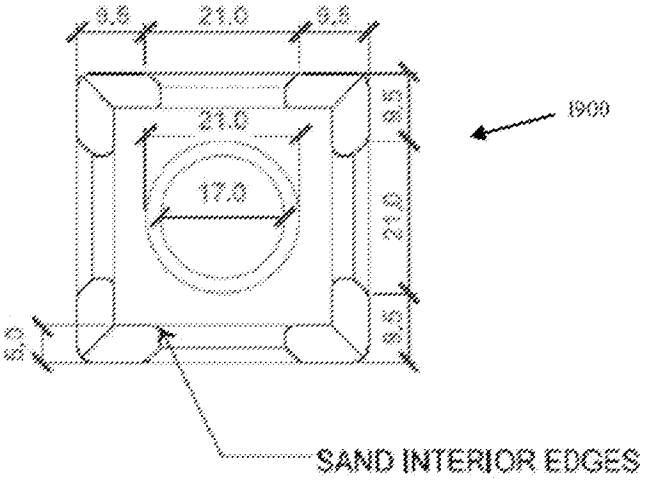
FIG. 19D illustrates a top view of a Level 2 Montessori toy, according to some embodiments of the present invention.
Figure 19A:
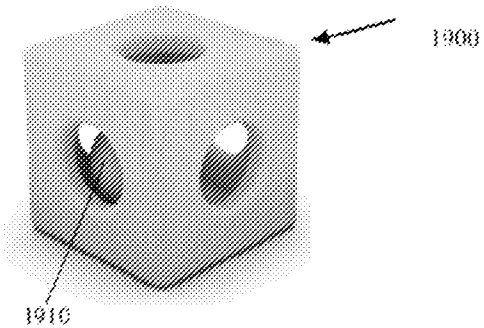
FIGS. 19A and 19B illustrate perspective views of a Level 2 Montessori toy, according to some embodiments of the present invention.
Figure 19B:
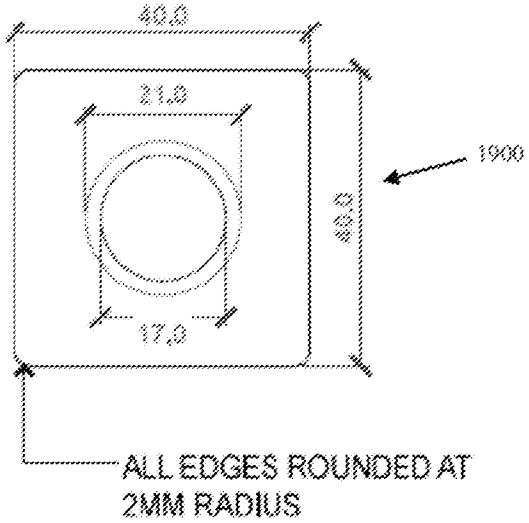

FIGS. 17A-17C illustrate various views of a Level 2 Montessori toy called the Interlocking Disc 1700, according to exemplary embodiments of the present invention. The AMI teacher's training manual, for children between the age of 0-3 years, has this toy in solid wood. However, solid wood Interlocking Discs failed the safety test. In some embodiments, the Interlocking Disc 1700 may include two discs 1710 and 1720 and a slit 1730. After multiple experimentations, the discs 1710 and 1720 were resized and the wood was switched to plywood. Subsequently, the interlocking Discs 1700 passed the safety test. In some embodiments, the dimensions of the Interlocking Discs 1700 may be as described in exemplary embodiment illustrated in FIGS. 17B-17C.

FIGS. 18A-18I illustrate various views of a Level 2 Montessori toy called the Pentagon with Spheres 1800, according to exemplary embodiments of the present invention. The AMI teacher's training manual, for children between the age of 0-3 years, has a toy called "sphere with balls." However, due to manufacturability and safety test issues, a similar toy is unfeasible. The sphere with balls had small balls attached on with string. This is a safety concern as the knots could untie leaving the child exposed to a hazardous small ball. The Pentagon with Spheres 1800 may have multiple sections 1810 that may form a general pentagonal shape. The sections 1810 may surround a central beam 1820. The section 1810 may be fixed together using any fastening means. For example, in some embodiments, the section 1810 may have holes running through them that facilitate in a rubber band passing through them to hold them in place around the central beam 1820. The central beam 1820 may have spheres 1830 on or both ends. The sections 1810 may have holes in them to facilitate stringing. The section 1810 may spin around the central beam 1820. In some embodiments, the dimensions of the Pentagon with Spheres 1800 may be as described in exemplary embodiments illustrated in FIGS. 18D-18I.

FIGS. 19A-19D illustrate various views of a Level 2 Montessori toy called the Cube Rattle 1900, according to exemplary embodiments of the present invention. The AMI teacher's training manual, for children between the age of 0-3 years, has a similar toy. However, the toy has a bell inside it. In some embodiments, Cube Rattle 1900 has a wooden ball 1910 inside it. In some embodiments, the ball 1910 may be made of any other safety test compliant material. Previous design iterations of the final design failed the drop test. In some embodiments, the ball 1910 may have dimensions as described in exemplary embodiment illustrated in FIG. 19C. In some embodiments, the dimensions of the Cube Rattle 1900 may be as described in exemplary embodiment illustrated in FIG. 19D. In some embodiment, the interior edges of the Cube Rattle 1900 may be sanded.

Figure 20:
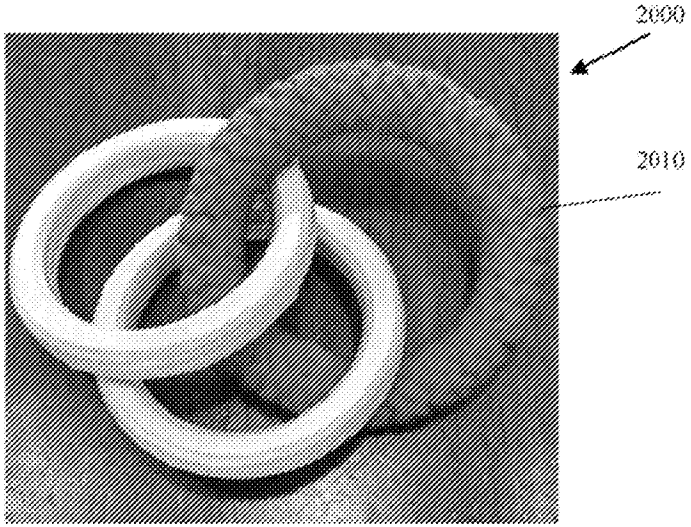
FIG. 20 illustrates a perspective view of a Level 2 Montessori toy, according to some embodiments of the present invention.
Figure 21C:
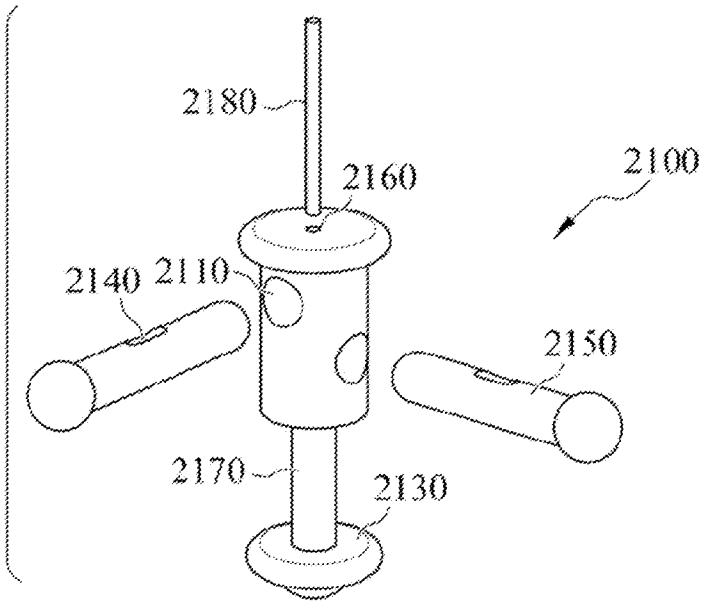
FIGS. 21A-21D illustrate perspective views of a Level 2 Montessori toy, according to some embodiments of the present invention.
Figure 21D:
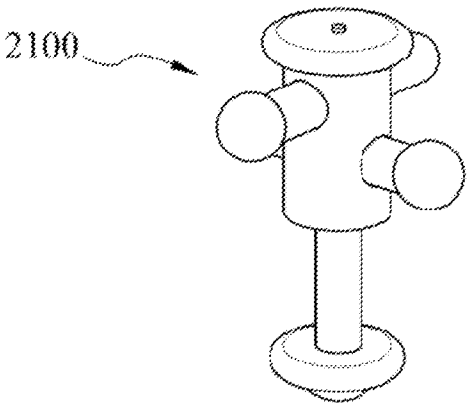
Figure 21B:
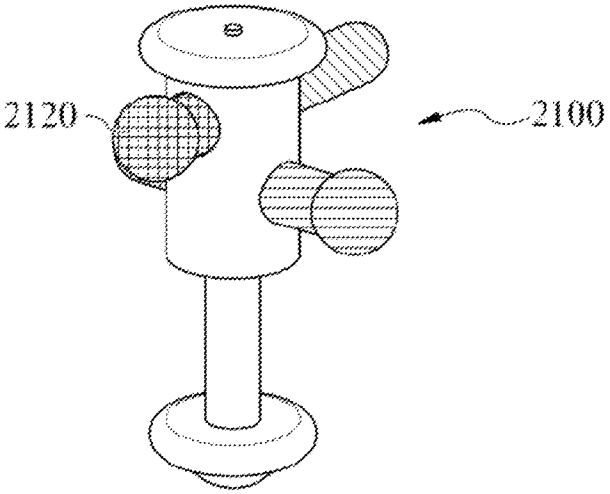
Figure 21A:
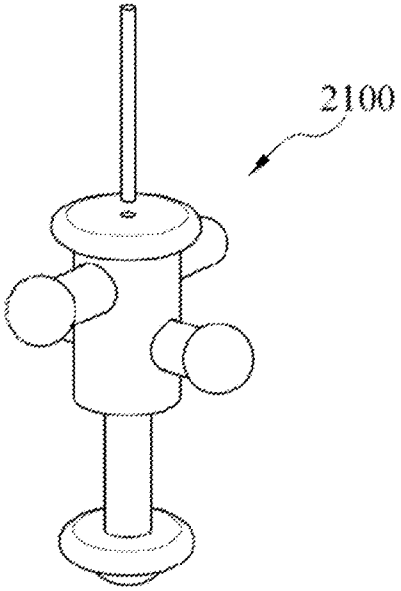

FIG. 20 illustrate various views of a Level 2 Montessori toy called the Interlocking Rings 2000, according to exemplary embodiments of the present invention. The AMI teacher's training manual, for children between the ages of 0-3 years, has a similar toy that consists of small, metal interlocking rings. In some embodiments, the Interlocking Rings 2000 may be made using plywood. The first iteration of the final design failed because Interlocking Rings 2000 was made out of solid wood. The second iteration was made out of plywood, which also failed the safety tests because all three rings were plywood and the third connector ring had to be cut open and then glued together in order to thread through the other rings. The second iteration kept breaking during the drop test. In the next iteration, the third connector ring 2010 was changed to fabric stuffed with poly-fil polyester. Even that iteration failed the safety test because the fabric ripped open during the tension test and resulted in a "small part." In some embodiments, the third connector ring 2010 may be crochet or some other material that passes the safety test. In some embodiments, the connector ring 2010 may have a diameter of 7 cm. In some embodiments, the connector ring 2010 may be of any color or combination of colors, such as red, cream, or blue. Additionally, the two different textures on the Interlocking Rings 2000 serve the purpose of stimulating the children's tactile and auditory senses.

FIGS. 21A-21G illustrate various views of a Level 2 Montessori toy called the Dolio 2100, according to exemplary embodiments of the present invention. The AMI teacher's training manual, for children between the age of 0-3 years, depicts a Dolio with a completely different design. For example, the suggested size in the manual violates the safety rules, the small balls are tied on with string that can break, and the children could come into contact with hazardous "small balls." Other examples of currently available Dolios include one made by a German manufacturer that is very big and unsuitable for the hands of a child aged 0-3 year. Such a Dolio would not provide any educational and/or developmental benefit. After multiple redesigns, the current Dolio 2100 design that is functional, light enough, fits well into a baby's hand, and is safe, was developed. In some embodiments, the Dolio 2100 may have balls 2120 at the end of the dowels 2150. The dowels 2150 may have slits 2140 that allow them to slide through holes 2110 on the front surface of the central rod 2170 that is attached to the base 2130 The slits 2140 may align with the central hole 2160 on the top surface of the central rod 2170. The central insert 2180 may be inserted into the central hole 2160 to limit the dowel's 2150 sliding. In some embodiments, the lengths of the dowels 2150 may be specified so as not to pass through "the rattle test fixture and supplemental test fixture." In some embodiments, the dimensions of the Dolio 2100 and its various components may be as described in exemplary embodiments illustrated in FIGS. 21E-211. The spheres 2120 may be a part of the dowel 2150 itself such that the spheres 2120 may be carved from the same piece of wood as the dowel 2150 itself. Such an arrangement would prevent the spheres 2120 from being detached from the dowel 2150 itself and pose any choking hazard. The Dolio 2200 may weigh around 66-68 grams. However, in other embodiments, it may weigh less or more than 66-68 grams. In some embodiments, the spheres 2120 may be of the same color as the rest of the Dolio 2200 and/or each other. In other embodiments, the spheres 2120 may be of a different color than the rest of the Dolio 2200 and/or each other.

Figure 22B:
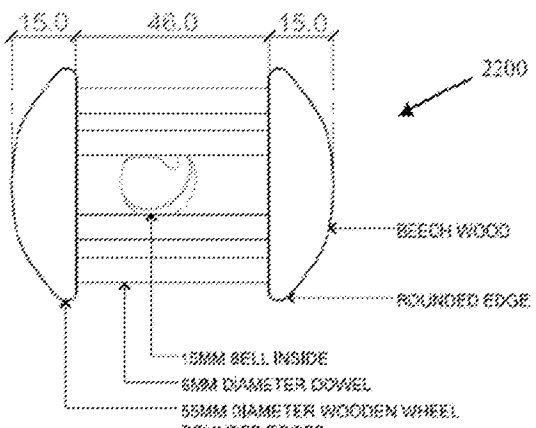
FIG. 22B illustrates a side view of a Level 2 Montessori toy, according to some embodiments of the present invention.
Figure 22A:
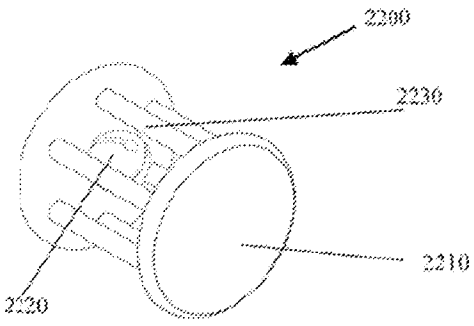
FIG. 22A illustrates a perspective view of a Level 2 Montessori toy, according to some embodiments of the present invention.
Figure 22C:
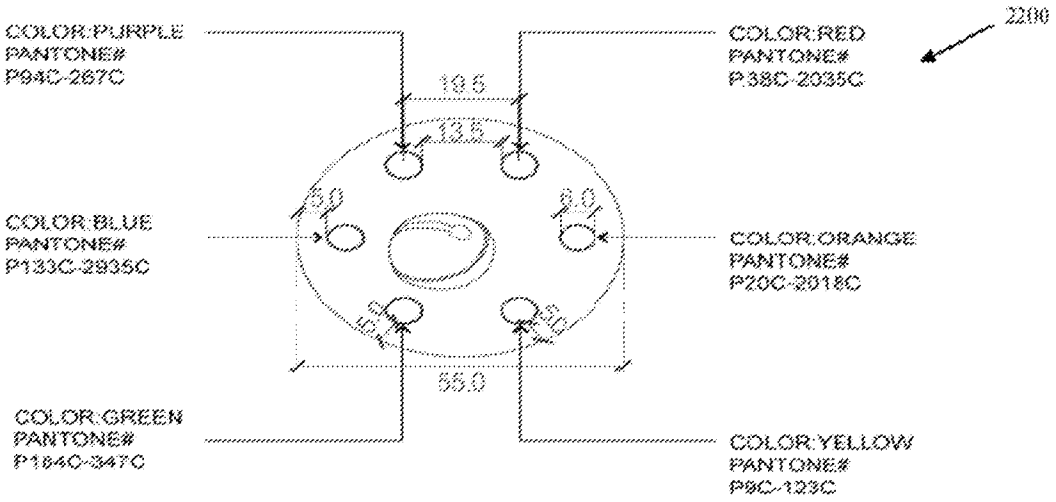
FIG. 22C illustrates an end view of a Level 2 Montessori toy, according to exemplary embodiments of the present invention.
Figure 33A:
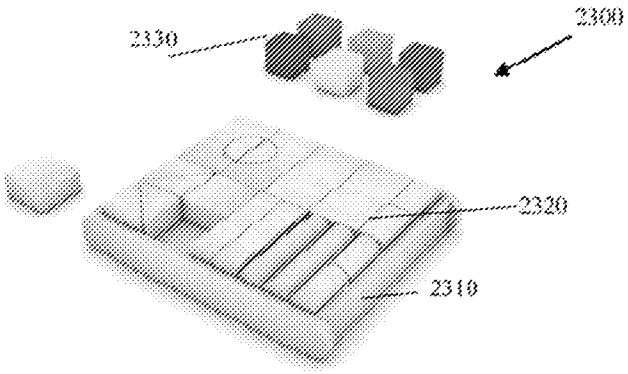
FIG. 33A illustrates a perspective view of a Level 4 Montessori toy, according to exemplary embodiments of the present invention.
Figure 23B:
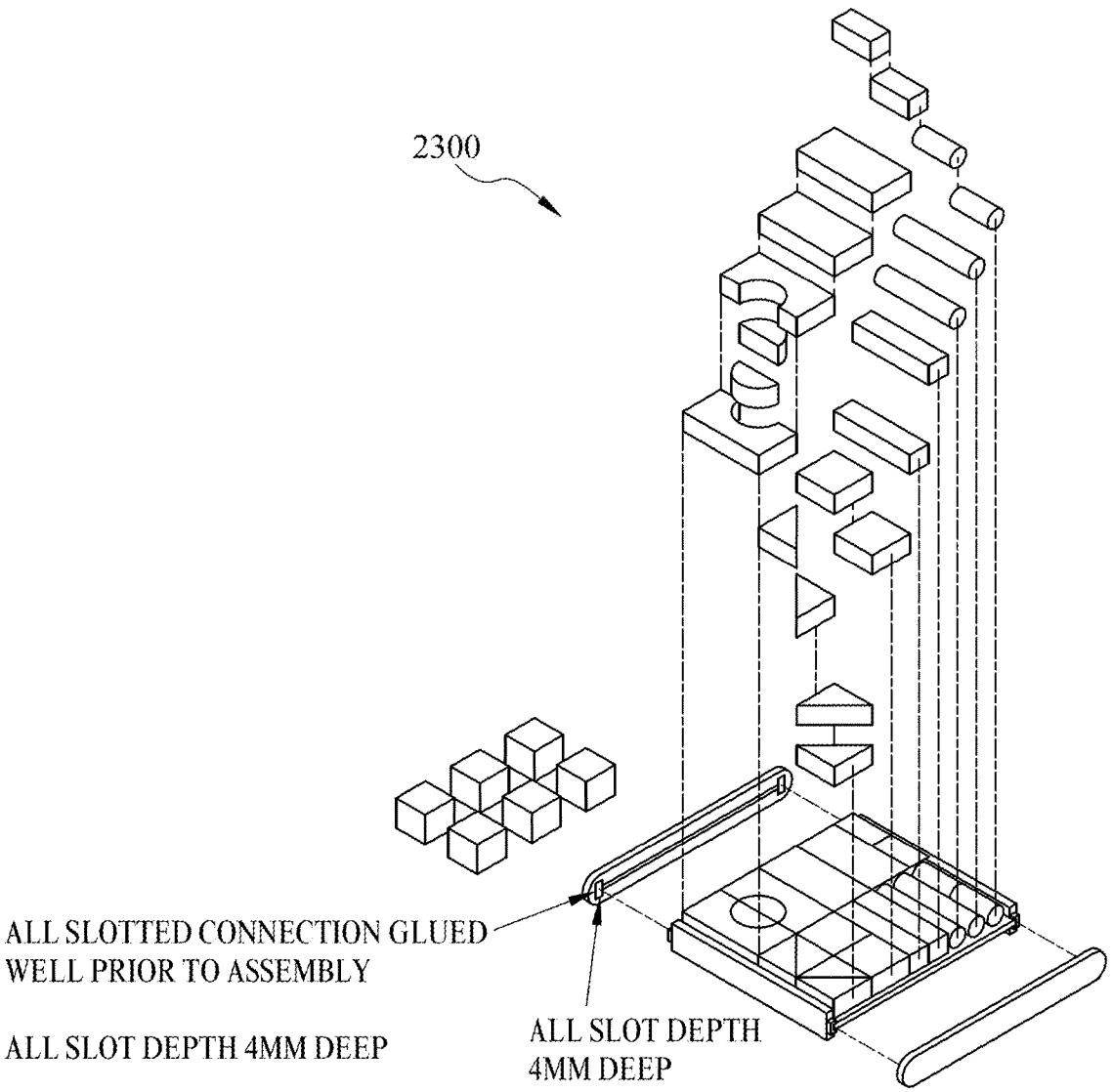
Figure 23C:
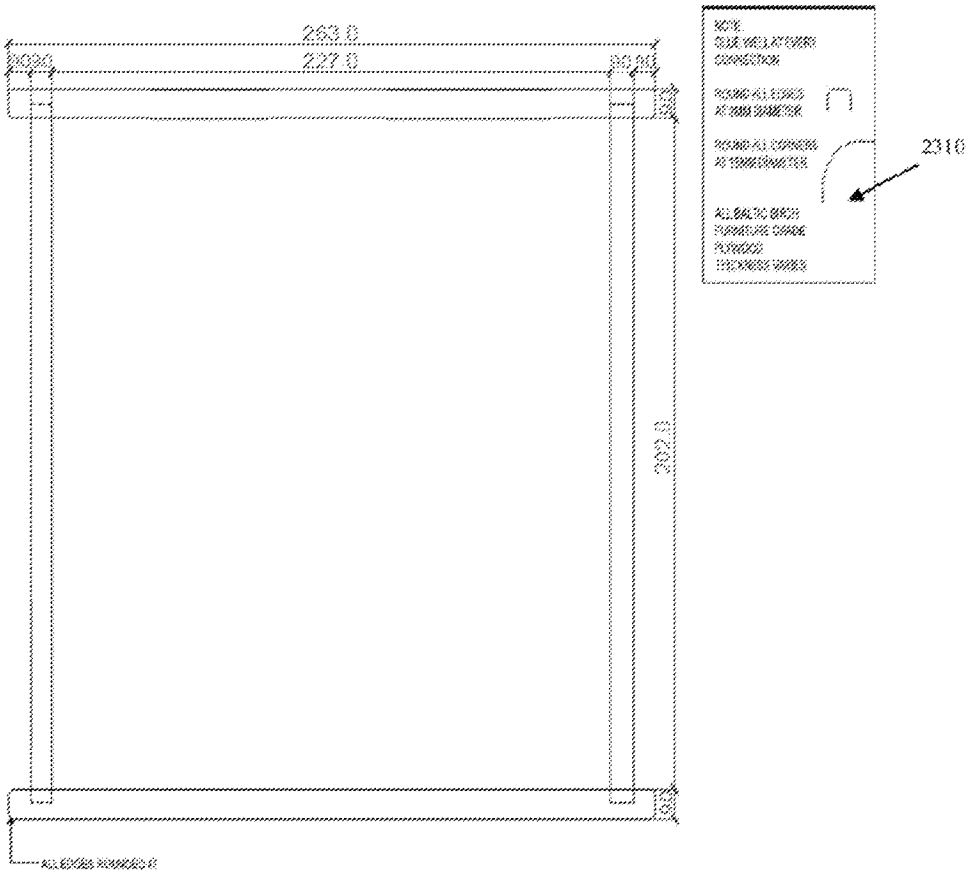
FIGS. 23C, 23E, and 23F illustrate top views of various components of a Level 2 Montessori toy, according to exemplary embodiments of the present invention.
Figure 23D:
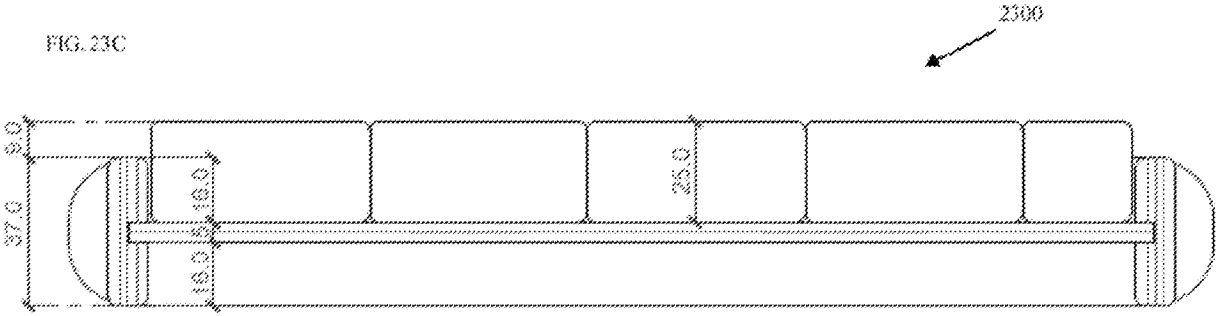
Figure 23E:
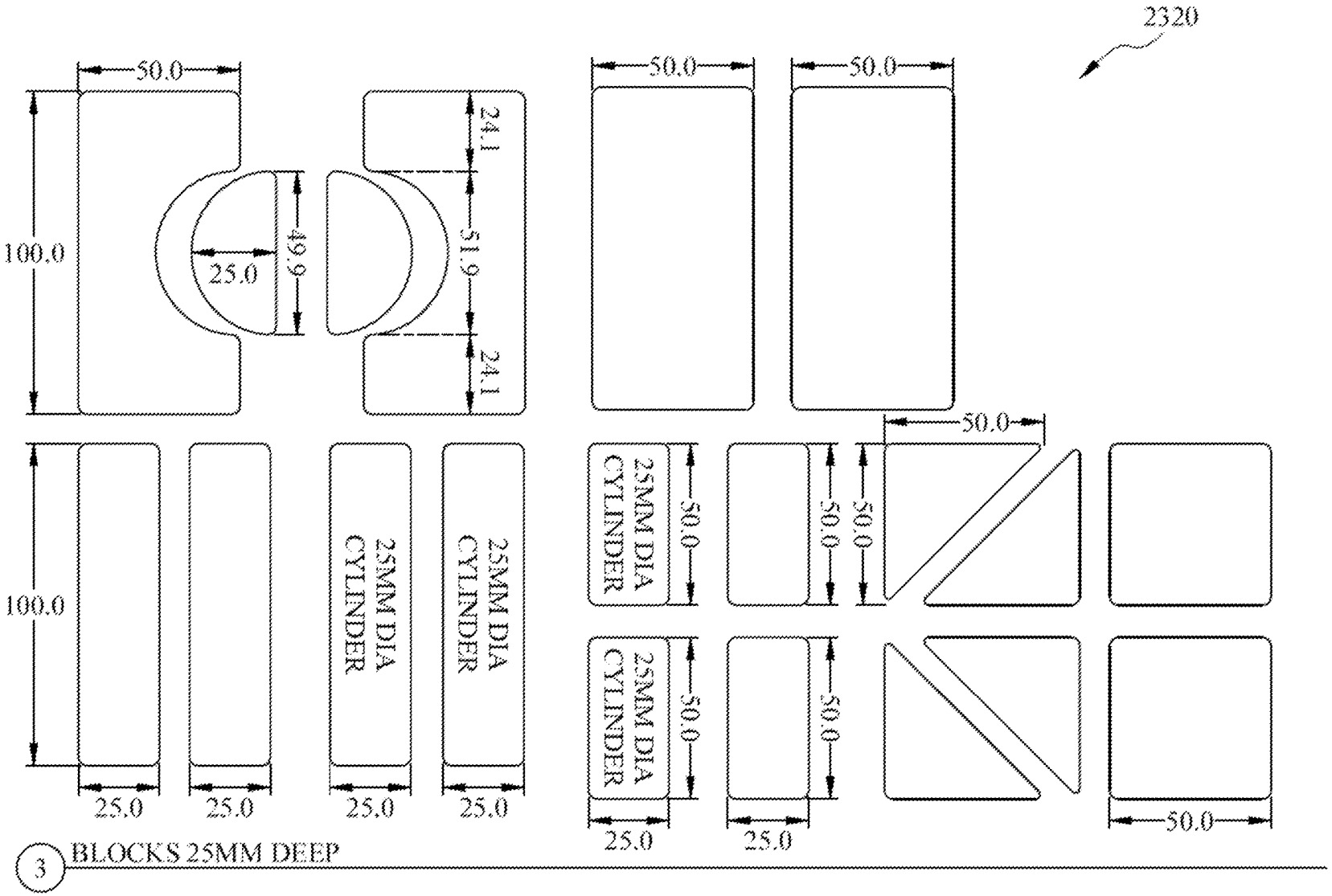
Figure 23F:
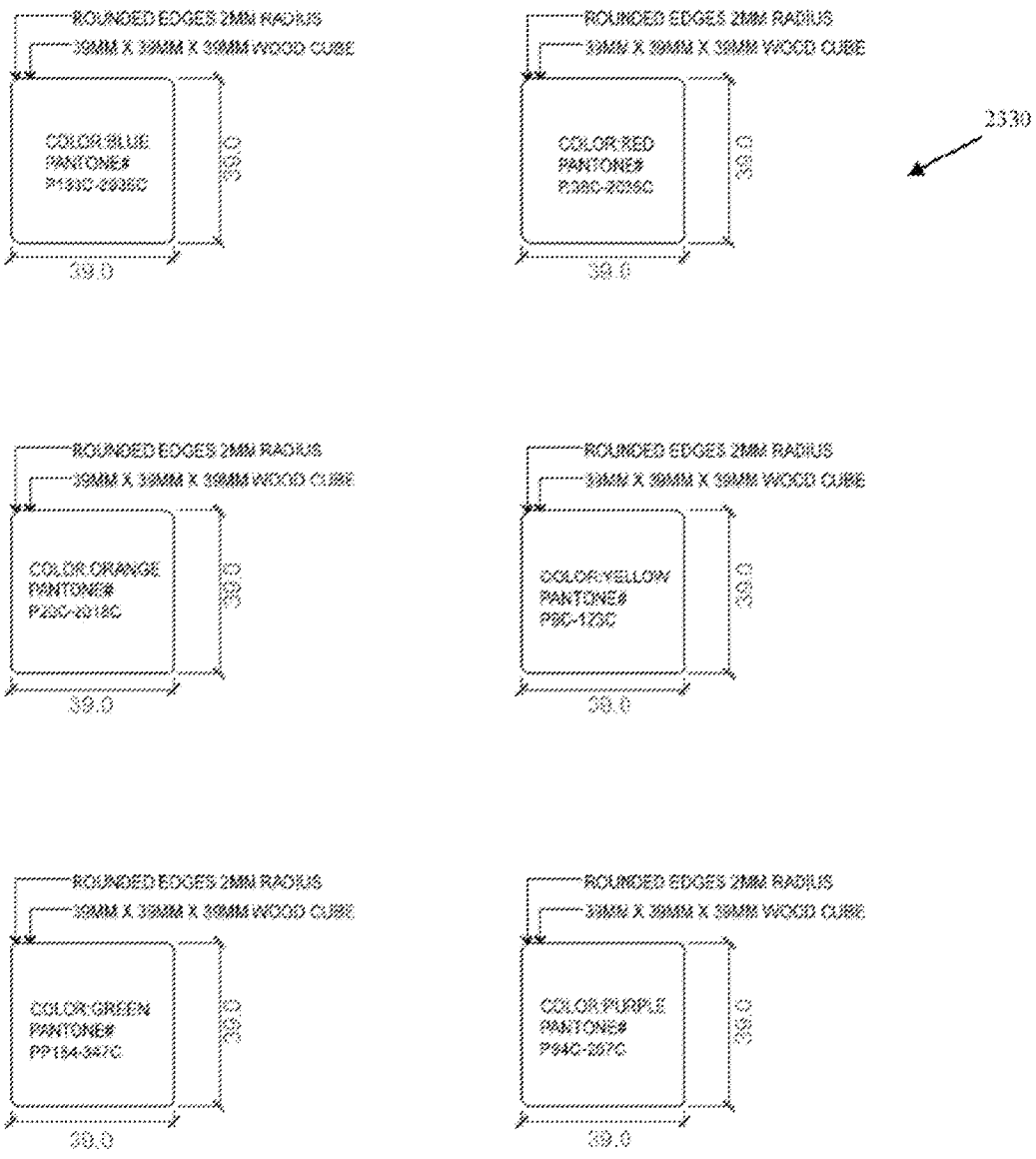
Figure 24A:
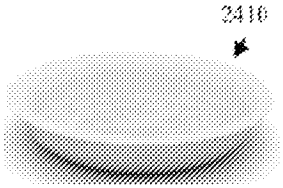
FIG. 24A illustrates a perspective view of a component of a Level 2 Montessori toy, according to exemplary embodiments of the present invention.
Figure 24C:
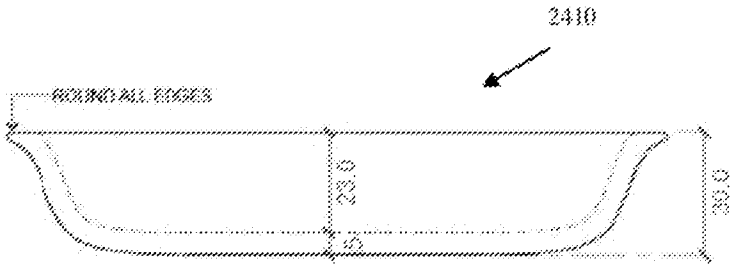
FIG. 24C illustrates a side view of a component of a Level 2 Montessori toy, according to exemplary embodiments of the present invention.
Figure 24D:
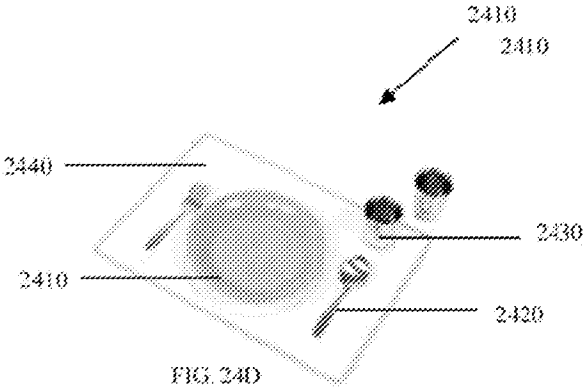
FIG. 24D illustrates a perspective view of a Level 2 Montessori toy, according to exemplary embodiments of the present invention.
Figure 24B:
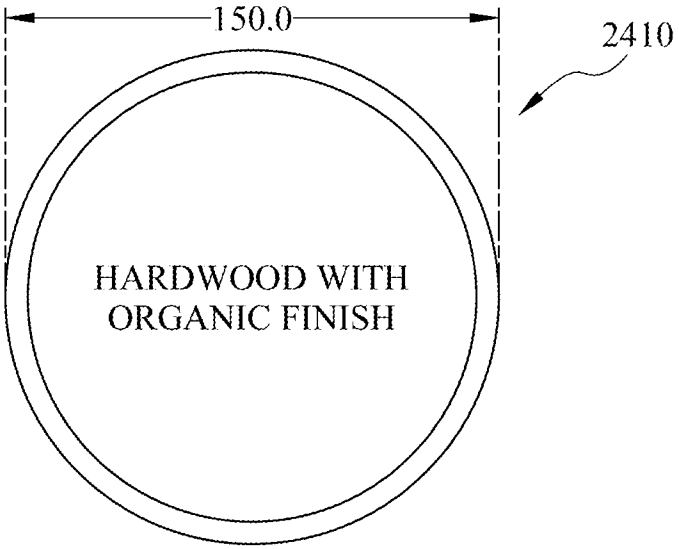
FIG. 24B illustrates a top view of a component of a Level 2 Montessori toy, according to exemplary embodiments of the present invention.
Figure 25B:
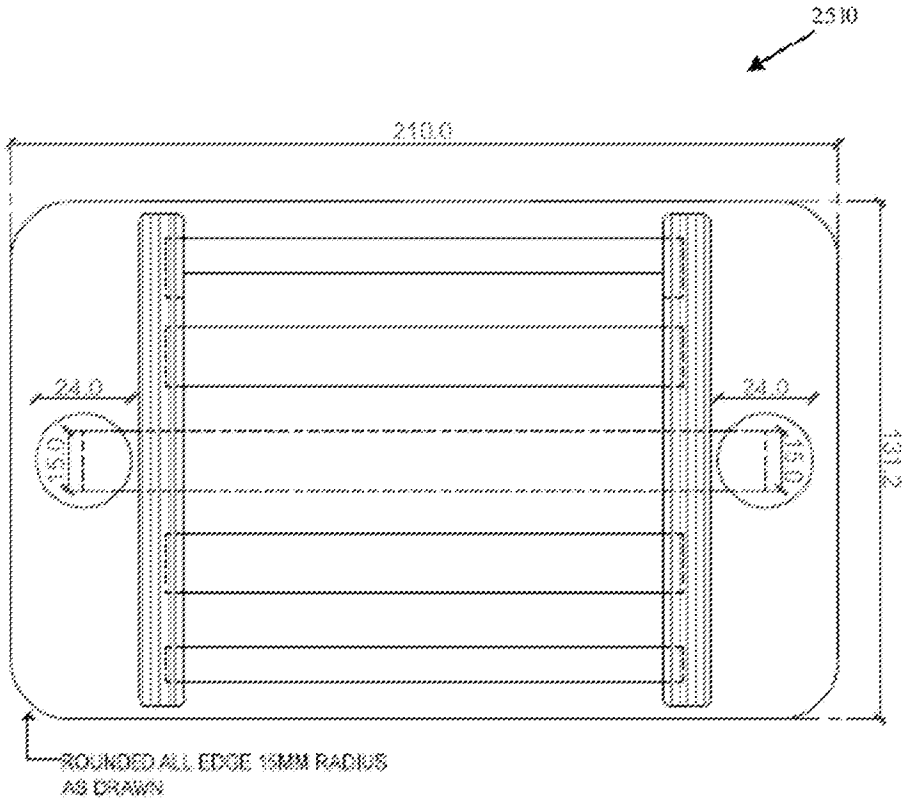
FIG. 25B illustrates a top view of a Level 3 Montessori toy, according to exemplary embodiments of the present invention.
Figure 25A:
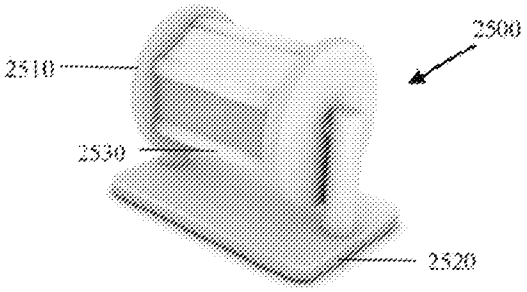
FIGS. 25A and 25D illustrate perspective views of a Level 3 Montessori toy, according to exemplary embodiments of the present invention.
Figure 25D:
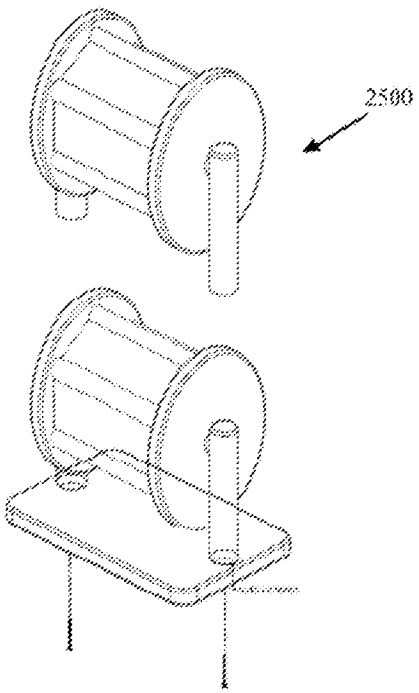
Figure 25C:
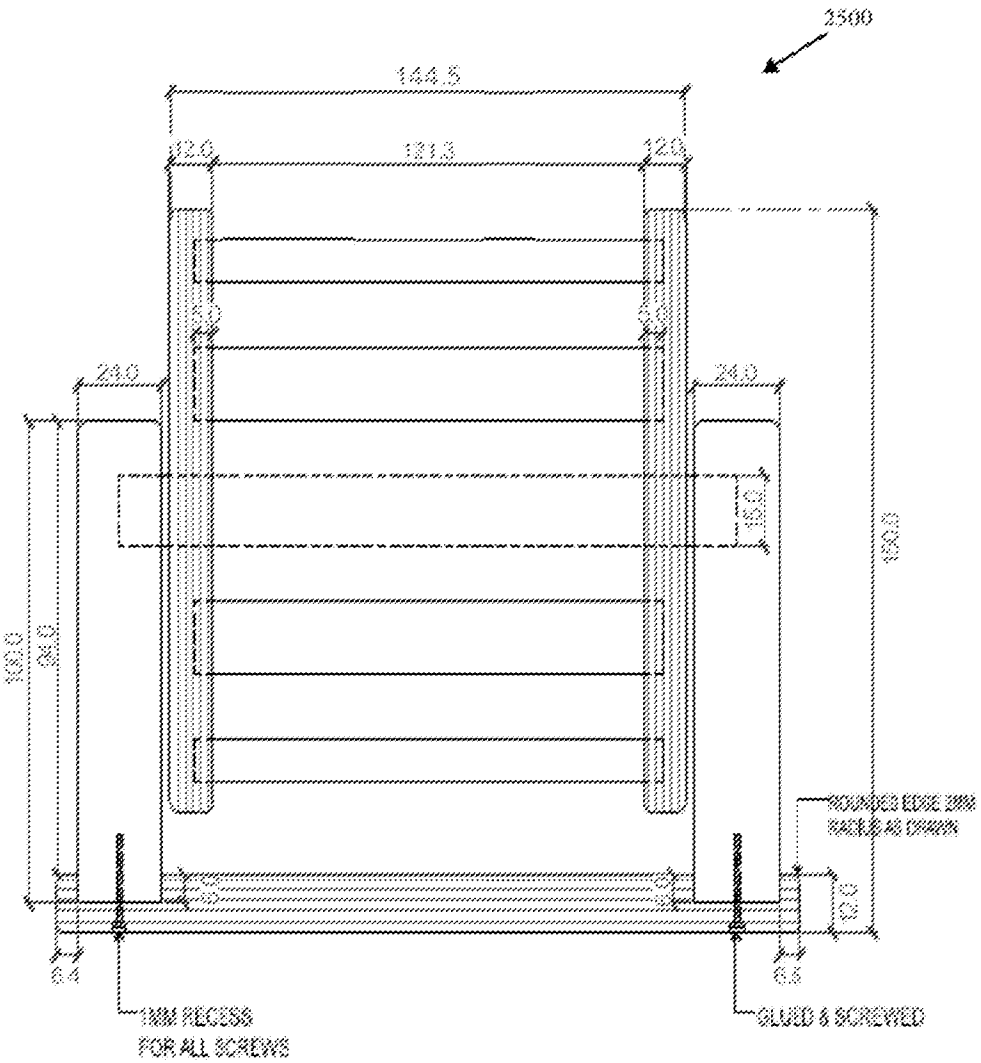
FIG. 25C illustrates a side view of a Level 3 Montessori toy, according to exemplary embodiments of the present invention.
Figure 25F:
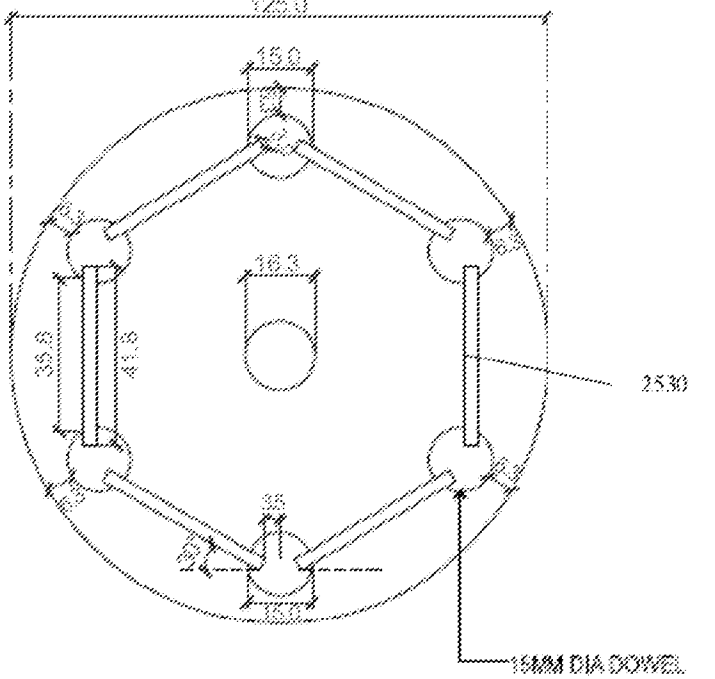
FIGS. 25F and 25G illustrate end views of various components of a Level 3 Montessori toy, according to exemplary embodiments of the present invention.
Figure 25E:
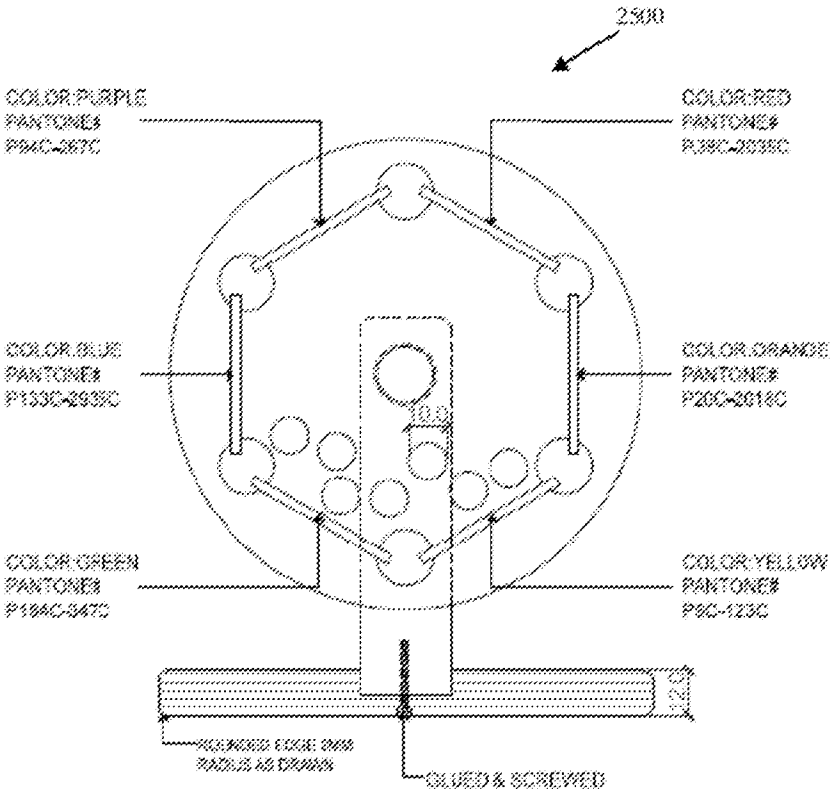
FIG. 25E illustrates an end view of a Level 3 Montessori toy, according to exemplary embodiments of the present invention.
Figure 25G:
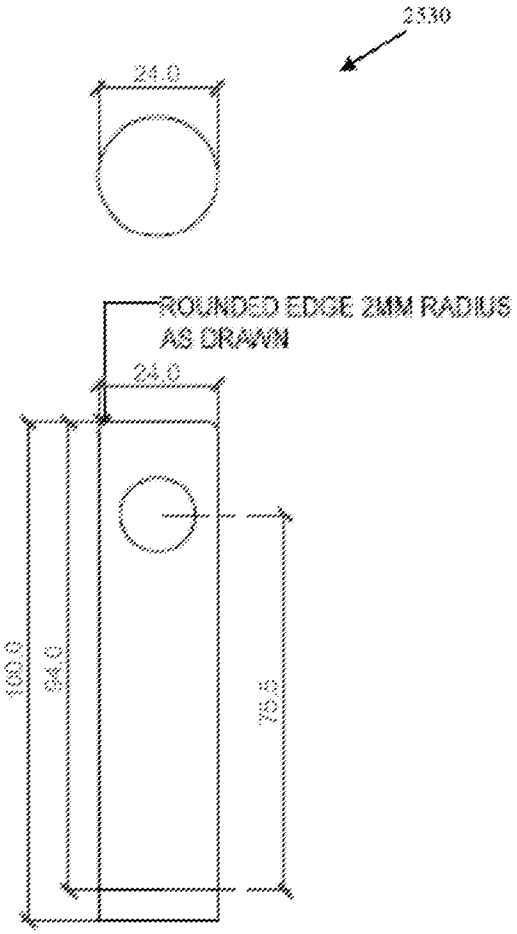
Figure 26A:
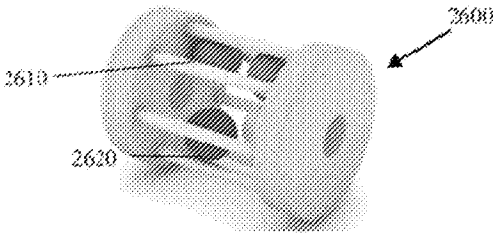
FIG. 26A illustrates a perspective view of a Level 3 Montessori toy, according to exemplary embodiments of the present invention.
Figure 26C:
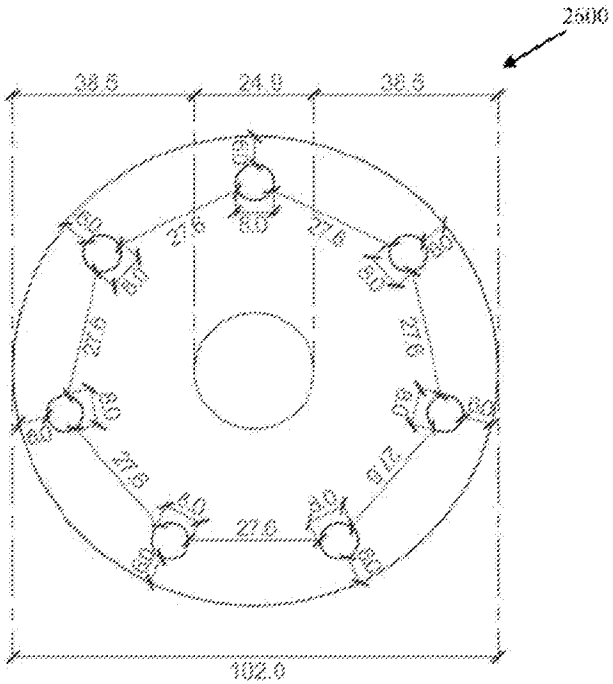
FIGS. 26B and 26C illustrate end views of various components of a Level 3 Montessori toy, according to exemplary embodiments of the present invention.
Figure 26D:
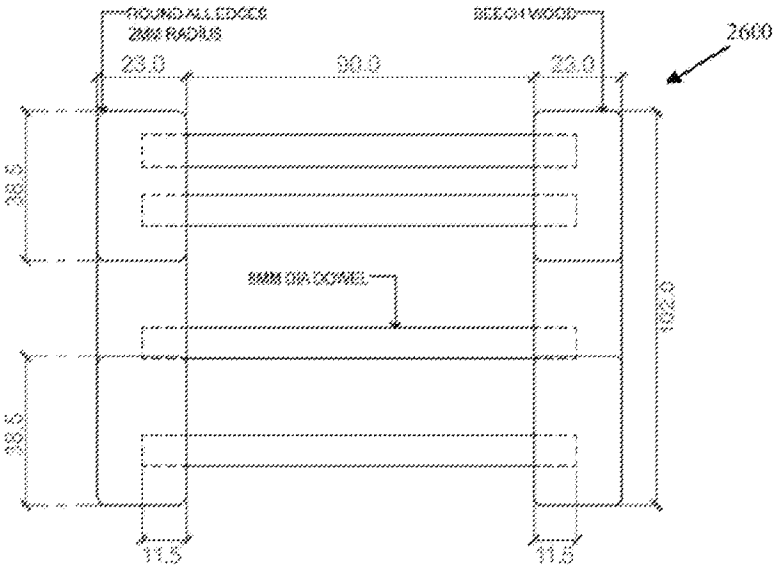
FIG. 26D illustrates a side view of various components of a Level 3 Montessori toy, according to exemplary embodiments of the present invention.
Figure 26B:
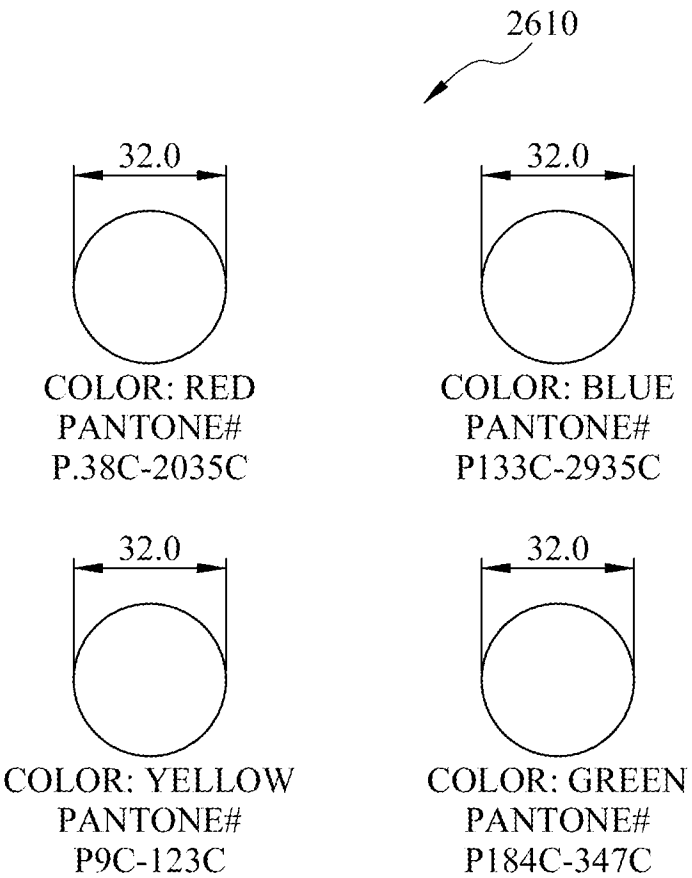
Figure 27A:
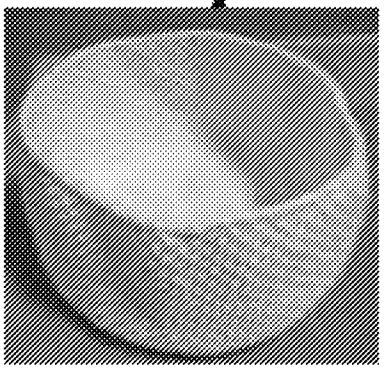
FIGS. 27A-27D illustrate perspective views of various components of a Level 3 Montessori toy, according to exemplary embodiments of the present invention.
Figure 27B:
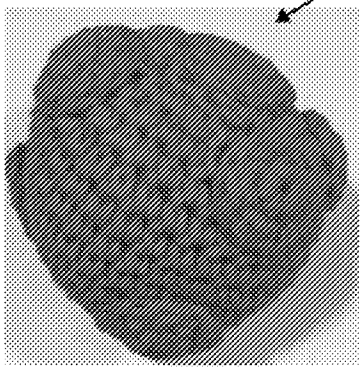
Figure 27C:
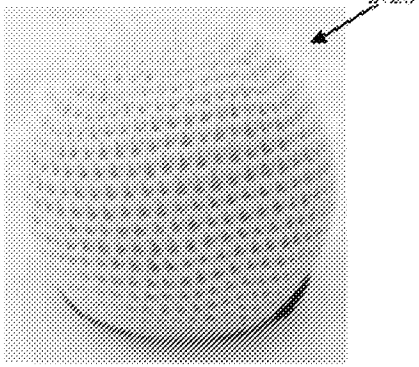
Figure 27D:
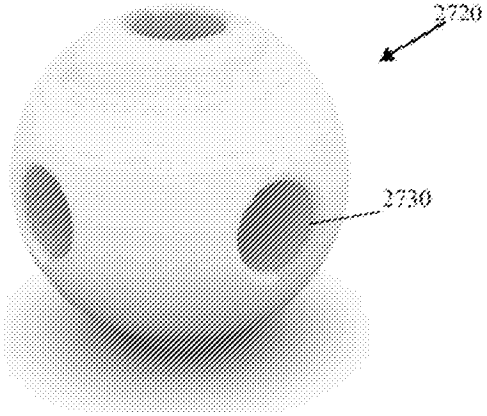
Figure 27E:
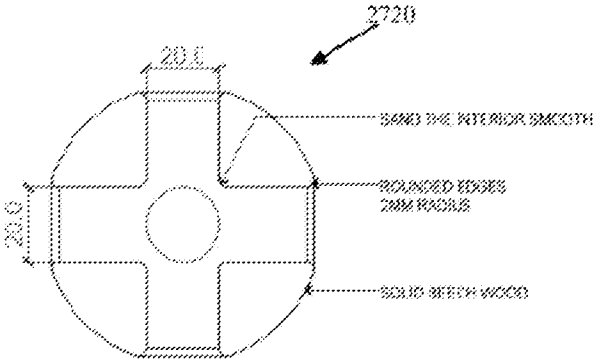
FIG. 27E illustrates a side view of a component of a Level 3 Montessori toy, according to exemplary embodiments of the present invention.
Figure 27F:
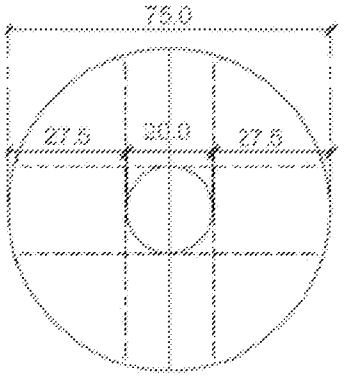
FIG. 27F illustrates a top view of a component of a Level 3 Montessori toy, according to exemplary embodiments of the present invention.
Figure 28B:
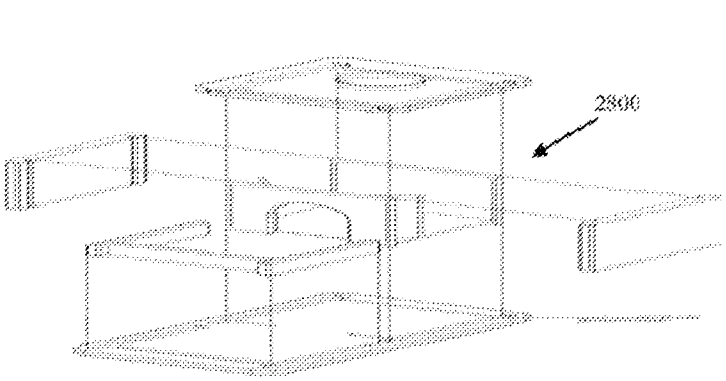
FIGS. 28A and 28B illustrate perspective views of a Level 3 Montessori toy, according to exemplary embodiments of the present invention.
Figure 28C:
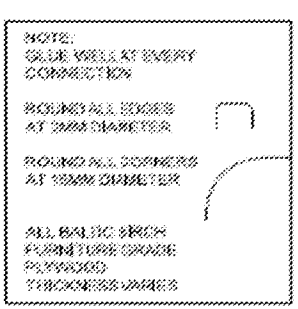
FIGS. 28C-28G illustrate side views of a Level 3 Montessori toy, according to exemplary embodiments of the present invention.
Figure 28A:
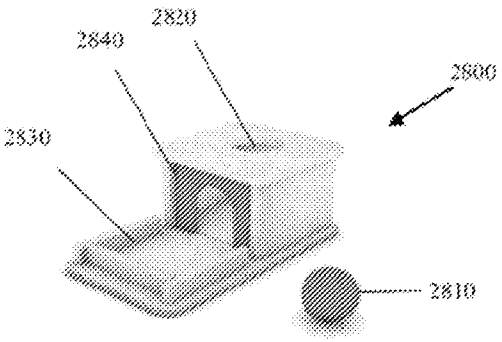
Figure 28D:
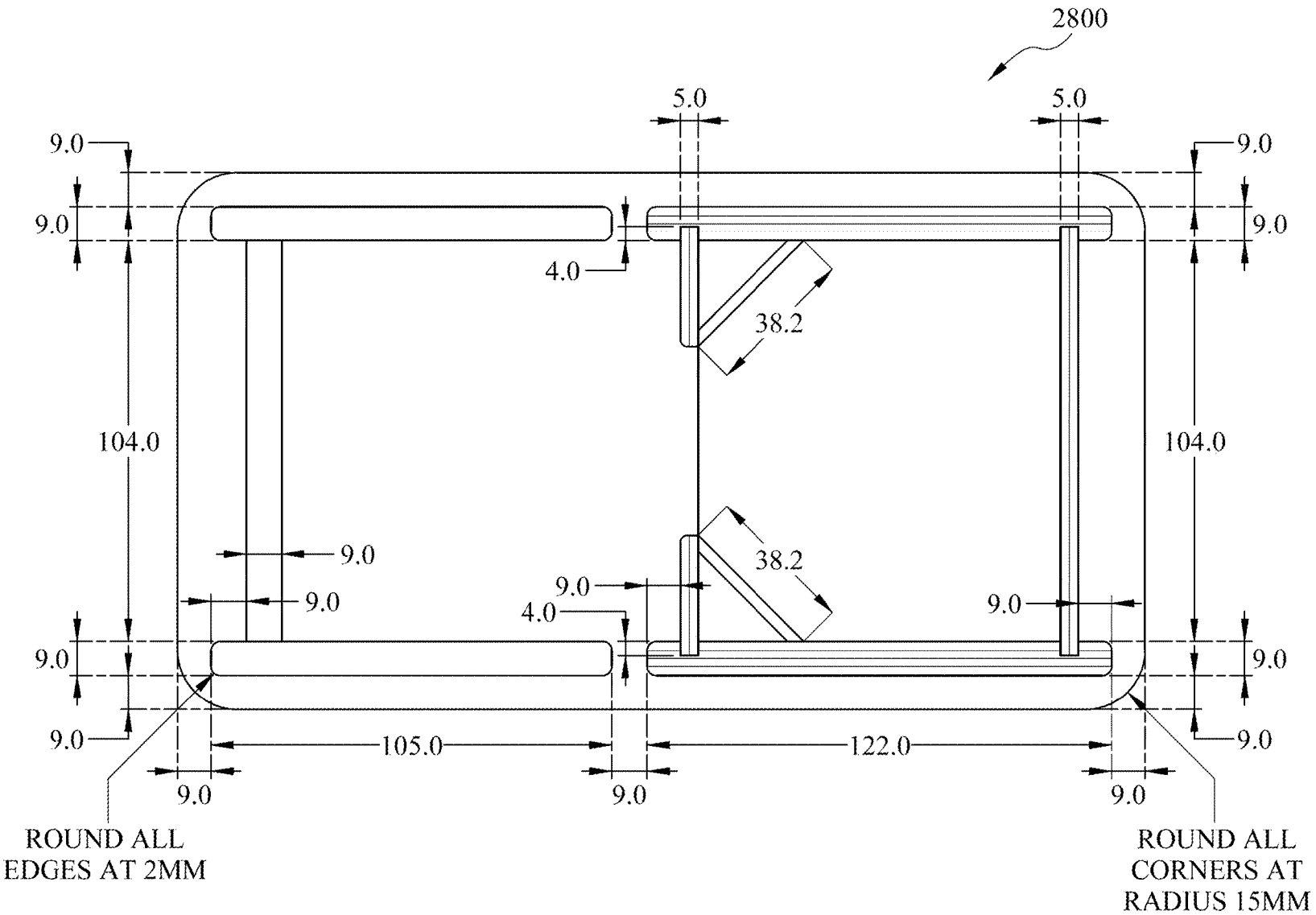
Figure 28E:
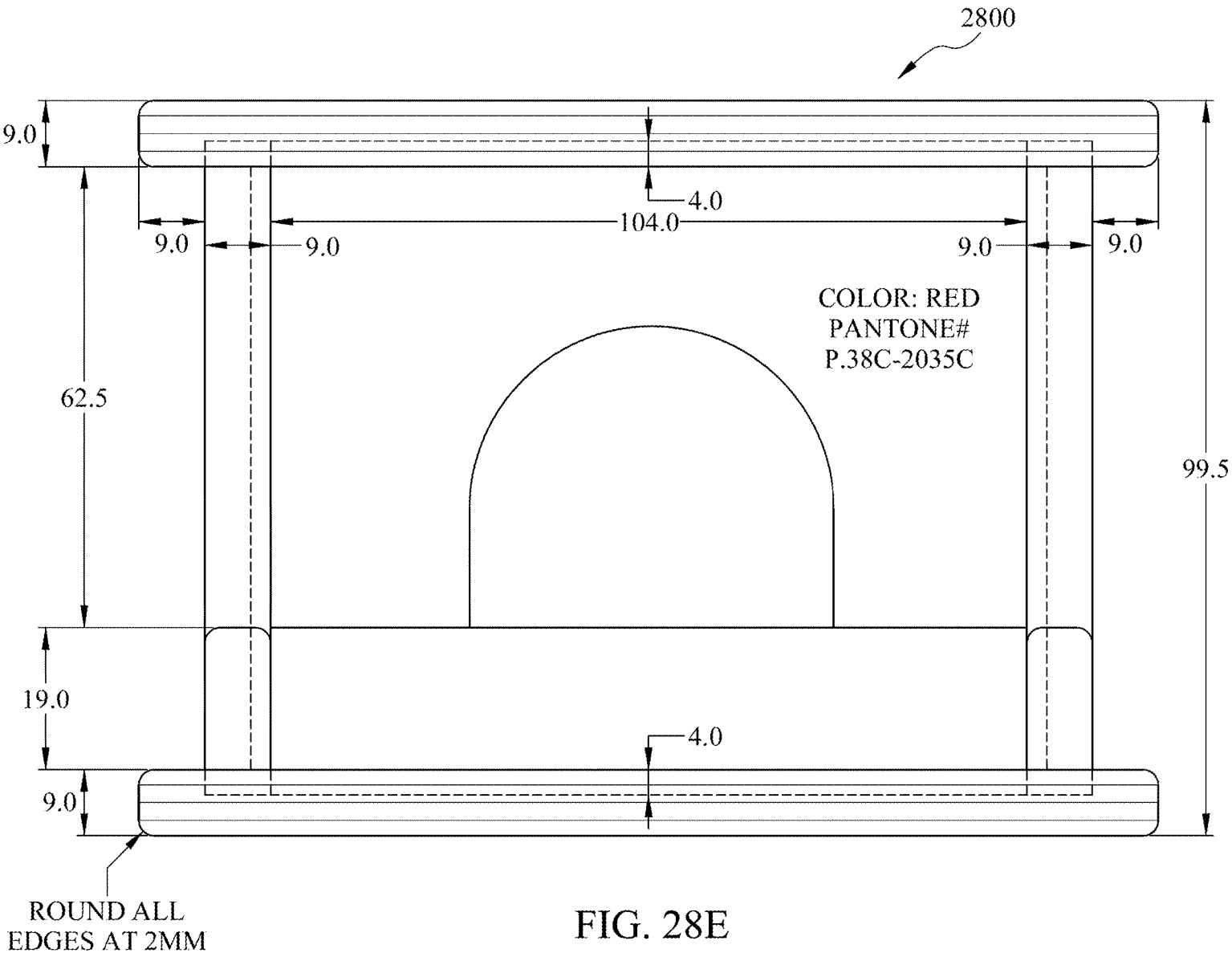
Figure 28F:
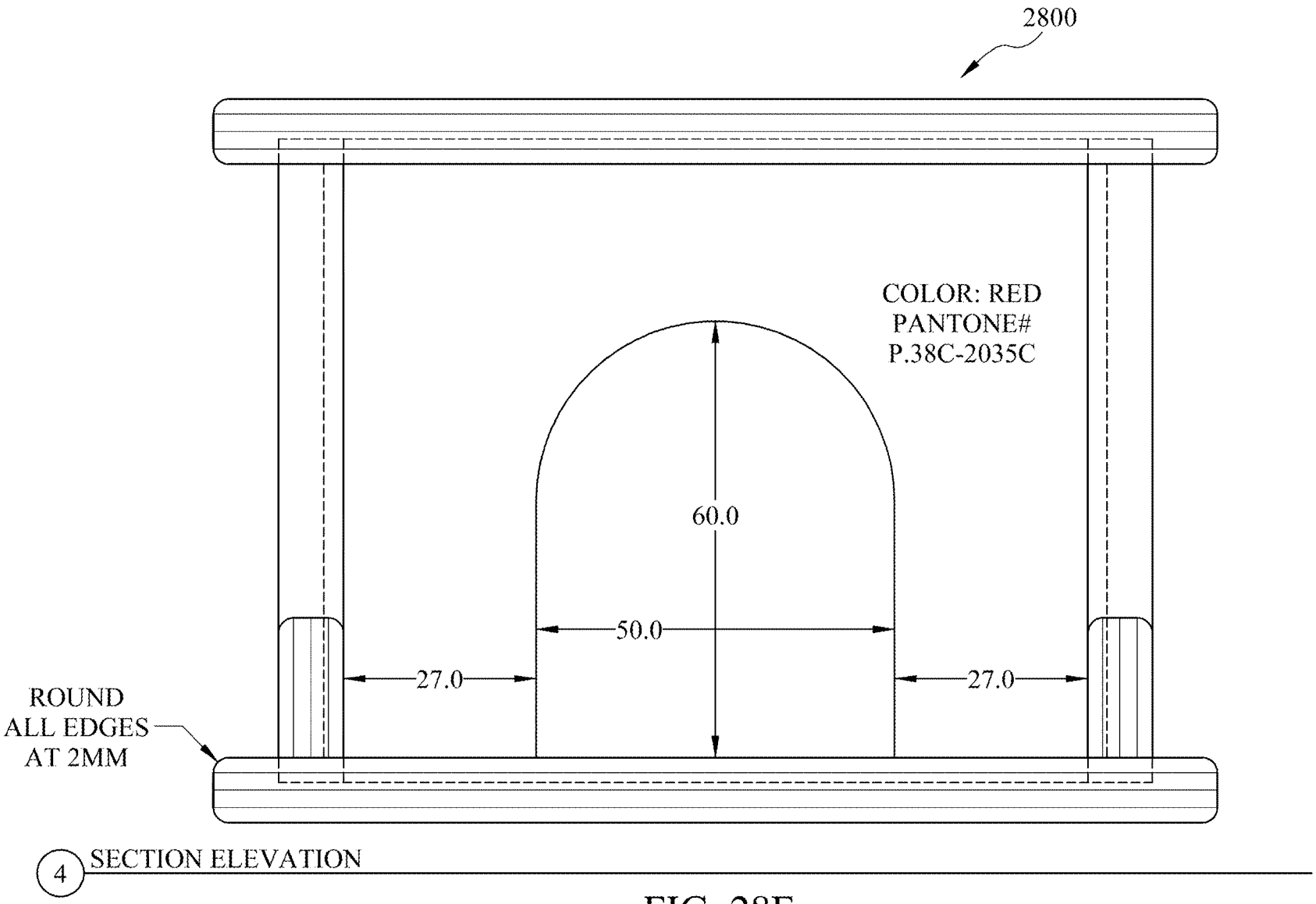
Figure 28G:
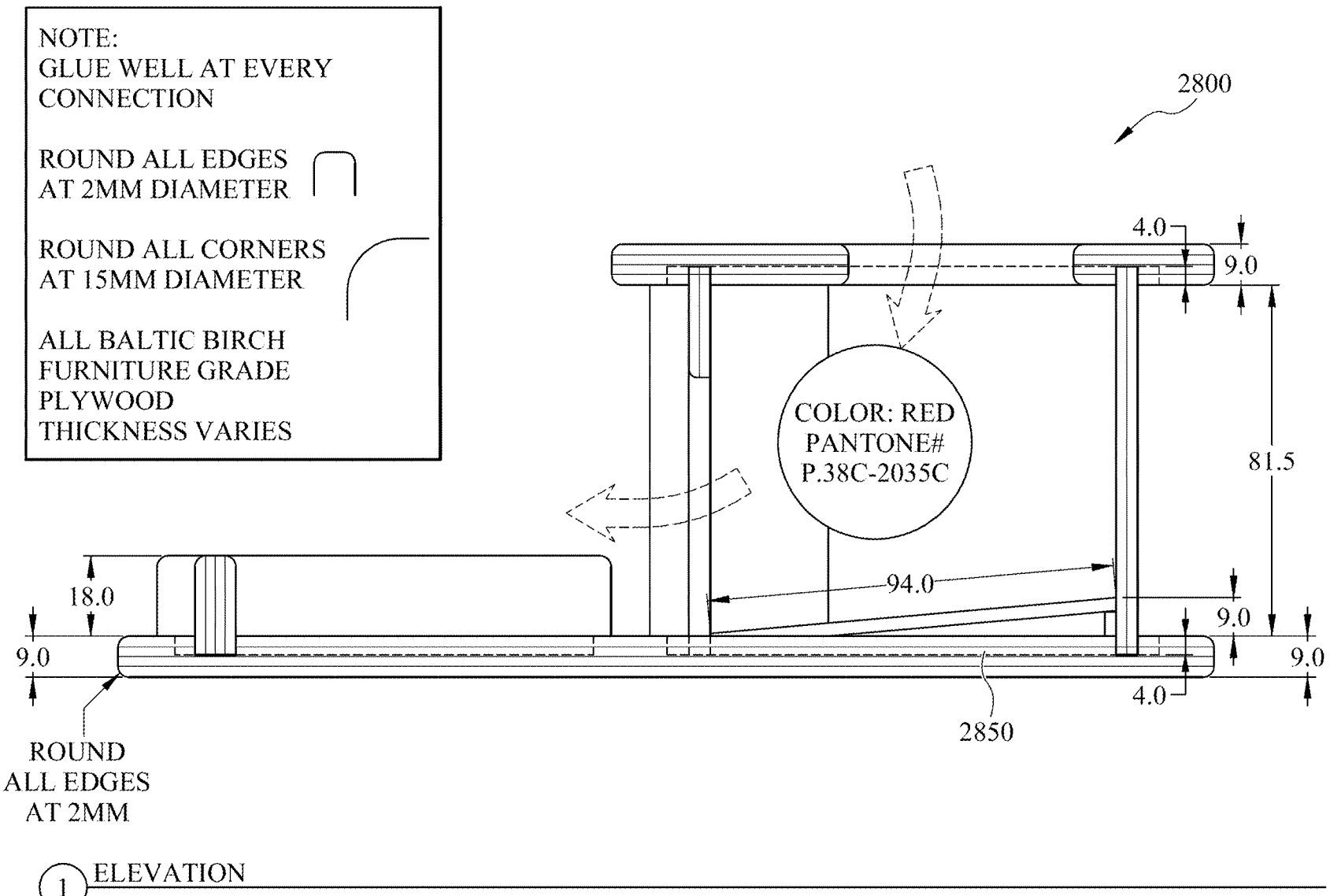
Figure 28H:
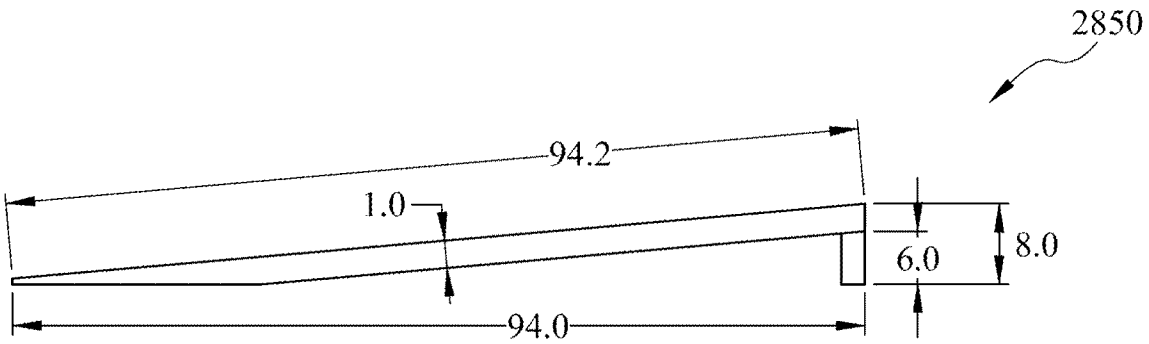
FIGS. 28H-28I illustrate side views of components of a Level 3 Montessori toy, according to exemplary embodiments of the present invention.
Figure 28I:
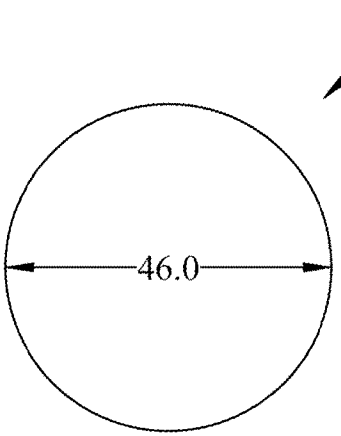
Figure 29B:
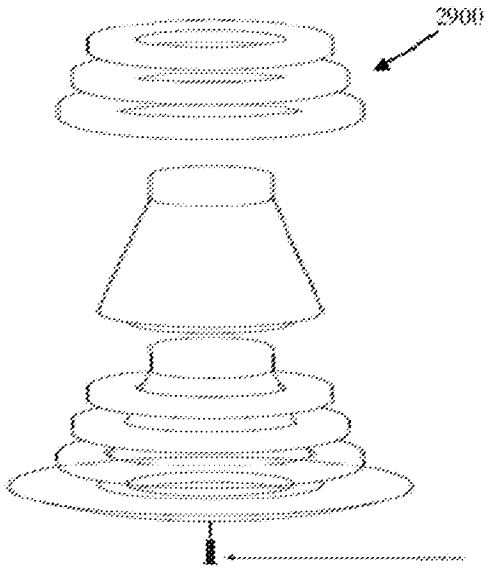
FIGS. 29A and 29B illustrate perspective views of a Level 3 Montessori toy, according to exemplary embodiments of the present invention.
Figure 29A:
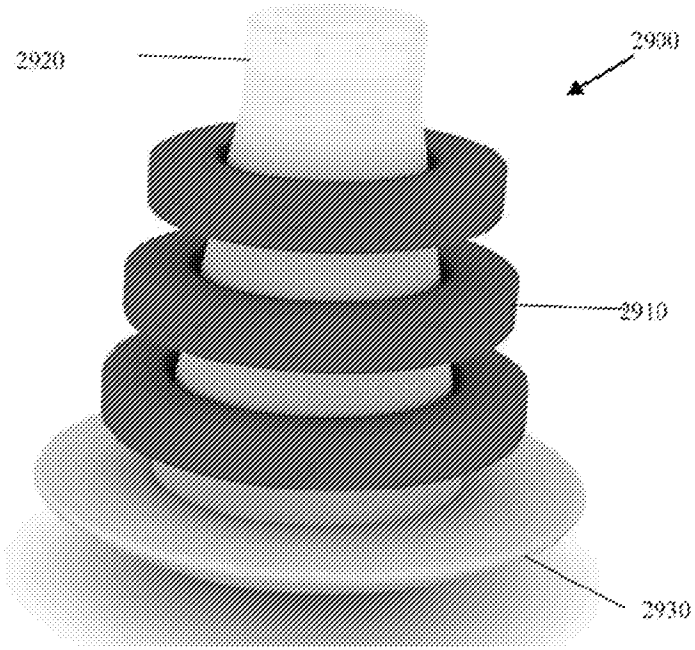
Figures 29C, 29D:
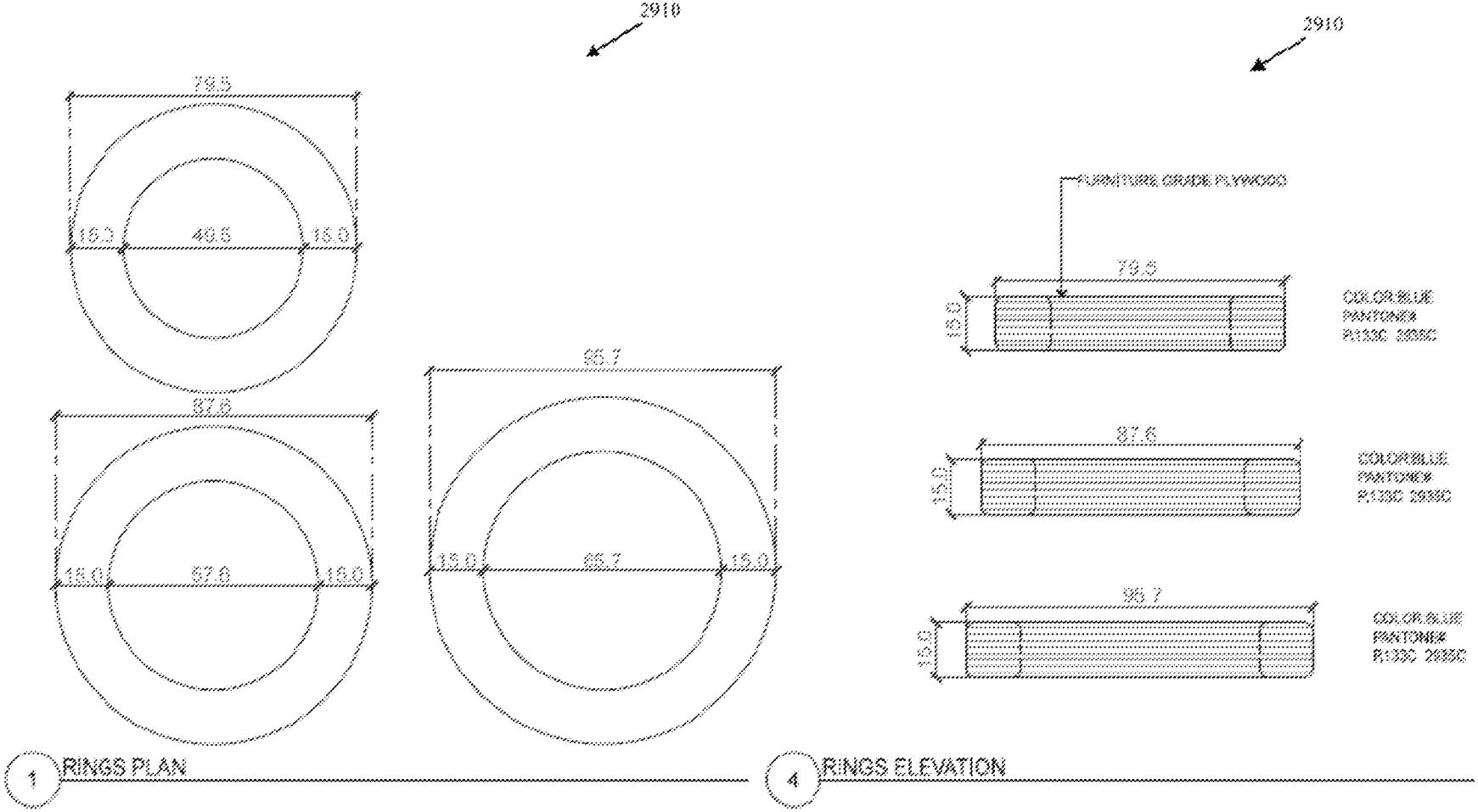
FIG. 29C illustrates a top view of a component of a Level 3 Montessori toy, according to exemplary embodiments of the present invention.
FIG. 29D illustrates a side view of a component of a Level 3 Montessori toy, according to exemplary embodiments of the present invention.
Figure 29F:
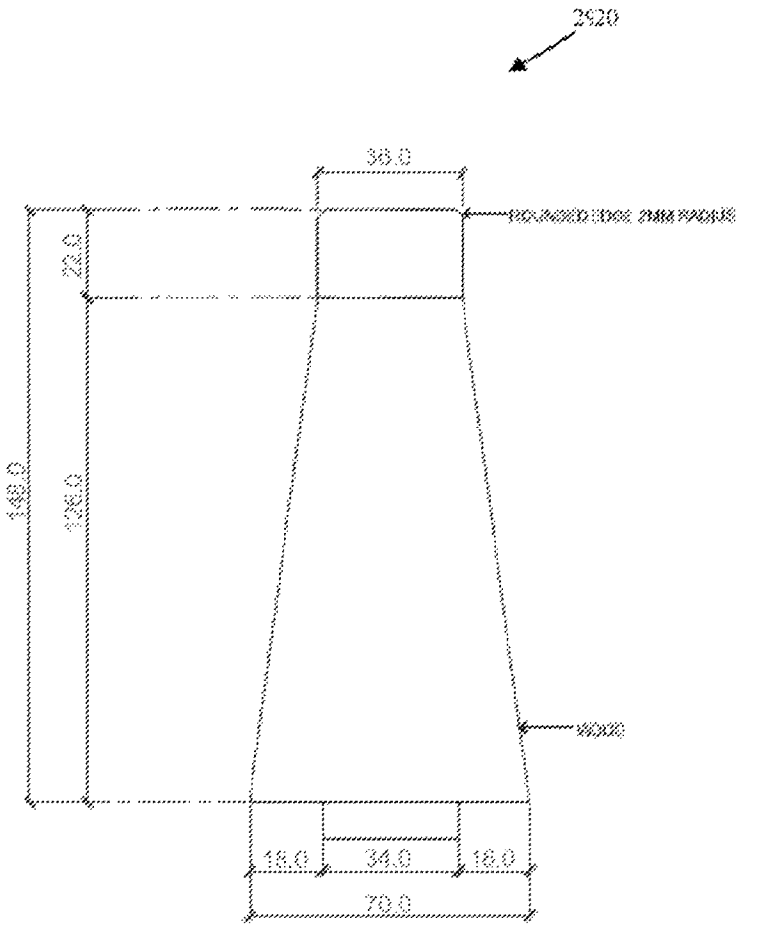
FIG. 29F illustrates a side view of a component of a Level 3 Montessori toy, according to exemplary embodiments of the present invention.
Figure 29E:
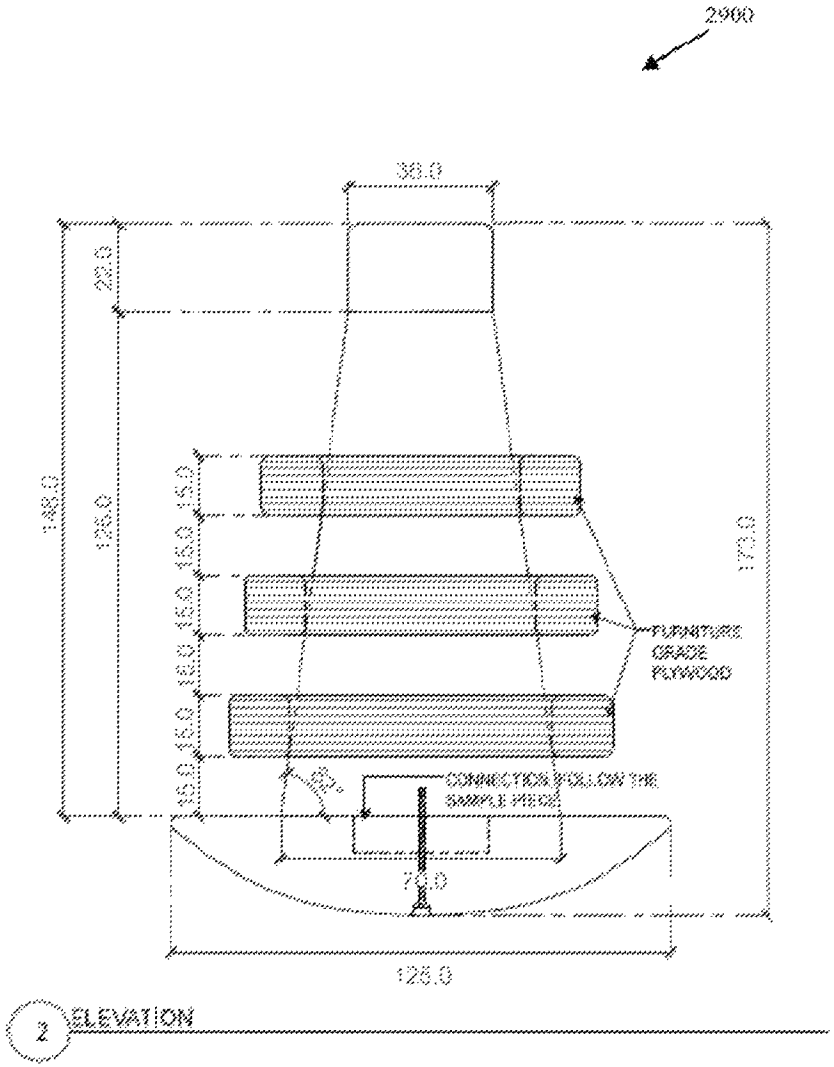
FIG. 29E illustrates a side view of a Level 3 Montessori toy, according to exemplary embodiments of the present invention.
Figure 29H:
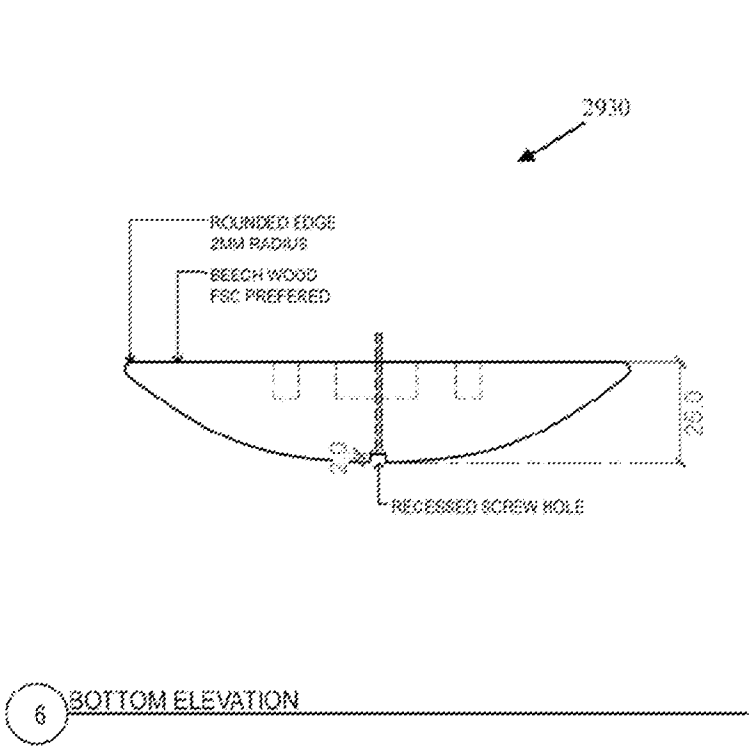
FIG. 29H illustrates a side view of a component of a Level 3 Montessori toy, according to exemplary embodiments of the present invention.
Figure 29G:
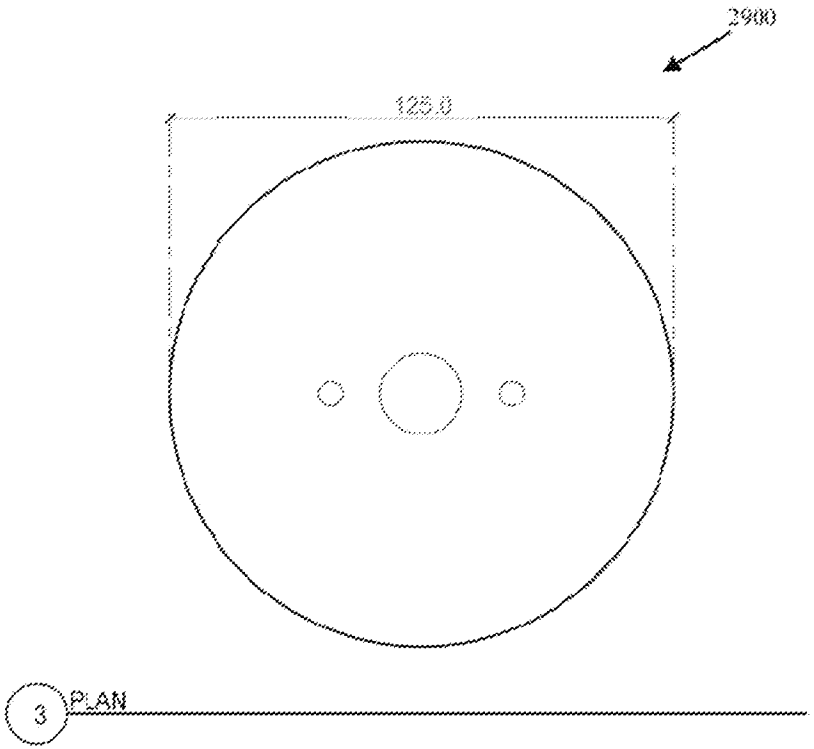
FIG. 29G illustrates a top view of a Level 3 Montessori toy, according to exemplary embodiments of the present invention.
Figure 30C:
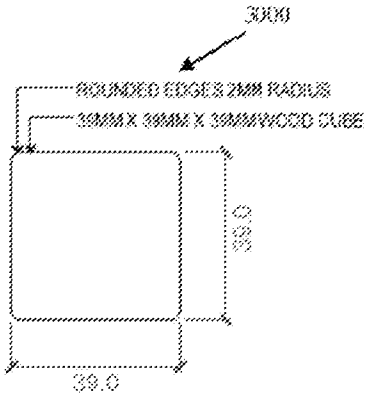
Figure 30F:
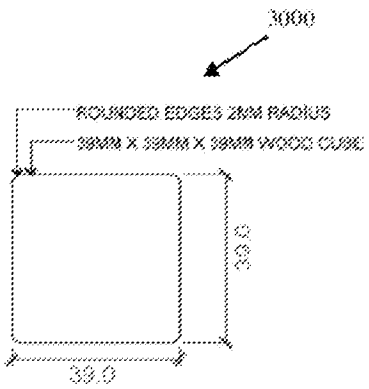
Figure 30B:
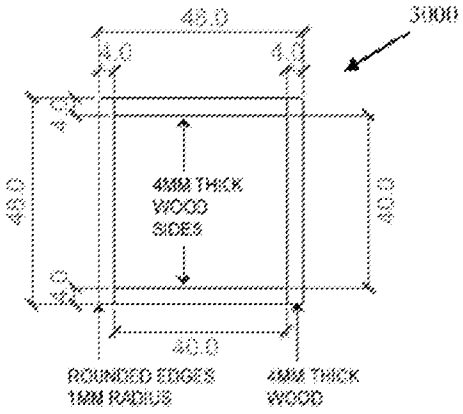
Figure 30E:
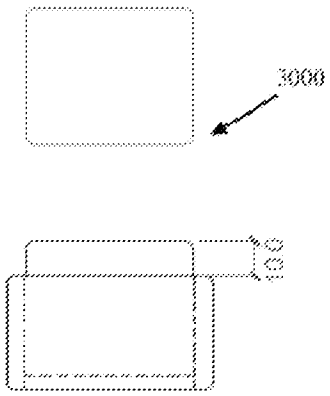
Figure 30A:
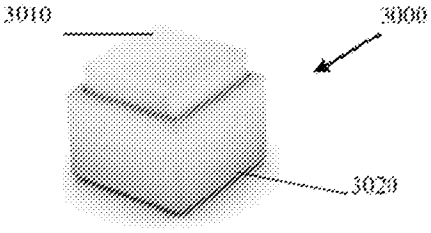
Figure 30D:
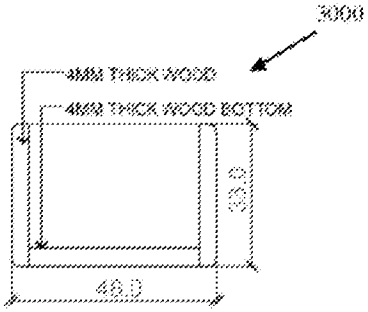
Figure 31B:
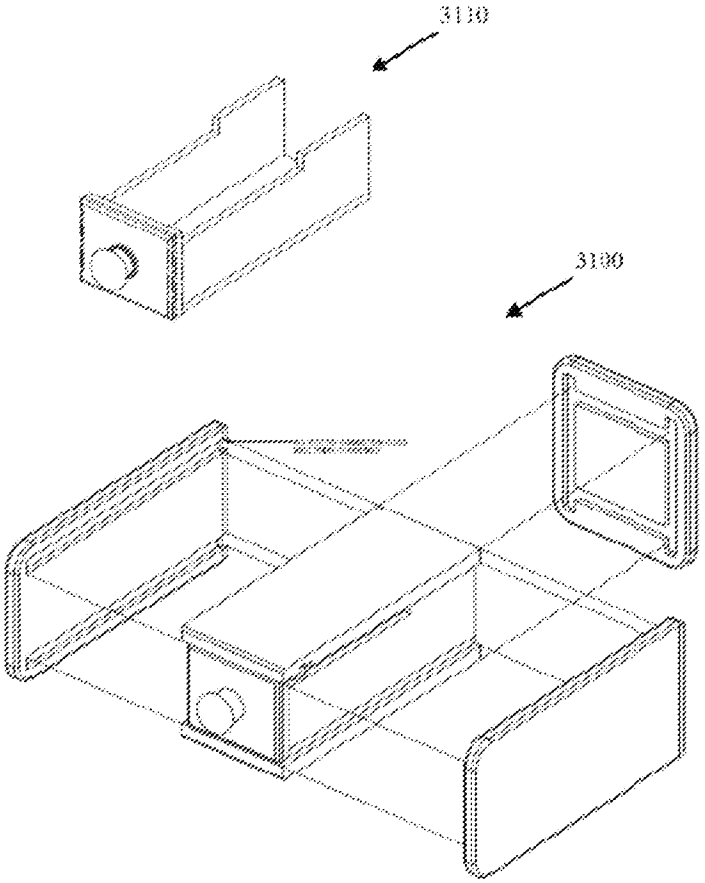
FIGS. 31A and 31B illustrate perspective views of a Level 4 Montessori toy, according to exemplary embodiments of the present invention.
Figure 31A:
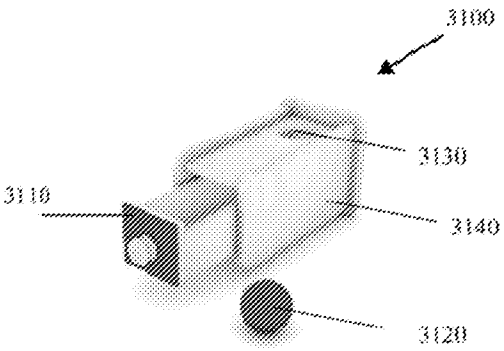
Figures 31C, 31D:
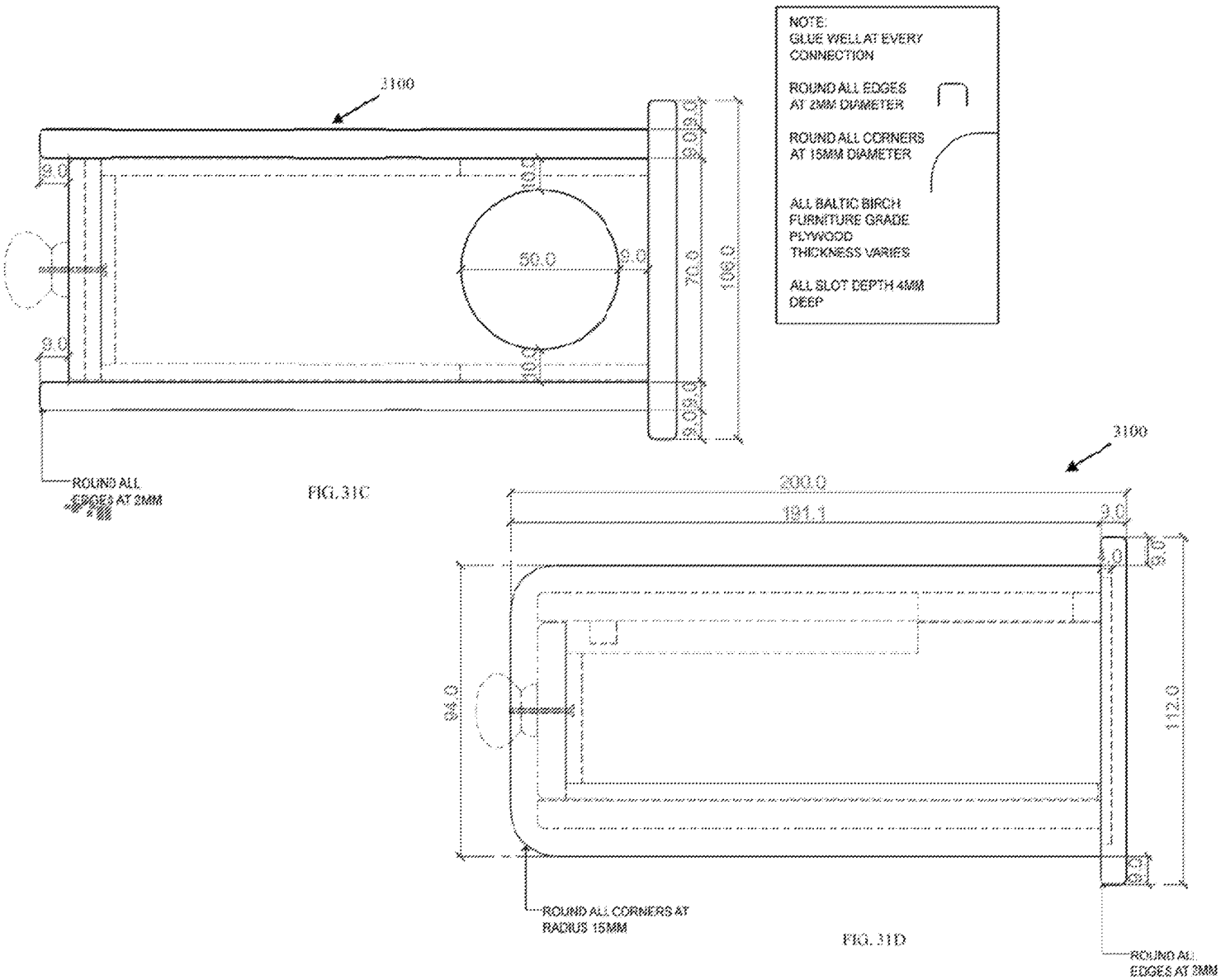
Figure 31F:
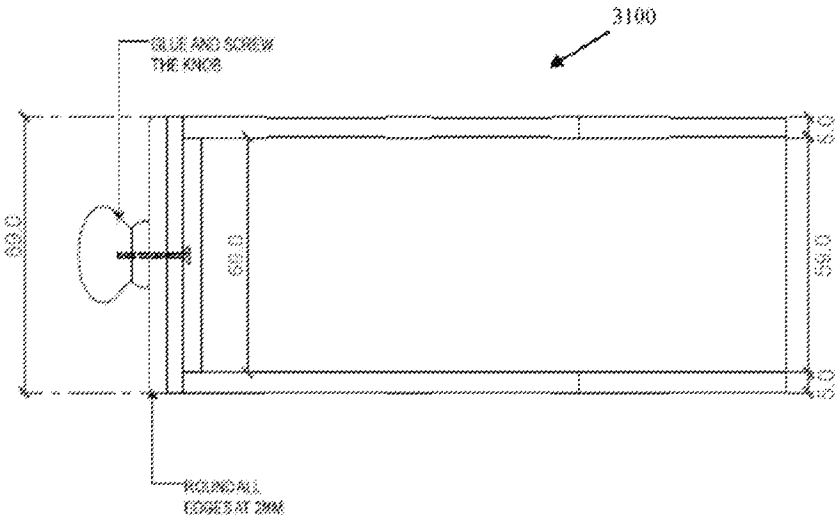
Figure 31G:
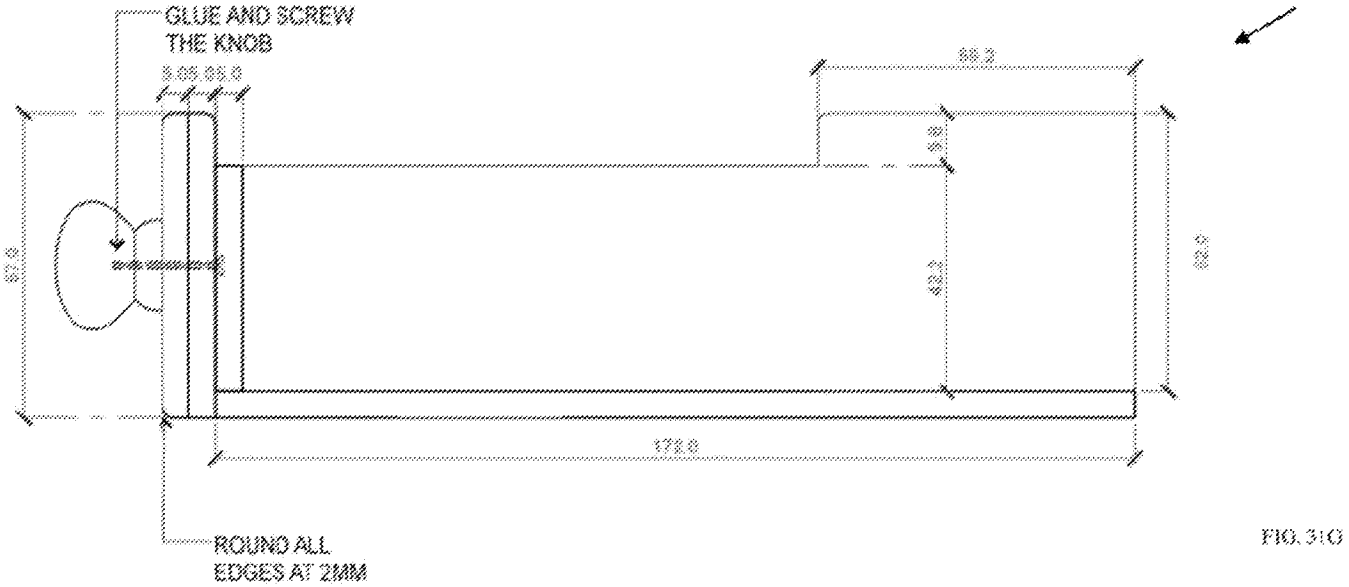
Figure 31H:
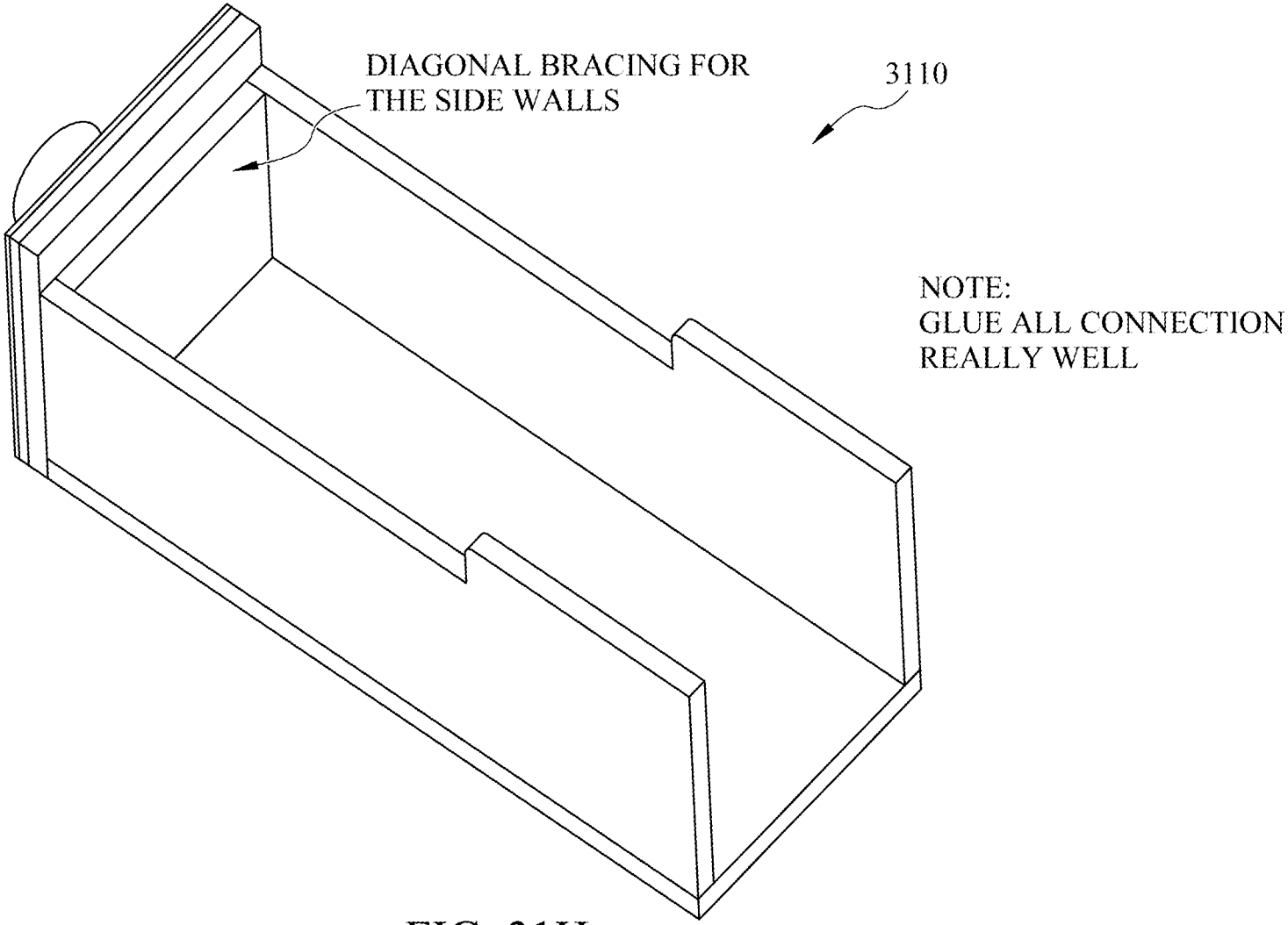
FIG. 31H illustrates a perspective view of a component of a Level 4 Montessori toy, according to exemplary embodiments of the present invention.
Figure 31J:
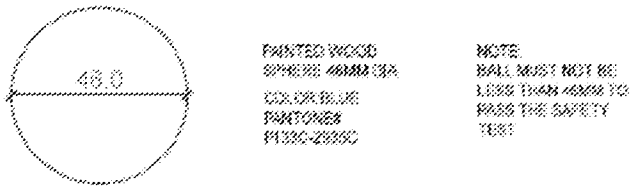
FIGS. 31I and 31J illustrate front views of a component of a Level 4 Montessori toy, according to exemplary embodiments of the present invention.
Figure 31I:
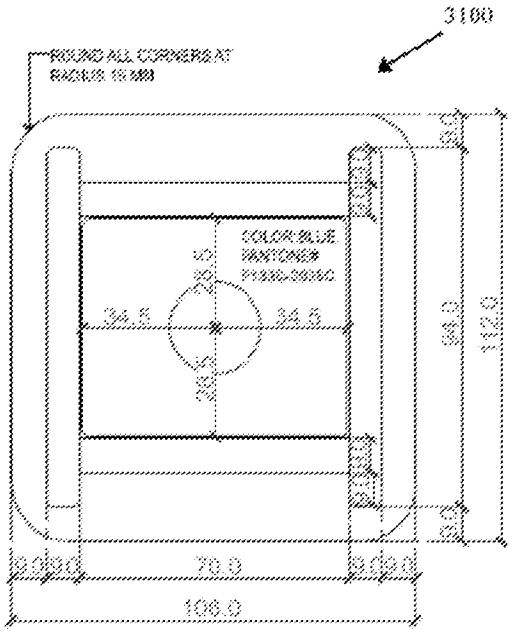
Figure 32A:
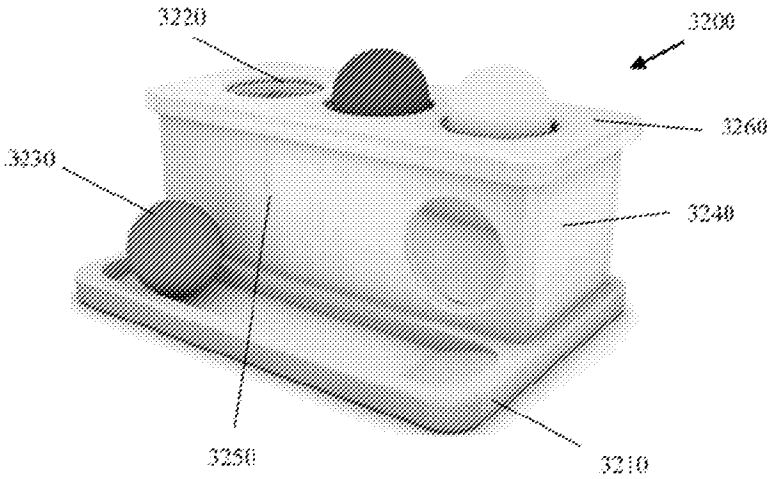
FIGS. 32A and 32B illustrate perspective views of a Level 4 Montessori toy, according to exemplary embodiments of the present invention.
Figure 32B:
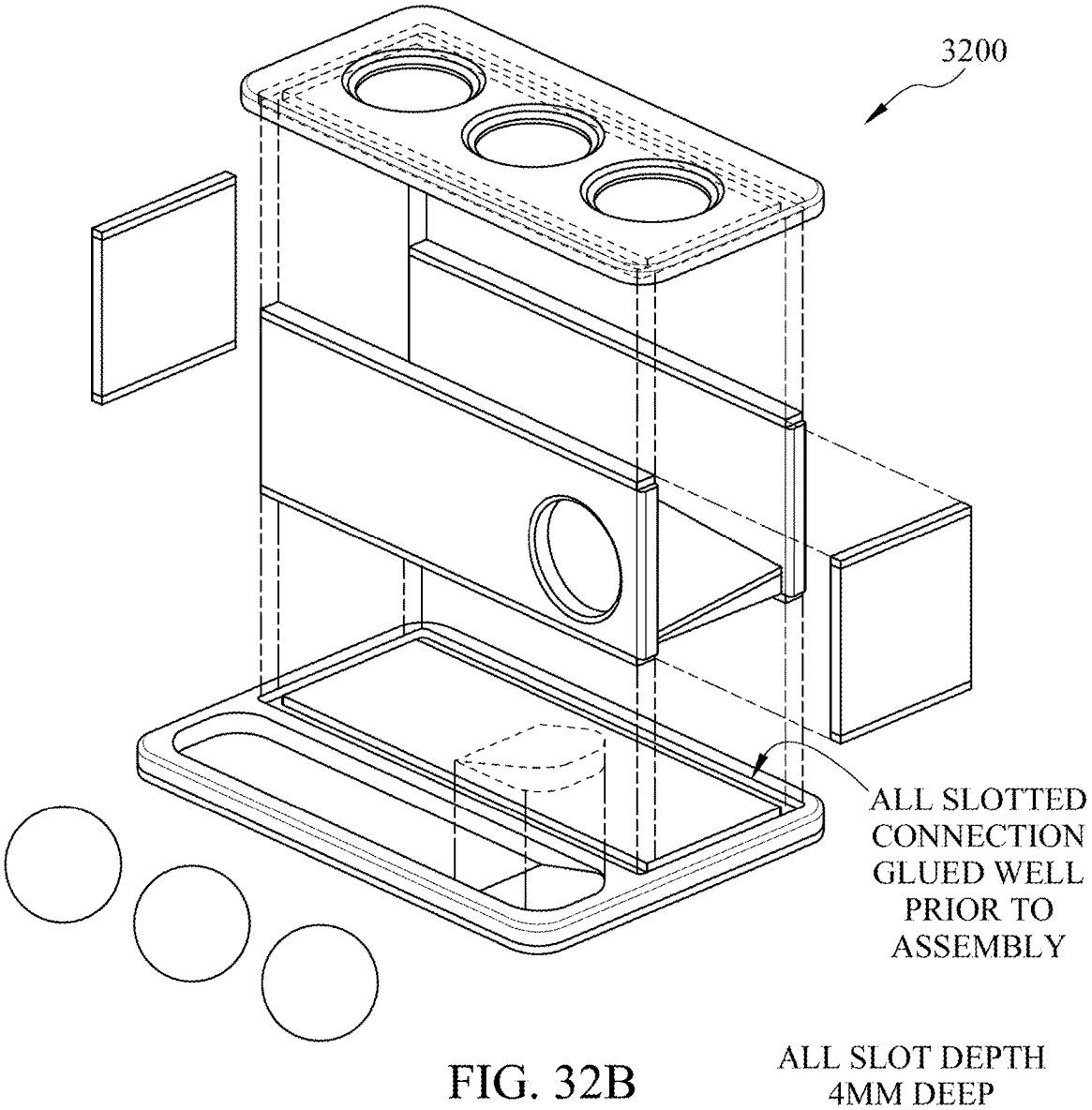
Figure 12C:
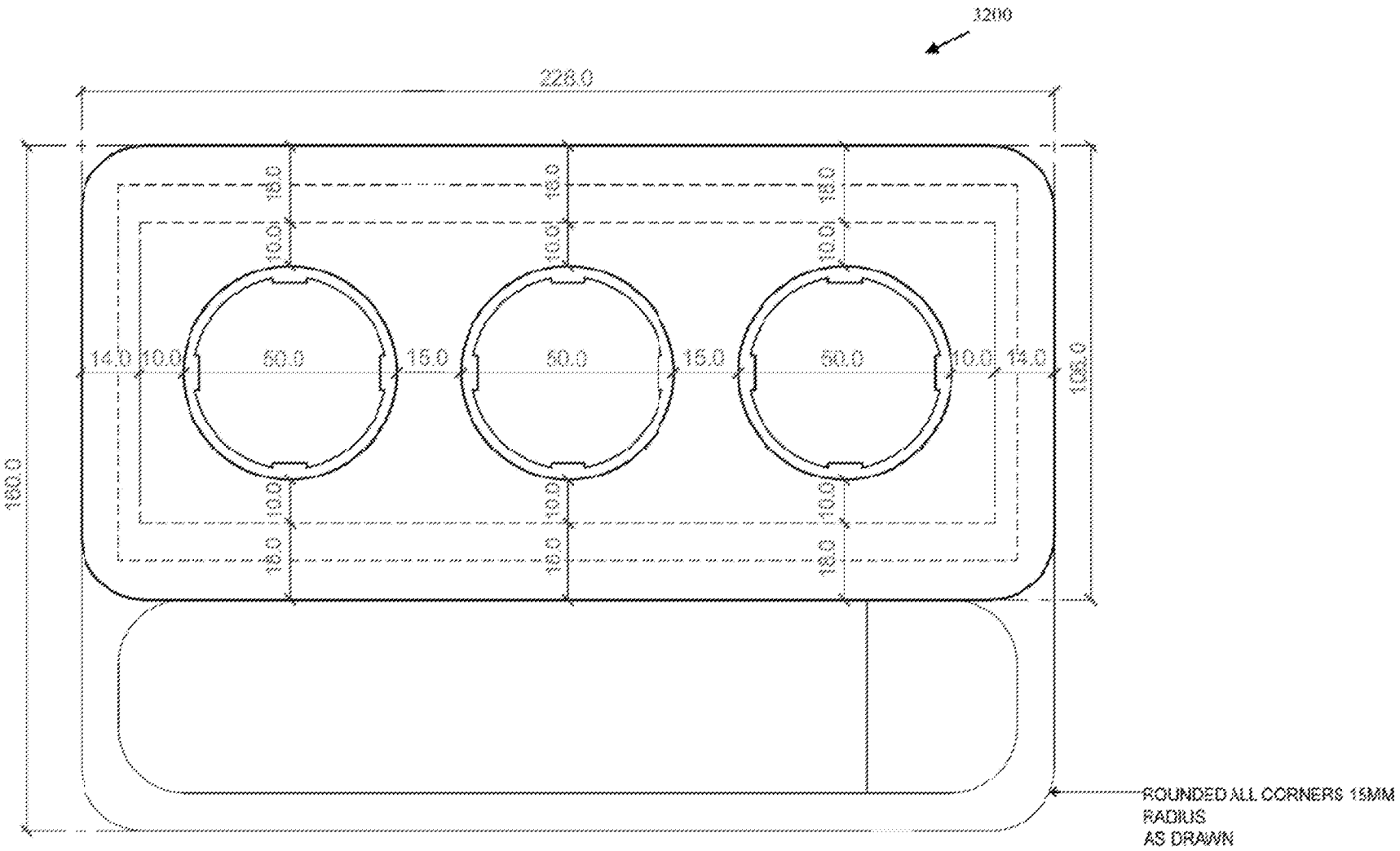
Figure 32D:
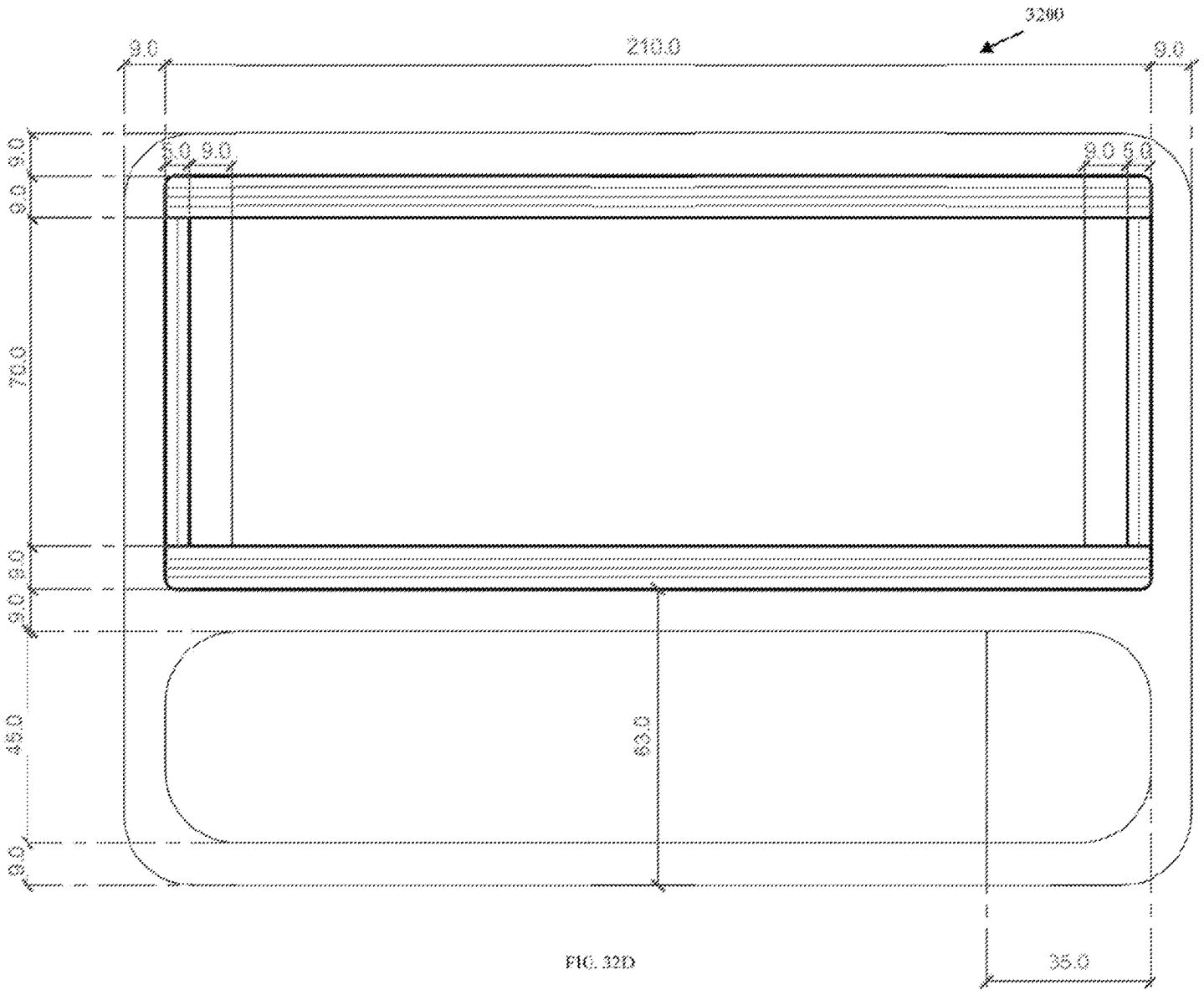
Figure 33F:
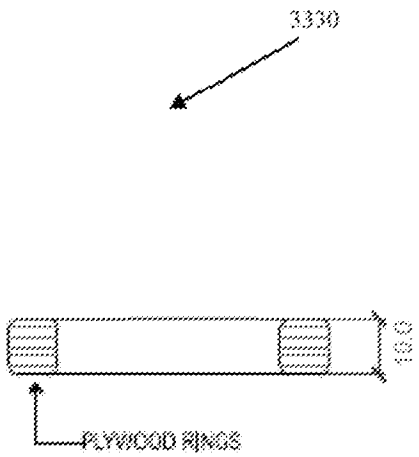
FIGS. 33D, 33F, 33H, and 33J illustrate side views of components of a Level 4 Montessori toy, according to exemplary embodiments of the present invention.
Figure 33E:
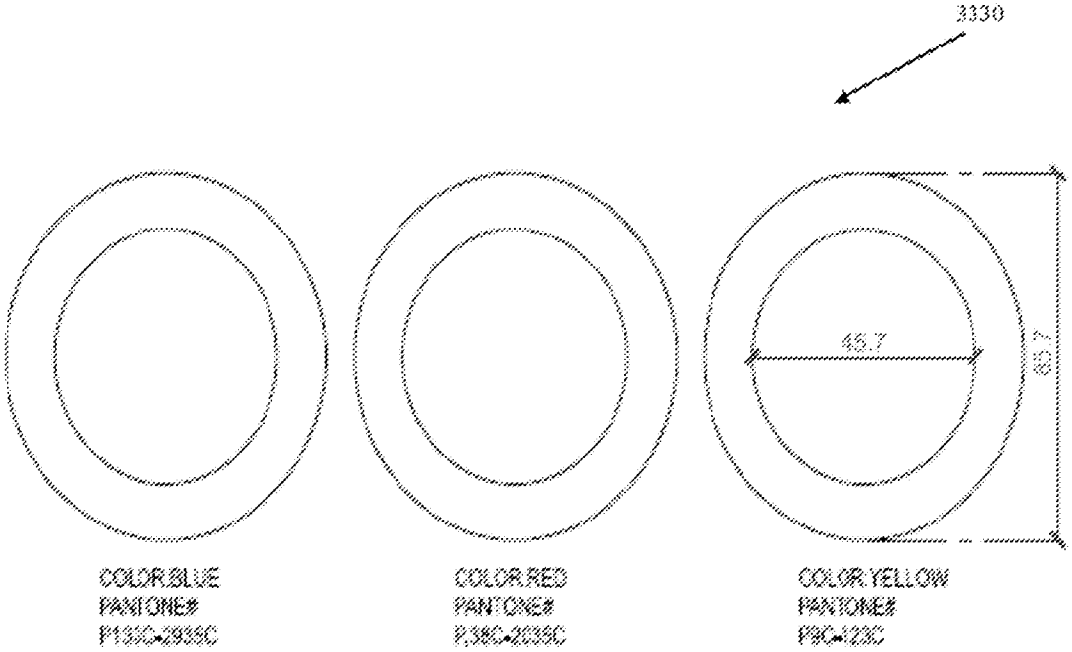
FIGS. 33E, 33G, and 33I illustrates top views of a component of a Level 4 Montessori toy, according to exemplary embodiments of the present invention.
Figure 33:
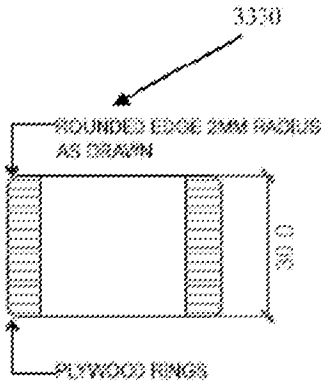
FIG. 33B illustrates a top view of a Level 4 Montessori toy, according to exemplary embodiments of the present invention.
FIG. 33C illustrates a side view of a Level 4 Montessori toy, according to exemplary embodiments of the present invention.
Figure 331:
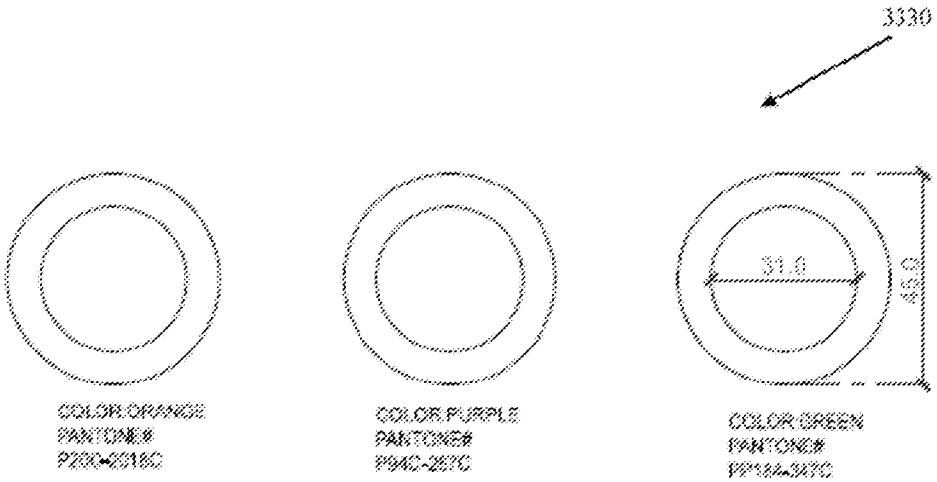

FIGS. 22A-22C illustrate various views of a Level 2 Montessori toy called the Cylinder Rattle 2200, according to exemplary embodiments of the present invention. The AMI teacher's training manual, for children between the age of 0-3 years, depicts a similar toy. The bell 2220 in the rattle 2210 was manufactured separately in order to avoid any lead content. In some embodiments, the bell 2220 in the rattle 2210 may not include any loop on top of it. In some embodiments, the bell 2220 may include a loop on top. In some embodiments, the dowels 2230 may be colored any color that meets the education and/or safety test requirements to provide visual simulation for the children. In some embodiments, the dimensions of the Cylinder Rattle 2200 may be as described in exemplary embodiments illustrated in FIGS. 22B-22C.

FIGS. 23A-23F illustrate various views of a Level 2 Montessori toy called the First Blocks 2300, according to exemplary embodiments of the present invention. In some embodiments, the First Blocks 2300 may include unit blocks 2320 that are proportional and expose children to math concepts as they play. In some embodiments, the First Blocks may also include a tray 2310. Research shows children aged 0-3 years benefit from block play, but most unit blocks are too large for their hands. In some embodiments, the shapes of the unit blocks 2320 were selected such that they work best for children aged 0-3 years. In some embodiments, the unit blocks were sized down and designed to fit a tray 2310. In some embodiments, larger cubes 2330 were also added to the mix to introduce the children to block play and thereby building a child's skills before presenting more challenge with subsequent blocks. In some embodiments, the cubes 2330 may be colored as per safety and educational requirements. In some embodiments, the dimensions of the Cylinder Rattle 2200 may be as described in exemplary embodiments illustrated in FIGS. 23B-23F.

FIGS. 24A-24D illustrate various components of a Level 2 Montessori toy called the Dining Set 2400, according to exemplary embodiments of the present invention. In some embodiments, the Dining Set 2400 may include a bowl 2410, utensils 2420, cups 2430, and a mat 2440. The AMI teacher's training manual, for children between the age of 0-3 years, describes this toy as an infant dining set. The mat for the Dining Set was bought from a Chinese manufacturer. In some embodiments, the bowls 2410 may be made out of wood. In some embodiments, the bowls 2420 may be made of stainless steel, silicone, or any other material that can withstand significant water exposure. The cups 2430 may be modeled after a shot glass and manufacturer using a lead free, children safe material. In some embodiments, the bowl 2410 may have the dimensions described in FIGS. 24B-24C.

FIGS. 25A-25G illustrate various views of a Level 3 Montessori toy called the Spinning Drum 2500, according to exemplary embodiments of the present invention. Previous, first and second, non-final designs failed the safety tests. Accordingly, after multiple experimentation, the final design was developed by sizing down and decreasing the weight of the Spinning Drum 2500. Next, multiple experimentations were made to figure out how to prevent the top piece 2510 with dowels 2530 from becoming disconnected from the base 2520. In some embodiments, the top piece 2510 may be screwed to the base 2520. In some embodiments, other fastening methods such as glue, Velcro, etc. may be used. In some embodiments, the dimensions of the Spinning Drums 2500 and dowel 2530 may be as described in exemplary embodiments illustrated in FIGS. 25B-25G.

FIGS. 26A-26D illustrate various views of a Level 3 Montessori toy called the Rolling Drum 2600, according to exemplary embodiments of the present invention. It is described in the AMI teacher's training manual for children aged 0-3 years. In some embodiments, the Rolling Drum 2600 differs from that described in the AMI teacher's training manual in the Rolling Drum 2600 is made out of a different wood and contained more balls 2610, which increases the educational value for the children. In some embodiments, the dimensions of the Rolling Drum 2600, dowels, 2610, and balls 2620 may be as described in exemplary embodiments illustrated in FIGS. 26B-26D.

FIGS. 27A-27F illustrate various components of a Level 3 Montessori toy called the Basket with Balls, according to exemplary embodiments of the present invention. The AMI teacher's training manual, for children between the age of 0-3 years, describes a basket with balls of different textures. In some embodiments, the balls 2720 may be made out of silicone. In some embodiments, the ball 2720 may be crochet with a bell in it. In some embodiments, the ball 2720 may be made out of wood. The balls 2720 may be made out of wood so that it rolls differently to balls made out of other materials. In some embodiments, the balls 2720 may include holes 2730, so that children can easily grasp it, and the ball does not roll in a straight path, which would make it engaging for crawling children to chase. In some embodiments, the wooden balls 2720 may have dimensions as described in FIGS. 27E-27F. In some embodiments, the crochet basket 2710 may have a diameter of 20 cm and be made out of cream colored, cotton yarn. In some embodiments, the crochet basket 2710 may be made of yarn of any other color. In some embodiments, the balls 2720 may have a diameter of 7.5 cm and be made of any single or a combination of colors such as red, blue, etc. and stuffed firmly with poly-fil polyester batting. In some embodiments, the balls 2720 may have a plastic rattle ball inside it. In some embodiments, the balls 2720 may have rattle balls made out of different materials that comply with the safety standards.

FIGS. 28A-28I illustrate various views of a Level 3 Montessori toy called the Object Permanence Box 1 2800, according to exemplary embodiments of the present invention. The AMI teacher's training manual, for children between the age of 0-3 years, describes a similar toy that is manufactured by other companies but none of them have passed the safety test. For example, http://shop.heutink-usa.com/object-permanence-box-with-tray.html. Around ten previous designs were developed and studied before developing the final design that passed the safety test. Safety testing firms were hired to help but were unsuccessful. The inventors were told not to use wood and switch to plastic instead. The Object Permanence Box 1's 2800 size, weight, thickness, design structure, and wood composition were changed multiple times. Even the ball's 2810 size, material, and color were changed. For example, other manufacturers use either a white or yellow plastic whiffle ball that violates the small ball regulation or a white wooden ball. The Object Permanence Box 1's 2800 may comprise a ball 2810, a box 2840 with a hole 2820 on its top surface, and a lid 2830. In some embodiments, the Object Permanence Box 1's 2800 may also include a ramp 2850. In some embodiments, the color of the front surface of the box 2820 matches with the color of the ball 2810 so that the children can connect and/or categorize them. This method of matching the colors, connecting, and categorizing is the Monti Kids method of painting various parts of the toys with only one color to call the children's attention to the purpose of the activity and ensure that they are not distracted with additional colors and superfluous painting. In some embodiments, the ball's 2810 size was increased to ensure that it does not violate the small ball rule. In some embodiments, the color of ball and/or the door may be any other color other than red. In some embodiments, the measurements of the Object Permanence Box 2800, the ramp 2850, and the ball 2810 may be as described in FIGS. 28B-28I.

FIGS. 29A-29H illustrate various views of a Level 3 Montessori toy called the Rocking Stacker 2900, according to exemplary embodiments of the present invention. The AMI teacher's training manual, for children between the age of 0-3 years, describes a similar toy by referencing a plastic Fisher Price toy with five rings and suggests that the teachers remove two rings leaving only three rings such that the rings don't touch each other while on the peg. However, such a design does not comply with the highest Montessori standards because it is not made in wood. In some embodiments, the Rocking Stacker 2900 is made out of wood. Previous design iterations failed because the rings 2910 were made out of solid wood. In some embodiments, the rings 2910 are made out of plywood. Previous design iterations also failed because the peg 2920 kept detaching from the base 2930 in the drop tests. In some embodiments, the peg 2920 may be attached to the base 2930 using fastening methods such as glue, screw, Velcro, etc., or any combinations thereof. In some embodiments, the rings 2910 sit on the peg and separated equidistantly from each other. In some embodiments, the rings 2910 may be of a weight that is light enough for a baby to hold and use but large enough to go over the peg 2920. In some embodiments, the measurements of the Rocking Stacker 2900, the pegs 2920, the rings 2910, and the base 2930 may be as described in FIGS. 29B-29H.

FIGS. 30A-30K illustrate various views of a Level 3 Montessori toy called the Shape Fitting 3000, according to exemplary embodiments of the present invention. The AMI teacher's training manual, for children between the age of 0-3 years, describes a similar toy that is manufactured by other companies, none of which have passed the safety tests because of their size, shape, and material. In some embodiments, the Shape Fitting 3000 can be two cuboidal elements 3010 and 3020. In some embodiments, their dimensions may be as described in FIGS. 30B-30F. In some embodiments, the Shape Fitting 3000 can be with a ball 3040 and a cup 3030. In some embodiments, their dimensions may be as described in FIGS. 30H-30K. In the previous design iterations, the ball 3040 and egg 3060 violated the "small ball" rule. Further experiments were performed to conform the Shape Fitting 3000 to the safety standards by changing the size of the cup 3040. However, multiple design iterations kept breaking during the drop tests.

FIGS. 31A-31J illustrate various views of a Level 3 Montessori toy called the Object Permanence Box-2 3100, according to exemplary embodiments of the present invention. The AMI teacher's training manual, for children between the age of 0-3 years, describes a similar toy that is manufactured by other companies, none of which have passed the safety tests. For example, see http://shop.heutink-usa.com/object-permanence-box-with-drawer.html. Also, the manual specifies that when the ball 3120 is put into the hole 3130 on the top surface of the box 3140 and the drawer 3110 is open, the drawer 3110 should still be insertable into the box 3140. Only some of the manufacturers make it this way. Safety tests were performed on fifteen previous design iterations. Safety testing firms were hired to help but were unsuccessful. The safety testing firms suggested that the toy cannot be made in wood and that it should be made in plastic. The Object Permanence Box 2's 3100 size, weight, thickness, design structure, and wood composition were changed multiple times. Even the ball's 3120 size, material, and color were changed. For example, other manufacturers use either a white or yellow plastic whiffle ball that violates the small ball regulation or a white wooden ball. In some embodiments, the color of the front surface of the drawer 3110 could be matched with the color of the ball 3120 so that the children can connect and/or categorize them. This method of matching the colors, connecting, and categorizing is the Monti Kids method of painting various parts of the toys with only one color to call the children's attention to the purpose of the activity and ensure that they are not distracted with additional colors and superfluous painting. In some embodiments, the side walls of the drawer 3110 have a "step" carved into the wood along the top. In some embodiments, the ball's 3120 size is such that it does not violate the small ball rule. In some embodiments, the front surface drawer 3110 and the ball 3120 are made of the same color that is not blue. In some embodiments, the dimensions of the Object Permanence Box 2 and the ball may be as described in 31B-31J.

FIGS. 32A-32D illustrate various views of a Level 4 Montessori toy called the Push Balls 3200, according to exemplary embodiments of the present invention. The AMI teacher's training manual, for children between the age of 0-3 years, describes a similar toy, which has four balls to push and a different style of tray in the front. The previous several design iterations broke during drop testing, both because of the construction of the box 3240 and the heavy weight and the design of the tray 3210 in the front. In some embodiments, the number of balls 3230 may be reduced to three to shrink the toy Push Balls 3200 and reduce its weight. Multiple experiments were performed before finalizing the design and internal construction of the tray 3210 in order to make it sturdy enough to pass the drop tests. No other company makes a Push Balls toy 3200 like this. Some other companies make similar purpose toys with hammers with which one can push the balls through holes 3220 on the top surface 3260 of the box 3240. But such toys do not have a built-in tray 3210 to catch the balls 3230 that come out through the hole 3225 on the front surface 3250 of the box 3250 and therefore the balls roll off, which makes it an unsuitable toy for children aged 0-3 years old. In some embodiments, the dimensions of the Push Balls 3200 and the balls 3230 may be as described in 32B-32D.

FIGS. 33A-33J illustrate various views of a Level 4 Montessori toy called the Stable Stacker 3300, according to exemplary embodiments of the present invention. The AMI teacher's training manual, for children between the age of 0-3 years, describes multiple pegs on a base each with different sized rings. The Stable Stacker 3300 may only have one stacker 3320 that can be used with various sized rings, thus eliminating the need for multiple stable stackers for each ring size. In some embodiments, the Stable Stacker 3300 may include three tall rings 3310 that are included to meet children's developmental needs. In some embodiments, the Stable Stacker 3300 may include shortened stacker 3320 in order for it to only accommodate six rings 3330. Previous design iterations failed safety tests because the stacker 3320 broke off from the base 3350 during drop testing. However, in some embodiments, the stacker 3320 may be connected to the base 3350 using fastening methods such as glue, screws, Velcro, etc., or any combinations thereof. In some embodiments, the dimensions of the Stable Stacker 3300 and its various components may be as described in 33B-33J.

Figure 34B:
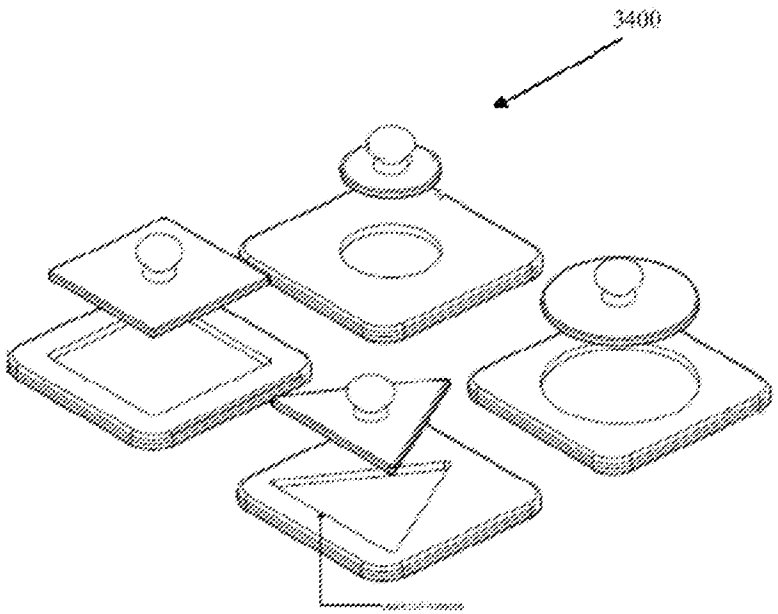
FIGS. 34A and 34B illustrate perspective views of a Level 4 Montessori toy, according to exemplary embodiments of the present invention.
Figure 34A:
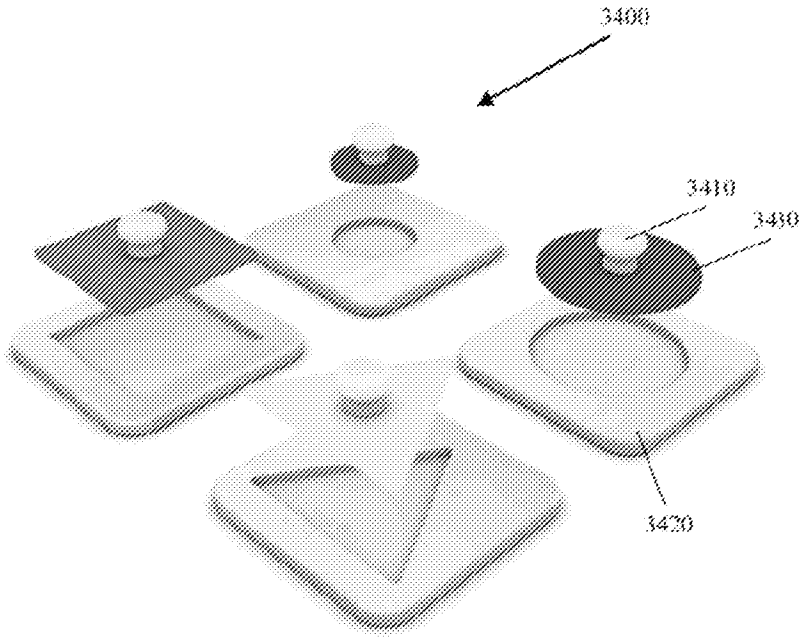
Figure 34B:
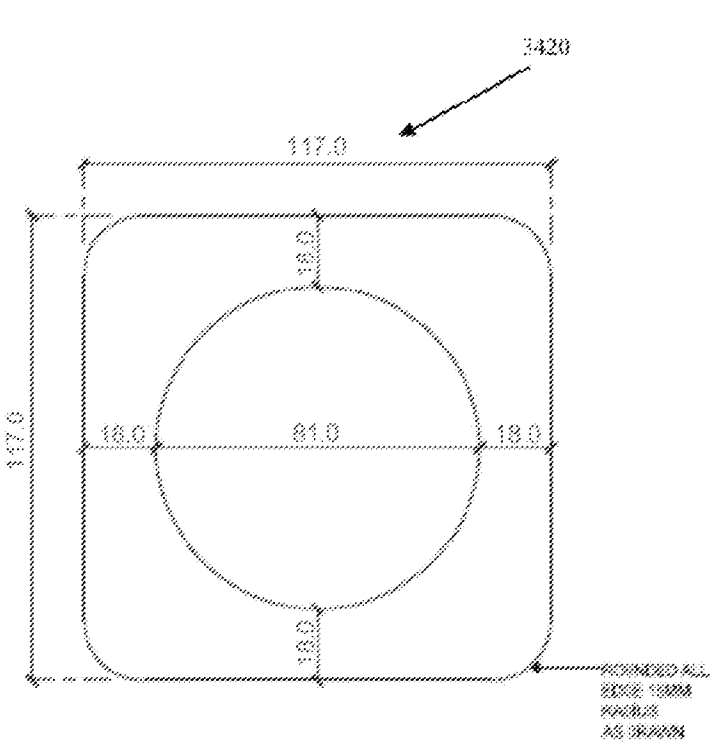
Figure 34C:
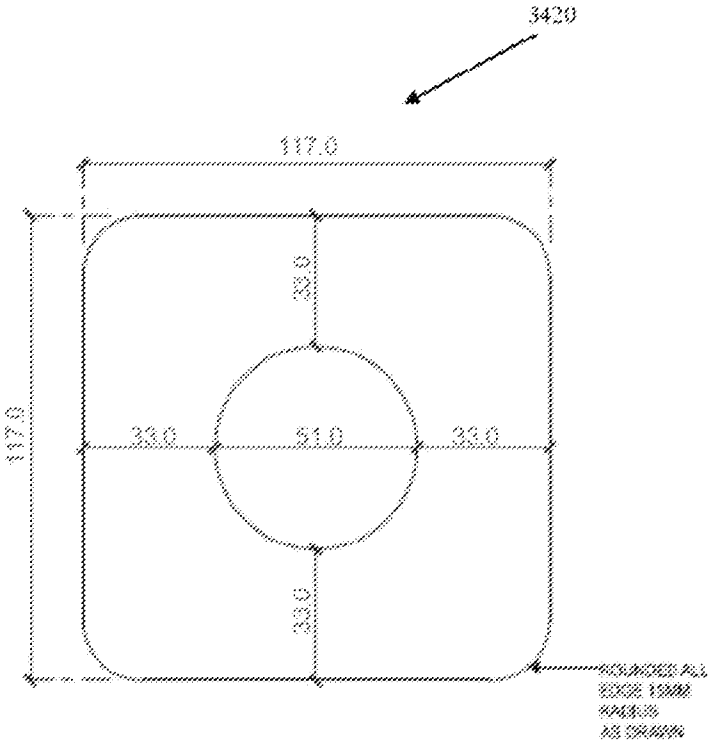
Figure 34F:
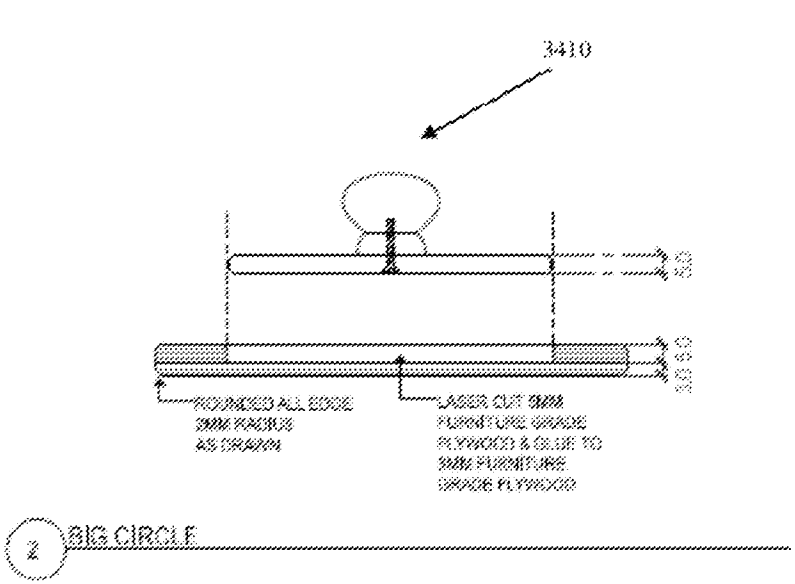
Figure 34E:
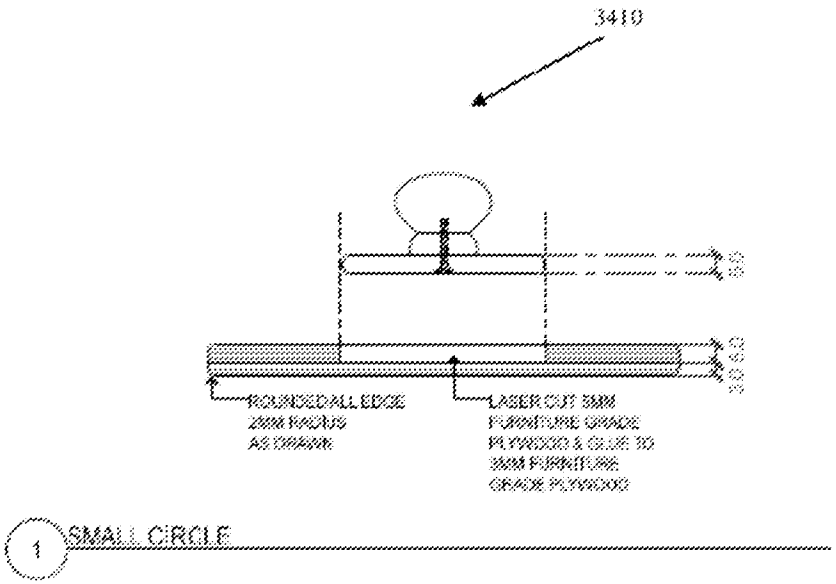
Figure 34L:
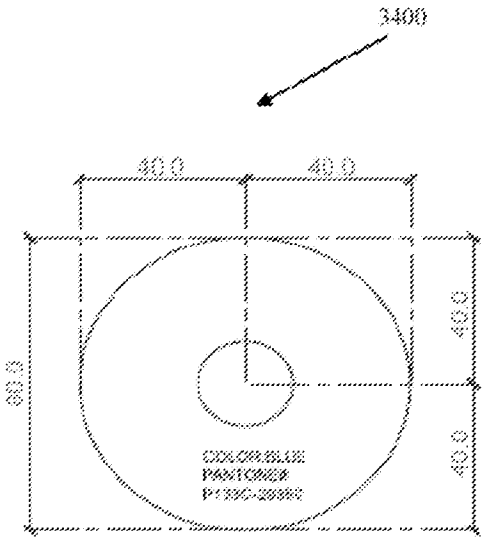
Figure 34N:
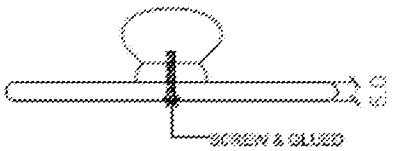
Figure 34K:
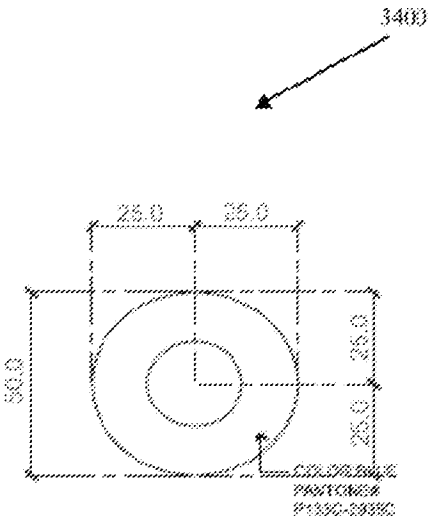
Figure 34M:
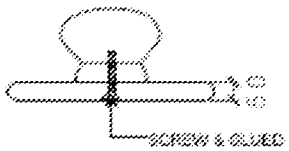
Figure 35B:
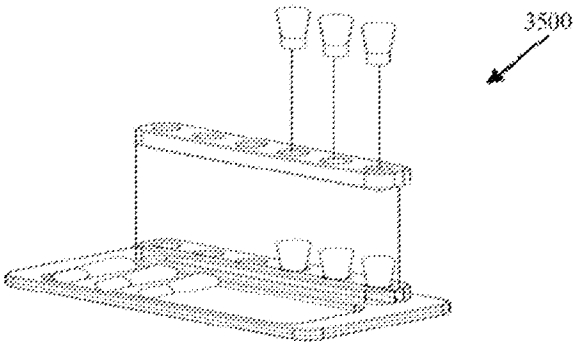
FIGS. 35A and 35B illustrate perspective views of a Level 4 Montessori toy, according to exemplary embodiments of the present invention.
Figure 35A:
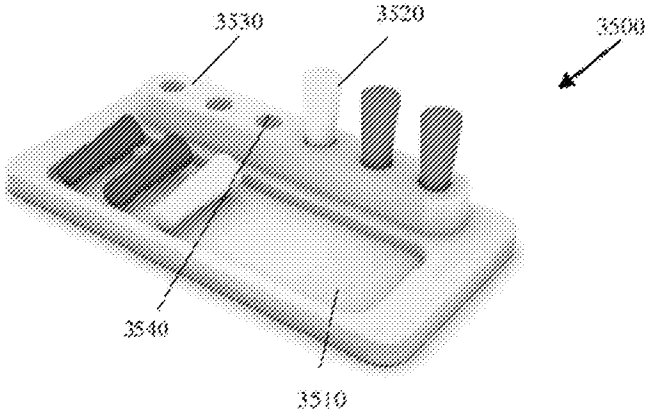
Figure 35C:
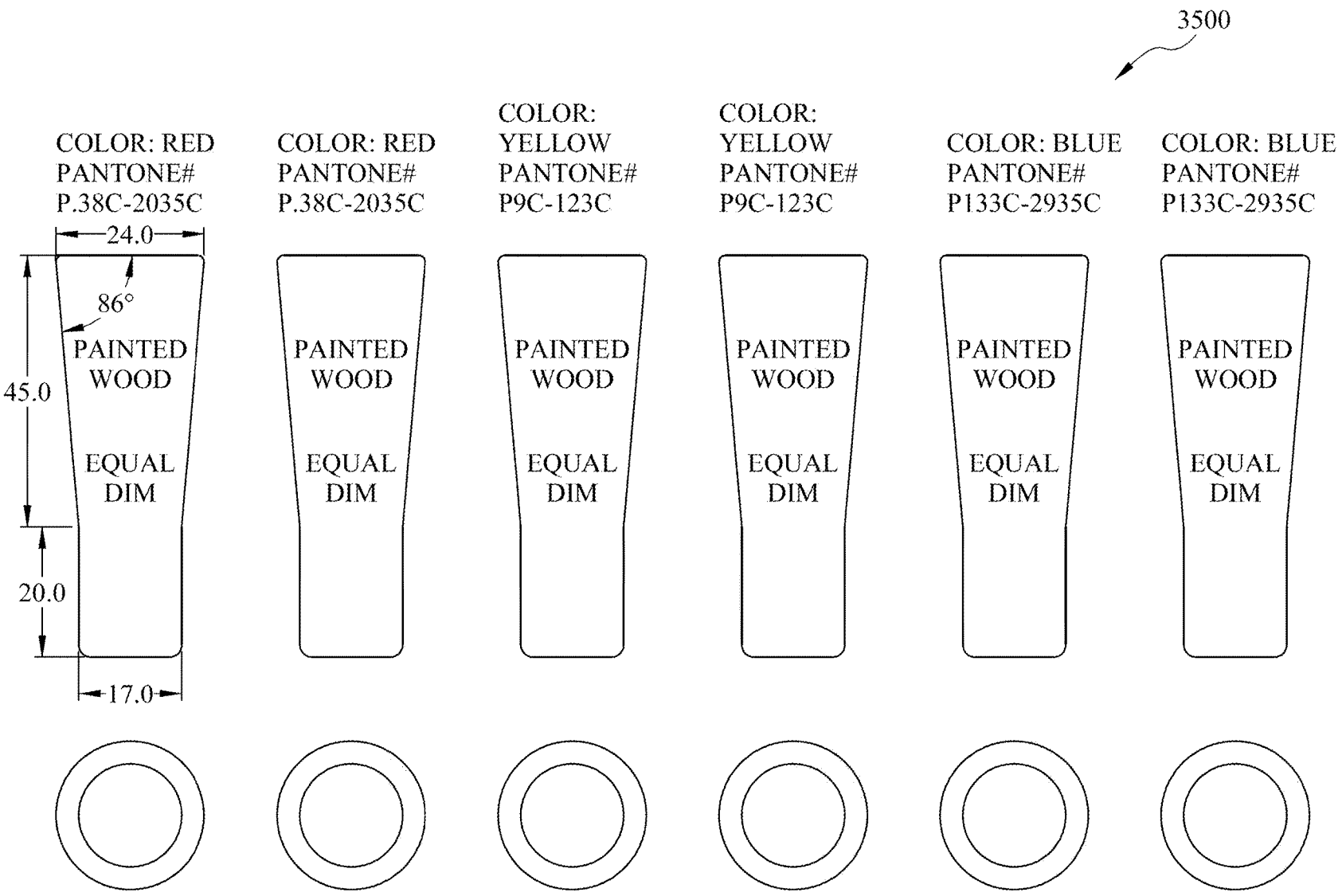
FIG. 35C illustrates a side view and a top view of components of a Level 4 Montessori toy, according to exemplary embodiments of the present invention.
Figure 35D:
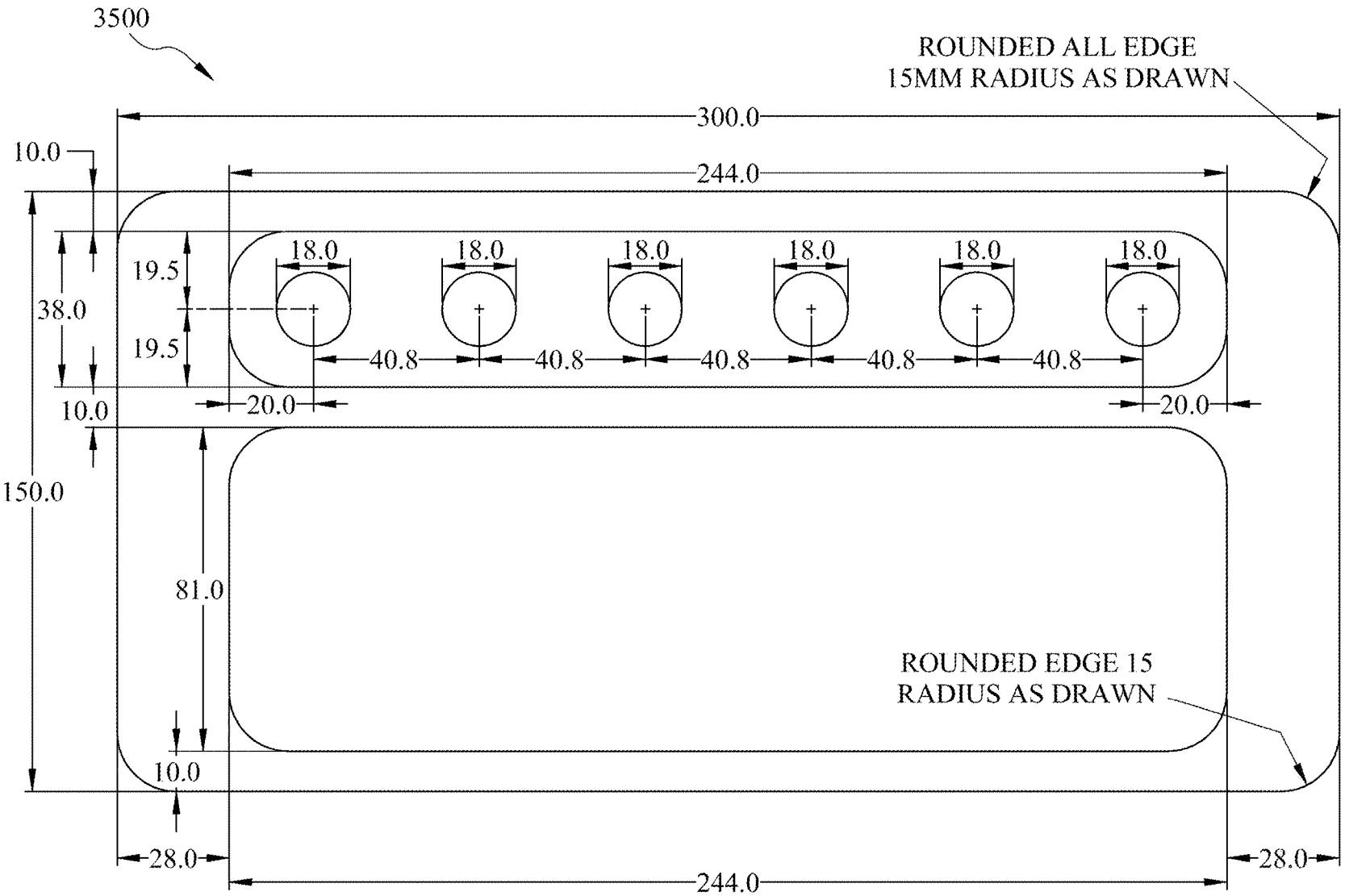
FIG. 35D illustrates a top view of a Level 4 Montessori toy, according to exemplary embodiments of the present invention.
Figure 35E:
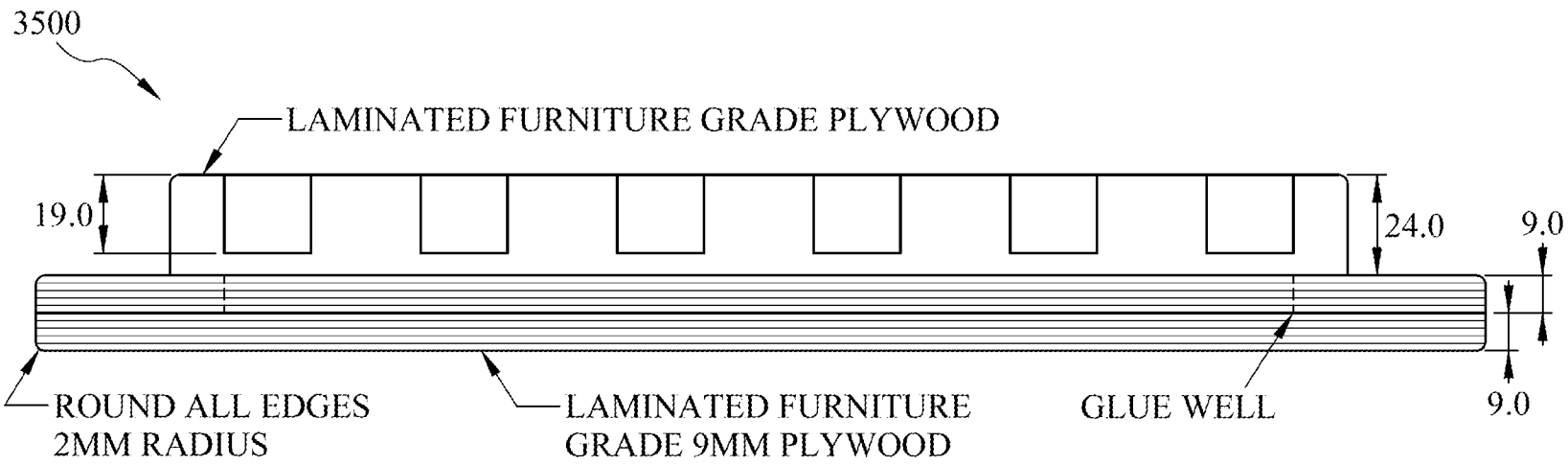
FIGS. 35E and 35F illustrate side views of a Level 4 Montessori toy, according to exemplary embodiments of the present invention.
Figure 35F:
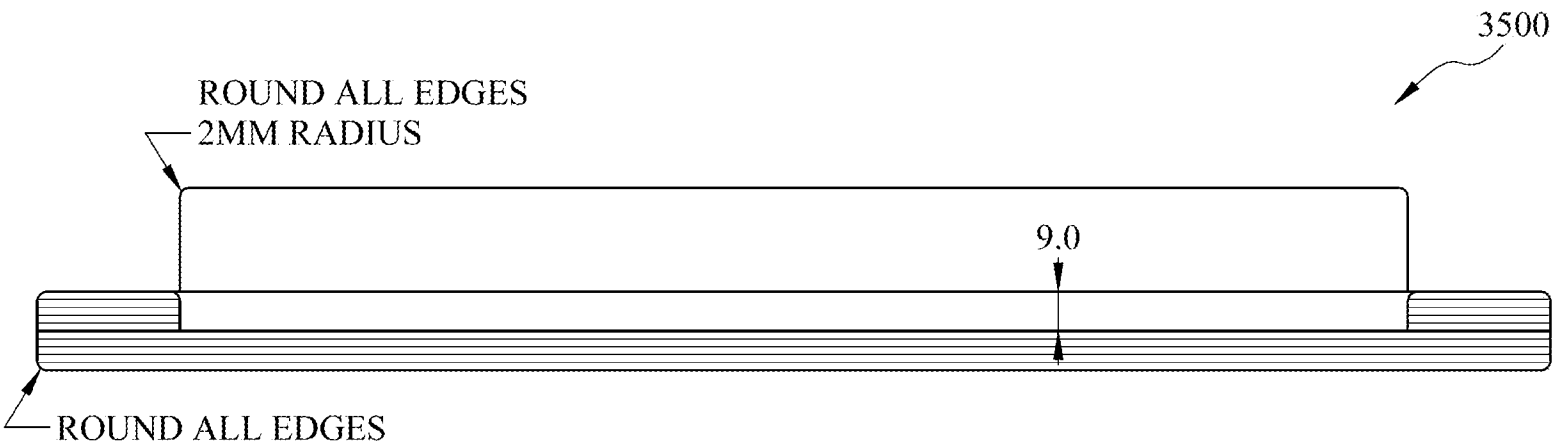
Figure 36A:
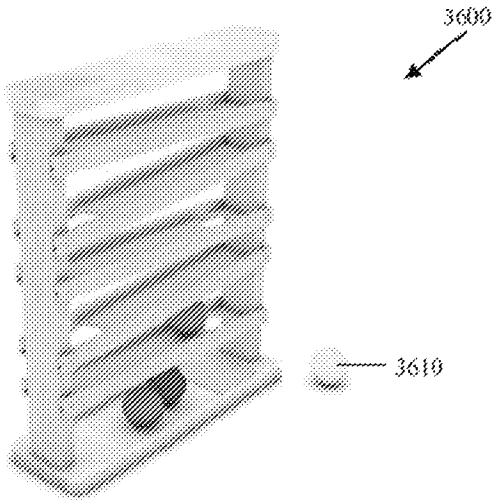
FIGS. 36A and 36B illustrate perspective views of a Level 4 Montessori toy, according to exemplary embodiments of the present invention.
Figure 36B:
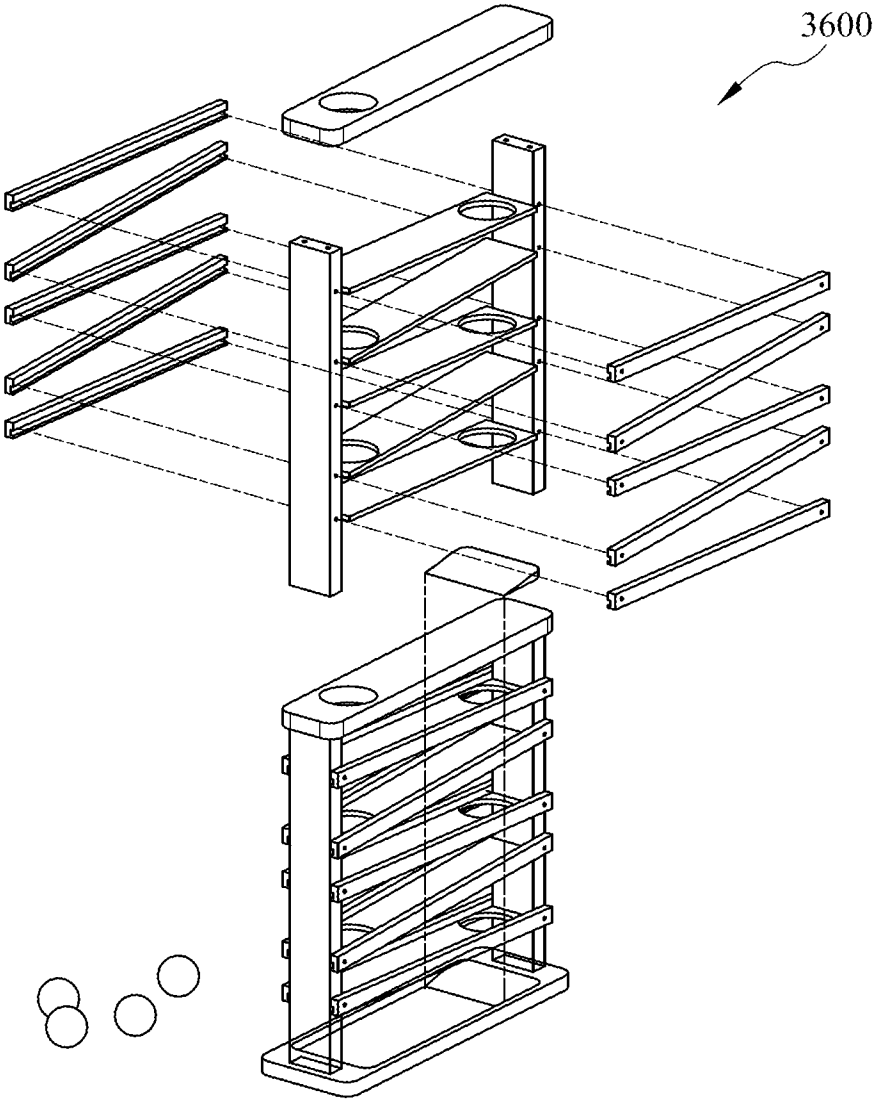
Figures 36C, 36D:
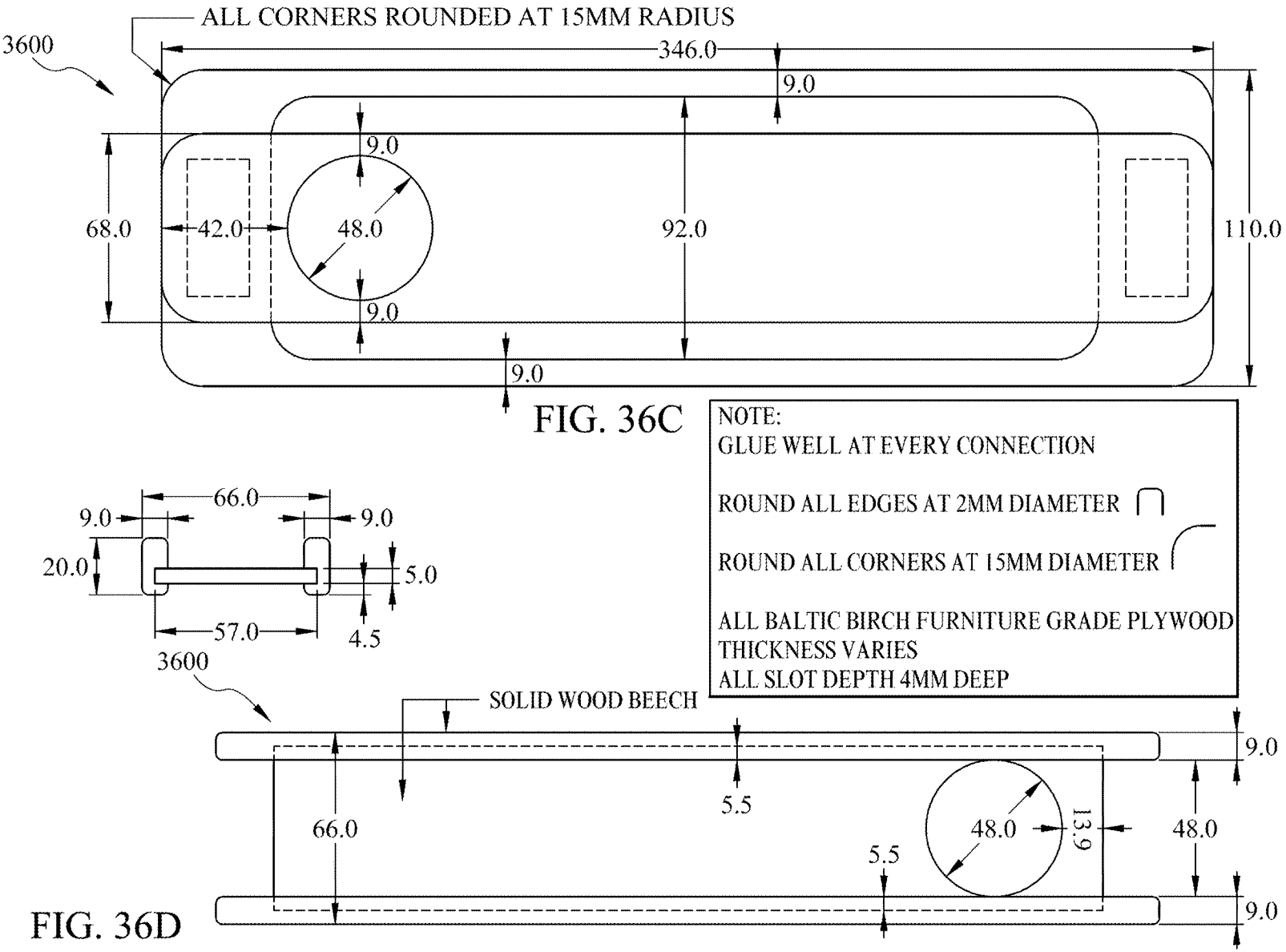
FIG. 36C illustrates a top view of a Level 4 Montessori toy, according to exemplary embodiments of the present invention.
FIGS. 36D and 36E illustrate side views of a Level 4 Montessori toy, according to exemplary embodiments of the present invention.
Figure 36E:
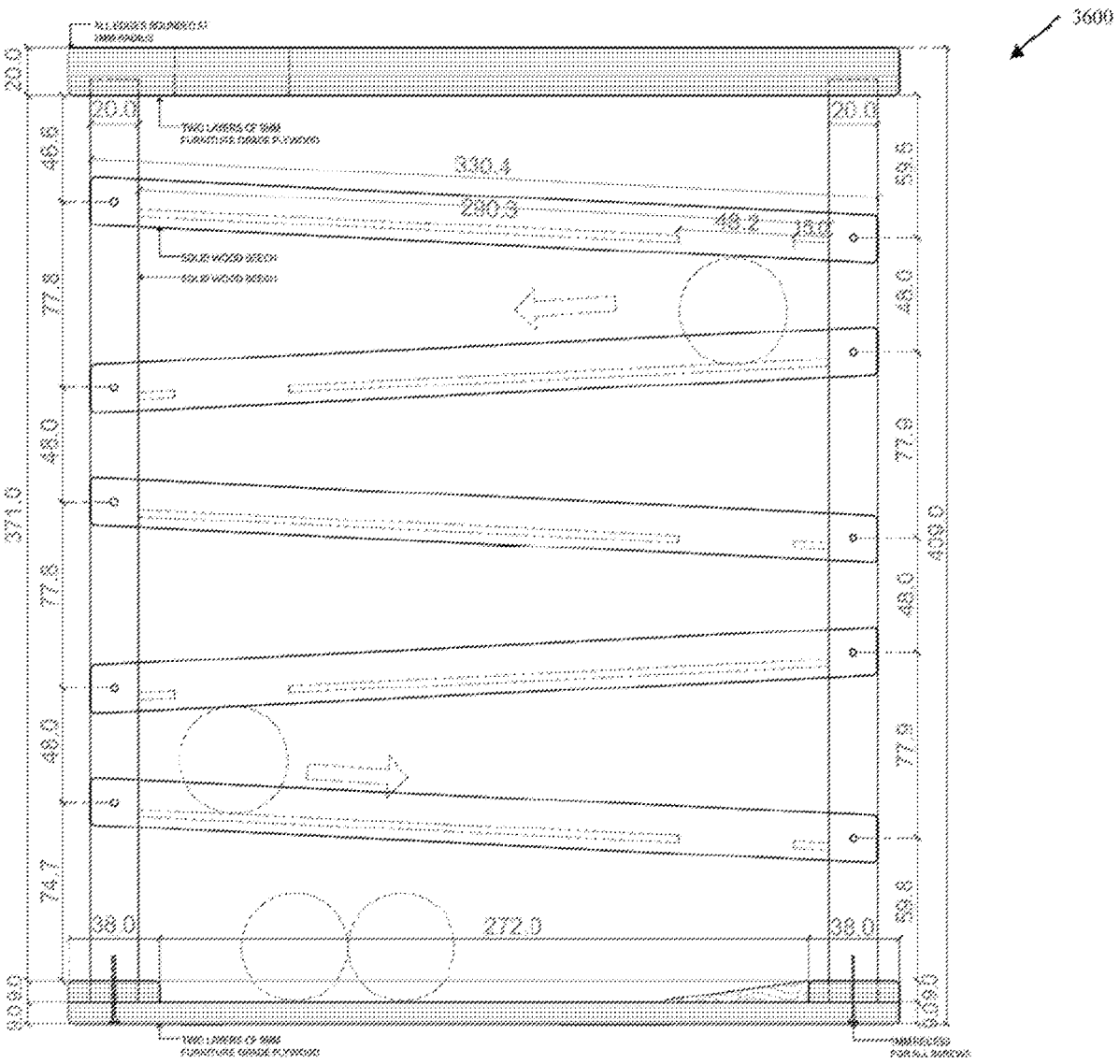
Figure 37A:
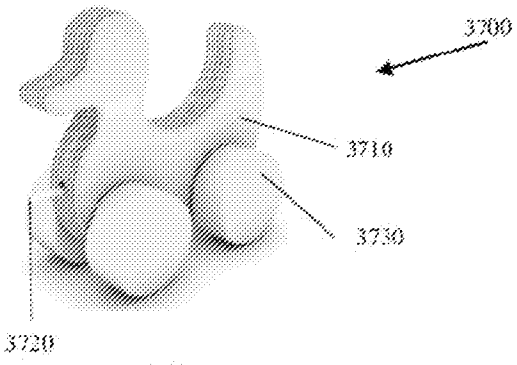
FIGS. 37A and 37B illustrate perspective views of a Level 5 Montessori toy, according to exemplary embodiments of the present invention.
Figure 37C:
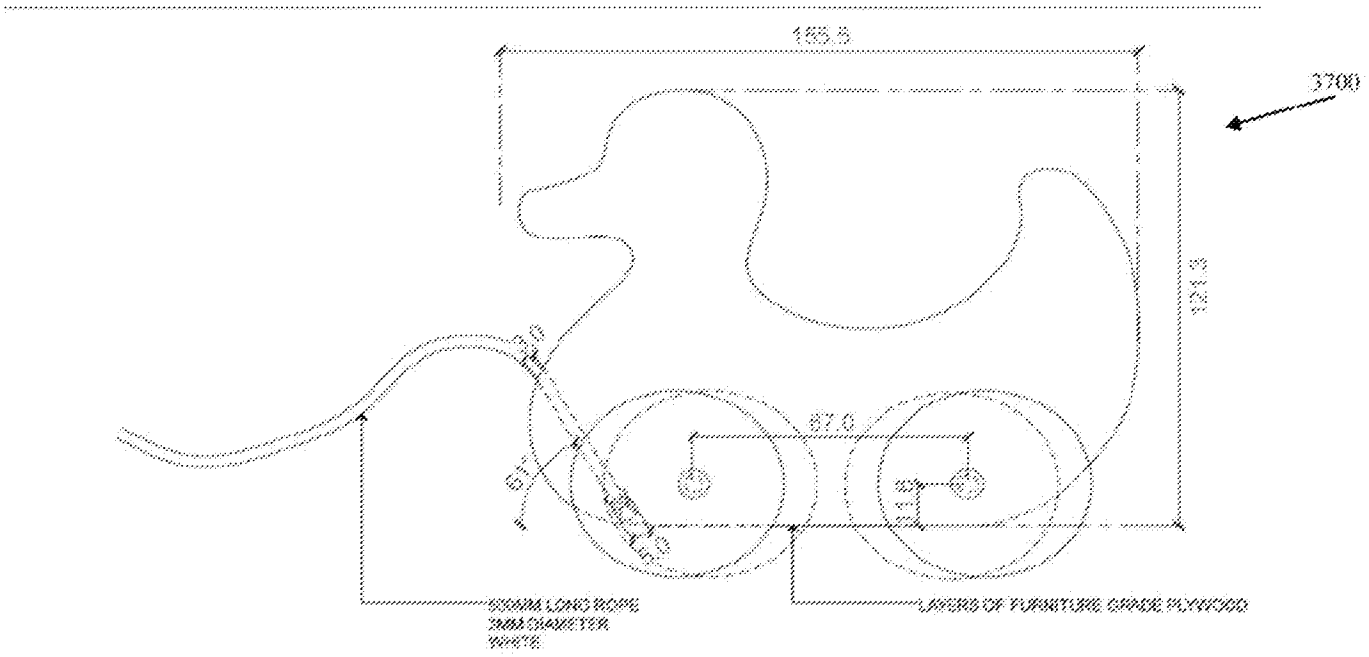
FIG. 37C illustrates a side view of a Level 5 Montessori toy, according to exemplary embodiments of the present invention.
Figure 37B:
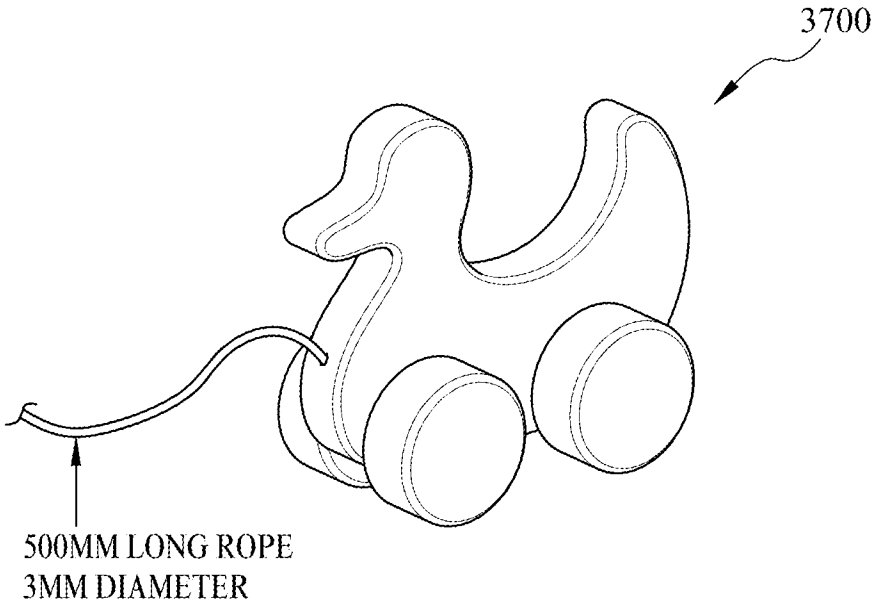
Figure 37E:
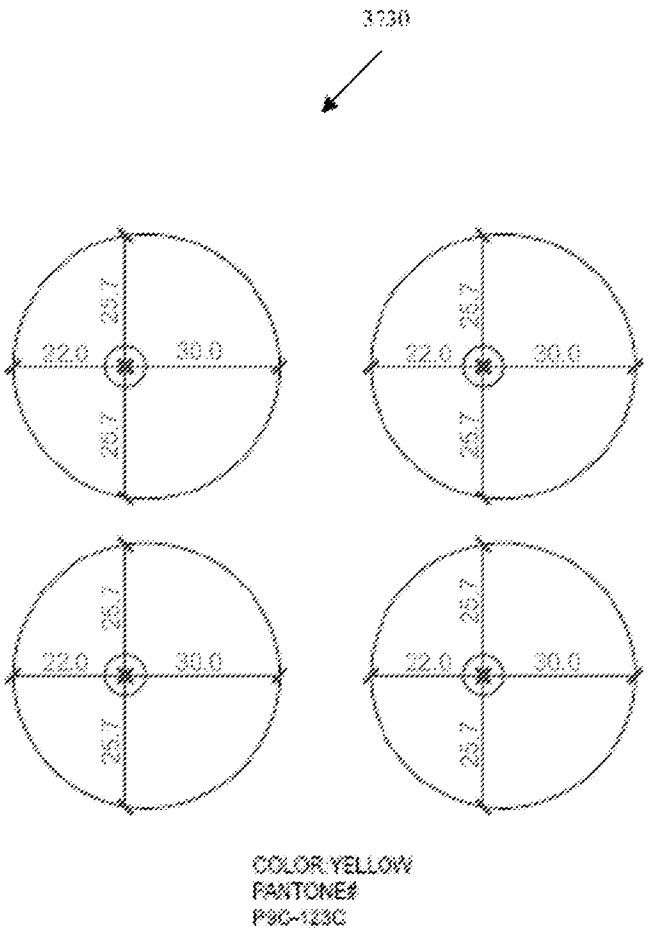
FIG. 37E illustrates side views of a component of a Level 5 Montessori toy, according to exemplary embodiments of the present invention.
Figure 37D:
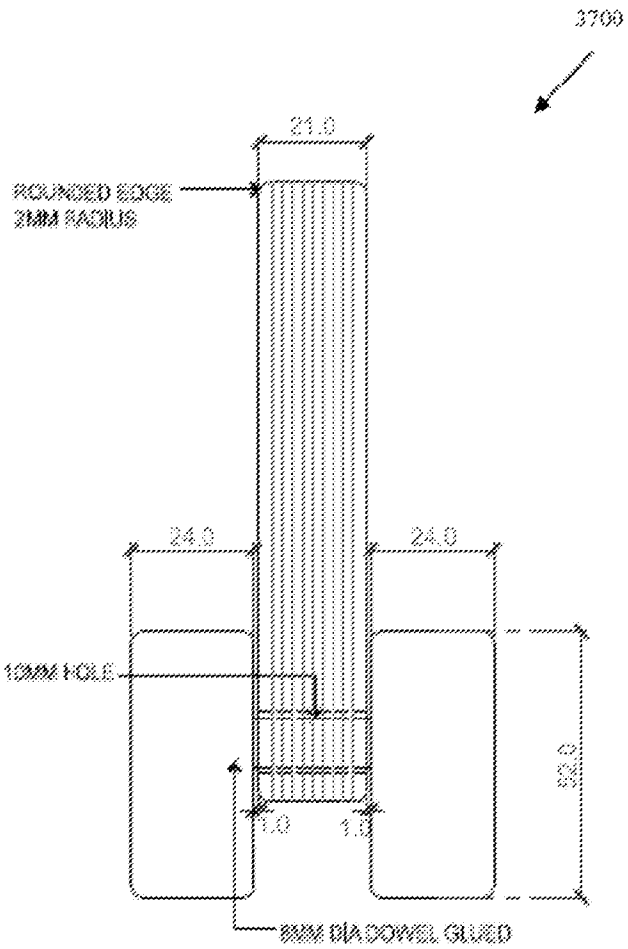
FIG. 37D illustrates an end view of a Level 5 Montessori toy, according to exemplary embodiments of the present invention.
Figure 38B:
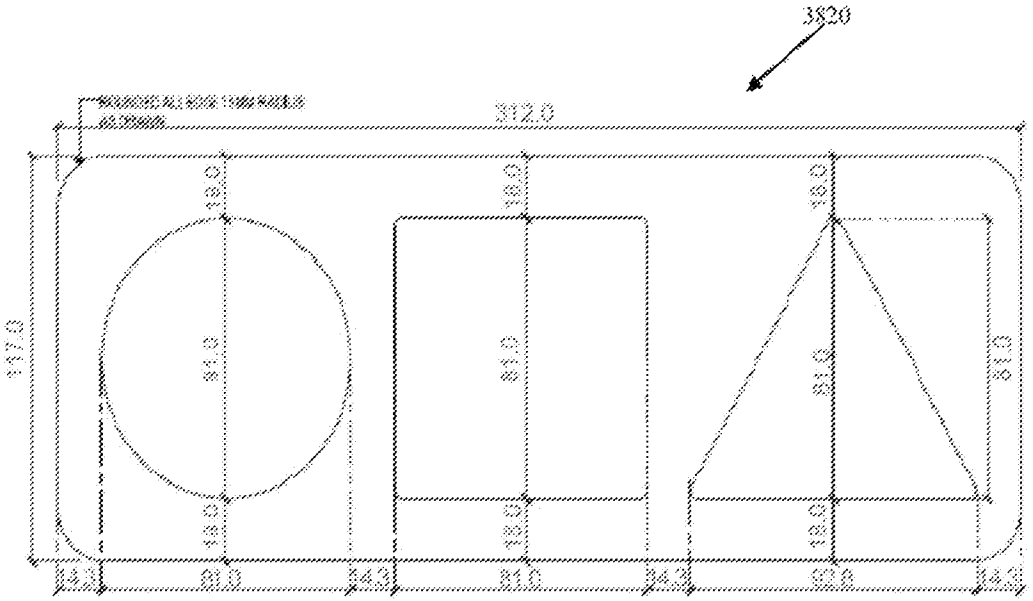
FIGS. 38B, 38C, 38E, and 38H illustrate top views of components of a Level 5 Montessori toy, according to exemplary embodiments of the present invention.
Figure 38A:
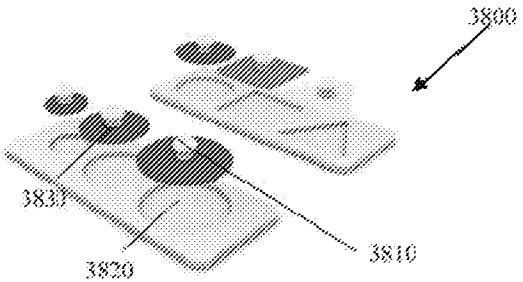
FIG. 38A illustrates a perspective view of a Level 5 Montessori toy, according to exemplary embodiments of the present invention.
Figure 38C:
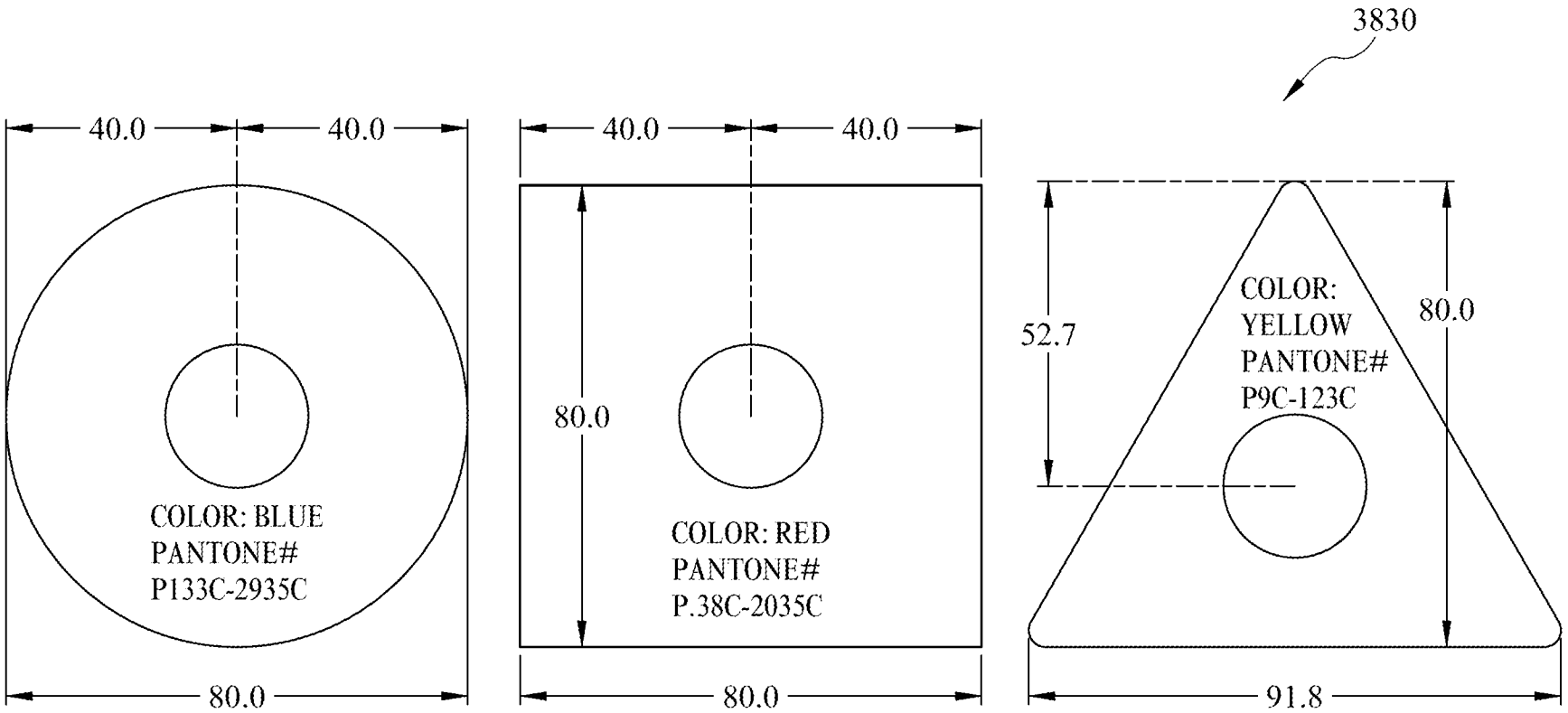
Figures 38D, 38E, 38F, 38G, 38H:
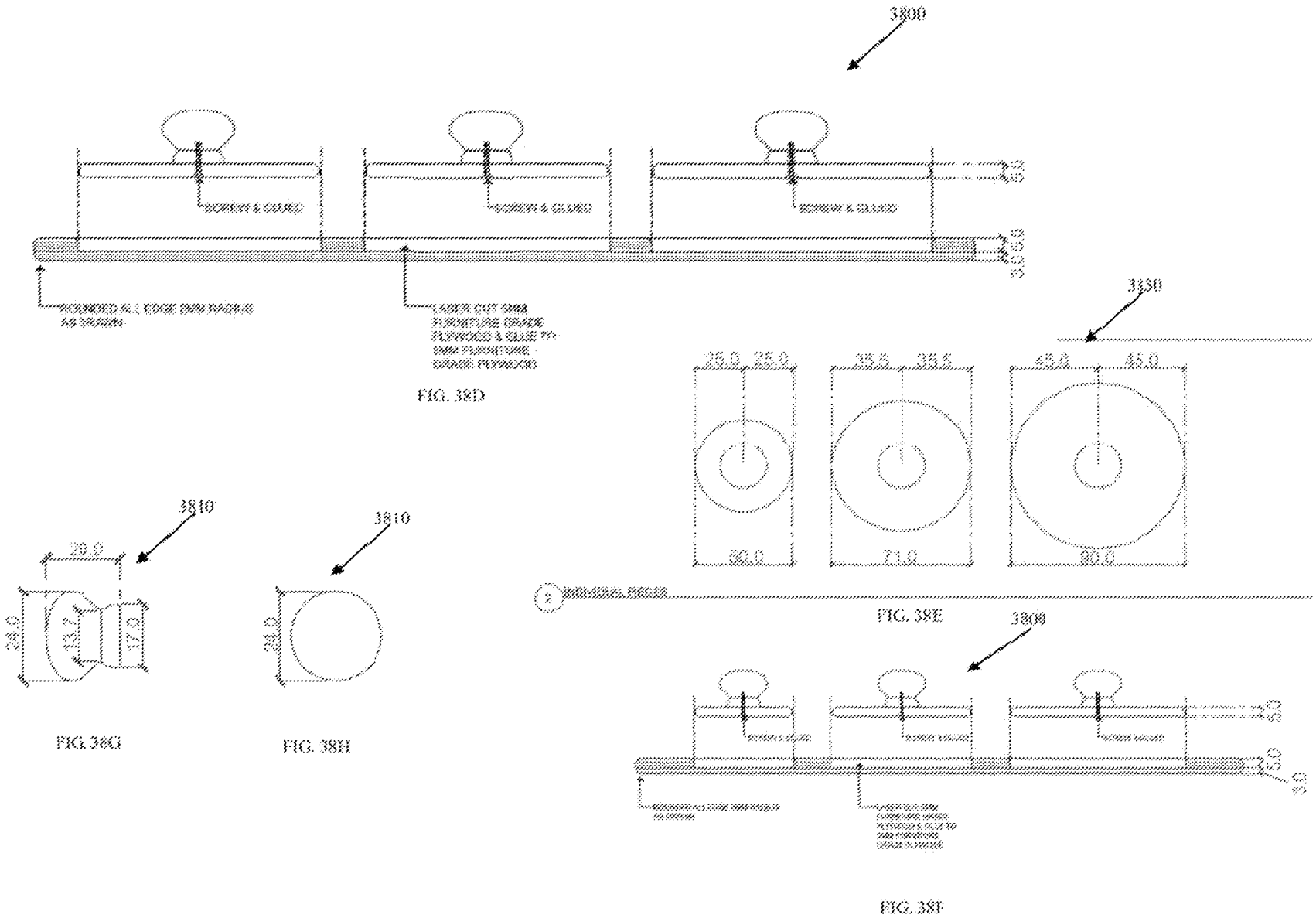
FIGS. 38D, 38F, and 38G illustrate side views of components of a Level 5 Montessori toy, according to exemplary embodiments of the present invention.
Figure 39B:
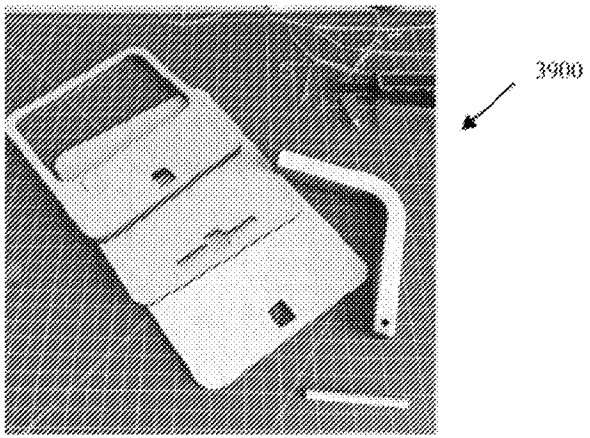
FIGS. 39B-39G illustrate perspective views of manufacturing a Level 5 Montessori toy, according to exemplary embodiments of the present invention.
Figure 39D:
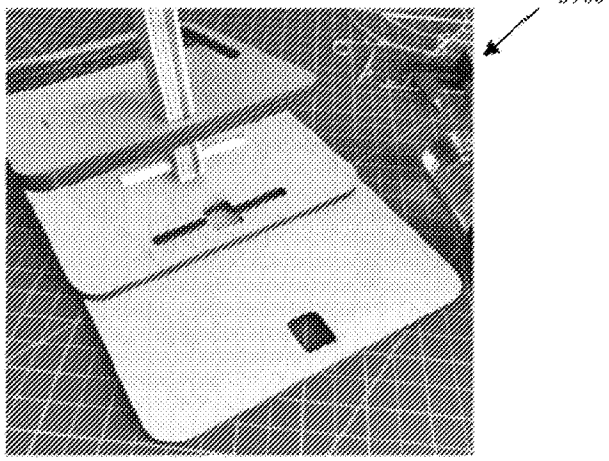
Figure 39A:
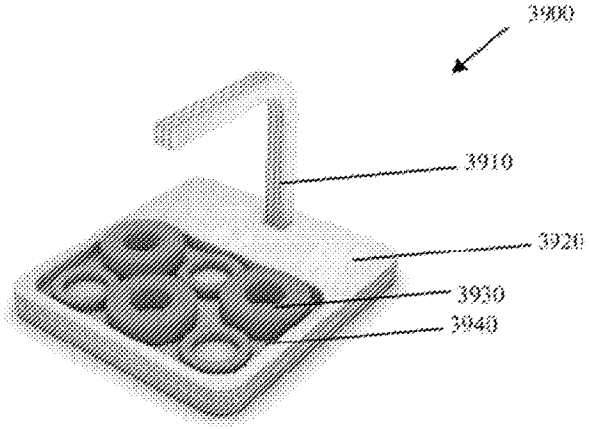
FIG. 39A illustrates a perspective view of a Level 5 Montessori toy, according to exemplary embodiments of the present invention.
Figure 39C:
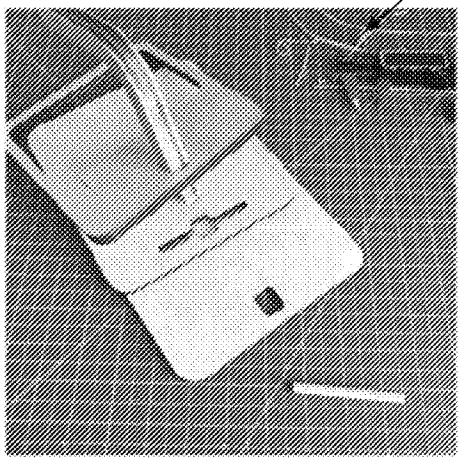
Figure 39F:
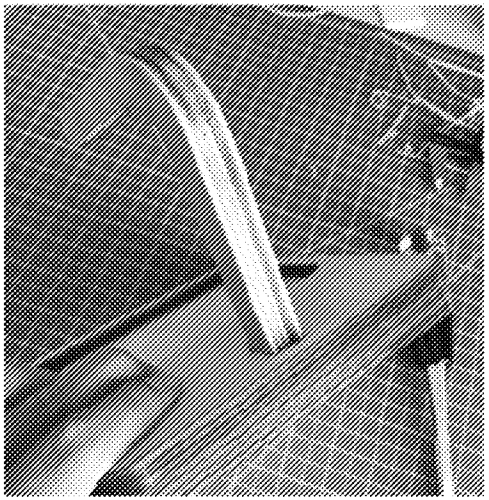
Figure 39H:
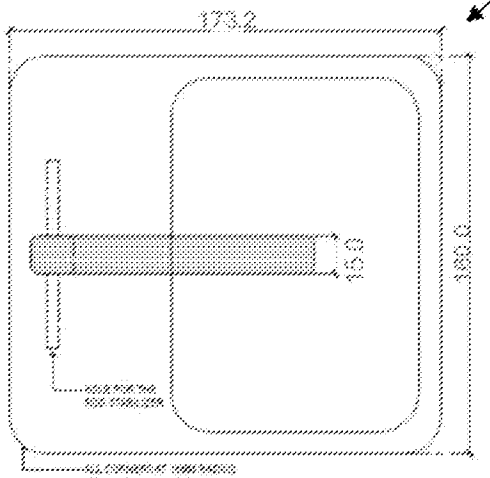
FIG. 39H illustrates a top view of a Level 5 Montessori toy, according to exemplary embodiments of the present invention.
Figure 39E:
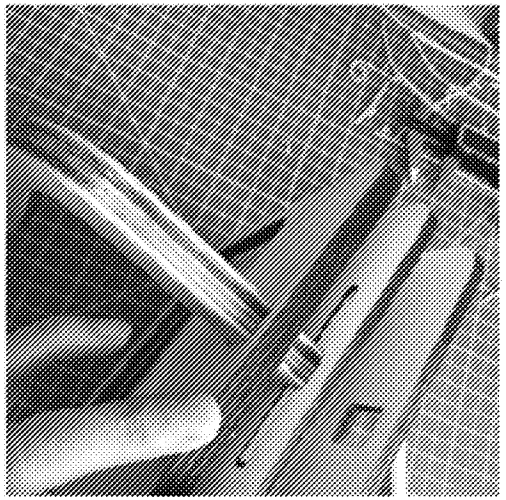
Figure 39G:
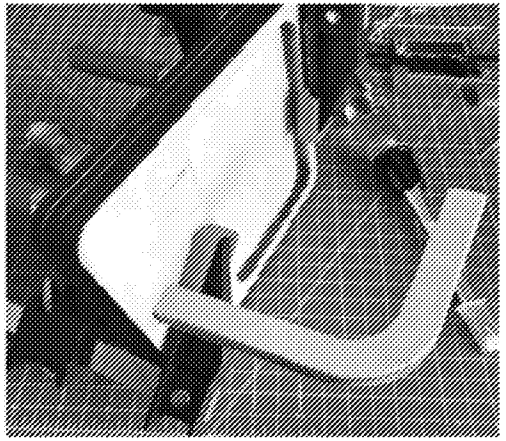
Figure 39J:
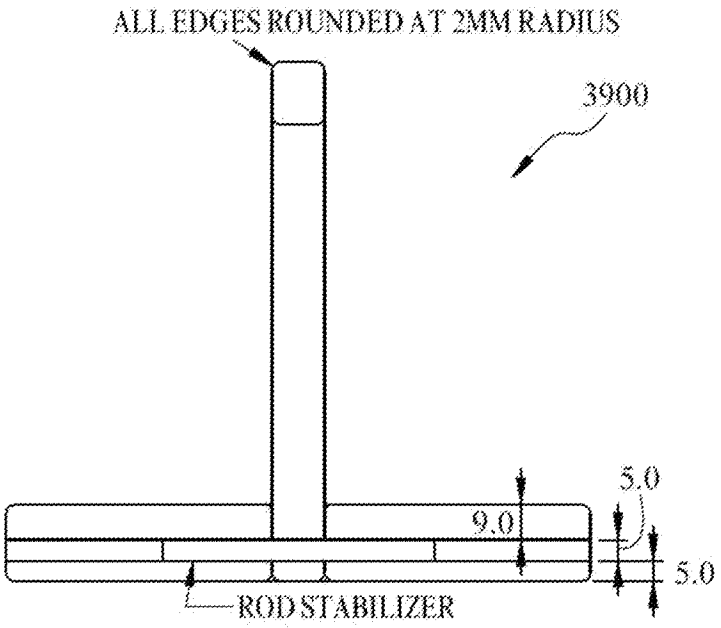
FIG. 39J illustrates an end view of a Level 5 Montessori toy, according to exemplary embodiments of the present invention.
Figure 39L:
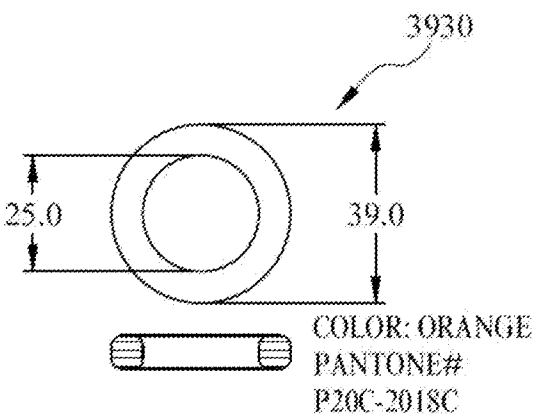
FIGS. 39K and 39L illustrate side views and stop views of components of a Level 5 Montessori toy, according to exemplary embodiments of the present invention.
Figure 39I:
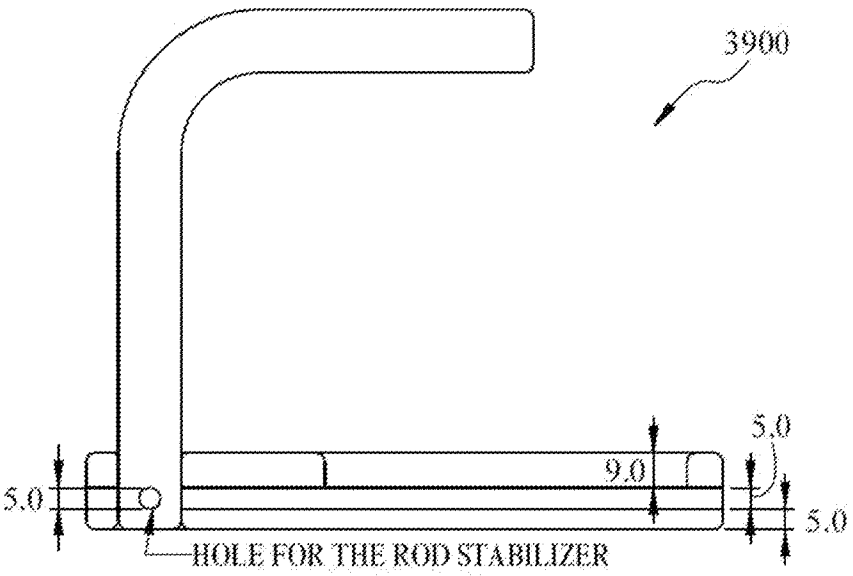
FIG. 39I illustrates a side view of a Level 5 Montessori toy, according to exemplary embodiments of the present invention.
Figure 39K:
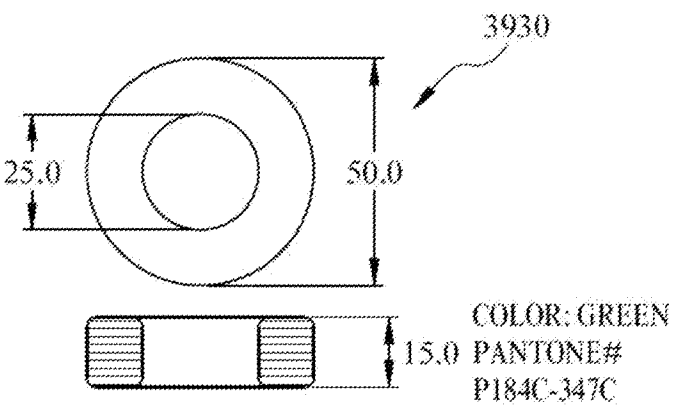
Figure 39N:
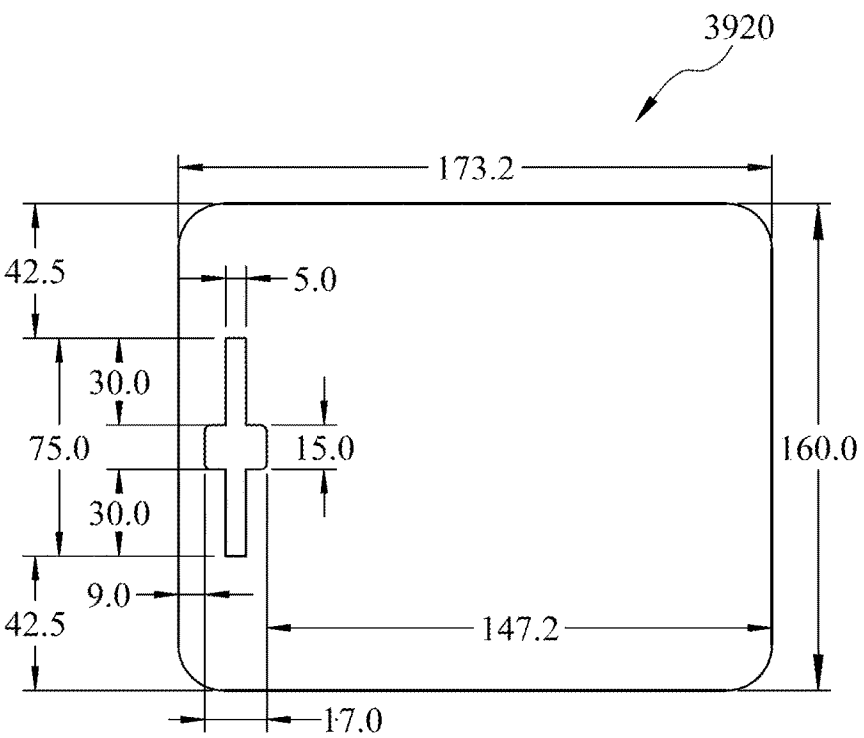
FIGS. 39M, 39N, and 39P illustrates top views of a component of a Level 5 Montessori toy, according to exemplary embodiments of the present invention.
Figure 39M:
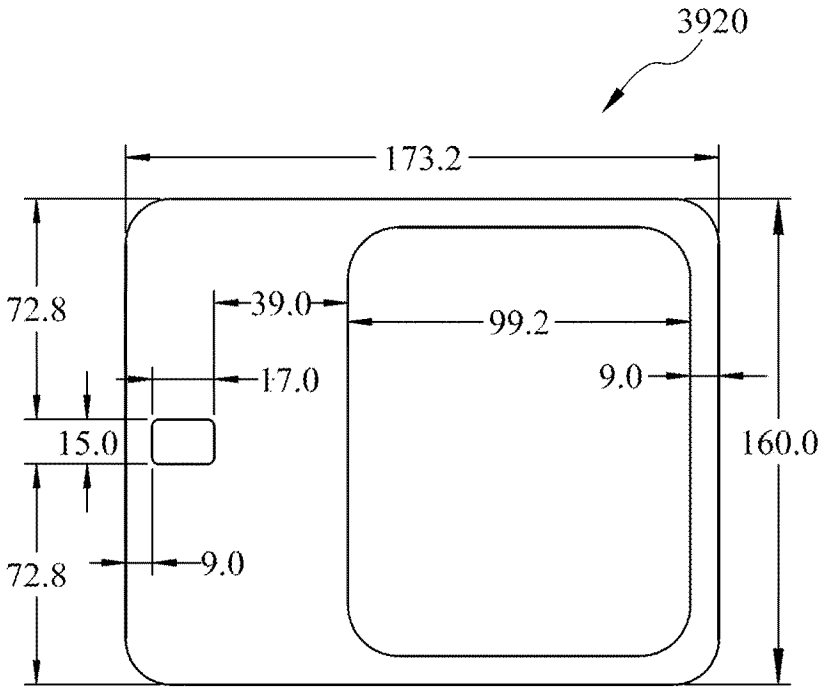
Figure 39O:
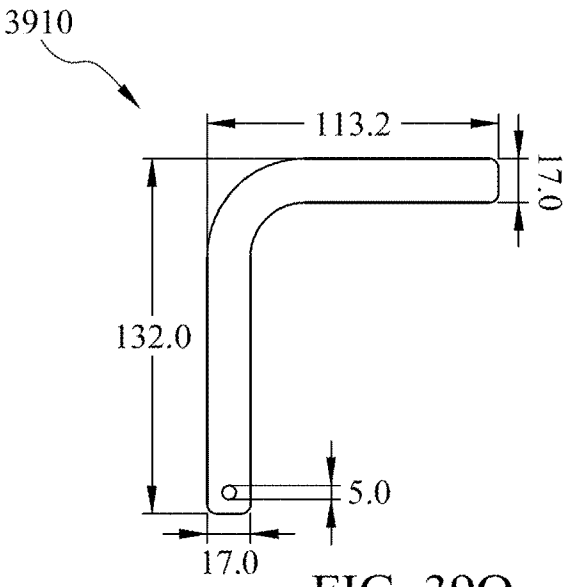
FIG. 39O illustrates a side view of a component of a Level 5 Montessori toy, according to exemplary embodiments of the present invention.
Figure 39Q:
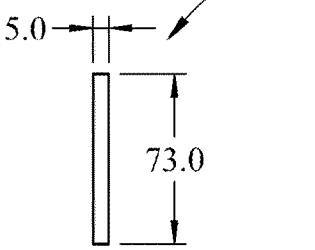
Figure 39P:
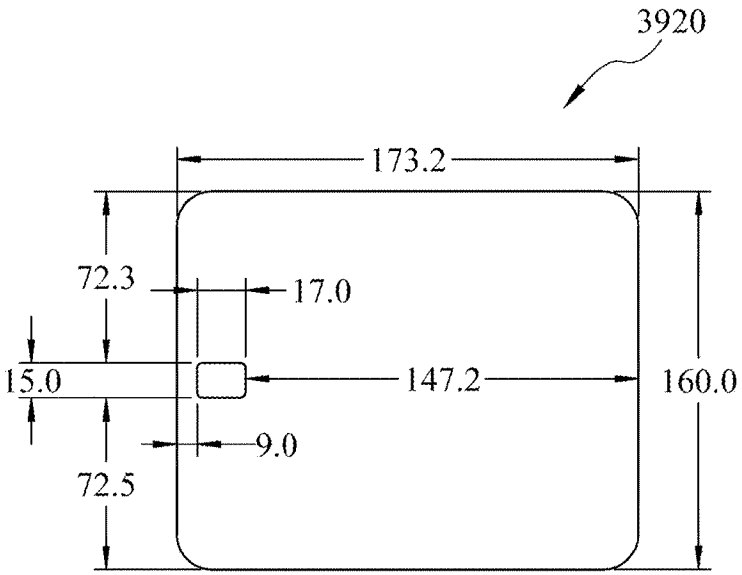
Figure 400:
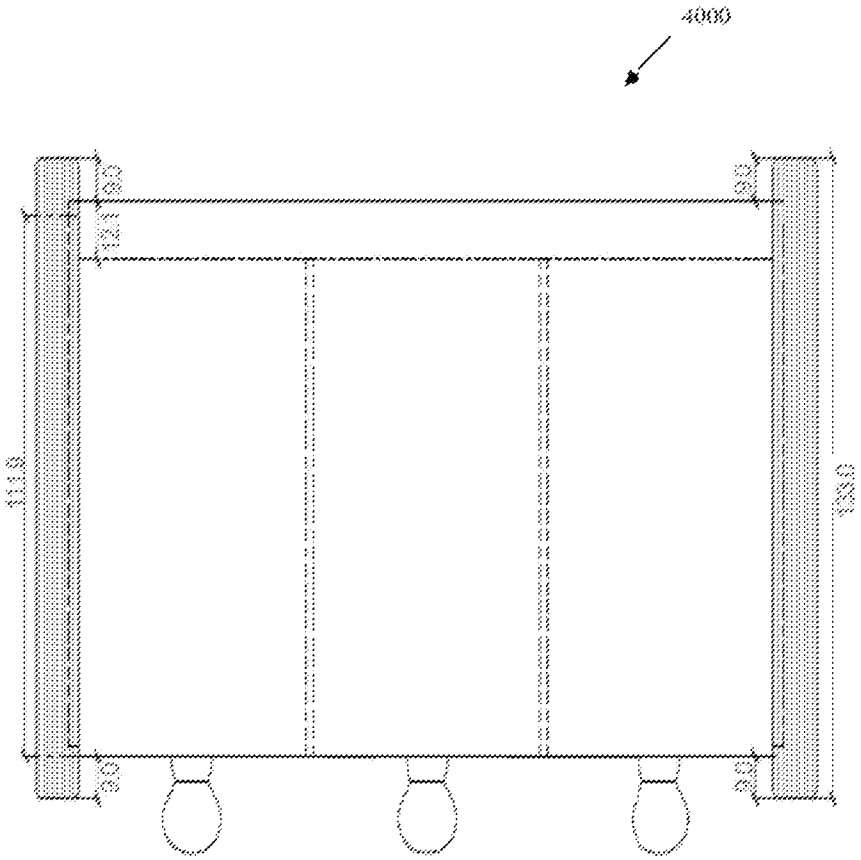

FIG. 34A-34T illustrate various views of a Level 4 Montessori toy called the First Puzzles 3400, according to exemplary embodiments of the present invention. The AMI teacher's training manual, for children between the age of 0-3 years, describes a similar toy that is manufactured by other companies. However, none of those toys have passed the safety tests. Previous design iterations failed because the puzzle knob 3410 kept detaching during tension testing. In some embodiments, the puzzle knob 3410 is attached to the shapes 3430 which are connected to base 3420 using fastening methods such as glue, screws, Velcro, etc., or any combinations thereof. In some embodiments, the dimensions of the First Puzzles 3400 and its various components may be as described in 34B-34T.

FIGS. 35A-35F illustrate various views of a Level 4 Montessori toy called the Peg Box 3500, according to exemplary embodiments of the present invention. The AMI teacher's training manual, for children between the age of 0-3 years, describes a similar toy that is manufactured by other companies. However, none of those toys have passed the safety tests. Previous design iterations failed safety tests because the tray 3510 broke apart from the peg holder 3530. Multiple experiments were performed to figure out how to connect them in a way that could pass the safety tests. Designing the pegs 3520 took many experiments because the standard existing design, as depicted in http://shop.heutink-usa.com/imbucare-peg-box.html, is a peg with a spherical top, which violates the safety regulation that prohibits shafts with spherical or nearly spherical ends. Other designs in the market contain pegs that are cylindrical, but they do not meet the educational purpose of the Peg Box 3500, in which the pegs 3520 should be able to fit into the holes 3540 in only one direction. In some embodiments, the pegs 3520 only fits into the holes 3540 in one direction, thereby passing both safety and educational standards. In some embodiments, the dimensions of the Peg Box 3500 and its various components may be as described in 35B-35F.

FIGS. 36A-36H illustrate various views of a Level 4 Montessori toy called the Tracker 3600, according to exemplary embodiments of the present invention. The AMI teacher's training manual, for children between the age of 0-3 years, describes a similar toy. Previous design iterations failed because they broke during drop testing. After performing multiple experiments, the Tracker's 3600 optimal weight in order to not break during drop testing was determined. In some embodiments, the Tracker 3600 weighs more than 3 lbs. In some embodiments, the Tracker 3600 weighs 3 lbs. In some embodiments, the size, shape, and weight of the balls 3610 was also changed to not pose a small ball hazard. In some embodiments, the dimensions of the Tracker 3600 and its various components may be as described in 36B-36G. In some embodiments, the dimensions of the Tracker 3600 and its various components may be as described in 36B-36H.

FIGS. 37A-37E illustrate various views of a Level 5 Montessori toy called the Pull Toy 3700, according to exemplary embodiments of the present invention. The Pull Toy 3700 may include a duck 3710, a string 3720, and wheels 3730. Other companies such as Papa Don's Toys also manufactures similar ducks, but they do not pass the safety test. Previous design iterations also failed the safety tests because the ducks 3710 were made out of plywood and the duck's 3710 head broke during drop testing. After multiple experiments, it was determined that the ducks 3710 would remain intact during a drop test if the width of the duck 3710 was increased. In toys manufactured by other companies, the string was attached to the duck 3710 using metal hooks posing a severe safety risk. In some embodiments, the string 3720 may be threaded through two holes on the duck's 3710 body. In some embodiments, the string 3720 may be knotted and glued to prevent disconnection. In some embodiments, the string 3720 may be fastened to the duck 3710 by some other safe means. In some embodiments, the dimensions of the Pull Toy 3700 and its various components may be as described in 37B-37E. Any other dimensions that may make the Pull Toy 3700 safety compliant may also be used.

FIGS. 38A-38H illustrate various views of a Level 5 Montessori toy called the Multishape Puzzles 3800, according to exemplary embodiments of the present invention. The AMI teacher's training manual, for children between the age of 0-3 years, describes a similar toy that is manufactured by other companies. However, none of those toys have passed the safety tests. Previous design iterations failed because the puzzle knob 3810 kept detaching during tension testing. In some embodiments, the puzzle knob 3810 is attached to the shapes 3830, which are connected to the base 3820 using fastening methods such as glue, screws, Velcro, etc., or any combinations thereof. In some embodiments, the dimensions of the Multishape Puzzles 3800 and its various components may be as described in 38B-38H.

FIGS. 39A-39E illustrate various views of a Level 5 Montessori toy called the Curved Dowel 3900, according to exemplary embodiments of the present invention. The AMI teacher's training manual, for children between the age of 0-3 years, describes a similar toy that is manufactured by other companies, such as Heutink that uses metal rods and Alison's Montessori that uses wooden rods. Neither of them has passed the safety tests and neither include rings of different sizes for varying challenges. Previous design iterations failed the safety tests. Multiple experiments were performed to determine how to connect the curved dowel 3910 to the base 3930 to prevent breaking and cracking during a drop test. The curved dowel 3910 may be attached to the base 3930 using a rod stabilizer that passes through a hole in the curved down 3910 and the base 3910. In some embodiments, the ring 3920 may be designed to an appropriate size. In some embodiments, rings 3920 of two different sizes may be added to increase the educational value of the Curved Dowel 3900. In some embodiments, the rings 3920 may be of different colors. The rings 3920 may sit on a valley 3940 on the base 3930. The base 3920 may be made of multiple leaves of safety compliant material stacked on top of each other. The Curved Dowel 3900 may be glued well at every connection or attached by any other fastening methods. The edges of the Curved Dowel 3900 may be rounded at approximated 2 mm. The corners of the Curved Dowel 3900 may be rounded at approximately 15 mm diameter. The leaves may be made of Baltic birch furniture grade plywood or any other safety compliant material. In some embodiments, the rings 3920 may be of the same color. In some embodiments, the dimensions of the Curved Dowel 3900 and its various components may be as described in 39H-39Q. The Curved Dowel 3900 may have a robust internal assembly and may be carved from any safety compliant wood. In some embodiments, the Curved Dowel 3900 may be put together as illustrated in FIGS. 38B-39G.

FIGS. 40A-40L illustrate various views of a Level 5 Montessori toy called the Box with Bins 4000, according to exemplary embodiments of the present invention. The AMI teacher's training manual, for children between the age of 0-3 years, describes a similar toy that is manufactured by other companies. However, none of those toys have passed the safety tests and they do not include coins for sorting. Also, the manual specifies that when a child opens the bin 4030 it should stay open until the child closes it. Few of the existing Box with Bins meet this need. Multiple experiments were performed to ensure the highest standards of education and safety. Fifteen different previous design iterations were tested in order to finalize a design that passes the safety test. Safety testing firms were hired to help but were unsuccessful. The safety testing firms suggested that the toy cannot be made in wood and that it should be made in plastic. The Box with Bins's 4000 size, weight, thickness, design structure, wood thickness at different places, and wood composition was changed multiple times. After performing multiple experiments, the Box with Bins's 4000 optimal weight in order to not break during drop testing was determined. In some embodiments, the Box with Bins's 4000 weighs more than 3 lbs. In some embodiments, the Box with Bins's 4000 weighs 3 lbs. In some embodiments, color coded coins 4020 may be added to the Box with Bins's 4000 for sorting. In some embodiments, the dimensions of the Box with Bins 4000, bins 4030, box 4010, knobs 4040, and coins 4020, and other components may be as described in 40B-40L.

FIGS. 41A-41G illustrate various views of a Level 5 Montessori toy called the Coin Box 4100, according to exemplary embodiments of the present invention. The AMI teacher's training manual, for children between the age of 0-3 years, describes a similar toy that is shaped like a treasure chest, which does not pass the drop test and does include different shapes that are mathematically proportional to maximize educational value like the Coin Box 4100 design. Some manufacturers make it with a drawer, which also does not pass the drop test. In some embodiments, the Coin Box 4100 may include unique design for the box 4110 and lid 4120. In some embodiments, the assortment of coins 4130 may also be unique with shapes that may be mathematically proportioned to maximize the educational value. Multiple experiments were performed to determine the design that would pass the safety tests. In some embodiments, the Coin Box 4100 may be painted according to the Monti kids' methods described above. In some embodiments, the dimensions of the Coin Box 4100 and its various components may be as described in 41B-41G.

Figure 42Q:
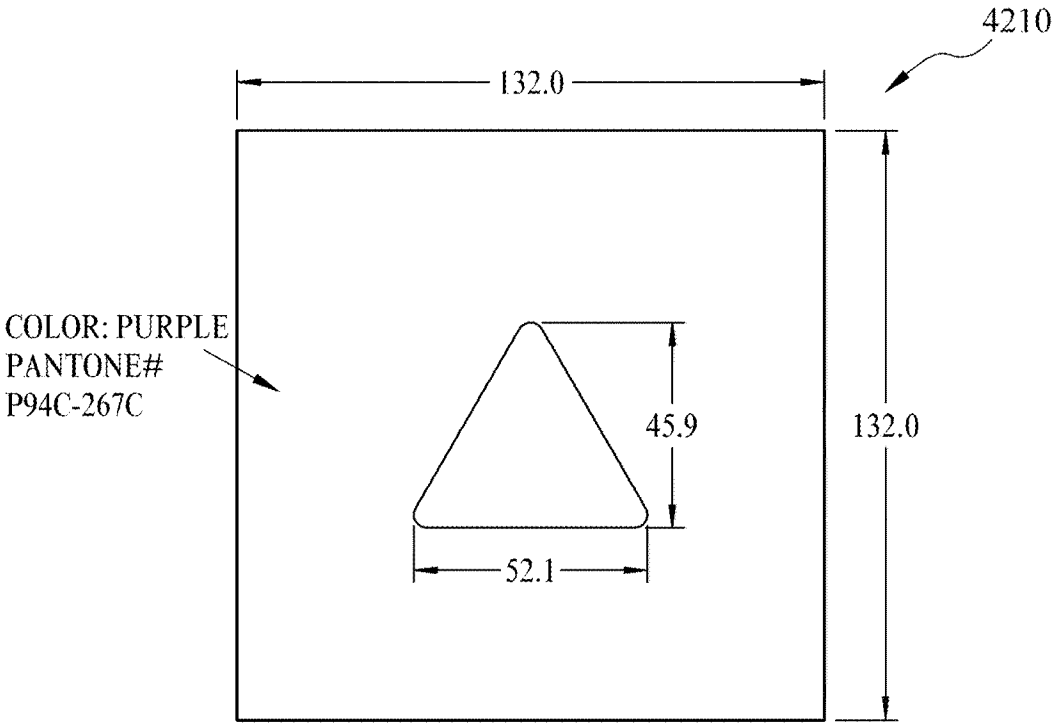

FIGS. 42A-42Q illustrate various views of a Level 5 Montessori toy called the Mail Box 4200, according to exemplary embodiments of the present invention. The AMI teacher's training manual, for children between the age of 0-3 years, describes a similar toy that has a sliding top lid, which does not pass the drop test. Some manufacturers make it with a drawer, which also does not pass the drop test. In some embodiments, the Mail Box 4200 may include a unique design for the box 4230 and lid 4240. The Mail Box 4200 may also include shapes 4220 and stencils 4210 with holes. A problem with the existing designs is that the shapes can fit in each other's hole. Multiple experiments were performed to arrive at the design that passed the safety test while ensuring that the shapes 4220 fit into only one hole each in order to maximize the educational value. In some embodiments, the shapes may be made of any color. In some embodiments, the Mail Box 4200 may be painted according to the Monti Kids methods described above. The Mail Box 4200 may be glued well at every connection or attached by any other fastening methods. The edges of the Mail Box 4200 may be rounded at approximated 2 mm. The corners of the Mail Box 4200 may be rounded at approximately 15 mm diameter. The components of the Mail Box 4200 may be made of Baltic birch furniture grade plywood or any other safety compliant material. In some embodiments, the shapes 4220 and the stencils 4210 may be the same color, such as purple. In other embodiments, the colors may vary. In some embodiments, the dimensions of the Mail Box 4200 and its various components may be as described in 42D-42Q.

FIGS. 43A-43E illustrate various views of a Level 6 Montessori toy called the Shapes on Pegs 4300, according to exemplary embodiments of the present invention. It may include pegs 4330, base board 4310, and shapes 4340. The AMI teacher's training manual, for children between the age of 0-3 years, describes multiple pegs on a base each with different shapes to thread. The Shapes on Pegs 4300 may be used with different shapes, thus eliminating the need for multiple pegs. In some embodiments, Shapes on Pegs 4300 may combine different activities into one, including a tray 4310 in the base 4320 to make it easy to use in the home. Previous design iterations failed safety tests because the dowels 4330 broke off during the drop test and/or the sphere 4340 posed a small ball hazard. Multiple experiments were performed to develop a design that would pass the safety tests. In some embodiments, the dimensions of the Shapes on Pegs 4300 and its various components may be as described in 43B-43E.

FIGS. 44A-44G illustrate various views of a Level 6 Montessori toy called the Bolt Board 4400, according to exemplary embodiments of the present invention. The AMI teacher's training manual, for children between the age of 0-3 years, describes a toy with a basket with large wooden nuts and bolts. In some embodiments, the Bolt Board 4400 by Monti Kids redesigned that toy to make it stable and easier to use for children aged 0-3 years. In some embodiments, the Bolt Board 4400 may include a toy on the board 4410 making it easier for parents to use at home. In some embodiments, the bolts 4420 may include at least two different lengths. In some embodiments, the bolts 4420 may include at least three different lengths for increased educational value. In some embodiments, the dimensions of the Bolt Board 4400 and its various components may be as described in 44B-44G. In some embodiments, the toys on the board 4410 may be of any color.

FIGS. 45A-45H illustrate various views of a Level 6 Montessori toy called the Language Set 4500, according to exemplary embodiments of the present invention. The AMI teacher's training manual, for children between the age of 0-3 years, contains many language activities that calls for replicas of objects and paper cards with photos of objects. For example, in some embodiments, the Language Set 4500 may contain photos of various people with various professions, as depicted in the FIGS. 45B-45H. Generally, Montessori teachers source plastic replicas from different places and make or purchase the paper cards. In some embodiments, the Language Set 4500 may be designed to reflect the purpose of the toy as described in the manual. In some embodiments, the tray 4510 may be made out of wood. The tray 4510 may also be made out of any other material that passes the safety tests. In some embodiments, the Language Set 4500 may be made out of plywood. After failing several times, current designs that passed and are depicted in some of the exemplary embodiments were developed. In some embodiments, the dimensions of the Language Set 4500 and its various components may be as described in 45B-45H.

FIGS. 46A-46K illustrate various views of a Level 6 Montessori toy called the Motor Planning Box 4600, according to exemplary embodiments of the present invention. The AMI teacher's training manual, for children between the age of 0-3 years, describes a similar toy that is manufactured by other companies. However, none of those toys have passed the safety tests. Additionally, the manual specifies the importance that when a ball is put into the hole 4610 and the drawer 4630 is open, the drawer 4630 should not be able to close. But other companies do not meet this requirement. Multiple experiments were performed to develop a design that meets the highest standards of education and safety. Multiple experiments were performed to ensure the highest standards of education and safety. Fifteen different previous design iterations were tested in order to finalize a design that passes the safety test. Safety testing firms were hired to help but were unsuccessful. The safety testing firms suggested that the toy cannot be made in wood and that it should be made in plastic. The Motor Planning Box 4600 and the drawer's 4630 size, weight, thickness, design structure, wood thickness at different places, and wood composition was changed multiple times. In some embodiments, the ball's size, material, and color was changed. In some embodiments, different parts of the Motor Planning Box 4600 were painted in any color according to the Monti Kids' method of painting as described above. In some embodiments, the dimensions of the Motor Box 4600, knob 4640, box, 4620, hole 4610, drawer 4630, and other components may be as described in 46B-46K.

FIGS. 47A-47I illustrate various views of a Level 6 Montessori toy called the Bead Stringing 4700, according to exemplary embodiments of the present invention. The AMI teacher's training manual, for children between the age of 0-3 years, describes a bead stringing activity with different sizes of tiny beads and a string with a metal needle on the end. That design does not pass the safety testing. Monti kids designed a unique set of beads to teach children using a progression of difficulty. In some embodiments, the Bead Stringing 4700 may include a wooden needle 4710 and a wooden stopper 4720 at the end of the string 4730 to make it age appropriate. In some embodiments, the needle 4710 may be painted white so that young children can distinguish between the needle 4710 and the stopper 4720. Other distinguishing colors may also be used. In some embodiments, the string may be under 12 cm long. In some embodiments, the beads 4740 may be made out of wood. In some embodiments, the beads 4740 may be introduced in a progression to maximize the educational value for children aged 0-3 years. In some embodiments, the beads 4740 may of the same color. In some embodiments, the beads 4740 may be of different color. In some embodiments, the beads 4740 may of the same shape. In some embodiments, the beads 4740 may be of different shape. The most critical safety test that had to be passed for this toy was the 4.14 (ASTM F963-08), Cords, Straps, and Elastics (effective date Dec. 31, 2011). In some embodiments, the dimensions of the Bead Stringing 4700 and its various components may be as described in FIGS. 47D-47I.

FIGS. 48A-48K illustrate various views of a Level 6 Montessori toy called the Sorting 4800, according to exemplary embodiments of the present invention. The AMI teacher's training manual, for children between the age of 0-3 years, describes a similar sorting activity using household objects to sort such as walnuts and shells. These objects do not pass safety tests. Accordingly, multiple experiments were performed to invent objects that would pass the safety tests and also serve the purpose of the toys. During the experiments, a series of wooden shapes 4820 to be introduced in a progression were designed. A unique set of shapes 4820 and the way to introduce them into the Sorting 4800 toy was invented. In some embodiments, the shapes 4820 may be of the same color. In some embodiments, the shapes 4820 may be of different colors. A unique tray 4810 was also invented. Montessori teachers typically use a food serving tray that has one large compartment and two small compartments, which can be found in kitchen stores and is typically solid wood and round. In some embodiments, the tray 4810 may include handles different shapes and sizes. In some embodiments, the Sorting 4800 and/or its individual components may be made out of plywood. In some embodiments, the dimensions of the Sorting 4800 and its various components may be as described in FIGS. 48E-48K.

FIGS. 49A-49C illustrate various views of a Level 7 Montessori toy called the Push Toy 4900, according to exemplary embodiments of the present invention. The AMI teacher's training manual, for children between the age of 0-3 years, describes a push toy with very few details, as these are commercially available. Some toy companies make a version of a push toy but only few have passed safety testing for children aged 0-3 years and few are sized appropriately for this age group. In some embodiments, the Push Toy 4900 is smaller than most push toys on the market making the Push Toy 4900 suitable for children aged 0-3 years. In some embodiments, the dimensions of the Push Toy 4900 and its various components may be as described in FIG. 49 C, which is incorporated by reference in its entirety.

FIGS. 50A-50F illustrate various views of a Level 7 Montessori toy called the Dressing Frames 5000, according to exemplary embodiments of the present invention. The AMI teacher's training manual, for children between the age of 0-3 years, describes a similar toy; however, each fabric is on a separate wooden frame. In some embodiments, the Dressing Frames 5000 may include a frame 5010. In some embodiments, the frame 5010 may be disassembled. In some embodiments, the fabric 5020 of the frame 5010 may be switched—a feature that may make the wooden frames more suitable for homes since parents of children aged 0-3 years do not need to keep multiple wooden frames for each fabric. In some embodiments, the fabric 5020 may have dimensions as described in FIG. 50C. In some embodiments, the fabric 5020 may be blue with a white top. In some embodiments, any other combination of colors or a single color may be used for the fabric 5020. In some embodiments, the fabric 5020 may be made of 100% cotton light weight twill. In some embodiments, any other safety test compliant material may be used for the fabric 5020. In some embodiments, the fabric 5020 may have a Chevron/Zigzag pattern. In some embodiments, the fabric 5020 may have some other pattern. In some embodiments, the fabric 5020 may have a solid blue backing. In some embodiments, the fabric 5020 may have a backing in some other singular or combination of colors. In some embodiments, the fabric 5020 may have a heavy, craft-weight fusible interfacing adhered to its front. In some embodiments, the fabric 5020 may have a snap size of 20 mm-30 mm; an unfinished wood button of 20 mm-30 mm; and a round Velcro of size 20 mm-30 mm (85 hook/1000 loop). In some embodiments, the fabric 5020 may be wide enough to accommodate the frame 5010. In some embodiments, the fabric 5020 may have straight, flat seams and no extra threads. The existing dressing frames made by other Montessori toy companies do not follow the details described in the training manual and therefore sacrifice educational value. In some embodiments, the fabric 5020 may be soft. In some embodiments, the fabric 5020 may be rough. In some embodiments, the fabric 5020 may not be stiff. In some embodiments, the fabric 5020 may be stiff enough for children aged 0-3 years to use easily. In some embodiments, the dimensions of the Dressing Frames 5000 and its various components may be as described in FIGS. 50D-50F.

FIGS. 51A-51I illustrate various views of a Level 7 Montessori toy called the Cylinder Drop 5100, according to exemplary embodiments of the present invention. In some embodiments, the current invention may use five cylinders 5110 in sequence from thickest to thinnest so that children can more easily observe their relationships as they explore the more functions of this toy. The cylinders 5110 may be of any singular or a combination of color. The linear design is also more developmentally appropriate for children aged 0-3 years and allows them to systematically fit the cylinders 5110 into the holes 5120. In some embodiments, the cylinders 5110 may also be painted green or any other color according to the Monti Kids method described above. In some embodiments, the dimensions of the Cylinder Drop 5100 and its various components may be as described in 51C-511.

FIGS. 52A-52F illustrate various views of a Level 7 Montessori toy called the Baking Set 5200, according to exemplary embodiments of the present invention. The AMI teacher's training manual, for children between the age of 0-3 years, describes a baking set with various kitchen tools that can be bought from various kitchen stores. Generally, Montessori teachers search for small sizes and put a unique set together themselves. In some embodiments, the Baking Set 5200 may include a specially designed small cutting board 5210, wooden spoon 5230, and rolling pin 5220 to maximize educational value and safety, an apron 5240, and chef's hat 5250. In some embodiments, the hat 5240 may also be uniquely designed. In some embodiments, the apron 5250 may include Velcro in appropriate places as specified by the teacher's training manual so that toddlers can use it independently. In some embodiments, the small cutting board 5210, wooden spoon 5230, and rolling pin 5220, an apron 5240, and chef's hat 5250 may be of any singular or a combination of colors. In some embodiments, the chef's hats 5250 and the apron 5240 may be made out of 100% white cotton twill. In some embodiments, the apron may be 33 cm in height, include 2 layers of fabric in all areas: neck strap, waist strap, body; include white, matching polyester thread; include elastic in neck strap, and/or include soft, flexible Velcro. In some embodiments, the chef's hat may be 24 cm in height, include 2 layers of fabric in band; include white, matching polyester thread; and/or include soft, flexible Velcro strips for closure. In some embodiments, the dimensions of the Baking Set 5200 and its various components may be as described in FIGS. 52C-52F.

FIGS. 53A-53F illustrate various views of a Level 7 Montessori toy called the Ring Slide 5300, according to exemplary embodiments of the present invention. In some embodiments, the Ring Slide 5300 may include slats (spaces) 5310 in the chute 5320 so children can see the ring 5430 moving through, and thereby observing and learning the cause and effect principle behind this toy. In some embodiments, pillars 5340 may hold up the chute 5320. In some embodiments, the pillars 5340 and the chute 5320 may be fastened to each other using glue, screws, Velcro, etc., or any combinations thereof. In some embodiments, the dimensions of the Ring Slide 5300 and its various components may be as described in FIGS. 53C-53F.

FIGS. 54A-54C illustrate various views of a Level 7 Montessori toy called the Lacing 5400, according to exemplary embodiments of the present invention. The AMI teacher's training manual, for children between the age of 0-3 years, does not contain lacing, but rather describes a sewing exercise with a needle and thread and paper shapes. This would not pass safety, so Monti Kids designed a unique lacing activity that includes a progression of difficulty similar to traditional sewing exercises. In some embodiments, the Lacing 5400 may include a string 5420 of any safety test compliant length and width and shapes 5410 with holes 5430. In some embodiments, the string 5420 may be 60 mm long and may have a 3-mm diameter. In some embodiments, the shapes 5410 may be of any shape. In some embodiments, the shapes 5410 and/or the string 5420 may be of any color. The shapes 5410 may be of any safety test complaint material. The safety test material may include at least one hole 5430. Accordingly, multiple experiments were performed to come up with a design that meets the educational goals as well as conforms to the safety standards. Multiple design changes had to be made and parts were made according to the redesigns of the tray explained above in the toys called "language set" and "bead stringing." In some embodiments, the dimensions of the Lacing 5400 and its various components may be as described in FIG. 54C.

FIGS. 55A-55E illustrate various views of a Level 8 Montessori toy called the Peg Board 5500, according to exemplary embodiments of the present invention. In some embodiments, the Peg Board 5500 may include a tray 5510, holes 5520, and pegs 5530. In some embodiments, the pegs 5530 may taper. In some embodiments, the pegs 5530 may be straight. In some embodiments, the pegs 5530 may have a thinner bottom portion that attaches to appropriately sized holes 5520. In some embodiments, the pegs 5530 may be made of a safety test compliant material. In some embodiments, the pegs 5530 may be made of any singular color or a combination of colors. In some embodiments, the colors of the pegs 5530 may be same or different to other pegs 5530. In some embodiments, the number of pegs 5530 may be 25. In some embodiments, the number of pegs 5530 can be less than or greater than 25. A similar design is used by a company called Tri Ang. In some embodiments, the dimensions of the Peg Board 5500 and its various components may be as described in FIGS. 55C-55E.

FIGS. 56A-56E illustrate various views of a Level 8 Montessori toy called the Fabric Winder 5600, according to exemplary embodiments of the present invention. The Fabric Winder 5600 may include a housing 5610, fabric 5620, and holder 5630. In some embodiments, the fabric 5620 may be red. In some embodiments, the fabric 5620 may be of any other singular or a combination of colors. In some embodiments, the dimensions of the Fabric Winder 5600 and its various components may be as described in FIGS. 56C-56E.

FIGS. 57A-57F illustrate various views of a Level 8 Montessori toy called the Fraction Circles 5700, according to exemplary embodiments of the present invention. In some embodiments, the Fraction Circles 5700 may include slots 5710, tray 5720, full circles 5730, half circles 5730, and quarter circles 5740. In some embodiments, each circle may be of any single or combination of color. In some embodiments, the circles may have different colors to each other. In some embodiments, the dimensions of the Fraction Circles 5700 and its various components may be as described in FIGS. 57C-57F.

FIGS. 58A-58G illustrates a perspective view of a Level 8 Montessori toy called the Gluing Set 5800, according to exemplary embodiments of the present invention. The AMI teacher's training manual, for children between the age of 0-3 years, describes a glue box. Other toy manufacturing companies such as Neinhuis makes a version of this that does not pass the safety tests. Multiple experiments that required changing the internal structure of the box, thickness of wood, and brush rest design, were performed. In some embodiments, the Gluing Set 5800 may include a lid 5810 and a body 5820. In some embodiments, multiple small compartments 5840 suitable for paper shapes may be added. Such small compartments 5840 facilitate storing each piece of the set (i.e., each paper shape, jar, brush rest, brush), which would make it easier for a small child to use, set up, and clean up independently. In some embodiments, a set of unique paper shapes 5830 may also be added to promote educational value. In some embodiments, papers and glue may be included in the set. In some embodiments, the dimensions of the Gluing Set 5800 and its various components may be as described in FIGS. 58C-58G.

Figure 59D:
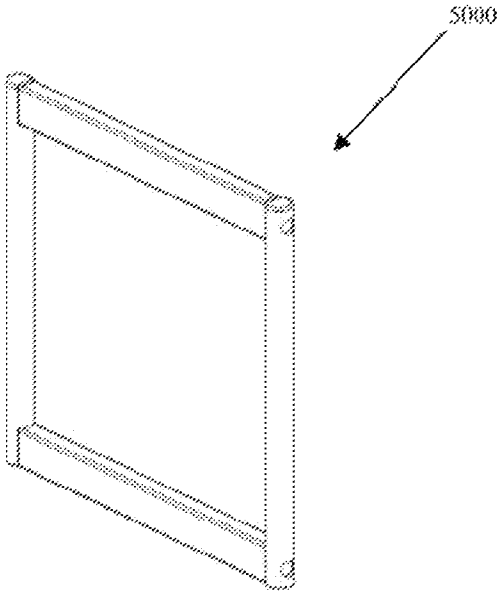
Figure 59E:
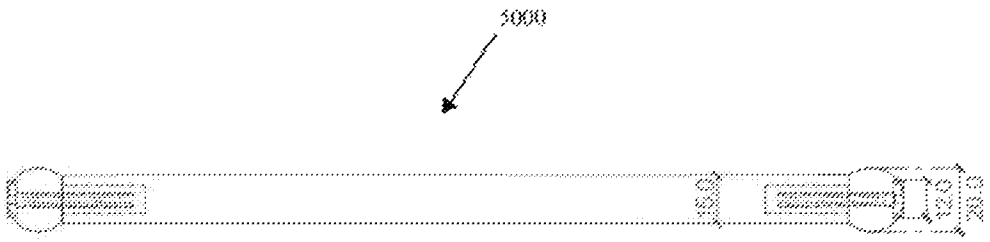
Figure 59H:
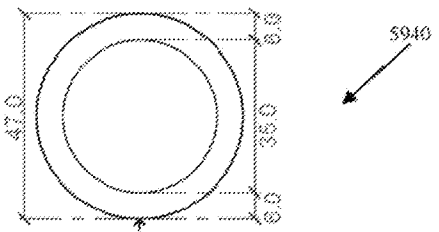
Figure 59I:
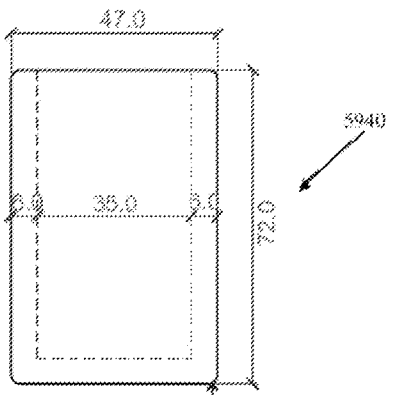
Figure 59F:
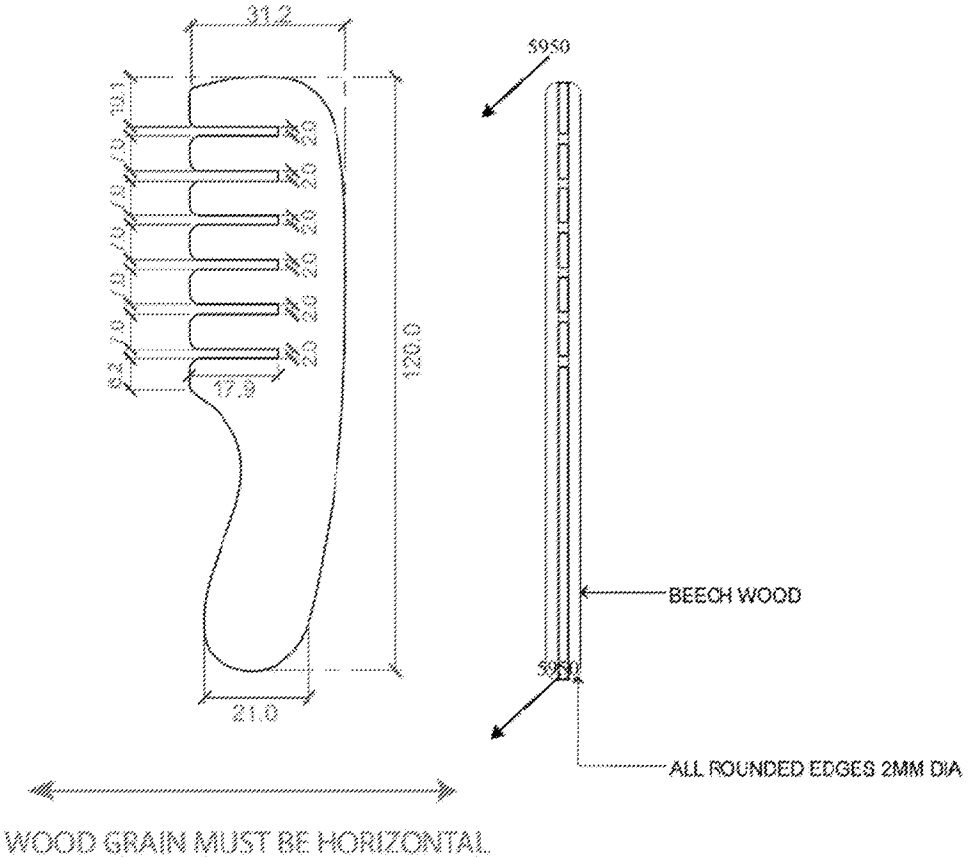
Figure 59G:
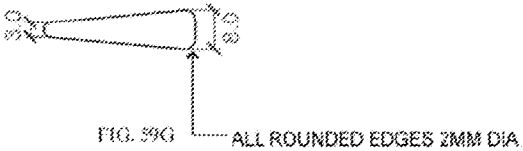
Figure 59L:
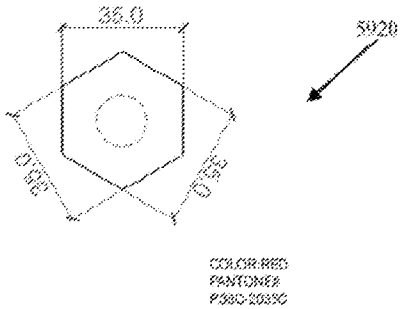
Figure 59M:
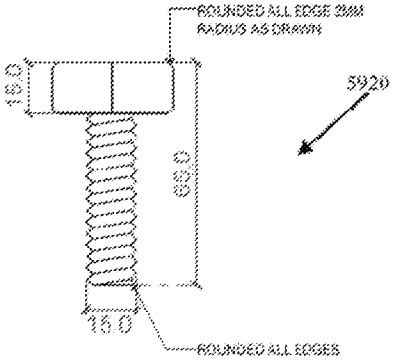
Figure 59N:
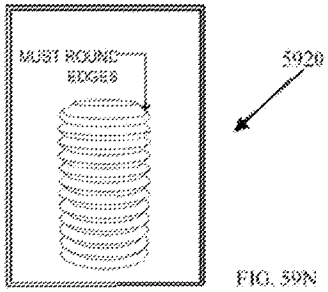
Figure 59J:
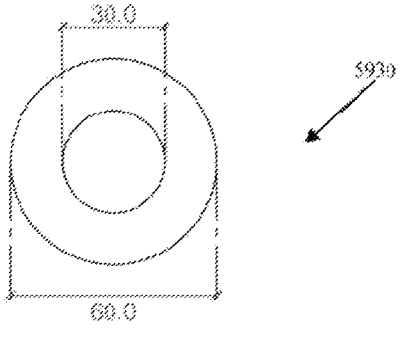
Figure 59K:
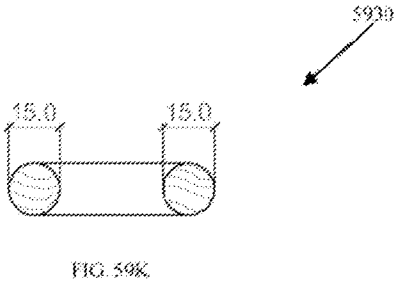
Figure 59O:
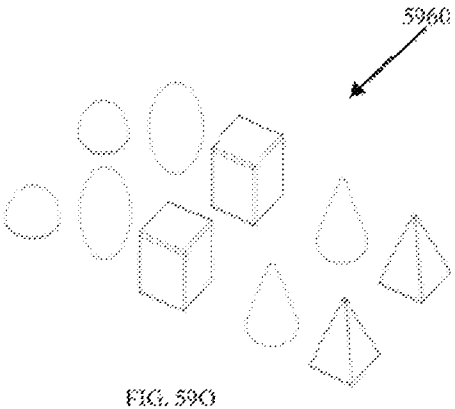
Figure 59P:
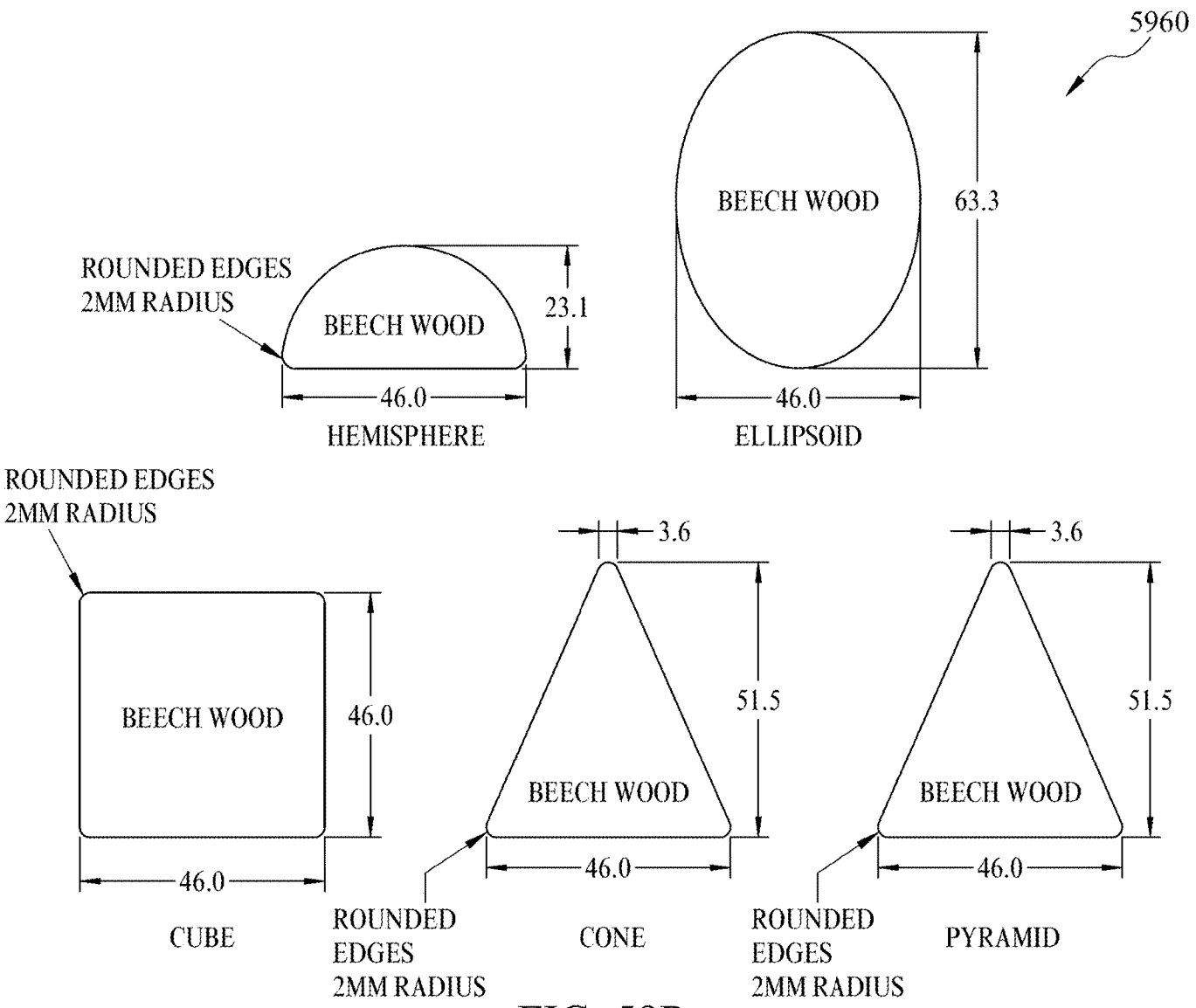
Figure 59Q:
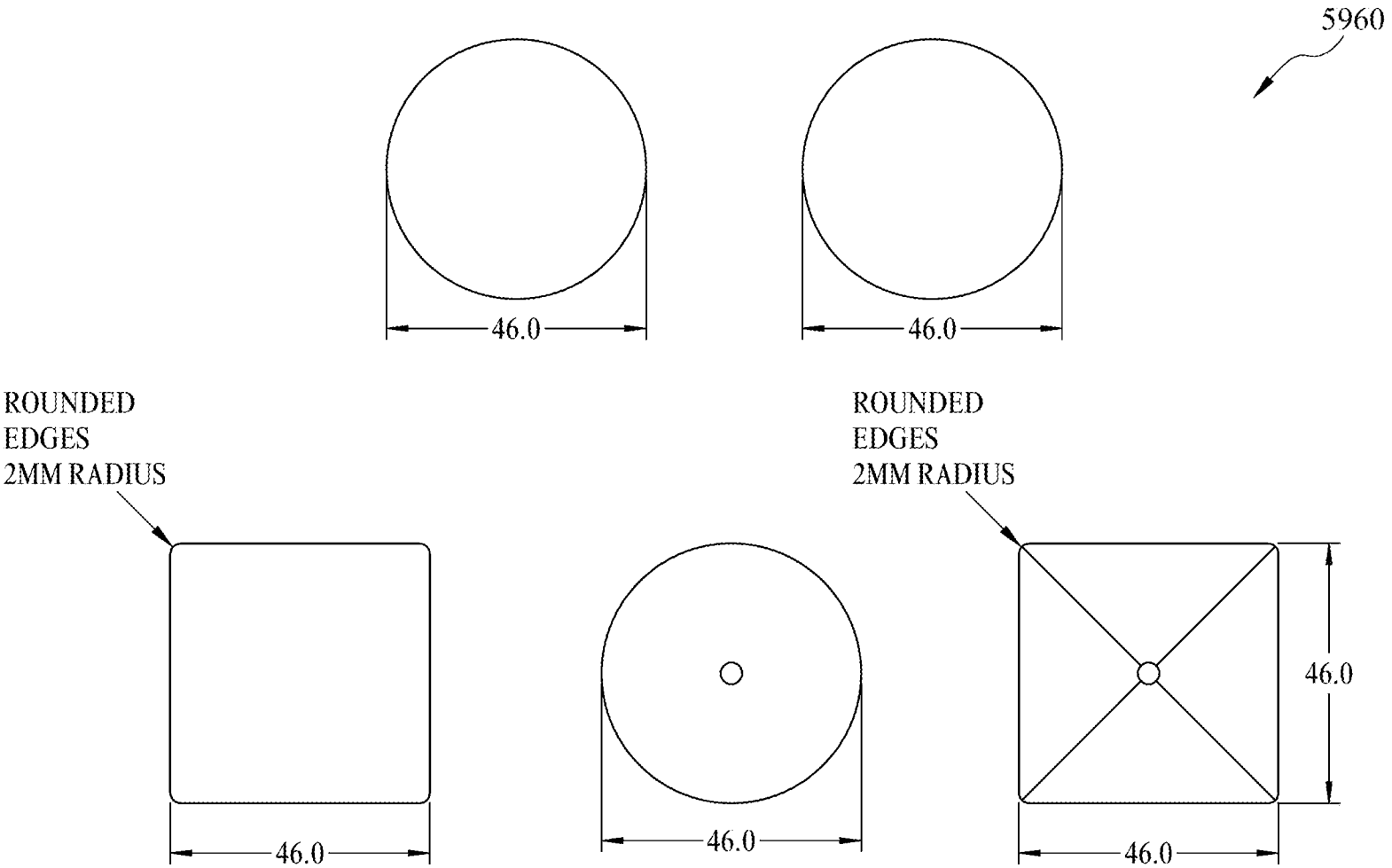

FIGS. 59A-59Q illustrate various views of a Level 8 Montessori toy called the Mystery Bags 5900, according to exemplary embodiments of the present invention. The AMI teacher's training manual, for children between the age of 0-3 years, describes mystery bag sets but they do not give a pattern for the bag and they do not specify exactly what should be in each bag. In some embodiments, the mystery bags may be designed in various shapes. An exemplary set of shapes 5960 is illustrated in FIG. 59D. Generally, Montessori teachers put these together from thrift stores and such. In some embodiments, the pattern of the bag 5900 may be designed so that it can stand up so as to make it easy for children aged 0-3 years to put their hands in them without looking and play a mystery game. In some embodiments, the mystery bag 5900 may have a diameter of 14 cm and a height of 21 cm. In some embodiments, the mystery bags may be of any color such as blue, red, yellow, or any combination of colors. In some embodiments, the fabric used on the outside of the mystery bags 5900 may be 100% cotton, lightweight twill fabric. In some embodiments, the inside of the mystery bag 5900 may include a white satin lining. In some embodiments, the strings 5970 may be made of a 3-mm thick nylon cord. In some embodiments, the mystery bags 5900 may be lined with white nylon. In some embodiments, the mystery bags 5900 may be made by using 100% lightweight cotton twill with mid weight fusible interfacing (like Pellon 931TD) for exterior sides AND bottom twill circle. The lining may be 100% polyester white satin. Next, the seams in twill exterior side sections may be stitched. The rectangular seams around openings for drawstring cords at each side may then be sewn with matching polyester thread. For example, red for red twill, yellow for yellow twill, and blue for blue twill. Next, the circular twill and/or interfacing bottom is sewn onto exterior sides using matching polyester thread. Next, the interior lining edges may be sewn first, leaving a 3-inch opening one side and then the circular bottom may be sown onto interior sides using matching polyester thread such as white for white satin lining. Next, with the right sides together and side seams matched perfectly, the bag lining may be stitched to the exterior section. Next, the bag and the lining may be turned right sides out through the 3-inch opening in the lining. Next, the 2-inch opening may be closed with matching polyester thread by stitching it at the top. The interior lining edge seams may be hand blind stitched one time at each side to attach interior lining to exterior of the bag to prevent lining from slipping up using matching colored polyester thread. Next, the stitching may be knotted firmly and hidden in seam such that it cannot be seen from outside of bag. Next, the top of the bag may be pressed for even top section. Using matching colored polyester thread, the bag is chain stitched to create a drawstring path. Next a nylon cord may be inserted into the opening. The ends of the nylon cord may be brought together and knotted firmly. Finally, the ends of the nylon cord may be melted to prevent fraying. Multiple experiments were performed to ensure that the strings 5970 would not pose a strangulation hazard per the cords and straps test. In some embodiments, unique object sets 5910 may be added to the bag 5900. In some embodiments, the objects set 5910 may include a cup 5940, and a comb 5950. In some embodiments, the object set 5910 may include a screw 5920 and a ring 5930. In some embodiments, the object set may include a doily 5980. In some embodiments, the doily 5980 may have a diameter of 7 cm. In some embodiments, the doily 5980 may be made of any safety test compliant material such as a cream color cotton yarn crochet. Multiple experiments were performed to develop optimal shapes and designs that would pass the safety tests. For example, during the experiments, the point on the cone and triangular prisms was failing because it was a projection and had to be modified to pass the safety standards. In some embodiments, the shapes set 5960 is unique and may be proportional to each other in order to teach mathematical principals and geometric names. The most critical tests that the Mystery Bags had to pass were: 1) 4.8 (ASTM F963-11), Projections (except bath toy projections) (effective date Jun. 10, 2013); 2) 4.6 (ASTM F963-11), Small Objects (except labeling and/or instructional literature requirements) (effective date Jun. 10, 2013); and 3) 4.14 (ASTM F963-08), Cords, Straps, and Elastics (effective date Dec. 31, 2011). In some embodiments, the dimensions of the Mystery Bags 5900 and its various components may be as described in FIGS. 59F-59Q.

FIG. 60 illustrates a toy Tray 6000, according to exemplary embodiments of the present invention. The AMI teacher's training manual, for children between the age of 0-3 years, describes a similar toy that is manufactured by other companies but none of them have passed the safety test. In some embodiments, the Tray 6000 may include a handle 6010 and a body 6020. In some embodiments, the Tray 6000 may be used in place of any of the trays mentioned in the toys described above. In some embodiments, the Tray 6000 may be of any color that meets the safety and/or educational standards. In some embodiments, the Tray 6000 may be made of any material that meets the safety and/or educational standards.

The invention claimed is:

1. A toy, comprising:

a base;

a central rod;

wherein the central rod further comprises at least one first hole on a top surface and one second hole at a front surface;

at least one dowel, wherein the at least one dowel comprises at least one slit and a sphere at an end of the at least one dowel;

wherein the at least one dowel is insertable into the at least one second hole at the front surface of the central rod;

a central insert, the central insert is insertable into the central rod through the at least one first hole on the top surface of the central rod; and wherein the central insert is configured to pass through the at least one slit in the at least one dowel when the central insert is inserted into the central rod.

* * * * *